US008582986B2

(12) United States Patent
Kawai

(10) Patent No.: US 8,582,986 B2
(45) Date of Patent: Nov. 12, 2013

(54) INVENTORY MANAGEMENT DEVICE AND INVENTORY MANAGEMENT METHOD

(75) Inventor: Atsushi Kawai, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 151 days.

(21) Appl. No.: 13/314,991

(22) Filed: Dec. 8, 2011

(65) Prior Publication Data

US 2012/0148267 A1 Jun. 14, 2012

(30) Foreign Application Priority Data

Dec. 10, 2010 (JP) ..... 2010-275861
Dec. 16, 2010 (JP) ..... 2010-280326

(51) Int. Cl.
*G03G 15/00* (2006.01)

(52) U.S. Cl.
USPC ..... 399/8

(58) Field of Classification Search
USPC ..... 399/8, 24
See application file for complete search history.

(56) References Cited

U.S. PATENT DOCUMENTS

| | | | | |
|---|---|---|---|---|
| 7,962,050 | B2 * | 6/2011 | Shustef et al. | 399/8 |
| 2007/0122164 | A1 * | 5/2007 | Shiori et al. | 399/8 |
| 2009/0327103 | A1 * | 12/2009 | Handley et al. | 705/28 |

FOREIGN PATENT DOCUMENTS

| | | |
|---|---|---|
| JP | 2002-092439 | 3/2002 |
| JP | 2004-234155 | 8/2004 |
| JP | 2008-90710 | 4/2008 |
| JP | 2008-271231 | 11/2008 |

OTHER PUBLICATIONS

Japanese Decision to Grant Patent mailed Dec. 11, 2012, directed to Japanese application 2010-275861, w/English translation, 6 pgs.
Japanese Decision to Grant Patent mailed Dec. 11, 2012, directed to Japanese application 2010-280326, w/English translation, 6 pgs.

* cited by examiner

*Primary Examiner* — David Gray
*Assistant Examiner* — Gregory H Curran
(74) *Attorney, Agent, or Firm* — Morrison & Foerster LLP

(57) ABSTRACT

Provided is an inventory management device, connected over a network to groups of image processing devices, for managing inventory, by device group, of consumable supplies used in the image processing devices. The inventory management device includes an inventory information storage unit that stores inventory information by device group and an inventory supplement selection unit that selects supplies to supplement the inventory. The inventory information includes, in association for each supply, an inventory amount, an image processing device identifier, a device group identifier, a maximum inventory amount for the device group, and a projected replacement timing. When a supply is replaced, the inventory supplement selection unit refers to the inventory information for the device group of the image processing device in which the supply was replaced to select supplies to supplement the inventory without exceeding the maximum inventory amount, starting from the supply with the earliest projected replacement timing.

25 Claims, 62 Drawing Sheets

FIG. 10A

| ... | Notification destination (XXX. XXX. 11. 0) | Image processing device identifier (100-A02) | Toner cartridge identifier (KM0533-Y) | Confirmed timing of replacement (2011. 08. 09) | ... |
|---|---|---|---|---|---|

FIG. 10B

| Image processing device identifier | Device group identifier | IP address | Functions | | | | |
|---|---|---|---|---|---|---|---|
| | | | Color/ monochrome | Printer | Scanner | Copier | FAX |
| 100-A01 | A-T07-JP | XXX. XXX. 49. 7 | Color | YES | YES | YES | NO |
| 100-A02 | A-T07-JP | XXX. XXX. 49. 0 | Color | YES | NO | NO | NO |
| 100-A03 | A-T07-JP | XXX. XXX. 49. 8 | Monochrome | YES | YES | YES | YES |
| 100-B01 | B-T07-JP | YYY. YYY. 23. 4 | Color | YES | YES | YES | NO |
| 100-B02 | B-T07-JP | YYY. YYY. 23. 9 | Monochrome | NO | NO | NO | YES |

FIG. 11

| Image processing device identifier | Toner cartridge identifier | Consumed amount (mg) |
|---|---|---|
| 100-A02 | KM0533-C (Cyan) | 5 |
| | KM0533-M (Magenta) | 10 |
| | KM0533-Y (Yellow) | 7 |
| | KM0533-K (Black) | 27 |

FIG. 13A

| Device group | Maximum amount of inventory | Image processing device | Category | Toner cartridge | | | |
|---|---|---|---|---|---|---|---|
| | | | | Cyan (C) | Magenta (M) | Yellow (Y) | Black (K) |
| A-T07 -JP | 4 | 100-A01 (Color) | In stock | × | × | × | ✓ |
| | | | Projected timing of next replacement | 2011/ 08/01 | Just replaced | 2011/ 08/20 | 2011/ 06/30 |
| | | 100-A02 (Color) | In stock | × | ✓ | × | ✓ |
| | | | Projected timing of next replacement | 2011/ 07/25 | 2011/ 10/10 | 2011/ 08/30 | 2011/ 07/15 |
| | | 100-A03 (Monochrome) | In stock | N/A | N/A | N/A | × |
| | | | Projected timing of next replacement | N/A | N/A | N/A | 2011/ 09/10 |

FIG. 13B

| Priority | Projected timing of next replacement | Image processing device | Toner cartridge |
|---|---|---|---|
| 1 | 2011/07/25 | 100-A02 | KM0533-C (Cyan) |
| 2 | 2011/08/01 | 100-A01 | KM0533-C (Cyan) |
| 3 | 2011/08/20 | 100-A01 | KM0533-Y (Yellow) |
| 4 | 2011/08/30 | 100-A02 | KM0533-Y (Yellow) |
| 5 | 2011/09/10 | 100-A03 | KM072-K (Black) |
| 6 | Just replaced | 100-A01 | KM0533-M (Magenta) |

FIG. 16A

| Image processing device | Category | Toner cartridge | | | |
|---|---|---|---|---|---|
| | | Cyan (C) | Magenta (M) | Yellow (Y) | Black (K) |
| 100-A01 (Color) | In stock | × | × | × | ✓ |
| | Projected timing of next replacement | 2011/08/01 | Just replaced | 2011/07/20 | 2011/06/30 |
| | Remaining amount of toner (%) | 50 | 100 | 60 | 10 |
| 100-A02 (Color) | In stock | × | ✓ | × | ✓ |
| | Projected timing of next replacement | 2011/07/22 | 2011/10/10 | 2011/08/30 | 2011/07/15 |
| | Remaining amount of toner (%) | 20 | 30 | 80 | 20 |
| 100-A03 (Monochrome) | In stock | N/A | N/A | N/A | × |
| | Projected timing of next replacement | N/A | N/A | N/A | 2011/09/10 |
| | Remaining amount of toner (%) | N/A | N/A | N/A | 70 |

FIG. 16B

| Priority | Projected timing of next replacement | Remaining amount of toner (%) | Image processing device | Toner cartridge |
|---|---|---|---|---|
| 2 | **2011/07/20** | 60 | 100-A01 | KM0533-Y(Yellow) |
| **1** | **2011/07/22** | **20** | 100-A02 | KM0533-C(Cyan) |
| 3 | 2011/08/01 | 50 | 100-A01 | KM0533-C(Cyan) |
| 4 | 2011/08/30 | 80 | 100-A02 | KM0533-Y(Yellow) |
| 5 | 2011/09/10 | 70 | 100-A03 | KM072-K(Black) |
| 6 | Just replaced | 100 | 100-A01 | KM0533-M(Magenta) |

FIG. 18A

| Image processing device | Category | Toner cartridge | | | |
|---|---|---|---|---|---|
| | | Cyan (C) | Magenta (M) | Yellow (Y) | Black (K) |
| 100-A01 (Color) | In stock | ✓ | × | × | ✓ |
| | Projected timing of next replacement | 2011/08/01 | Just replaced | 2011/08/20 | 2011/06/30 |
| 100-A02 (Color) | In stock | × | ✓ | × | ✓ |
| | Projected timing of next replacement | 2011/07/24 | 2011/10/10 | 2011/08/30 | 2011/07/25 |
| 100-A03 (Monochrome) | In stock | N/A | N/A | N/A | × |
| | Projected timing of next replacement | N/A | N/A | N/A | 2011/09/10 |

FIG. 18B

| Priority | Projected timing of next replacement | Toner color | Image processing device | Toner cartridge |
|---|---|---|---|---|
| 2 | **2011/07/24** | C | 100-A02 | KM0533-C (Cyan) |
| 1 | **2011/07/25** | **K** | 100-A02 | KM0533-K (Black) |
| 3 | 2011/08/20 | Y | 100-A01 | KM0533-Y (Yellow) |
| 4 | 2011/08/30 | Y | 100-A02 | KM0533-Y (Yellow) |
| 5 | 2011/09/10 | 70 | 100-A03 | KM072-K (Black) |
| 6 | Just replaced | 100 | 100-A01 | KM0533-M (Magenta) |

FIG. 20A

| Image processing device | Category | Toner cartridge | | | |
|---|---|---|---|---|---|
| | | Cyan (C) | Magenta (M) | Yellow (Y) | Black (K) |
| 100-A01 (Color) | In stock | × | × | × | ✓ |
| | Projected timing of next replacement | 2011/08/01 | Just replaced | 2011/07/20 | 2011/06/30 |
| | Variation in toner consumption rate | 3.1 | Just replaced | 2.8 | 2.1 |
| 100-A02 (Color) | In stock | × | ✓ | × | ✓ |
| | Projected timing of next replacement | 2011/07/22 | 2011/10/10 | 2011/08/30 | 2011/07/15 |
| | Variation in toner consumption rate | 7.6 | 3.2 | 14.9 | 2.5 |
| 100-A03 (Monochrome) | In stock | N/A | N/A | N/A | × |
| | Projected timing of next replacement | N/A | N/A | N/A | 2011/09/10 |
| | Variation in toner consumption rate | N/A | N/A | N/A | 5.4 |

FIG. 20B

| Priority | Projected timing of next replacement | Variation in toner consumption rate | Image processing device | Toner cartridge |
|---|---|---|---|---|
| 2 | **2011/07/20** | 2.8 | 100-A01 | KM0533-Y (Yellow) |
| **1** | **2011/07/22** | **7.6** | 100-A02 | KM0533-C (Cyan) |
| 3 | 2011/08/01 | 3.1 | 100-A01 | KM0533-C (Cyan) |
| 4 | 2011/08/30 | 14.9 | 100-A02 | KM0533-Y (Yellow) |
| 5 | 2011/09/10 | 5.4 | 100-A03 | KM072-K (Black) |
| 6 | Just replaced | Just replaced | 100-A01 | KM0533-M (Magenta) |

FIG. 22A

| Image processing device | Category | Toner cartridge | | | |
|---|---|---|---|---|---|
| | | Cyan (C) | Magenta (M) | Yellow (Y) | Black (K) |
| 100-A01 (Color) | In stock | × | × | ✓ | × |
| | Projected timing of next replacement | 2011/08/01 | Just replaced | 2011/07/20 | 2011/06/28 |
| | FAX function | NO | NO | NO | NO |
| 100-A02 (Color) | In stock | × | ✓ | × | ✓ |
| | Projected timing of next replacement | 2011/07/22 | 2011/10/10 | 2011/08/30 | 2011/07/15 |
| | FAX function | NO | NO | NO | NO |
| 100-A03 (Monochrome) | In stock | N/A | N/A | N/A | × |
| | Projected timing of next replacement | N/A | N/A | N/A | 2011/06/30 |
| | FAX function | N/A | N/A | N/A | YES |

FIG. 22B

| Priority | Projected timing of next replacement | FAX function | Image processing device | Toner cartridge |
|---|---|---|---|---|
| 2 | **2011/06/28** | NO | 100-A01 | KM0533-K(Black) |
| **1** | **2011/06/30** | **YES** | 100-A03 | KM072-K(Black) |
| 3 | 2011/07/22 | NO | 100-A02 | KM0533-C(Cyan) |
| 4 | 2011/08/01 | NO | 100-A01 | KM0533-C(Cyan) |
| 5 | 2011/08/30 | NO | 100-A02 | KM0533-Y(Yellow) |
| 6 | Just replaced | NO | 100-A01 | KM0533-M(Magenta) |

FIG. 24A

| Image processing device | Category | Toner cartridge | | | |
|---|---|---|---|---|---|
| | | Cyan (C) | Magenta (M) | Yellow (Y) | Black (K) |
| 100-A01 (Color) | In stock | × | × | × | ✓ |
| | Projected timing of next replacement | 2011/08/01 | Just replaced | 2011/07/20 | 2011/06/30 |
| | Duration of suspension (h) | 6 | 6 | 6 | 1 |
| 100-A02 (Color) | In stock | × | ✓ | × | ✓ |
| | Projected timing of next replacement | 2011/07/22 | 2011/10/10 | 2011/08/30 | 2011/07/15 |
| | Duration of suspension (h) | 1 | 1 | 1 | 0.2 |
| 100-A03 (Monochrome) | In stock | N/A | N/A | N/A | × |
| | Projected timing of next replacement | N/A | N/A | N/A | 2011/09/10 |
| | Duration of suspension (h) | N/A | N/A | N/A | 0.5 |

FIG. 24B

| Priority | Projected timing of next replacement | Duration of suspension (h) | Image processing device | Toner cartridge |
|---|---|---|---|---|
| 2 | **2011/07/20** | 6 | 100-A01 | KM0533-Y (Yellow) |
| **1** | **2011/07/22** | **1** | 100-A02 | KM0533-C (Cyan) |
| 3 | 2011/08/01 | 6 | 100-A01 | KM0533-C (Cyan) |
| 4 | 2011/08/30 | 1 | 100-A02 | KM0533-Y (Yellow) |
| 5 | 2011/09/10 | 0.5 | 100-A03 | KM072-K (Black) |
| 6 | Just replaced | 6 | 100-A01 | KM0533-M (Magenta) |

FIG. 26A

| Image processing device | Category | Toner cartridge | | | |
|---|---|---|---|---|---|
| | | Cyan (C) | Magenta (M) | Yellow (Y) | Black (K) |
| 100-A01 (Color) | In stock | × | × | ✓ | × |
| | Projected timing of next replacement | 2011/08/01 | Just replaced | 2011/07/20 | 2011/06/28 |
| | Exchangeability | YES | YES | YES | YES |
| 100-A02 (Color) | In stock | × | ✓ | × | ✓ |
| | Projected timing of next replacement | 2011/07/22 | 2011/10/10 | 2011/08/30 | 2011/07/15 |
| | Exchangeability | YES | YES | YES | YES |
| 100-A03 (Monochrome) | In stock | N/A | N/A | N/A | × |
| | Projected timing of next replacement | N/A | N/A | N/A | 2011/06/30 |
| | Exchangeability | N/A | N/A | N/A | NO |

FIG. 26B

| Priority | Projected timing of next replacement | Exchangeability | Image processing device | Toner cartridge |
|---|---|---|---|---|
| 2 | **2011/06/28** | YES | 100-A01 | KM0533-K (Black) |
| **1** | **2011/06/30** | **NO** | 100-A03 | KM072-K (Black) |
| 3 | 2011/07/22 | YES | 100-A02 | KM0533-C (Cyan) |
| 4 | 2011/08/01 | YES | 100-A01 | KM0533-C (Cyan) |
| 5 | 2011/08/30 | YES | 100-A02 | KM0533-Y (Yellow) |
| 6 | Just replaced | YES | 100-A01 | KM0533-M (Magenta) |

FIG. 39A

| Device group | Image processing device | Category | Toner cartridge | | | |
|---|---|---|---|---|---|---|
| | | | Cyan (C) | Magenta (M) | Yellow (Y) | Black (K) |
| A-T07-JP | 100-A01 (Color) | In stock | ✓ | × | × | ✓ |
| | | Projected timing of next replacement | 2011/08/01 | Just replaced | 2011/08/10 | 2011/06/30 |
| | 100-A02 (Color) | In stock | × | ✓ | × | ✓ |
| | | Projected timing of next replacement | 2011/07/25 | 2011/10/10 | 2011/10/30 | 2011/07/15 |
| | 100-A03 (Monochrome) | In stock | N/A | N/A | N/A | × |
| | | Projected timing of next replacement | N/A | N/A | N/A | 2011/09/10 |

FIG. 39B

| Projected timing of next replacement | Selection day count d | Image processing device | Toner cartridge |
|---|---|---|---|
| 2011/07/25 | **40** | 100-A02 | KM0533-C (Cyan) |
| 2011/08/10 | **56** | 100-A01 | KM0533-Y (Yellow) |
| 2011/09/10 | 87 | 100-A03 | KM072-K (Black) |
| 2011/10/30 | 137 | 100-A02 | KM0533-Y (Yellow) |
| Just replaced | Just replaced | 100-A01 | KM0533-M (Magenta) |

Confirmed timing of replacement: 2011/06/15

FIG. 42A

| Image processing device | Category | Toner cartridge | | | |
|---|---|---|---|---|---|
| | | Cyan (C) | Magenta (M) | Yellow (Y) | Black (K) |
| 100-A01 (Color) | In stock | ✓ | × | × | ✓ |
| | Projected timing of next replacement | 2011/08/01 | Just replaced | 2011/08/10 | 2011/06/30 |
| 100-A02 (Color) | In stock | × | ✓ | × | ✓ |
| | Projected timing of next replacement | 2011/09/01 | 2011/10/10 | 2011/10/30 | 2011/07/15 |
| 100-A03 (Monochrome) | In stock | N/A | N/A | N/A | × |
| | Projected timing of next replacement | N/A | N/A | N/A | 2011/09/01 |

FIG. 42B

| Projected timing of next replacement | Selection day count d | Image processing device | Toner cartridge |
|---|---|---|---|
| 2011/08/10 | **56** | 100-A01 | KM0533-Y (Yellow) |
| 2011/09/01 | 78 | 100-A02 | KM0533-C (Cyan) |
| 2011/09/01 | **78** | 100-A03 | **KM072-K (Black)** |
| 2011/10/30 | 137 | 100-A02 | KM0533-Y (Yellow) |
| Just replaced | Just replaced | 100-A01 | KM0533-M (Magenta) |

Confirmed timing of replacement: 2011/06/15

FIG. 44A

| Image processing device | Category | Toner cartridge | | | |
|---|---|---|---|---|---|
| | | Cyan (C) | Magenta (M) | Yellow (Y) | Black (K) |
| 100-A01 (Color) | In stock | ✓ | × | × | ✓ |
| | Projected timing of next replacement | 2011/08/01 | Just replaced | 2011/07/20 | 2011/06/30 |
| | Variation v in toner consumption rate | 3.1 | Just replaced | 2.8 | 2.1 |
| 100-A02 (Color) | In stock | × | ✓ | × | ✓ |
| | Projected timing of next replacement | 2011/07/20 | 2011/10/10 | 2011/08/30 | 2011/07/15 |
| | Variation v in toner consumption rate | 7.6 | 3.2 | 14.9 | 2.5 |
| 100-A03 (Monochrome) | In stock | N/A | N/A | N/A | × |
| | Projected timing of next replacement | N/A | N/A | N/A | 2011/09/10 |
| | Variation v in toner consumption rate | N/A | N/A | N/A | 5.4 |

FIG. 44B

| Projected timing of next replacement | Selection day count d | Variation v in toner consumption rate | Image processing device | Toner cartridge |
|---|---|---|---|---|
| 2011/07/20 | **35** | 2.8 | 100-A01 | KM0533-Y(Yellow) |
| 2011/07/20 | **35** | 7.6 | 100-A02 | KM0533-C(Cyan) |
| 2011/08/30 | **76** | **14.9** | 100-A02 | KM0533-Y(Yellow) |
| 2011/09/10 | 87 | 5.4 | 100-A03 | KM072-K(Black) |
| Just replaced | Just replaced | Just replaced | 100-A01 | KM0533-M(Magenta) |

Confirmed timing of replacement: 2011/06/15

FIG. 46A

| Image processing device | Category | Toner cartridge | | | |
|---|---|---|---|---|---|
| | | Cyan (C) | Magenta (M) | Yellow (Y) | Black (K) |
| 100-A01 (Color) | In stock | ✓ | × | ✓ | × |
| | Projected timing of next replacement | 2011/08/01 | Just replaced | 2011/07/20 | 2011/08/30 |
| | FAX function | NO | NO | NO | NO |
| 100-A02 (Color) | In stock | × | ✓ | × | ✓ |
| | Projected timing of next replacement | 2011/09/22 | 2011/10/10 | 2011/10/30 | 2011/07/15 |
| | FAX function | NO | NO | NO | NO |
| 100-A03 (Monochrome) | In stock | N/A | N/A | N/A | × |
| | Projected timing of next replacement | N/A | N/A | N/A | 2011/08/30 |
| | FAX function | N/A | N/A | N/A | YES |

FIG. 46B

| Projected timing of next replacement | Selection day count d | FAX function | Image processing device | Toner cartridge |
|---|---|---|---|---|
| 2011/08/30 | 76 | NO | 100-A01 | KM0533-K (Black) |
| 2011/08/30 | **76** | **YES** | 100-A03 | KM072-K (Black) |
| 2011/09/22 | 99 | NO | 100-A02 | KM0533-C (Cyan) |
| 2011/10/30 | 137 | NO | 100-A02 | KM0533-Y (Yellow) |
| Just replaced | Just replaced | NO | 100-A01 | KM0533-M (Magenta) |

Confirmed timing of replacement: 2011/06/15

FIG. 48A

| Image processing device | Category | Toner cartridge | | | |
|---|---|---|---|---|---|
| | | Cyan (C) | Magenta (M) | Yellow (Y) | Black (K) |
| 100-A01 (Color) | In stock | ✓ | × | × | ✓ |
| | Projected timing of next replacement | 2011/08/01 | Just replaced | 2011/08/01 | 2011/06/30 |
| | Usage period p (years) | 6 | 6 | 6 | 6 |
| 100-A02 (Color) | In stock | × | ✓ | × | ✓ |
| | Projected timing of next replacement | 2011/08/10 | 2011/10/10 | 2011/10/30 | 2011/07/15 |
| | Usage period p (years) | 1 | 1 | 1 | 1 |
| 100-A03 (Monochrome) | In stock | N/A | N/A | N/A | × |
| | Projected timing of next replacement | N/A | N/A | N/A | 2011/09/01 |
| | Usage period p (years) | N/A | N/A | N/A | 2 |

FIG. 48B

| Projected timing of next replacement | Selection day count d | Usage period p (years) | Image processing device | Toner cartridge |
|---|---|---|---|---|
| 2011/08/01 | 47 | 6 | 100-A01 | KM0533-Y(Yellow) |
| 2011/08/10 | **56** | **1** | 100-A02 | KM0533-C(Cyan) |
| 2011/09/01 | 78 | 2 | 100-A03 | KM072-K(Black) |
| 2011/10/30 | 137 | 1 | 100-A02 | KM0533-Y(Yellow) |
| Just replaced | Just replaced | 6 | 100-A01 | KM0533-M(Magenta) |

Confirmed timing of replacement: 2011/06/15

FIG. 50A

| Image processing device | Amount of toner consumed (g) | | | |
|---|---|---|---|---|
| | Jul - Sep | Oct - Dec | Jan - Mar | Apr - Jun |
| 100-A01 (Color) | 160 | 100 | 80 | 200 |
| 100-A02 (Color) | 150 | 80 | 110 | 130 |
| 100-A03 (Monochrome) | 250 | 120 | 100 | 110 |
| Total amount of toner consumed t (g) | 560 | 300 | 290 | 440 |

FIG. 50B

| Total amount of toner consumed t (g) over three months | Time frame for selection |
|---|---|
| $t<200$ | 30 days |
| $200 \leq t \leq 400$ | 60 days |
| $400<t$ | 90 days |

FIG. 51A

| Image processing device | Category | Toner cartridge | | | |
|---|---|---|---|---|---|
| | | Cyan (C) | Magenta (M) | Yellow (Y) | Black (K) |
| 100-A01 (Color) | In stock | ✓ | × | ✓ | × |
| | Projected timing of next replacement | 2011/08/01 | Just replaced | 2011/07/20 | 2011/07/30 |
| 100-A02 (Color) | In stock | × | ✓ | × | ✓ |
| | Projected timing of next replacement | 2011/09/22 | 2011/10/10 | 2011/10/30 | 2011/07/15 |
| 100-A03 (Monochrome) | In stock | N/A | N/A | N/A | × |
| | Projected timing of next replacement | N/A | N/A | N/A | 2011/08/30 |

FIG. 51B

| Projected timing of next replacement | Selection day count d | Image processing device | Toner cartridge |
|---|---|---|---|
| 2011/07/30 | **45** | 100-A01 | KM0533-K (Black) |
| 2011/08/30 | **76** | 100-A03 | KM072-K (Black) |
| 2011/09/22 | 99 | 100-A01 | KM0533-C (Cyan) |
| 2011/10/30 | 137 | 100-A02 | KM0533-Y (Yellow) |
| Just replaced | Just replaced | 100-A01 | KM0533-M (Magenta) |

Confirmed timing of replacement: 2011/06/15

FIG. 55

| ... | Notification destination (XXX.XXX.11.0) | Image processing device identifier (100-A02) | Toner cartridge identifier (KM0533-Y) | Date of cartridge near empty state detection (2011.06.15) | ... |
|---|---|---|---|---|---|

INVENTORY MANAGEMENT DEVICE AND INVENTORY MANAGEMENT METHOD

This application is based on applications No. 2010-275861 and No. 2010-280326 filed in Japan, the contents of which are hereby incorporated by reference.

BACKGROUND OF THE INVENTION (1) Field of the Invention

The present invention relates to an inventory management device for managing a user's inventory of consumable supplies used in an image processing device that forms images on recording sheets using consumable supplies such as toner. The present invention also relates to an inventory management method implemented in such an inventory management device.

(2) Description of the Related Art

In a conventional electrophotographic image processing device, such as a photocopier or printer, it is determined that toner in a toner cartridge is near empty when the toner falls below a predetermined threshold. Generally, a message appears on a display device, such as a control panel, to inform the user of the low toner level. Upon seeing the message, the user can either ready a replacement toner cartridge or order one if none is on hand.

In recent years, it is becoming increasingly more common for image processing devices to be connected to an inventory management device over a communications circuit, and for the inventory management device to be further connected to a remote inventory management system with which it exchanges a variety of information in order to manage inventory for the image processing device. In many cases, the inventory management device is located at the company that sells or services the image processing device and uses information received from image processing devices of a plurality of users, including information that the toner is near empty, for maintenance of the image processing device. If an image processing device is connected to such an inventory management device, the administrator of the inventory management device can identify when the toner is near empty or when the toner cartridge has been replaced.

The inventory management device is sometimes further connected to a system for ordering replacement supplies, such as toner. In this case, the inventory management device can order replacement supplies through the supply ordering system and deliver the supplies to the user. This provides an automatic delivery system whereby replacement supplies are automatically delivered to the user without the user having to place an order.

Such an automatic delivery system is particularly useful for relieving the user of the burden of repeatedly ordering consumable supplies that need to be replaced relatively frequently, such as toner. This system is also beneficial for manufacturers, as it reduces the paperwork associated with ordering.

Japanese Patent Application Publication No. 2008-271231 discloses a consumable supply ordering management system provided with a management device that manages device groups of a plurality of image forming devices, wherein when the number of orders for consumable supplies received from each device group reaches a set number of orders for the device group, consumable supplies are ordered in bulk for the device group.

On the other hand, Japanese Patent Application Publication No. 2008-90710 discloses a system for managing devices (printers) in groups, wherein when it is projected that the inventory of a consumable supply will fall below a predetermined threshold during the period required for delivery, a supplement of the consumable supply is delivered along with any other consumable supply that is less than a preset maximum inventory.

The systems disclosed in Japanese Patent Application Publication No. 2008-271231 and Japanese Patent Application Publication No. 2008-90710, however, focus on improving delivery efficiency in order to reduce delivery costs, without taking into account how much space for inventory a user has available. Such systems, therefore, may cause problems for users with a tight inventory space who would have trouble storing a bulk delivery of supplies.

Especially for a user of a plurality of image processing devices who does not have enough inventory space to stock a spare of every toner cartridge used in every one of the image processing devices, it is nevertheless extremely difficult for the user to determine which color toner cartridge for which image processing device to keep in stock as a spare.

Furthermore, in the systems disclosed in Japanese Patent Application Publication No. 2008-271231 and Japanese Patent Application Publication No. 2008-90710, the user has to set thresholds for the number of orders for consumable supplies and the minimum inventory, yet the user may not know what values are appropriate settings, or may find it a nuisance to have to set such values.

On the other hand, users who have a less restricted inventory space can stock a certain amount of consumable supplies. Particularly when such a user has a variety of image processing devices that use a variety of types of consumable supplies, however, if the user stocks a large quantity of supplies, the user may find it troublesome to search for a spare supply in the pile of inventory when one of the supplies needs to be replaced in one of the image processing devices.

SUMMARY OF THE INVENTION

An aspect of the present invention is an inventory management device, connected over a network to one or more device groups each including one or more image processing devices, for managing inventory, by device group, of consumable supplies used in the image processing devices, the inventory management device comprising: a replaced supply information acquisition unit configured to acquire, from each image processing device, replaced supply information that includes an indication of replacement of a supply in the image processing device, a type of the supply that is replaced, and an identifier of the image processing device; a consumption information acquisition unit configured to acquire consumption information indicating a degree of consumption of each supply in use in each image processing device; a projected replacement timing unit configured to calculate, in accordance with the consumption information, a projected replacement timing for replacement of each supply as necessitated by consumption; an inventory information storage unit for storing inventory information by device group, the inventory information including, in association for each supply, a current amount of the inventory, an identifier of the image processing device in which the supply is to be used, an identifier of the device group of the image processing device, a maximum inventory amount that is set for the device group, and the projected replacement timing calculated by the projected replacement timing unit, the inventory information storage unit updating the inventory information by referring to the replaced supply information; and an inventory supplement selection unit configured to select one or more supplies to supplement the inventory, wherein upon acquisition of the replaced supply information by the replaced supply information acquisition unit, the inventory supplement selection unit refers to the updated inventory information for the device group of the image processing device from which the replaced supply information is acquired in order to operate in a first supply selection mode for selecting, from among supplies used in the device group and not currently in the inventory, each supply to supplement the inventory without exceeding the maximum inventory amount for the device group, starting from the supply with an earliest projected replacement timing.

Another aspect of the present invention is an inventory management method used in an inventory management device, connected over a network to one or more device groups each including one or more image processing devices, for managing inventory, by device group, of consumable supplies used in the image processing devices, the inventory management method comprising the steps of: acquiring consumption information indicating a degree of consumption of each supply in use in each image processing device; calculating, in accordance with the consumption information, a projected replacement timing for replacement of each supply as necessitated by consumption; storing inventory information by device group, the inventory information including, in association for each supply, a current amount of the inventory, an identifier of the image processing device in which the supply is to be used, an identifier of the device group of the image processing device, a maximum inventory amount that is set for the device group, and the projected replacement timing; acquiring, from each image processing device, replaced supply information that includes an indication of replacement of a supply in the image processing device, a type of the supply that is replaced, and an identifier of the image processing device providing the replaced supply information; updating the inventory information by referring to the replaced supply information when the replaced supply information is acquired; and operating in a first supply selection mode, upon acquisition of the replaced supply information, to refer to the inventory information for the device group of the image processing device providing the replaced supply information in order to select, from among supplies used in the device group and not currently in the inventory, one or more supplies to supplement the inventory without exceeding the maximum inventory amount for the device group, starting from the supply with an earliest projected replacement timing.

Yet another aspect of the present invention is an inventory management device, connected over a network to one or more device groups each including one or more image processing devices, for managing inventory, by device group, of consumable supplies used in the image processing devices, the inventory management device comprising: a consumption information acquisition unit configured to acquire consumption information indicating a degree of consumption of each supply in use in each image processing device; a projected replacement timing unit configured to calculate, in accordance with the consumption information, a projected replacement timing for replacement of each supply as necessitated by consumption; an inventory information storage unit for storing inventory information by device group, the inventory information including, in association for each supply, a current amount of the inventory, an identifier of the image processing device in which the supply is to be used, an identifier of the device group of the image processing device, and the projected replacement timing calculated by the projected replacement timing unit; an inventory supplement timing information acquisition unit configured to acquire, from each image processing devices, inventory supplement timing information including a consumption indicator indicating an occurrence of a predetermined state of consumption, a type of a consumed supply in which the state of consumption occurs, and an identifier of the image processing device in which the consumed supply is used, the occurrence of the predetermined state of consumption indicating that the inventory is to be supplemented; and an inventory supplement selection unit configured to select one or more supplies to supplement the inventory, wherein upon acquisition of the inventory supplement timing information by the inventory supplement timing information acquisition unit, the inventory supplement selection unit refers to the inventory information for the device group of the image processing device in which the consumed supply is used in order to operate in a first supply selection mode for selecting, from among supplies used in the device group and not currently in the inventory, each supply to supplement the inventory, the projected replacement timing of each selected supply falling within a selection time frame of a preset standard length.

Still another aspect of the present invention is an inventory management method used in an inventory management device, connected over a network to one or more device groups each including one or more image processing devices, for managing inventory, by device group, of consumable supplies used in the image processing devices, the inventory management method comprising the steps of: acquiring consumption information indicating a degree of consumption of each supply in use in each image processing device; calculating, in accordance with the consumption information, a projected replacement timing for replacement of each supply as necessitated by consumption; storing inventory information by device group, the inventory information including, in association for each supply, a current amount of the inventory, an identifier of the image processing device in which the supply is to be used, an identifier of the device group of the image processing device, and the projected replacement timing; acquiring, from each image processing device, inventory supplement timing information including a consumption indicator indicating an occurrence of a predetermined state of consumption of a supply, a type of a consumed supply in which the state of consumption occurs, and an identifier of the image processing device in which the consumed supply is used, the occurrence of the predetermined state of consumption indicating that the inventory is to be supplemented; and operating in a first supply selection mode, upon acquisition of the inventory supplement timing information, to refer to the inventory information for the device group of the image processing device in which the consumed supply is used in order to select, from among supplies used in the device group and not currently in the inventory, one or more supplies to supplement the inventory, the projected replacement timing of each selected supply falling within a selection time frame of a preset standard length.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 10A shows an example of the configuration of a notification frame of replaced toner information, and FIG. 10B shows an example of the configuration of image processing device registration information.

FIG. 11 shows an example of the configuration of consumed toner information.

FIG. 13A is a table showing an example of the configuration of inventory information in Embodiment 1, and FIG. 13B is a table showing the priority of toner cartridges to supplement the inventory as determined based on the inventory information in FIG. 13A.

FIG. 16A is a table showing an example of the configuration of inventory information in Embodiment 2, and FIG. 16B is a table showing the priority of toner cartridges to supplement the inventory as determined based on the inventory information in FIG. 16A.

FIG. 18A is a table showing an example of the configuration of inventory information in Modification 1, and FIG. 18B is a table showing the priority of toner cartridges to supplement the inventory as determined based on the inventory information in FIG. 18A.

FIG. 20A is a table showing an example of the configuration of inventory information in Modification 2, and FIG. 20B is a table showing the priority of toner cartridges to supplement the inventory as determined based on the inventory information in FIG. 20A.

FIG. 22A is a table showing an example of the configuration of inventory information in Modification 3, and FIG. 22B is a table showing the priority of toner cartridges to supplement the inventory as determined based on the inventory information in FIG. 22A.

FIG. 24A is a table showing an example of the configuration of inventory information in Modification 4, and FIG. 24B is a table showing the priority of toner cartridges to supplement the inventory as determined based on the inventory information in FIG. 24A.

FIG. 26A is a table showing an example of the configuration of inventory information in Modification 5, and FIG. 26B is a table showing the priority of toner cartridges to supplement the inventory as determined based on the inventory information in FIG. 26A.

FIG. 39A is a table showing an example of the configuration of inventory information in Embodiment 3, and FIG. 39B is a table showing the method of selecting toner cartridges to supplement the inventory as determined based on the inventory information in FIG. 39A.

FIG. 42A is a table showing an example of the configuration of inventory information in Embodiment 4, and FIG. 42B is a table showing the method of selecting toner cartridges to supplement the inventory as determined based on the inventory information in FIG. 42A.

FIG. 44A is a table showing an example of the configuration of inventory information in Modification 24, and FIG. 44B is a table showing the method of selecting toner cartridges to supplement the inventory as determined based on the inventory information in FIG. 44A.

FIG. 46A is a table showing an example of the configuration of inventory information in Modification 25, and FIG. 46B is a table showing the method of selecting toner cartridges to supplement the inventory as determined based on the inventory information in FIG. 46A.

FIG. 48A is a table showing an example of the configuration of inventory information in Modification 26, and FIG. 48B is a table showing the method of selecting toner cartridges to supplement the inventory as determined based on the inventory information in FIG. 48A.

FIG. 50A is a table showing, for three-month periods, the amount of toner consumed by each image processing device 100 and the total for the device group as a whole, and FIG. 50B is a table showing the correspondence between the amount of toner consumed in a device group as a whole and the time frame for selection.

FIG. 51A is a table showing an example of the configuration of inventory information in Modification 27, and FIG. 51B is a table showing the method of selecting toner cartridges to supplement the inventory as determined based on the inventory information in FIG. 51A.

FIG. 55 shows an example of the configuration of a notification frame of near empty information in Modification 31.

DESCRIPTION OF PREFERRED EMBODIMENTS

The following describes embodiments of aspects of the present invention with reference to the drawings.

Embodiment 1

1. Overall System Configuration

Figure 1:
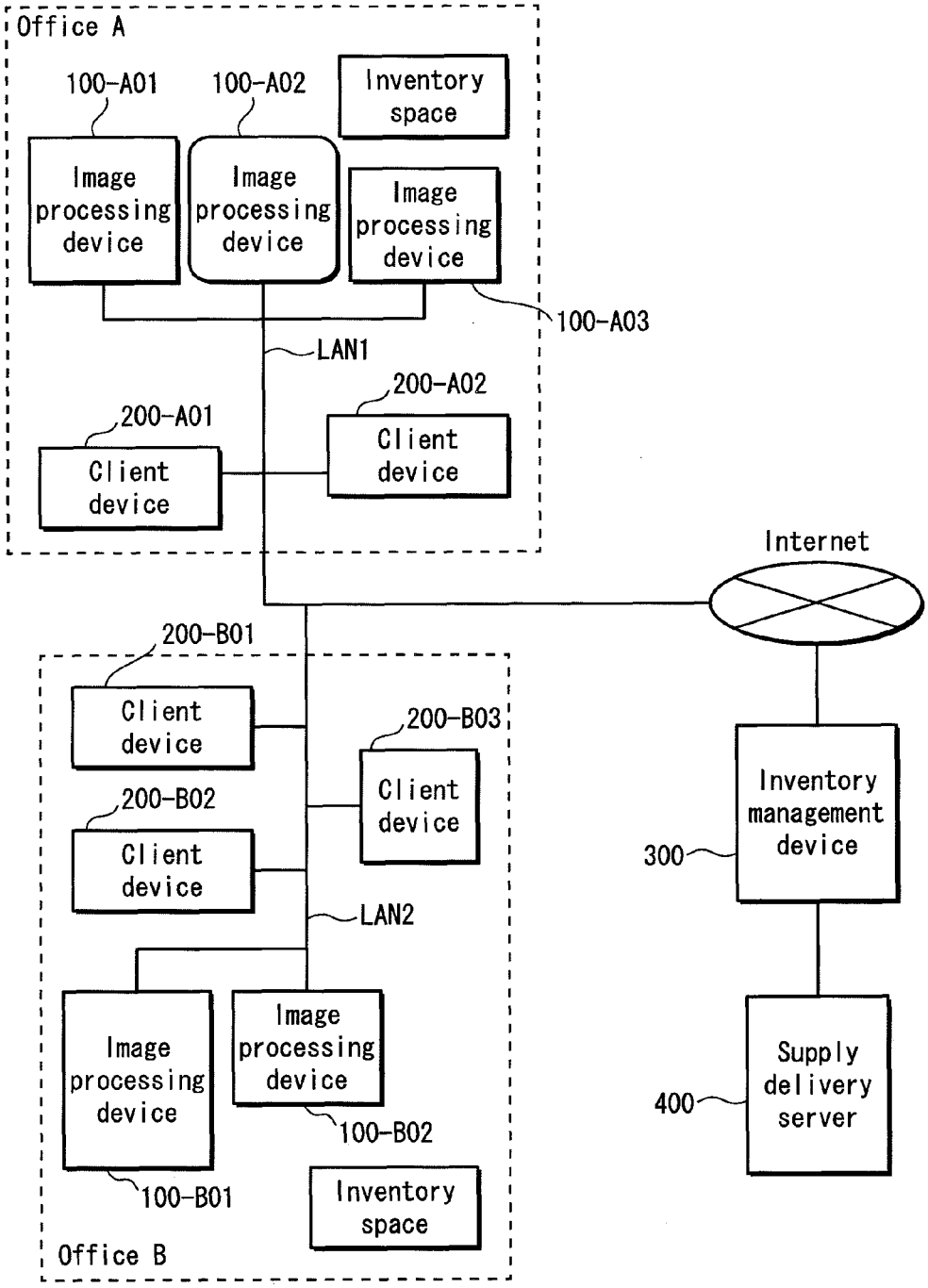
FIG. 1 schematically shows the configuration of an inventory management system provided with an inventory management device according to an embodiment of an aspect of the present invention.

FIG. 1 schematically shows the configuration of an inventory management system provided with an inventory management device according to an embodiment of an aspect of the present invention.

As shown in FIG. 1, in the inventory management system, an image processing device 100 and a client device 200 are connected over a Local Area Network (LAN), and an inventory management device 300, a supply delivery server 400, and the like are connected to the LAN over a network such as the Internet.

The image processing device 100 is, for example, a Multiple Function Peripheral (MFP) having the functions of printing, copying, faxing, and scanning, but instead of having all of these functions, the image processing device 100 may have only some or one of these functions. The image processing device 100 may be color or monochrome. In the example described in Embodiment 1, the image processing device 100 is either color or black and white. The same is also true for other embodiments and modifications.

The client device 200 is, for example, a personal computer (PC) that issues print jobs to the image processing device 100 for printing, on recording sheets, documents or images created using application software installed on the PC.

For example, in office A, image processing devices 100-A01, 100-A02, and 100-A03 and client devices 200-A01 and 200-A02 are connected via a LAN1, and in office B, image processing devices 100-B01 and 100-B02 and client devices 200-B01, 200-B02, and 200-B03 are connected via a LAN2. Office A and office B represent a user's company or a department thereof.

Since a user's inventory decreases each time the user replaces a toner cartridge, which is a consumable supply, the inventory management device 300 acquires, from the image processing devices 100 to which it is connected over the network, information on toner cartridge replacement, such as the fact that a toner cartridge was replaced, the color of the toner in the replaced toner cartridge, the image processing device 100 in which the toner cartridge was replaced, and the like. The inventory management device 300 manages the user's inventory for the device group of the image processing devices 100 connected to the inventory management device 300, or by dividing the connected devices into a plurality of device groups, and selects one or more toner cartridges to supplement the user's inventory, instructing the supply delivery server 400 to deliver the selected toner cartridge(s) to the user. Details are provided later.

The above device group is set to encompass the image processing devices 100 that are to be managed as a group in the user's department or company. In FIG. 1, the image processing devices 100-A01, 100-A02, and 100-A03 in office A are managed as one device group, and the image processing devices 100-B01 and 100-B02 in office B are managed as another device group. Normally, a device group includes a plurality of image processing devices 100, but a device group may include only one image processing device 100. In this context, the term "device group" is used even when only one image processing device 100 belongs to the device group.

In the present embodiment, the inventory management device 300 manages inventory for a plurality of device groups, but the inventory management device 300 may manage inventory for only one device group.

Upon receiving, from the inventory management device 300, an instruction to deliver one or more toner cartridges to supplement the user's inventory, the supply delivery server 400 performs processing for delivery of the indicated toner cartridge(s).

2. Structure of Image Processing Device 100

2.1 Overall Structure of Image Processing Device 100

Figure 2:
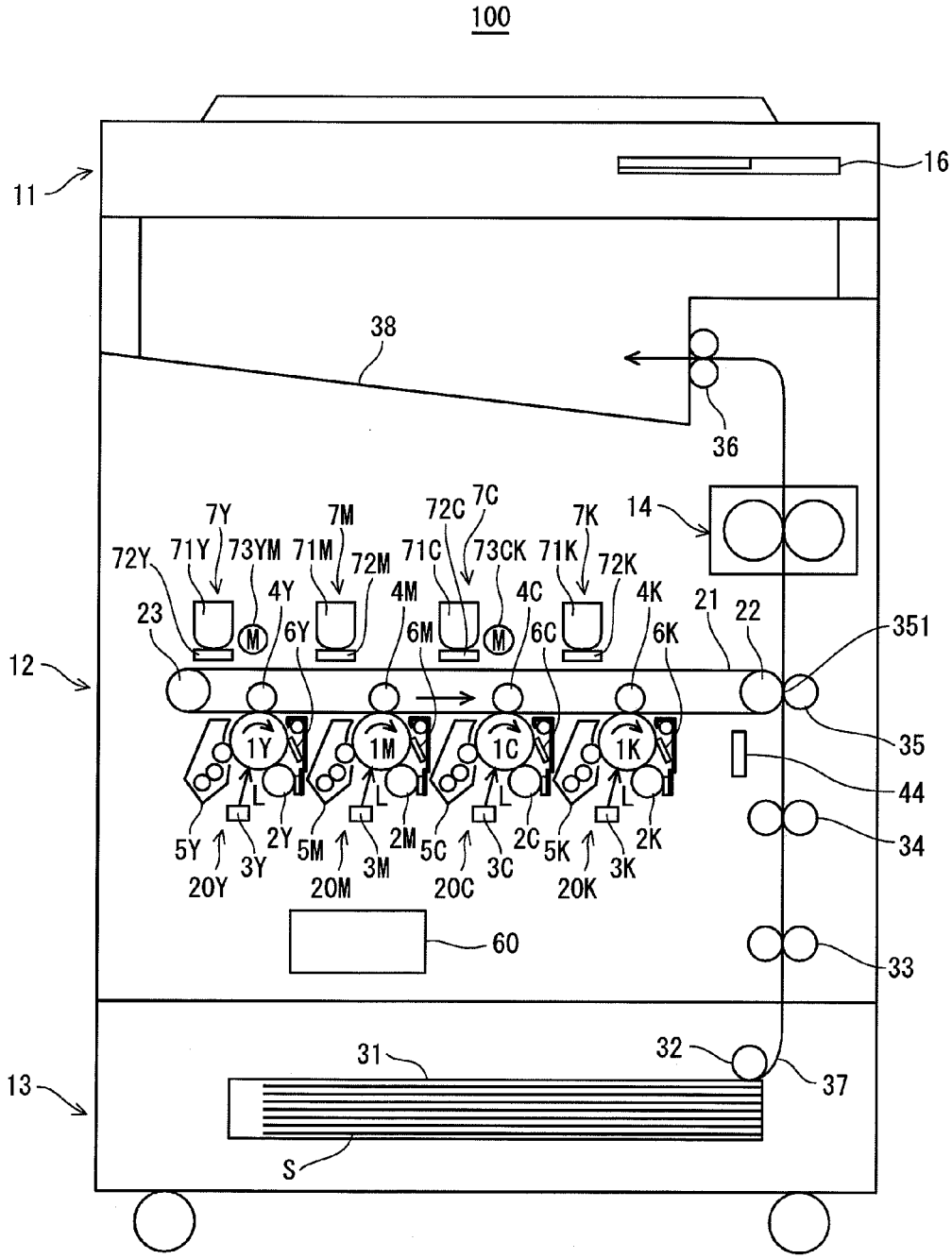
FIG. 2 schematically shows the configuration of a tandem-type color digital printer that is the image processing device in the inventory management system of Embodiment 1 of the present invention.

FIG. 2 is a cross-section diagram schematically showing the overall configuration of the image processing device 100. This figure illustrates a tandem-type color digital MFP as an example of the image processing device 100.

The image processing device 100 is provided with an image reading unit 11, an image forming unit 12, a paper feed unit 13, a fixing unit 14, a control unit 60, a control panel 16, and the like, and is an MFP that can perform jobs such as a copy job to form an image on a recording sheet based on image data from reading an original image, a print job to form an image on a recording sheet based on image data transmitted over a network from an external device, or a transmission job to transmit image data to an external device by FAX or E-mail. The image processing device 100 forms a color image composed of cyan (C), magenta (M), yellow (Y), and black (K), or a monochrome image, such as a black image, and replicates the image on a recording sheet. Hereinafter, the colors cyan, magenta, yellow, and black are referred to respectively as C, M, Y, and K. These letters are attached to various components to distinguish the color to which the components correspond.

The image reading unit 11 is a widely-known device that reads an original image placed on the image processing device 100 and outputs obtained image data.

The image forming unit 12 is provided with imaging units 20C, 20M, 20Y, and 20K corresponding to the colors C, M, Y, and K; an intermediate transfer belt 21; toner supply units 7C, 7M, 7Y, and 7K that supply toner of the colors C, M, Y, and K to the corresponding imaging unit 20; and the like.

The imaging units 20C, 20M, 20Y, and 20K are respectively provided with photoreceptor drums 1C, 1M, 1Y, and 1K, charging rollers 2C, 2M, 2Y, and 2K, exposure units 3C, 3M, 3Y, and 3K, first transfer rollers 4C, 4M, 4Y, and 4K, developing units 5C, 5M, 5Y, and 5K, cleaners 6C, 6M, 6Y, and 6K for cleaning the photoreceptor drums 1C, 1M, 1Y, and 1K, and the like. The imaging units 20C, 20M, 20Y, and 20K form toner images respectively of the colors C, M, Y, and K on the photoreceptor drums 1C, 1M, 1Y, and 1K.

The intermediate transfer belt 21 is an endless belt, extending between a driving roller 22 and a driven roller 23 and rotated in the direction shown by the arrow in FIG. 2.

The paper feed unit 13 is provided with a paper feed cassette 31 storing paper S; a feed roller 32, for feeding one sheet of the paper S in the paper feed cassette 31 at a time to a transport path 37; a pair of transport rollers 33, for transporting the fed sheet of paper S; a pair of timing rollers 34, for adjusting the timing at which the transported sheet of paper S is sent to a second transfer position 351; a second transfer roller 35; and the like.

The fixing unit 14 is provided with a fixing roller and a pressure roller that press against each other, a heater for heating the fixing roller, and the like.

The control panel 16 is provided with a group of keys for receiving instructions for copying, selection of color or monochrome mode, or the like, and with a liquid crystal display unit for notifying or warning the user by displaying a variety of information.

Upon receiving an instruction for copying or the like from the user via the control panel 16, the control unit 60 causes the image reading unit 11, the image forming unit 12, and the like to perform the copying or other operation in accordance with the instruction. Specifically, in the case of copying, the control unit 60 causes the image reading unit 11 to read an original image, and drives laser diodes in the exposure units 3C, 3M, 3Y, and 3K based on the obtained image data. As a result, laser light L corresponding to the color of the laser diode of each of the exposure units 3C, 3M, 3Y, and 3K is emitted, so that the photoreceptor drums 1C, 1M, 1Y, and 1K are scanned one line at a time.

Before this scanning, the photoreceptor drums 1C, 1M, 1Y, and 1K are uniformly charged by the charging rollers 2C, 2M, 2Y, and 2K, so that an electrostatic latent image forms on each of the photoreceptor drums 1C, 1M, 1Y, and 1K due to scanning by the laser light L. The formed electrostatic latent images are developed with developer stored in the developing units 5C, 5M, 5Y, and 5K, thus forming toner images on the photoreceptor drums 1C, 1M, 1Y, and 1K.

Toner cartridges 71C, 71M, 71Y, and 71K, and sub-hoppers 72C, 72M, 72Y, and 72K are respectively positioned above the imaging units 20C, 20M, 20Y, and 20K to serve as a mechanism for supplying toner to the developing units 5C, 5M, 5Y, and 5K in the imaging units 20C, 20M, 20Y, and 20K.

By opening a door (hereinafter, "TC door cover"; not shown in the figures) provided in the front of the image processing device 100, the toner cartridges 71C, 71M, 71Y, and 71K can each be removed and replaced with a new toner cartridge.

Figure 3:
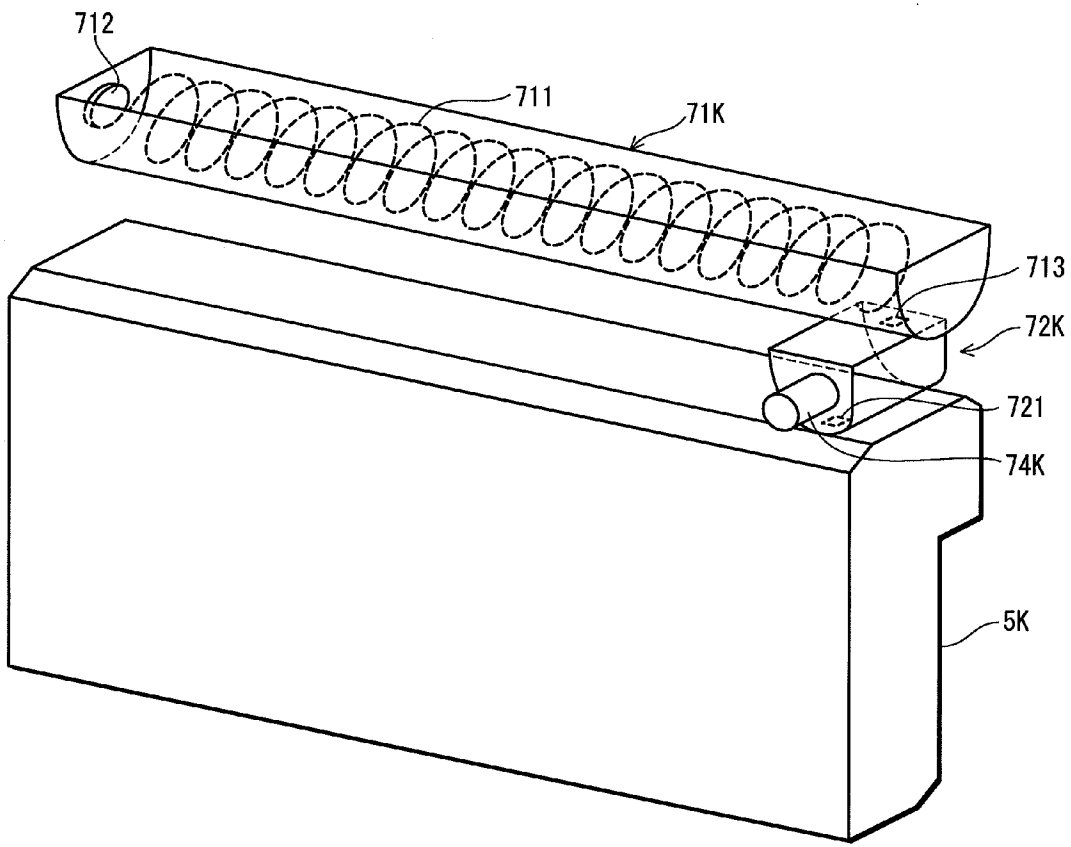
FIG. 3 schematically shows the configuration of the developing unit, toner cartridge, and sub-hopper shown in FIG. 2.

FIG. 3 shows the structure of the toner cartridge 71K, the sub-hopper 72K, and the developing unit 5K. In reality, the number of these structures corresponds to the number of imaging units. The following describes these structures for the color black (K) as a representative example. The structures are basically the same for the colors C, M, and Y, except for the difference in toner color. In the following description and in the figures, the reference sign indicating the color in the constituent elements of the toner cartridge 71K and the sub-hopper 72K is omitted.

The toner cartridge 71K is semi-cylindrical, as shown in FIG. 3, and has an internal space filled with toner. A gear mechanism 712 is provided on a back wall of the toner cartridge 71K (the side of the toner cartridge 71K by the back of the image processing device 100 when loaded therein). The toner cartridge 71K houses a spiral spring 711 that has one end attached to the gear mechanism 712 and can rotate in the internal space of the toner cartridge 71K.

A toner feed hole 713 is formed at the bottom of the toner cartridge 71K by the front side (the side of the toner cartridge 71K by the front of the image processing device 100 when loaded therein). The bottom of the toner feed hole 713 is aligned with an upper opening of the sub-hopper 72K when the toner cartridge 71K is loaded. When the TC door cover is opened and the toner cartridge 71K loaded into the image processing device 100, the gear mechanism 712 connects to a stepping motor (hereinafter "cartridge motor") 73CK provided in the image processing device 100 (see FIG. 2) to drive the spiral spring 711. As a result, an appropriate amount of toner in the toner cartridge 71K is fed through the toner feed hole 713 and supplied to the sub-hopper 72K disposed therebelow.

A toner feed hole 721 is also provided at the bottom of the sub-hopper 72K. The toner feed hole 721 is aligned with a toner inlet provided at the top of the developing unit 5K, which is disposed below the toner feed hole 721.

Note that this type of image processing device is provided with four toner cartridges corresponding to the colors C, M, Y, and K, whereas two cartridge motors 73 drive the spiral springs 711. One of the cartridge motors 73 drives the Y and M toner cartridges, and the other drives the C and K toner cartridges. The gear mechanism 712 for the colors Y and K is formed by an odd number of gears and a one-directional clutch, and the gear mechanism 712 for the colors M and C is formed by an even number of gears and a one-directional clutch. As a result, when the cartridge motors 73 are rotated in the normal direction, the spiral spring 711 for the colors Y and C rotates, whereas the other spiral spring 711 (for the colors M and K) idles. Conversely, when the cartridge motors 73 are rotated in the opposite direction, the spiral spring 711 for the colors M and K rotates, whereas the other spiral spring 711 (for the colors Y and C) idles. The toner that is supplied is thus switched by switching between normal and opposite rotation of the cartridge motors 73.

Figure 4:
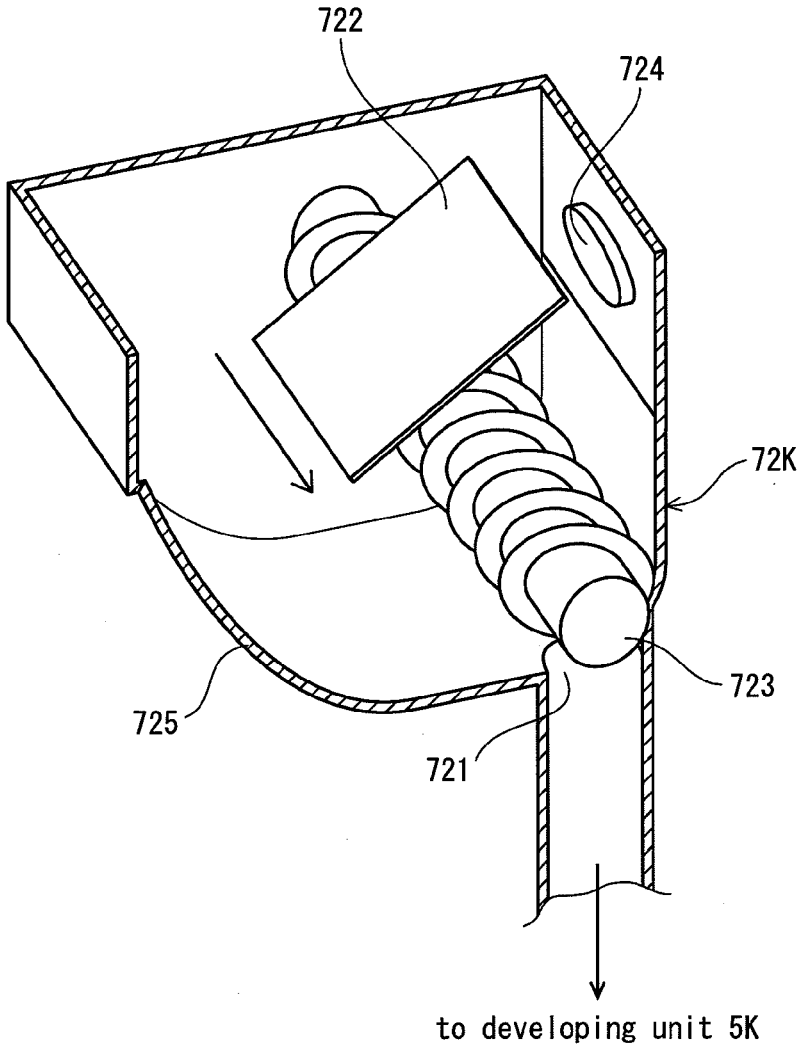
FIG. 4 is a partially cut-away perspective view showing the internal configuration of the sub-hopper shown in FIG. 3.

FIG. 4 is a partially cut-away diagram showing the internal configuration of the main body 725 of the sub-hopper 72K. The main body 725 of the sub-hopper 72K is in the shape of a quarter cylinder and houses a scraping paddle 722, a spiral roller 723, and a toner empty sensor 724. A toner opening (not shown in the figure) is provided at an upper part of one edge of the main body 725 in the axial direction of the spiral roller 723 (in FIG. 4, the edge towards the back of the drawing). The sub-hopper 72K is connected to the toner cartridge 71K loaded thereabove via the toner opening.

The spiral roller 723 is formed by a rotation shaft and a spiral blade, extending along the circumferential surface of the rotation shaft, and is supported by the main body 725 so as to be rotatable. One end of the rotation shaft passes through the main body 725 and is connected, either directly or via a gear, to a stepping motor (hereinafter, "sub-hopper motor") 74K (see FIG. 3) that is provided near the sub-hopper 72K. The rotation shaft receives the driving force of the sub-hopper motor so that the spiral roller 723 rotates.

The scraping paddle 722 is fixed to the spiral roller 723 and rotates along with the spiral roller 723 in order both to mix the toner in the sub-hopper 72K and equalize the fluid level of the toner in the sub-hopper 72K.

Due to its own weight, toner moves into the sub-hopper 72K from the toner cartridge 71K loaded above the sub-hopper 72K, is transported in the direction shown by the arrow due to rotation of the spiral roller 723 (in FIG. 4, towards the front of the drawing), and is supplied to the developing unit 5K through the toner feed hole 721 provided at a downstream edge of the sub-hopper 72K in the direction of toner transport (the opposite edge from the toner opening).

The toner empty sensor 724, formed by a piezo sensor, is provided on an inner wall of the main body 725 of the sub-hopper 72K and detects whether any toner is in the sub-hopper 72K.

Figure 5:
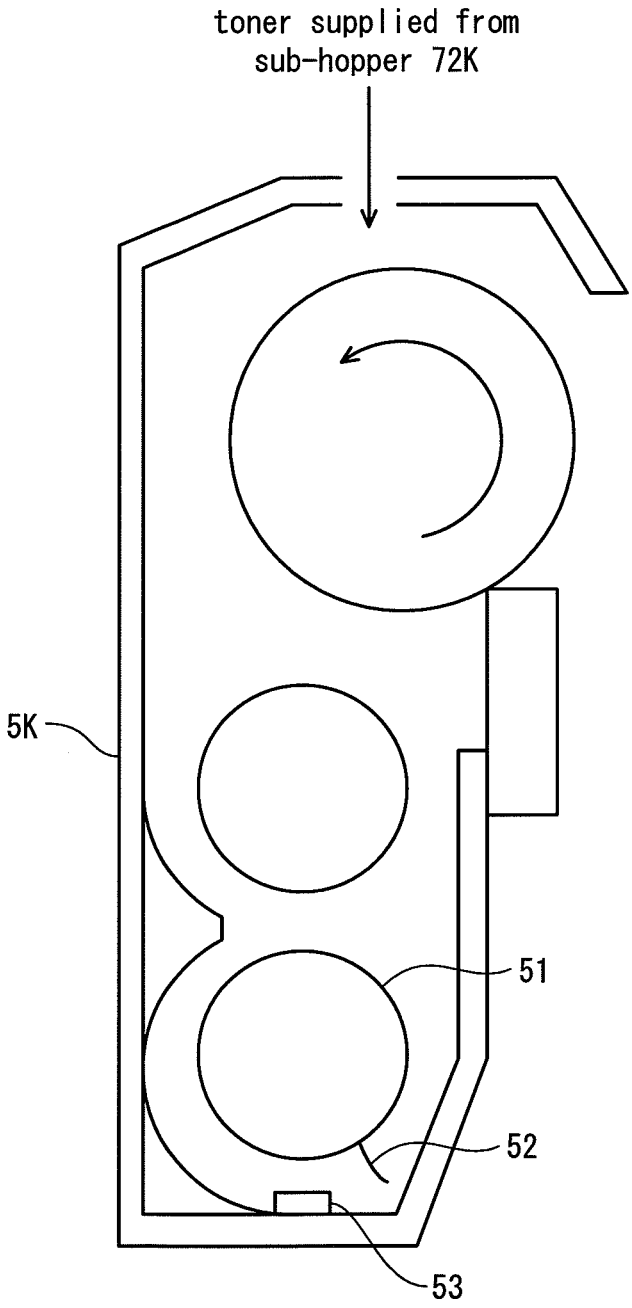
FIG. 5 is a cross-section diagram schematically showing the internal configuration of the developing unit.

FIG. 5 is a cross-section diagram schematically showing the internal configuration of the developing unit 5K. The developing unit 5K is filled with developer (toner and carrier). The developing unit 5K is rotated by a developing motor, not shown in the figures, and is provided with a mixing screw 51 that transports developer. The mixing screw 51 is equipped with a Mylar sheet 52. As the Mylar sheet 52 rotates, the developer in the developing unit 5K is mixed.

A toner concentration sensor 53 is provided on the bottom of the developing unit 5K and detects toner concentration. The Mylar sheet 52 mixes the developer so that new developer flows around the toner concentration sensor 53. In other words, for each rotation of the mixing screw, the developer around the toner concentration sensor is replaced.

The toner concentration sensor 53 is, for example, a magnetic sensor that, based on change in coil inductance, detects magnetic permeability of the developer (toner and carrier) transported within the developing unit 5K by the mixing screw 51. Based on the magnetic permeability detected by the toner concentration sensor 53, the proportion of carrier in the developer is detected, since the carrier is a magnetic material. The proportion of toner in the developer, i.e. the toner concentration, is thereby indirectly detected. For example, when the proportion of carrier included in the developer is low, a high proportion of toner is detected. On the other hand, when the proportion of carrier included in the developer is high, a low proportion of toner is detected. The detection signal from the toner concentration sensor 53 is input into the control unit 60 (see FIG. 2), and based on the detection signal, the necessary amount of toner to supply is calculated.

2.2 Structure of Control Unit in Image Processing Device 100

Figure 6:
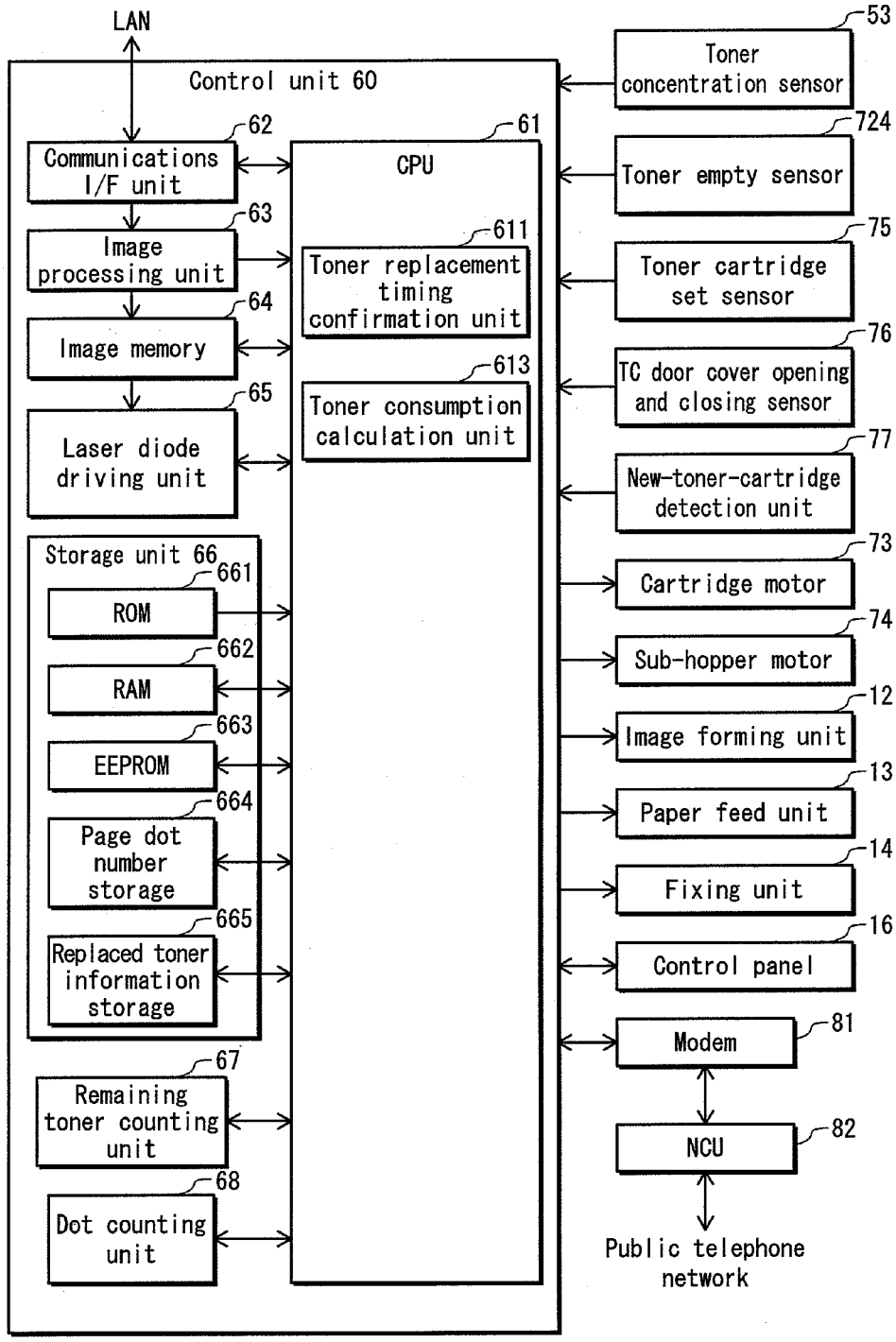
FIG. 6 is a control block diagram for the image processing device.

FIG. 6 is a block diagram showing the structure of the control unit 60.

As shown in FIG. 6, the main components of the control unit 60 are a CPU 61, a communications interface (I/F) unit 62, an image processing unit 63, an image memory 64, a laser diode driving unit 65, a storage unit 66, a remaining toner counting unit 67, and a dot counting unit 68.

The communications I/F unit 62 is an interface, such as a LAN card or LAN board, for connecting to a LAN. The communications I/F unit 62 receives data for a print job from an external source and transmits the received data to the image processing unit 63.

The image processing unit 63 transforms the print job received from the communications I/F unit 62 into image data of the colors C, M, Y, and K and outputs the image data to the image memory 64, which stores the image data by color.

The laser diode driving unit 65 reads the image data of each color from the image memory 64 and drives the laser diodes in the exposure units 3.

A modem 81 is connected to a public phone network or the like via a Network Control Unit (NCU) 82 to exchange FAX data with another device designated by the user.

The storage unit 66 is provided with components such as a Read Only Memory (ROM) 661, a Random Access Memory (RAM) 662, an Electrically Erasable and Programmable Read Only Memory (EEPROM) 663, a page dot number storage 664, and a replaced toner information storage 665.

The ROM 661 stores control programs related to image formation.

The CPU 61 reads necessary programs from the ROM 661 and comprehensively controls operations of the image reading unit 11, the image forming unit 12, the paper feed unit 13, and the fixing unit 14 while adjusting the timing thereof. The CPU 61 thus smoothly performs printing based on print job data received by the communications I/F unit 62, copying based on copy jobs input by the user through the control panel 16, and the like.

Upon receiving a detection signal from the toner concentration sensor 53, the CPU 61 reads the necessary program from the ROM 661 and drives the cartridge motor 73 and the sub-hopper motor 74 to supply the required amount of toner to the developing unit 5.

Furthermore, upon receiving a detection signal from the toner empty sensor 724, the CPU 61 determines the state of the toner in the sub-hopper 72, and depending on the result of the determination, displays a message on the display unit of the control panel 16 instructing the user to replace the toner cartridge.

The RAM 662 is used as the work area for the CPU 61.

The functions of the CPU 61 include a toner replacement timing confirmation unit 611 and a toner consumption calculation unit (consumption information calculation unit) 613.

The toner replacement timing confirmation unit 611 confirms the timing at which a toner cartridge was replaced based on detection signals from a toner cartridge set sensor 75, a TC door cover opening and closing sensor 76, and the toner empty sensor 724.

When a toner cartridge is replaced and the toner replacement timing confirmation unit 611 confirms the date the toner cartridge was actually replaced as the timing of toner replacement, the replaced toner information storage 665 stores replaced toner information composed of information indicating the type of toner cartridge that was replaced as detected by the toner cartridge set sensor 75, an identifier identifying the image processing device 100, and information on the confirmed timing of toner replacement.

The remaining toner counting unit 67 determines the status of toner remaining in the toner cartridge 71 by cumulatively adding the amount of rotation, such as the rotation time and rotation angle, of the cartridge motor 73 to calculate the amount of toner supplied from the toner cartridge 71 to the sub-hopper 72 and subtracting the result from the initial toner amount to calculate the amount of toner remaining in the toner cartridge 71.

When image formation begins, the dot counting unit 68 calculates, in order of the pages, the number of dots per page in units of pixels, treating the total value for all of the pixels as the number of page dots for each page. The number of page dots is counted for each color separately. Since dots are only counted for images, a page (sheet) with no image whatsoever has a count of zero as the number of page dots for each color.

Each number of page dots is stored in the page dot number storage 664 sequentially upon being calculated by the dot counting unit 68 and in association with time information for the number of page dots, i.e. information showing the date and time at which the page was printed. The page dot number storage 664 is a storage unit constituted by non-volatile memory such as EEPROM.

The toner consumption calculation unit 613 reads and cumulatively adds the number of dots stored in the page dot number storage 664 for each color for a predetermined period of time to calculate a cumulative number of dots for the period of time. The toner consumption calculation unit 613 then calculates, for each color, the amount of toner expected to have been consumed (consumption information) for image formation during the predetermined period of time. This calculation is performed for example by storing information on an estimated amount of toner consumed for one dot of each color in the ROM 661 or the like in advance and multiplying the estimated amount of toner by the cumulative number of dots for the period of time. Accordingly, the calculated amount is an estimation. The amount of toner for one dot is sought in advance by experiment or other such means. The amount of toner consumed may be calculated using a different method than the one above.

Furthermore, the page dot number storage 664 and the replaced toner information storage 665 may be separate storage media or separate storage regions of the same storage medium.

The EEPROM 663 may be caused to perform either or both the functions of the page dot number storage 664 and the replaced toner information storage 665.

Additionally, the CPU 61 is not limited to a single CPU, but may be formed by a plurality of CPUs working together.

3. Functional Structure of Inventory Management Device

Figure 7:
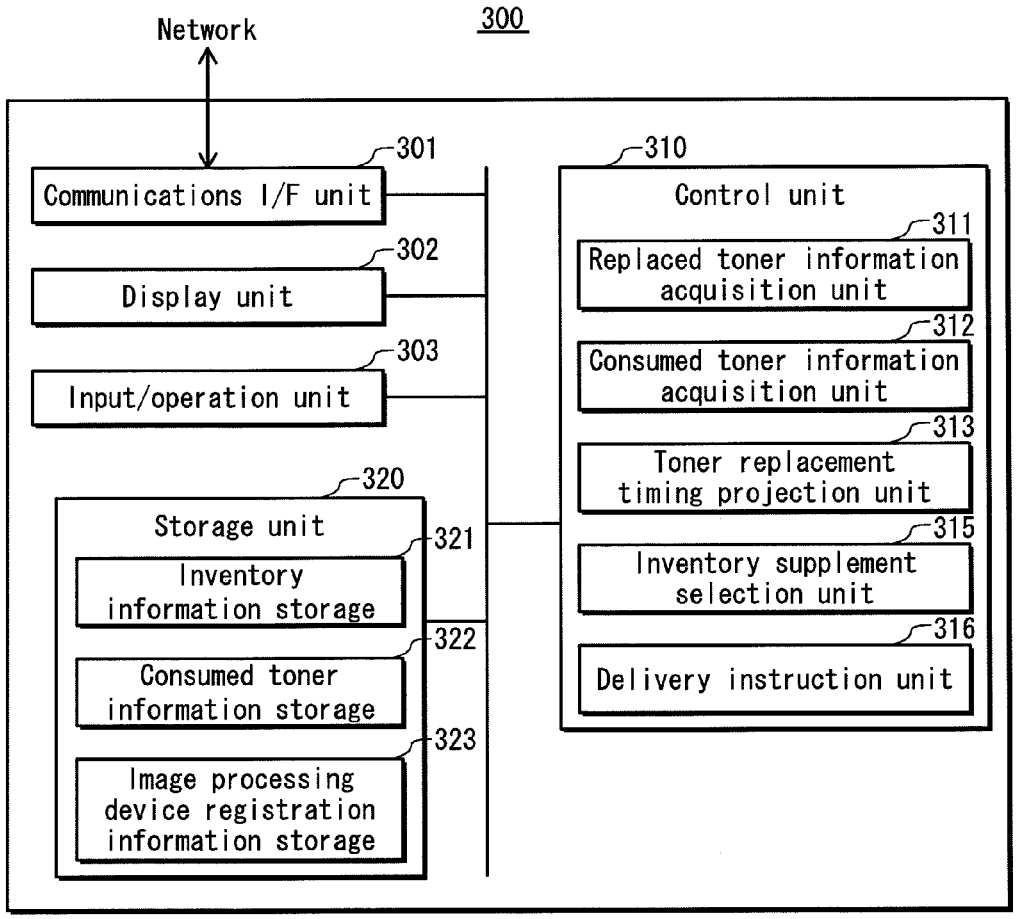
FIG. 7 is a control block diagram for the inventory management device.

FIG. 7 is a control block diagram showing the configuration of the inventory management device 300. As shown in FIG. 7, the inventory management device 300 is provided with a communications I/F unit 301, a display unit 302, an input/operation unit 303, a storage unit 320, and the like, which are each connected to a control unit 310.

The communications I/F unit 301 transmits and receives replaced toner information, consumed toner information, and the like to and from the image processing devices 100-A01, 100-A02, . . . via a network such as a LAN or the Internet. Details are provided later.

The storage unit 320 includes an inventory information storage 321, a consumed toner information storage 322, and an image processing device registration information storage 323.

The inventory information storage 321 stores information on the inventory status of toner cartridges used in each image processing device 100 belonging to each device group, storing the information as inventory information by device group.

The consumed toner information storage 322 stores consumed toner information, which is information on the consumed amount of toner of each color in each image processing device 100.

For each of the image processing devices 100 for which the inventory management device 300 manages inventory, the image processing device registration information storage 323 stores an identifier of the device group to which the image processing device 100 belongs, an IP address, and attributes on image processing functions such as whether the image processing device is color or monochrome and whether the image processing device 100 is provided with a copy function or FAX function, storing this information in association with an identifier for the image processing device 100.

Note that the inventory information storage 321, the consumed toner information storage 322, and the image processing device registration information storage 323 may be separate storage regions in one storage medium, such as an EEPROM, or may be separate storage media. Details on these components are provided later.

The control unit 310 is provided with a replaced toner information acquisition unit 311, a consumed toner information acquisition unit 312, a toner replacement timing projection unit 313, an inventory supplement selection unit 315, a delivery instruction unit 316, and the like.

The replaced toner information acquisition unit 311 acquires information on any toner cartridges that have been replaced in each image processing device 100.

The consumed toner information acquisition unit 312 acquires information on the consumed amount of toner of each color in each image processing device 100.

For each toner cartridge in use in each image processing device 100, the toner replacement timing projection unit 313 projects a replacement time at which the toner will be completely consumed.

For each device group, the inventory supplement selection unit 315 selects one or more supplies (toner cartridges) for which inventory should be supplemented.

The delivery instruction unit 316 instructs the supply delivery server 400 to deliver the toner cartridge(s) selected by the inventory supplement selection unit 315.

Details on these components are provided later.

When, for example, the manager of the inventory management system performs maintenance and inspection, the display unit 302 displays information necessary for the manager and the input/operation unit 303 provides a data input means.

The supply delivery server 400 (detailed configuration not shown in the figures) is a general-purpose computer provided with a display unit, an input/operation unit, a storage unit, a control unit, a communications I/F unit, and the like. The supply delivery server 400 has the function to issue an order to an order-receiving terminal located where orders are received (such as the manufacturer or distributor of the image processing device 100) when the communications I/F unit receives an instruction (notification) to deliver a toner cartridge from the inventory management device 300. The order is based on a toner cartridge identifier and device group information included in the delivery instruction, designating delivery of the toner cartridge indicated by the toner cartridge identifier to the device group indicated by the device group information.

4. Replacement of Toner Cartridge 4.1 Change in Remaining Amount of Toner

Figure 8:
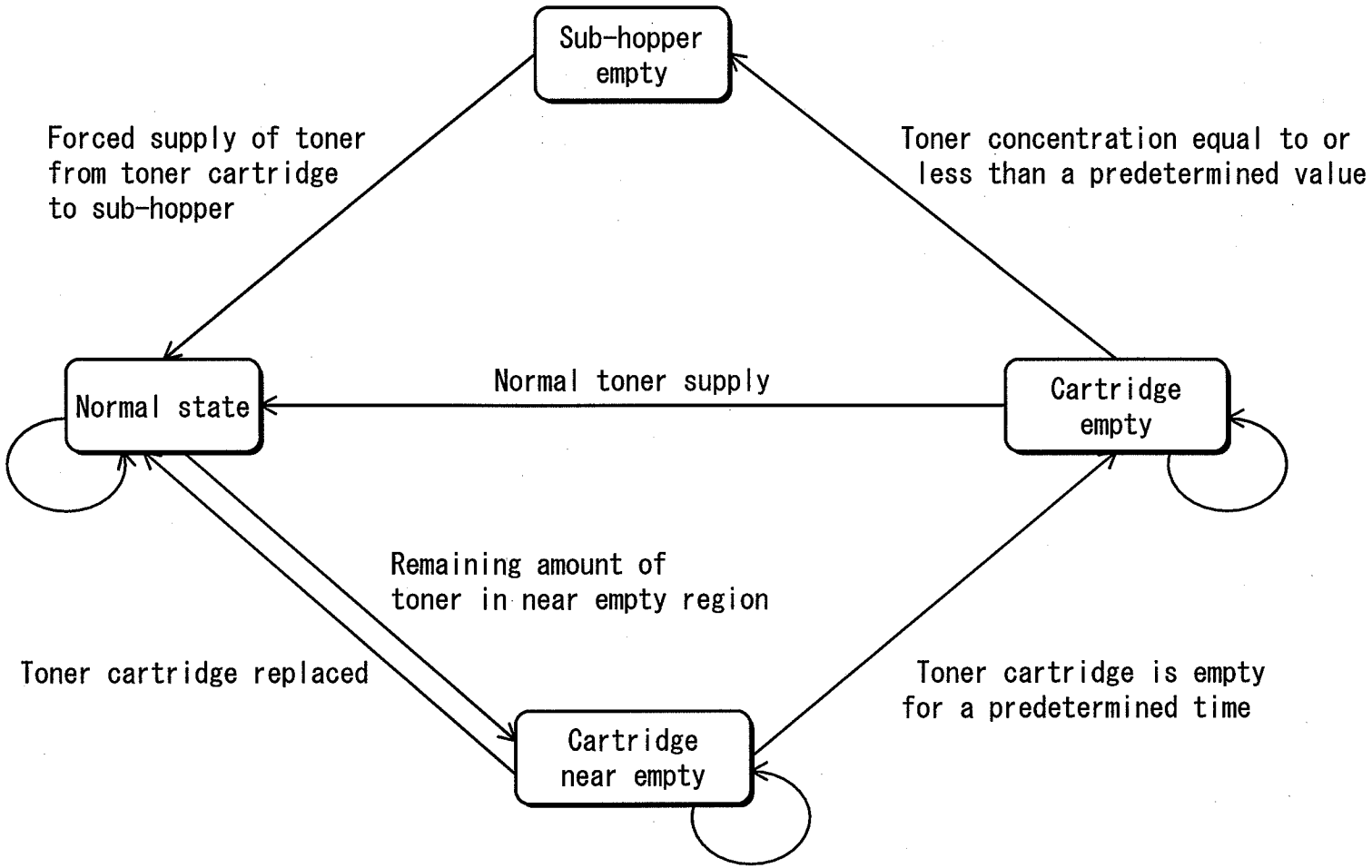
FIG. 8 shows the change in the state of the toner in the toner cartridge and the sub-hopper.

FIG. 8 shows the change in the state of the toner in the toner cartridge 71 and the sub-hopper 72.

The remaining amount of toner in the toner cartridge 71 and the sub-hopper 72 is in one of four states: cartridge near empty, cartridge empty, sub-hopper empty, and normal.

Cartridge near empty refers to a state in which the result of cumulatively adding the amount of rotation when the cartridge motor 73 rotates, in order to estimate the amount of toner supplied from the toner cartridge 71 to the sub-hopper 72, indicates that the toner in the toner cartridge 71 is near empty. In this state, enough toner still remains in the toner cartridge 71 to print several thousand pages, and therefore printing is permitted.

Cartridge empty refers to a state in which output of the toner empty sensor 724 in the sub-hopper 72 during rotation of the cartridge motor 73 has been OFF for a predetermined time. In this case, enough toner remains in the sub-hopper 72 to print approximately 100 pages, and therefore printing is permitted. Once the toner cartridge has been replaced, the amount of toner remaining in the sub-hopper 72 is restored by toner supply as usual, and output of the toner empty sensor 724 switches to ON, after which the state returns to normal.

Sub-hopper empty refers to a state in which toner has been further consumed in the cartridge empty state, so that no toner remains in the sub-hopper 72. Furthermore, in this state, toner in the developing unit 5 has been consumed, reducing the toner concentration. Specifically, the toner concentration in the developing unit 5 has been detected by the toner concentration sensor 53 consecutively 30 times as being at least 1% lower than a target toner concentration. At this point, printing is prohibited. The state returns to normal when the toner cartridge is replaced and toner is forcibly supplied from the new toner cartridge 71 to the sub-hopper 72.

Normal refers to a state other than the above states. The normal state changes to the cartridge near empty state when the amount of toner remaining in the toner cartridge 71 becomes near empty.

In the cartridge near empty state, a message is displayed on the control panel 16 notifying the user that it is almost time to replace the toner cartridge. In the cartridge empty state, a message is displayed encouraging the user to replace the toner cartridge. In the sub-hopper empty state, a full-screen warning is displayed indicating that the toner is depleted and that printing is prohibited.

4.2 Confirmation of Timing of Toner Cartridge Replacement

Some widely-used image processing devices and toner cartridges have a mechanism to detect when a new toner cartridge is loaded into the image processing device. The mechanism to detect a new toner cartridge may, for example, be for an IC chip provided in the toner cartridge to store information indicating that the toner cartridge is new (unused) and for the image processing device to read this information, or detection may be based on a fuse provided in the toner cartridge. These methods of detection are well known technology, and therefore further details are omitted.

In the present embodiment, the image processing device 100 is provided with a new-toner-cartridge detection unit 77. When a toner cartridge with a corresponding new-toner-cartridge detection mechanism is loaded into the image processing device 100, the loaded toner cartridge is detected as being new, thus indicating that the toner cartridge has just been replaced. In this case, the timing at which the toner cartridge was replaced is thus immediately confirmed.

On the other hand, when a toner cartridge not provided with a corresponding new-toner-cartridge detection mechanism is loaded into the image processing device 100, the image processing device 100 cannot tell whether the loaded toner cartridge is new.

To address this problem, the image processing device 100 is provided with a TC door cover opening and closing sensor 76 that detects when the TC door cover, located where toner cartridges are loaded into the image processing device 100, opens and closes, and with a toner cartridge set sensor 75 that detects that a toner cartridge has been loaded into the image processing device 100. When the TC door cover opening and closing sensor 76 detects that the TC door cover has opened and closed, the possibility that the toner cartridge has been replaced exists. The possibility that the toner cartridge has been replaced also exists when output by the toner cartridge set sensor 75 turns OFF (indicating that a toner cartridge has been removed) and subsequently turns ON (indicating that a toner cartridge has been loaded).

Opening and closing of the TC door cover, however, does not necessarily mean that the toner cartridge was replaced. It is also possible that the toner cartridge was removed but then reloaded without being replaced by a new toner cartridge.

Figure 9:
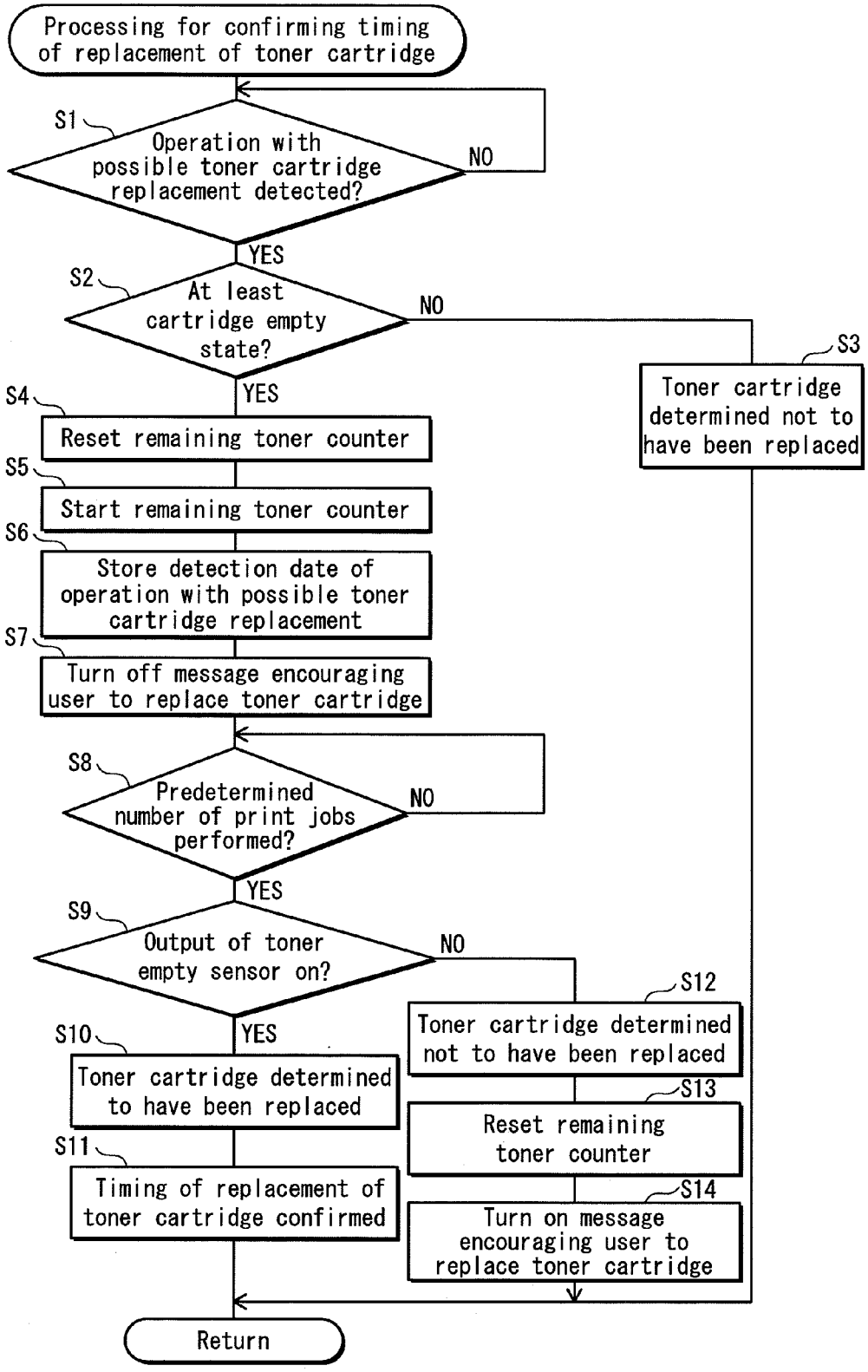
FIG. 9 is a flowchart showing processing for confirmation of the timing of toner cartridge replacement.

FIG. 9 is a flowchart showing processing for confirming that the toner cartridge has been replaced and for confirming the timing of toner cartridge replacement when a toner cartridge is replaced with a toner cartridge not provided with a new-toner-cartridge detection mechanism.

First, it is determined whether an operation has been detected during which the toner cartridge might have been replaced (hereinafter, an "operation with possible toner cartridge replacement"), such as opening and closing of the TC door cover, removal and loading of the toner cartridge, power to the image processing device 100 being turned OFF and back ON, or the like (step S1).

If an operation with possible toner cartridge replacement is detected (step S1: YES), it is determined whether the state of the toner is at least the cartridge empty state (step S2). The state of the toner being at least the cartridge empty state refers to being either the cartridge empty state or the sub-hopper empty state.

If the state of the toner is not at least the cartridge empty state (step S2: NO), there is no need to replace the toner cartridge, and the probability that the toner cartridge was replaced is low. Therefore, it is determined that the toner cartridge has not been replaced (step S3), and processing returns.

When the state of the toner is at least the cartridge empty state (step S2: YES), the probability that the toner cartridge was replaced is high, and it is therefore tentatively determined that the toner cartridge was replaced. The counter in the remaining toner counting unit 67 is reset (step S4) and counting beings anew (step S5). The date on which the operation with possible toner cartridge replacement was detected is tentatively stored as the replacement date (step S6), and display of the message on the control panel 16 encouraging the user to replace the toner cartridge is turned OFF (step S7).

It is then determined if a predetermined number of print jobs have been performed (step S8). In conjunction with a print job, the cartridge motor 73 is rotated so as to supply toner from the toner cartridge 71 to the sub-hopper 72, thus increasing the amount of toner in the sub-hopper 72. A predetermined number of print jobs refers to the number of print jobs required for enough toner to be supplied by rotation of the cartridge motor 73 for output of the toner empty sensor 724 to become ON. While the predetermined number varies depending on the documents or images printed, it may for example be from several dozen to several hundred A4 size sheets of paper.

If the predetermined number of print jobs has not been performed (step 8: NO), the determination in this step is performed again (step S8).

On the other hand, if the predetermined number of print jobs has been performed (step 8: YES), it is then determined whether the output of the toner empty sensor 724 is ON (step S9).

If the output of the toner empty sensor 724 is ON (step S9: YES), this means that the amount of toner in the sub-hopper 72 has increased, and thus it is determined that the toner cartridge has been replaced (step S10). The date on which the operation with possible toner cartridge replacement was detected as recorded in step S6 is then confirmed as the timing of toner cartridge replacement, which is the date the toner cartridge was actually replaced (step S11).

In step S9, if the output of the toner empty sensor 724 is not ON (step S9: NO), i.e. if the output is OFF, this means the amount of toner in the sub-hopper 72 has not increased, or in other words that toner has not been supplied from the toner cartridge 71 to the sub-hopper 72. Therefore, it is determined that the toner cartridge has not been replaced (step S12), the counter in the remaining toner counting unit 67 is reset (step S13), and a message is again displayed on the control panel 16 encouraging the user to replace the toner cartridge (step S14).

The above-described method confirms replacement of a toner cartridge not provided with a new-toner-cartridge detection mechanism, as well as the timing of the replacement. As described above, however, there is a time lag between actual replacement and subsequent confirmation of the replacement.

4.3 Projection of Timing of Toner Cartridge Replacement

The following describes projection of the timing of toner cartridge replacement.

4.3.1 Notification/Acquisition of Information on Replaced Toner Cartridge

When a toner cartridge is replaced with a new toner cartridge, the image processing device 100 detects the replacement by the above method and notifies the inventory management device 300.

FIG. 10A shows an example of the configuration of a notification frame of replaced toner information transmitted by the image processing device 100 to the inventory management device 300. As shown in FIG. 10A, the replaced toner information includes the following: a notification destination identifying the destination of the replaced toner information (the inventory management device 300); an image processing device identifier that identifies the notification source, i.e. the image processing device 100 providing the replaced toner information, which is the image processing device 100 in which replacement of the toner cartridge was detected; a toner cartridge identifier indicating the type of toner cartridge that was replaced; and the confirmed timing of replacement indicating the confirmed toner cartridge replacement date (actual date of replacement).

Information indicating the attributes of all of the managed image processing devices 100 is registered in advance in the inventory management device 300 and stored in the image processing device registration information storage 323 (see FIG. 7) as image processing device registration information.

FIG. 10B shows an example of the configuration of the image processing device registration information. As shown in FIG. 10B, the image processing device registration information stored in the image processing device registration information storage 323 lists, for each image processing device 100 in each device group (office A, office B) in the system in FIG. 1, the following in association: the identifier of the image processing device 100, the identifier of the device group to which the image processing device 100 belongs, destination information (in the example in the present embodiment, an IP address), and information on the functions of the image processing device 100 (color or monochrome, print function, scan function, copy function, FAX function). Note that in FIG. 10B, A-T07-JP is the identifier for office A, and B-T07-JP is the identifier for office B.

Upon acquiring the replaced toner information from the image processing device 100, the inventory management device 300 refers to the image processing device registration information to identify the device group to which the image processing device 100 supplying the replaced toner information belongs. In this way, the inventory management device 300 can identify which toner cartridge has been replaced and when, while identifying the corresponding image processing device 100 and the corresponding device group.

Note that the image processing device 100 may be configured to notify the inventory management device 300 of the above replaced toner information when replacement of the toner cartridge is confirmed, or the inventory management device 300 may be configured to access the replaced toner information storage 665 periodically and to check for and acquire the replaced toner information. Since accurate inventory management is difficult if too much time passes between actual replacement of the toner cartridge and the inventory management device 300 being notified of the replacement, it is preferable in this case for the inventory management device 300 to check for and acquire the replaced toner information every few hours or daily.

4.3.2 Details on Projection of Timing of Toner Cartridge Replacement

In the image processing device 100, when an image formation operation is executed, the dot counting unit 68 counts, in order of the pages, the number of dots per page in units of pixels, storing the number of dots in the page dot number storage 664 in association with information on the date and time the number of dots was counted.

The inventory management device 300 periodically issues a request to each image processing device 100 for consumed toner information on the toner consumed in each toner cartridge over a predetermined period of time. Upon receiving this request for consumed toner information, each image processing device 100 cumulatively adds the number of page dots counted during the requested period of time to calculate a cumulative number of dots for the period of time. The image processing device 100 then calculates, for each color, the amount of toner expected to have been consumed for image formation during the predetermined period of time. The image processing device 100 transmits the calculated amount of toner consumed for each color to the inventory management device 300.

FIG. 11 shows an example of the configuration of the consumed toner information that the image processing device 100 transmits to the inventory management device 300. As shown in FIG. 11, the consumed toner information includes the amount of toner consumed for each color during the requested period of time in association with the toner cartridge identifier, and also includes the identifier of the image processing device 100. The inventory management device 300 acquires such consumed toner information from each image processing device 100 multiple times, allowing a time interval to pass between each acquisition. For each toner cartridge, the inventory management device 300 calculates the remaining amount of toner and, based on the calculated amount, projects the day when the toner amount will reach zero, i.e. the timing of next replacement.

Figure 12:
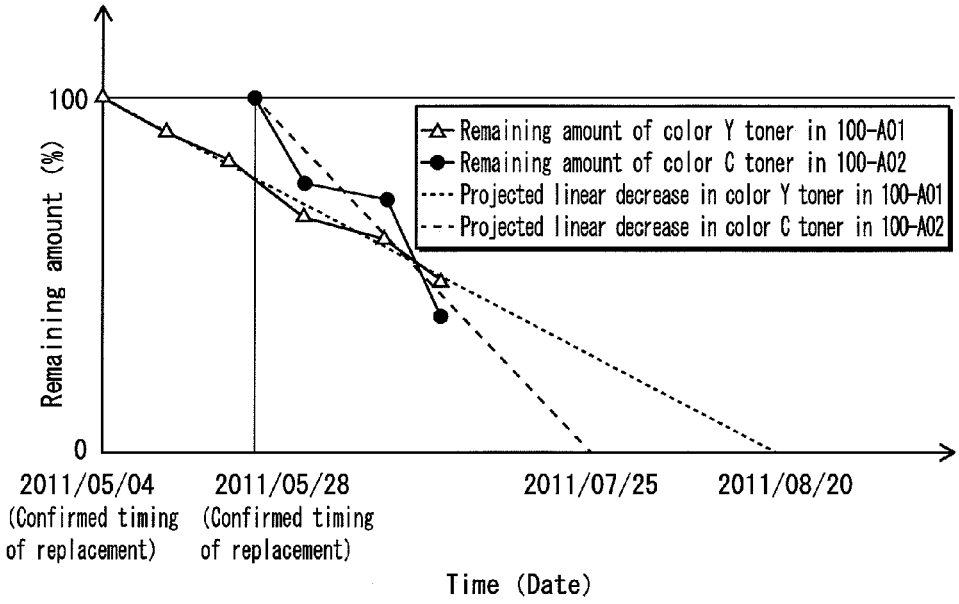
FIG. 12 is a graph showing the remaining amount of toner in toner cartridges and a method of projecting the timing of replacement.

FIG. 12 is a graph schematically showing a method of projecting the timing of toner cartridge replacement. In FIG. 12, the broken lines represent changes over time in the remaining amount of toner, whereas the dotted lines are a linear approximation obtained from the changes in the remaining amount of toner indicated by the broken lines. These linear approximations allow for projection of the timing of next replacement by seeking the point in time at which the remaining amount of toner as indicated by the linear approximation reaches 0%. As examples, FIG. 12 shows the changes in amount of remaining toner for the color Y toner cartridge in the image processing device 100-A01 and for the color C toner cartridge in the image processing device 100-A02, as well as the linear approximations for these toner cartridges.

The color Y toner cartridge in the image processing device 100-A01 was replaced on May 4, 2011, and the color C toner cartridge in the image processing device 100-A02 was replaced on May 28, 2011. The rate of consumption of the color C toner in the image processing device 100-A02, however, is faster than the rate of consumption of the color Y toner in the image processing device 100-A01. Therefore, the projected timing of next replacement for the color C toner cartridge is earlier. Specifically, the projected timing of next replacement for the color Y toner cartridge in the image processing device 100-A01 is Aug. 20, 2011, whereas the projected timing of next replacement for the color C toner cartridge in the image processing device 100-A02 is Jul. 25, 2011. The confirmed timing of replacement for each toner cartridge is acquired by referring to the replaced toner information.

Note that the amounts of toner consumed may be acquired periodically (over equal time intervals), but as long as the time interval between each acquisition is known, it is not necessary for the time interval to be the same between every acquisition.

In the present embodiment, each image processing device 100 stores, in the ROM 661 or the like, information on the estimated amount of toner consumed by the image processing device 100 for one dot and calculates the amount of toner consumed for each color by multiplying the cumulative number of dots for a period of time by the estimated amount of toner per dot, but the present invention is not limited in this way. For example, the inventory management device 300 may store, for each color, an estimated amount of toner consumed for one dot by each managed image processing device 100. After receiving the cumulative number of dots for a period of time from the image processing device 100, the inventory management device 300 may calculate the amount of toner of each color consumed by each image processing device 100.

5. Selection of Toner Cartridges to Supplement Inventory

FIG. 13A shows an example of inventory information that the inventory management device 300 uses to manage inventory of toner cartridges by device group. The inventory information includes a device group identifier, the maximum amount of inventory set for the device group, an identifier for each image processing device belonging to the device group, an inventory status for each toner cartridge used in each image processing device, and a projected timing of next replacement for each of the toner cartridges currently in use. These pieces of information are stored in association with each other in the inventory information storage 321 of the inventory management device 300 (see FIG. 7). As an example, FIG. 13A shows inventory information after having been updated upon the color M toner cartridge in the image processing device 100-A01 being replaced (i.e. the timing of replacement being confirmed) in office A. Since the color M toner cartridge in the image processing device 100-A01 has just been replaced (i.e. the timing of replacement has just been confirmed), the timing of next replacement has not been projected. At this point in time, the inventory space in office A is stocked with three toner cartridges: color K for the image processing device 100-A01, and colors M and K for the image processing device 100-A02. There is no inventory for six toner cartridges: colors C, M, and Y for the image processing device 100-A01, colors C and Y for the image processing device 100-A02, and color K for the image processing device 100-A03. Since the maximum amount of inventory is four, one toner cartridge to supplement the inventory is selected from among these six toner cartridges not stocked in the inventory. Note that in FIG. 13A, entries for the cartridges not included in the inventory are outlined in bold. The same is true in Embodiment 2 and in each of the modifications.

The inventory supplement selection unit 315 in the inventory management device 300 (see FIG. 7) refers to the inventory information and selects one or more toner cartridges (consumable supplies) to supplement the inventory. With reference to the figures, the following describes the method of the present embodiment for selecting the toner cartridge(s) to supplement the inventory.

The toner cartridges not currently included in the inventory for the device group (in this case, office A) are identified and listed in a table by projected timing of next replacement, starting with the earliest timing, as shown in FIG. 13B. As further shown in FIG. 13B, the toner cartridge with the earliest projected timing of next replacement is the color C toner cartridge for the image processing device 100-A02, which has a projected timing of next replacement of Jul. 25, 2011. In the present embodiment, a toner cartridge with an earlier projected timing of next replacement has a higher priority, and the toner cartridges to supplement the inventory are selected starting with the highest priority toner cartridge until reaching the maximum amount of inventory. Accordingly, in this example, since the color C toner cartridge for the image processing device 100-A02 has the highest priority, it is selected as the toner cartridge to supplement the inventory.

Since the color M toner cartridge for the image processing device 100-A01 has just been replaced, the timing of next replacement for this toner cartridge has not been projected. The remaining amount of toner immediately after replacement, however, can be assumed to be approximately 100%, and therefore this toner cartridge is included in the table as having the latest projected timing of next replacement, as shown in FIG. 13B. The same is true in Embodiment 2 and in each of the modifications.

Figure 14:
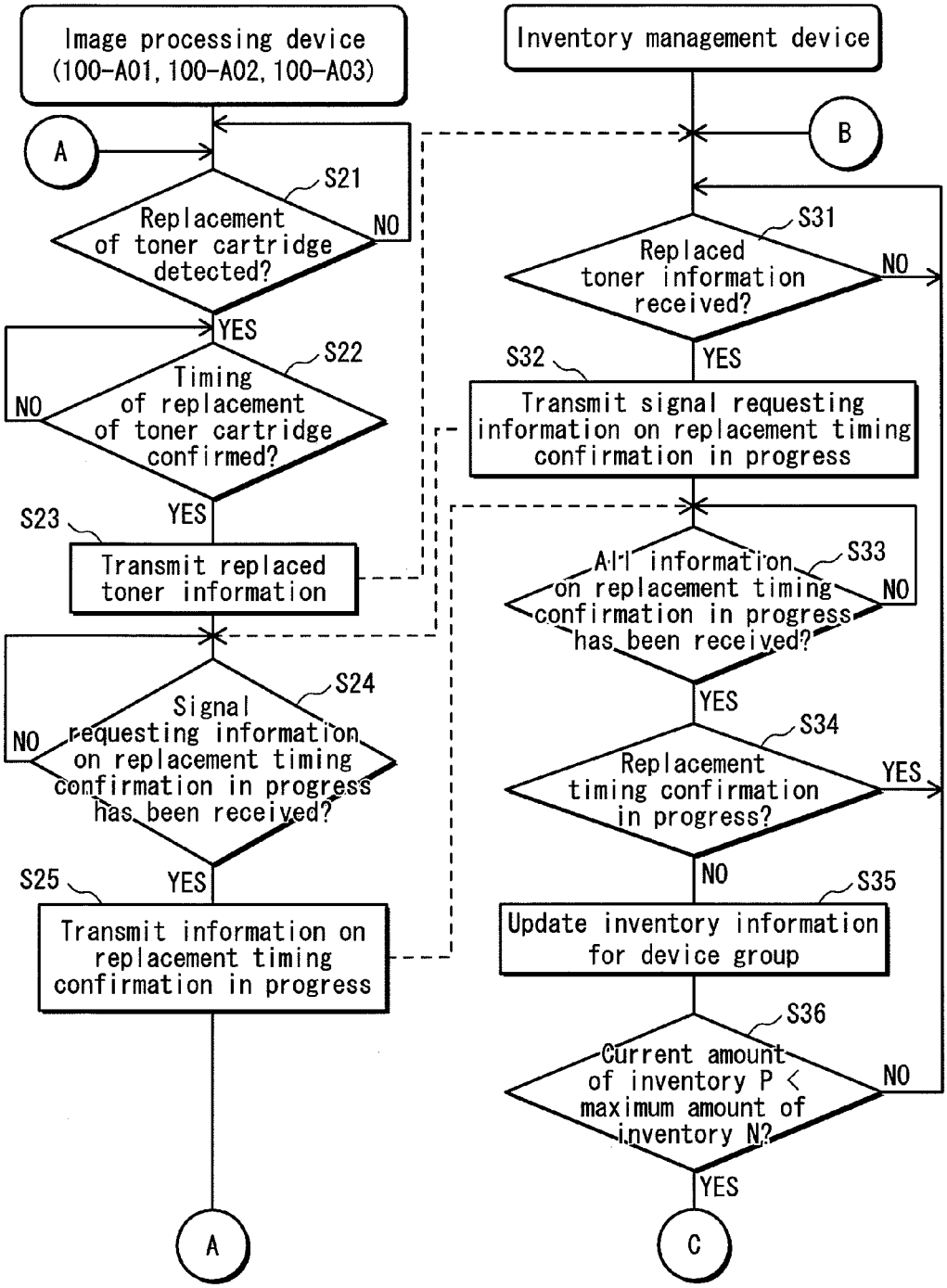
FIG. 14 is part of a flowchart showing a control sequence for the image processing device and the inventory management device for consumable inventory management by the inventory management device of Embodiment 1.
Figure 15:
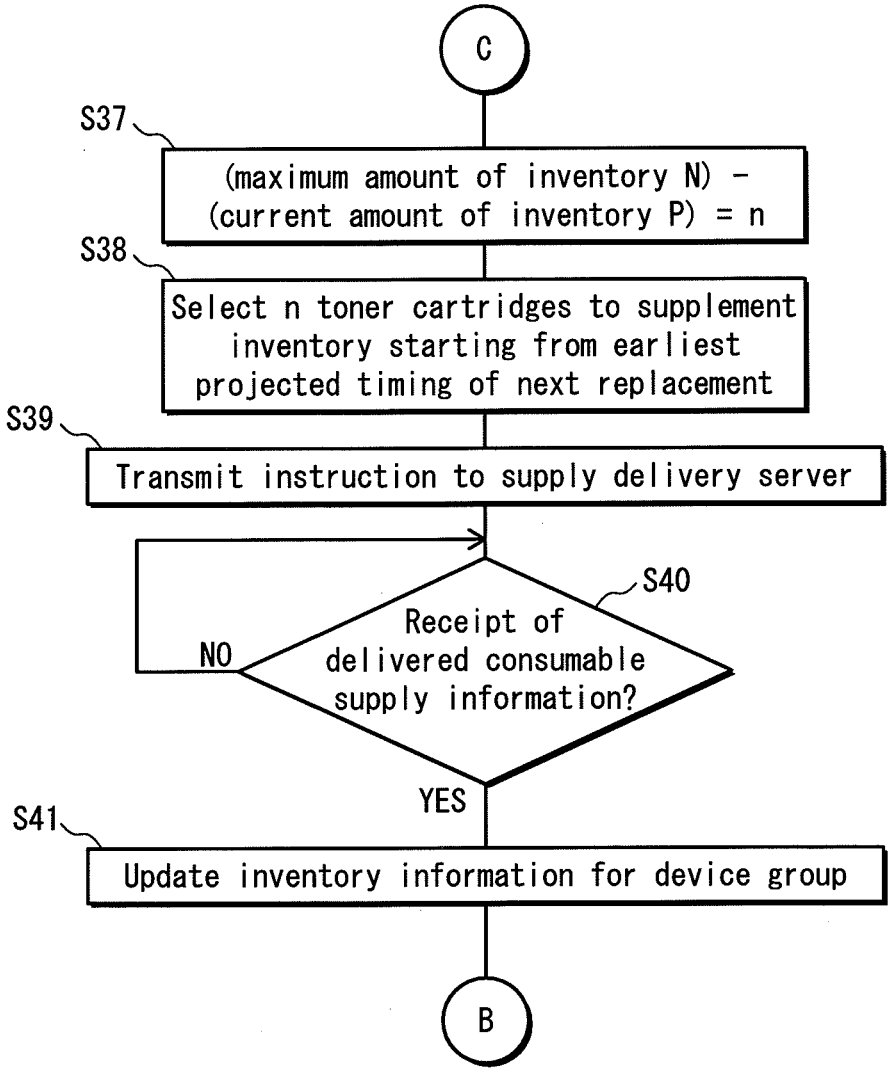
FIG. 15 is a flowchart showing a continuation of the flowchart in FIG. 14.

FIG. 14 is part of a flowchart showing a control sequence for the image processing device 100 and the inventory management device 300 for consumable inventory management by the inventory management device of the present embodiment. FIG. 15 is a continuation of FIG. 14 showing the remainder of the flowchart. The following describes an example for office A (see FIG. 1).

First, each of the image processing devices 100-A01, 100-A02, and 100-A03 belonging to office A self-monitor to detect replacement of a toner cartridge (step S21). This detection of replacement of a toner cartridge includes detection of an operation with possible toner cartridge replacement.

Upon detection of replacement of a toner cartridge in one of the image processing devices 100-A01, 100-A02, and 100-A03 (step S21: YES), the image processing device that detects replacement determines whether the toner replacement timing confirmation unit 611 (see FIG. 6) has confirmed the timing of replacement of the toner cartridge (step S22).

When the timing of replacement of the toner cartridge has not been confirmed (step S22: NO), the determination is repeated until the timing of replacement is confirmed (step S22).

When the timing of replacement of the toner cartridge has been confirmed (step S22: YES), the replaced toner information stored in the replaced toner information storage 665 (see FIG. 6) is transmitted to the inventory management device 300 (step S23).

The inventory management device 300 monitors for receipt of the replaced toner information (step S31). When the replaced toner information acquisition unit 311 (see FIG. 7) receives the replaced toner information (step S31: YES), the inventory management device 300 transmits a signal to each of the image processing devices 100-A01, 100-A02, and 100-A03 requesting information on whether, for any toner cartridges, the toner replacement timing confirmation is in progress (i.e. whether the toner replacement timing has not yet been confirmed for any toner cartridges; step S32).

At this point, the image processing devices 100-A01, 100-A02, and 100-A03 are monitoring for receipt of the signal requesting information on toner replacement timing confirmation in progress (step S24). Upon receiving the signal requesting information on toner replacement timing confirmation in progress (step S24: YES), the image processing devices transmit the information on toner replacement timing confirmation in progress to the inventory management device 300 (step S25).

The inventory management device 300 monitors for receipt of the information on toner replacement timing confirmation in progress from all of the image processing devices 100 to which the request signal was transmitted. Upon receiving the information on toner replacement timing confirmation in progress (step S33: YES), the inventory management device 300 refers to the received information to determine whether confirmation of the toner replacement timing is in progress for any toner cartridges (step S34).

If confirmation of the toner replacement timing is in progress for any toner cartridges in any of the image processing devices 100-A01, 100-A02, and 100-A03 (step S34: YES), processing returns to step S31, and the inventory management device 300 waits until receiving replaced toner information indicating confirmation of the toner replacement timing for the toner cartridge whose confirmation was in progress (step S31).

If confirmation of the toner replacement timing is not in progress for any toner cartridge (step S34: NO), the storage unit 320 in the inventory management device 300 (see FIG. 7) refers to the replaced toner information received in step S31 to update the inventory information for the device group (in this case, office A) to which belongs the image processing device 100 in which a toner cartridge was replaced (step S35). The storage unit 320 updates the inventory information by subtracting the replaced toner cartridge from the inventory. By thus waiting to update the inventory information in the case that confirmation of the toner replacement timing is in progress for a toner cartridge, the inventory information more accurately reflects current inventory status, resulting in a more accurate selection of the toner cartridge to supplement the inventory, as described below.

The inventory management device 300 then refers to the updated inventory information to determine whether a current amount of inventory P is smaller than a maximum amount of inventory N that is preset for the device group (in this case, office A; step S36).

When the current amount of inventory P is not smaller than the maximum amount of inventory N, i.e. when P is equal to or greater than N (step S36: NO), a supplement for the inventory would exceed the maximum amount of inventory. Therefore, in this case processing returns to step S31 without supplementing the inventory, and the inventory management device 300 monitors for receipt of the next replaced toner information (step S31).

When the current amount of inventory P is smaller than the maximum amount of inventory N (step S36: YES), the current amount of inventory P is subtracted from the maximum amount of inventory N to calculate the number n (n being a positive integer) of toner cartridges to supplement the inventory (step S37).

The inventory supplement selection unit 315 in the inventory management device 300 (see FIG. 7) refers to the inventory information to select n toner cartridges, starting from the earliest projected timing of next replacement, from among toner cartridges not in the inventory (step S38). The delivery instruction unit 316 (see FIG. 7) then instructs the supply delivery server 400 to deliver the selected toner cartridges to the user (in this case, the inventory manager for office A; step S39).

Subsequently, the inventory management device 300 monitors for receipt, from the supply delivery server 400, of delivered consumable supply information indicating that the designated toner cartridges were delivered to the user (in this case, the inventory manager for office A; step S40). Upon receipt of the delivered consumable supply information (step S40: YES), the inventory information storage 321 (see FIG. 7) refers to the received information to update the inventory information for the corresponding device group (in this case, office A) by adding the delivered toner cartridges to the inventory information of the device group (step S41). Processing then returns to step S31, and the inventory management device 300 monitors for receipt of the next replaced toner information.

As described above, in the present embodiment, inventory of toner cartridges, which are consumable supplies used in image processing devices, is managed by device group. The time when a toner cartridge will be consumed and require replacement is projected, and toner cartridges to supplement the inventory are selected from among the toner cartridges not in the inventory, starting with the earliest projected timing of next replacement until reaching the maximum amount of inventory. The selected toner cartridges are then delivered to the user. Hereinafter, the method of selecting toner cartridges to supplement the inventory in the present embodiment is referred to as the "first selection mode".

This structure allows for stocking of toner cartridges that have a high probability of being replaced next without exceeding the maximum amount of inventory, even for offices or other locations having an extremely limited inventory space that accommodates storage of only a very few toner cartridges. Therefore, even when only a very few toner cartridges are in stock, this structure avoids the problem of the user not having a replacement on hand for a toner cartridge that has been depleted, thereby contributing to providing an inventory management service that is even more convenient for the user.

Note that in step S36, replacing a toner cartridge causes the inventory to decrease by a corresponding amount, and therefore the current amount of inventory does not equal or exceed the maximum amount of inventory. If, however, surplus toner cartridges have been received from another department or office, for example, and the inventory information is updated by hand, the current amount of inventory P may temporarily exceed the maximum amount of inventory N. The determination in step S36 prevents such an irregular situation from indefinitely continuing without being resolved.

In the above-described embodiment, the device group of an image processing device in which a toner cartridge has been replaced is specified by looking up the image processing device identifier, included in the replaced toner information, in the image processing device registration information, but confirmation is not limited in this way. For example, the identifier for the device group to which belongs the image processing device 100 in which a toner cartridge has been replaced may be included in the replaced toner information. In this case, the device group identifier may be included as part of the image processing device identifier. With this structure, the inventory management device 300 (inventory information storage 321) acquires the identifier for the device group to which belongs the image processing device 100 in which a toner cartridge has been replaced without referring to the image processing device registration information, but rather directly from the replaced toner information.

Embodiment 2

In Embodiment 1, when selecting the toner cartridges to supplement the inventory, the criterion for prioritizing selection is an earlier projected timing of next replacement. When the projected timing of next replacement for another toner cartridge is within a predetermined amount of time (for example, a week) of the earliest projected timing of next replacement, however, the toner cartridges may actually require replacement at approximately the same time if the projected timings of next replacement are off target. In this case, it is not particularly meaningful to simply select the toner cartridge with the earliest projected timing of next replacement. If criteria for prioritizing selection other than the projected timing of next replacement exist, in some cases such criteria should also be taken into consideration when selecting the toner cartridges to supplement the inventory.

In the present embodiment, when the projected timing of next replacement for another toner cartridge is within a week of the earliest projected timing of next replacement, then in addition to the projected timing of next replacement as a first criterion for prioritization, the remaining amount of toner is also taken into consideration as a second criterion for prioritization when selecting the toner cartridges to supplement the inventory.

Note that to avoid repetition, a description of what is the same as in Embodiment 1 is omitted, and the same constituent elements are indicated with the same reference signs. The same is also true for all of the other embodiments and the modifications below.

FIG. 16A is an example of the structure of inventory information in the present embodiment. As an example, the following describes selection of toner cartridges to supplement the inventory at a point at which the color M toner cartridge in the image processing device 100-A01 in office A has been replaced (i.e. the timing of replacement has been confirmed).

Note that among the categories constituting the inventory information, the device group and the maximum amount of inventory are the same as in FIG. 13A, and therefore these categories are omitted from FIG. 16A. The same is also true for all of the modifications below.

At this point in time, the inventory space in office A is stocked with three toner cartridges: color K for the image processing device 100-A01, and colors M and K for the image processing device 100-A02. Since the maximum amount of inventory is four, one toner cartridge to supplement the inventory is selected.

The toner cartridges not currently included in the inventory for the device group (in this case, office A) are identified and listed in a table by projected timing of next replacement, starting with the earliest timing, as shown in FIG. 16B.

As further shown in FIG. 16B, the toner cartridge with the earliest projected timing of next replacement is the color Y toner cartridge for the image processing device 100-A01, which has a projected timing of next replacement of Jul. 20, 2011. Furthermore, the color C toner cartridge for the image processing device 100-A02 has a projected timing of next replacement within one week of this date (projected timing of next replacement: Jul. 22, 2011). In FIG. 16B, the projected timing of next replacement for these two toner cartridges is shown in bold.

The remaining amounts of toner for these toner cartridges are as follows: the remaining amount of toner for the color Y toner cartridge in the image processing device 100-A01 is 60%, whereas the remaining amount of toner for the color C toner cartridge in the image processing device 100-A02 is 20%.

If the remaining amount of toner is low, there is little capacity to accommodate an increase in the toner consumption rate beyond the projected rate, and the possibility exists of the toner being depleted shortly. In this embodiment, therefore, the priority of the color C toner cartridge in the image processing device 100-A02 is increased, since this toner cartridge has little remaining toner, resulting in this toner cartridge being selected as the toner cartridge to supplement the inventory. Note that in FIG. 16B, for the sake of clarity, the entry for the color C toner cartridge in the image processing device 100-A02 is outlined in bold, and the priority, the projected timing of next replacement, and the remaining amount of toner thereof are shown in bold.

Figure 17:
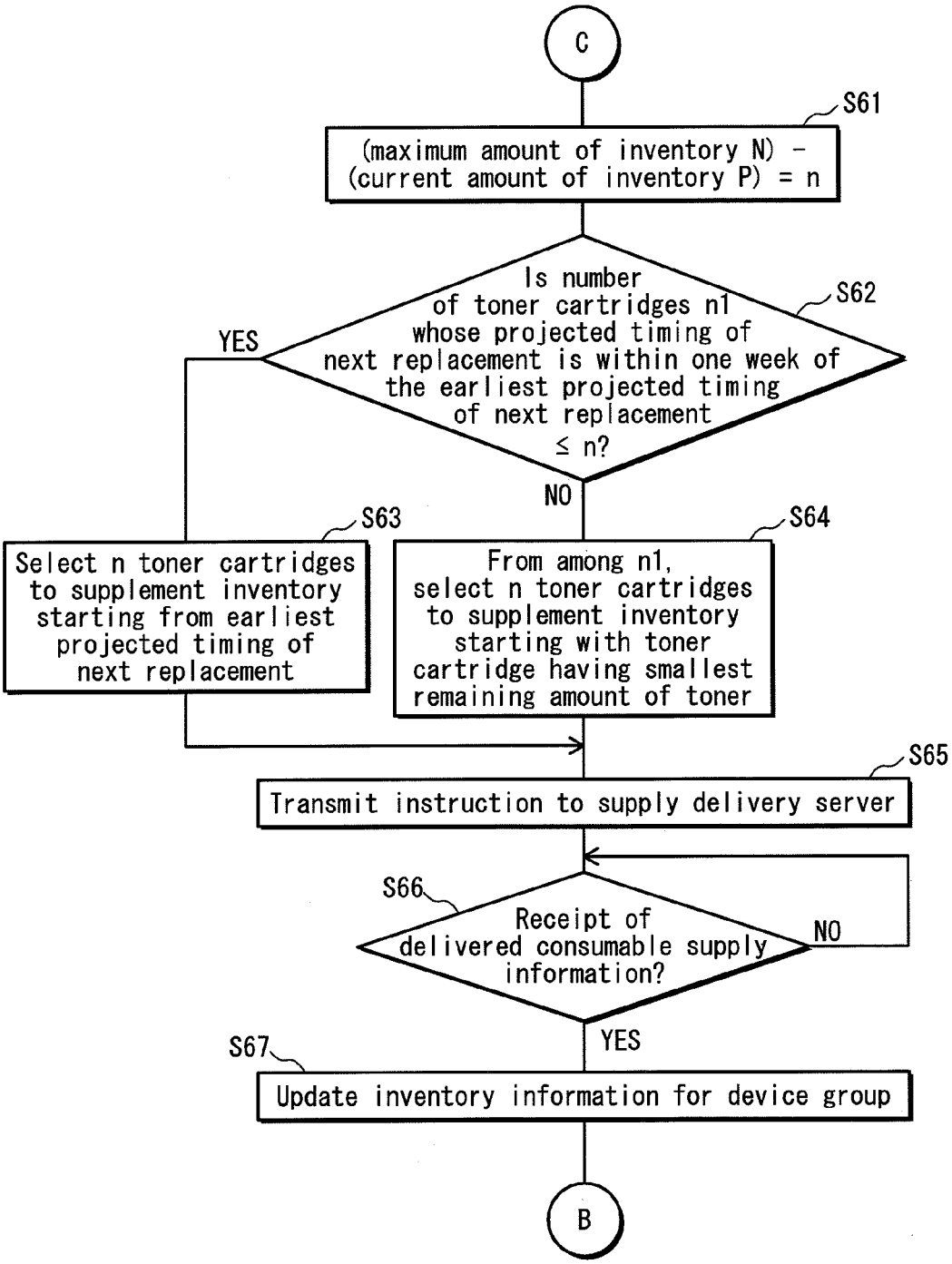
FIG. 17 is part of a flowchart of a control sequence for the image processing device and the inventory management device for consumable inventory management by the inventory management device of Embodiment 2, showing processing by the inventory management device.

FIG. 17 is part of a flowchart showing a control sequence for the image processing device 100 and the inventory management device 300 for consumable inventory management by the inventory management device of the present embodiment. Here, the control sequence for the image processing device 100 is the same as FIG. 14 and therefore is omitted from FIG. 17 and from the description below. Furthermore, in the control sequence for the inventory management device 300, processing before step S61 is the same as processing from step S31 through step S36 in FIG. 14, and thus these steps and a description thereof are similarly omitted.

In step S36 (see FIG. 14), when the current amount of inventory P is smaller than the maximum amount of inventory N (step S36: YES), the current amount of inventory P is subtracted from the maximum amount of inventory N to calculate the number n (n being a positive integer) of toner cartridges to supplement the inventory (step S61).

Next, among the toner cartridges not in the inventory, it is determined whether the total n1 (n1 being a positive integer) of any toner cartridges whose projected timing of next replacement is within one week of the earliest projected timing of next replacement, including the toner cartridge having the earliest projected timing of next replacement, is equal to or less than the number n of toner cartridges to supplement the inventory (step S62).

When n1 is not less than or equal to n, i.e. when $n<n1$ (step S62: NO), then as the toner cartridges to supplement the inventory, n toner cartridges are selected from among the toner cartridges whose projected timing of next replacement is within one week of the earliest projected timing of next replacement, starting with the toner cartridge having the smallest remaining amount of toner (step S64). The delivery instruction unit 316 (see FIG. 7) then instructs the supply delivery server 400 (see FIG. 1) to deliver the selected toner cartridges to the user (in this case, the inventory manager for office A; step S65).

In step S62, when $n1 \leq n$ (step S62: YES), then a selection of n toner cartridges by the first selection mode in Embodiment 1 includes all of the toner cartridges whose projected timing of next replacement is within one week of the earliest projected timing of next replacement. Therefore, among the toner cartridges not in the inventory, n toner cartridges are selected to supplement the inventory starting with the earliest projected timing of next replacement (step S63), and the supply delivery server 400 is instructed to deliver the selected toner cartridges to the user (step S65).

Steps S66 and S67 are the same as steps S40 and S41 in the flowchart in FIG. 15, and therefore a description thereof is omitted.

As described above, with the structure of the present embodiment, when there is a plurality of toner cartridges whose projected timing of next replacement is within a predetermined amount of time (in this embodiment, a week) of the earliest projected timing of next replacement, selection of the toner cartridge having the smallest remaining amount of toner is prioritized so that a replacement toner cartridge is always stocked in the inventory even if the toner consumption rate is faster than projected.

In the present embodiment, the predetermined amount of time (a week) is set in advance, but the present invention is not limited in this way. Alternatively, the user may be allowed to set and to change the amount of time via the control panel 16 or the client device 200. Furthermore, the present embodiment describes an example of one week as the predetermined amount of time, but the amount of time is not limited in this way, and may be shorter or longer than a week. If the amount of time is set too long, however, a toner cartridge whose projected timing of next replacement satisfies the second criterion for prioritization would have a high probability of existing during the amount of time. This may lead to the problem of the toner cartridge whose projected timing of next replacement is the earliest, but which does not satisfy the second criterion for prioritization, indefinitely not being selected and thus not being in stock when requiring replacement. Accordingly, it is preferable for the predetermined amount of time to be about one month at most. The same is true for each of the modifications to the present embodiment.

Modifications to Embodiment 2

In Embodiment 2, the remaining amount of toner is treated as the second criterion for prioritization, but the second criterion for prioritization is not limited to the remaining amount of toner. The following modifications are possible.

(1) In the present modification, the color of toner is taken into consideration as the second criterion for prioritization.

FIG. 18A is an example of the structure of inventory information in the present modification. As an example, the following describes selection of toner cartridges to supplement the inventory at a point at which the color M toner cartridge in the image processing device 100-A01 in office A has been replaced (i.e. the timing of replacement has been confirmed). At this point in time, the inventory space in office A is stocked with three toner cartridges: colors C and K for the image processing device 100-A01, and color M for the image processing device 100-A02. Since the maximum amount of inventory is four, one toner cartridge to supplement the inventory is selected.

The toner cartridges not currently included in the inventory for the device group (in this case, office A) are identified and listed in a table by projected timing of next replacement, starting with the earliest timing, as shown in FIG. 18B.

As further shown in FIG. 18B, the toner cartridge with the earliest projected timing of next replacement is the color C toner cartridge for the image processing device 100-A02, which has a projected timing of next replacement of Jul. 24, 2011. Furthermore, the color K toner cartridge for the image processing device 100-A02 has a projected timing of next replacement within one week of this date (projected timing of next replacement: Jul. 25, 2011). In FIG. 18B, the projected timing of next replacement for these two toner cartridges is shown in bold.

Here, it is assumed that even if all the color toner is depleted, monochrome printing is possible, whereas printing is impossible if all the black toner is depleted. Therefore, in this case, the priority of the black (K) toner cartridge is increased, so that the color K toner cartridge for the image processing device 100-A02 is selected as the toner cartridge to supplement the inventory. Note that in FIG. 18B, for the sake of clarity, the entry for this toner cartridge is outlined in bold, and the priority, the projected timing of next replacement, and the toner color thereof are shown in bold.

Figure 19:
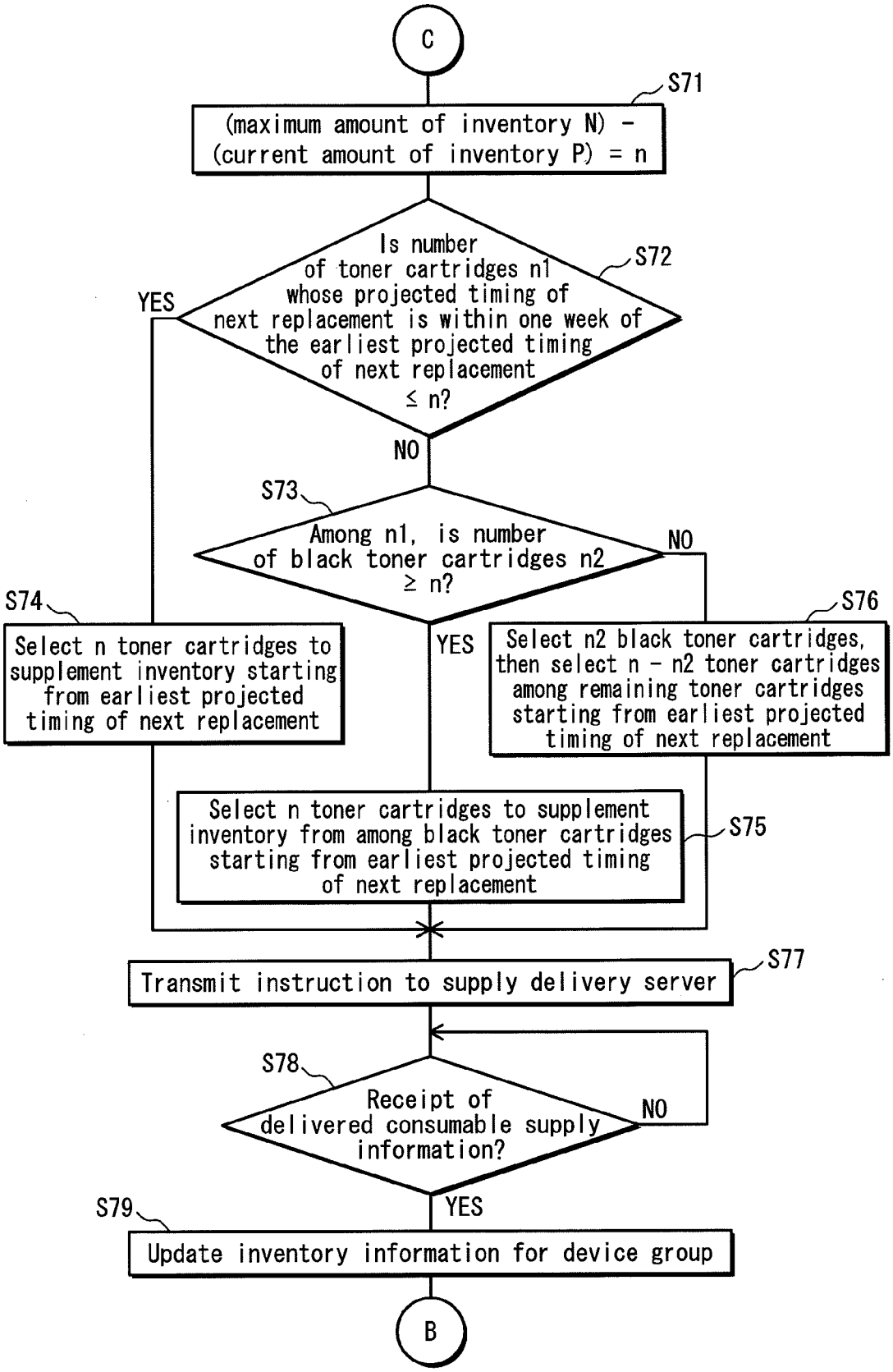
FIG. 19 is part of a flowchart of a control sequence for the image processing device and the inventory management device for consumable inventory management by the inventory management device of Modification 1, showing processing by the inventory management device.

FIG. 19 is part of a flowchart showing a control sequence for the image processing device 100 and the inventory management device 300 for consumable inventory management by the inventory management device of the present modification. Here, the control sequence for the image processing device 100 is the same as FIG. 14 and therefore is omitted from FIG. 19 and from the description below. Furthermore, in the control sequence for the inventory management device 300, processing before step S71 is the same as processing from step S31 through step S36 in FIG. 14, and thus these steps and a description thereof are similarly omitted.

Additionally, steps S71 and S72 are the same as steps S61 and S62 in the flowchart shown in FIG. 17, and thus a description thereof is omitted.

In step S72, when the number n1 of toner cartridges whose projected timing of next replacement is within a week of the earliest projected timing of next replacement is not less than or equal to n, i.e. when n<n1 (step S72: NO), it is determined whether the number n2 of black (K) toner cartridges among the toner cartridges whose projected timing of next replacement is within a week of the earliest projected timing of next replacement is equal to or greater than n (step S73).

When n2≥n (step S73: YES), then n toner cartridges to supplement the inventory are selected from among the n2 black toner cartridges starting from the toner cartridge with the earliest projected timing of next replacement (step S75), and the supply delivery server 400 is instructed to deliver the selected toner cartridges to the user (step S77).

When n2 is not greater than or equal to n, i.e. when n2<n (step S73: NO), then after selecting the n2 black toner cartridges as toner cartridges to supplement the inventory, n-n2 toner cartridges are selected from among the remaining toner cartridges not in the inventory other than the selected black toner cartridges, starting from the toner cartridge with the earliest projected timing of next replacement (step S76), and the supply delivery server 400 is instructed to deliver the total of n selected toner cartridges to the user (step S77).

In step S72, when n1≤n (step S72: YES), then a selection of n toner cartridges by the first selection mode in Embodiment 1 includes all of the toner cartridges whose projected timing of next replacement is within one week of the earliest projected timing of next replacement. Therefore, among the toner cartridges not in the inventory, n toner cartridges are selected to supplement the inventory starting with the earliest projected timing of next replacement (step S74), and the supply delivery server 400 is instructed to deliver the selected toner cartridges to the user (step S77).

Steps S78 and S79 are the same as steps S40 and S41 in the flowchart in FIG. 15, and therefore a description thereof is omitted.

As described above, with the structure of the present modification, when there is a plurality of toner cartridges whose projected timing of next replacement is within a predetermined amount of time (in this modification, a week) of the earliest projected timing of next replacement, selection of the black (K) toner cartridge is prioritized so that at least monochrome printing will always be possible.

(2) If the toner consumption rate fluctuates greatly, the projected of the timing of next replacement easily becomes off target, increasing the risk of the toner being depleted more quickly than projected.

In the present modification, the variation in the toner consumption rate is taken into consideration as the second criterion for prioritization.

FIG. 20A is an example of the structure of inventory information in the present modification. As an example, the following describes selection of toner cartridges to supplement the inventory at a point at which the color M toner cartridge in the image processing device 100-A01 in office A has been replaced (i.e. the timing of replacement has been confirmed). At this point in time, the inventory space in office A is stocked with three toner cartridges: color K for the image processing device 100-A01, and colors M and K for the image processing device 100-A02. Since the maximum amount of inventory is four, one toner cartridge to supplement the inventory is selected.

The toner cartridges not currently included in the inventory for the device group (in this case, office A) are identified and listed in a table by projected timing of next replacement, starting with the earliest timing, as shown in FIG. 20B.

As further shown in FIG. 20B, the toner cartridge with the earliest projected timing of next replacement is the color Y toner cartridge for the image processing device 100-A01, which has a projected timing of next replacement of Jul. 20, 2011. Furthermore, the color C toner cartridge for the image processing device 100-A02 has a projected timing of next replacement within one week of this date (projected timing of next replacement: Jul. 22, 2011). In FIG. 20B, the projected timing of next replacement for these two toner cartridges is shown in bold.

The variation in toner consumption rate for these toner cartridges are as follows: the variation in toner consumption rate for the color Y toner cartridge in the image processing device 100-A01 is 2.8, whereas the variation in toner consumption rate for the color C toner cartridge in the image processing device 100-A02 is 7.6. Accordingly, in this case, the priority of the color C toner cartridge in the image processing device 100-A02 is increased as this toner cartridge has a larger variation in toner consumption rate, so that the color C toner cartridge is selected to supplement the inventory. Note that in FIG. 20B, for the sake of clarity, the entry for the color C toner cartridge in the image processing device 100-A02 is outlined in bold, and the priority, the projected timing of next replacement, and the variation in toner consumption rate thereof are shown in bold.

In the present modification, the index used as the variation in the toner consumption rate is the standard deviation of the toner consumption rate. The toner consumption rate is the amount of toner consumed per unit of time (day), which is obtained from the total amount of toner consumed during the predetermined period of time as used to calculate the projected timing of next replacement. The index is not limited in this way, however, and any index that indicates the degree of variation in the toner consumption rate may be used.

Figure 21:
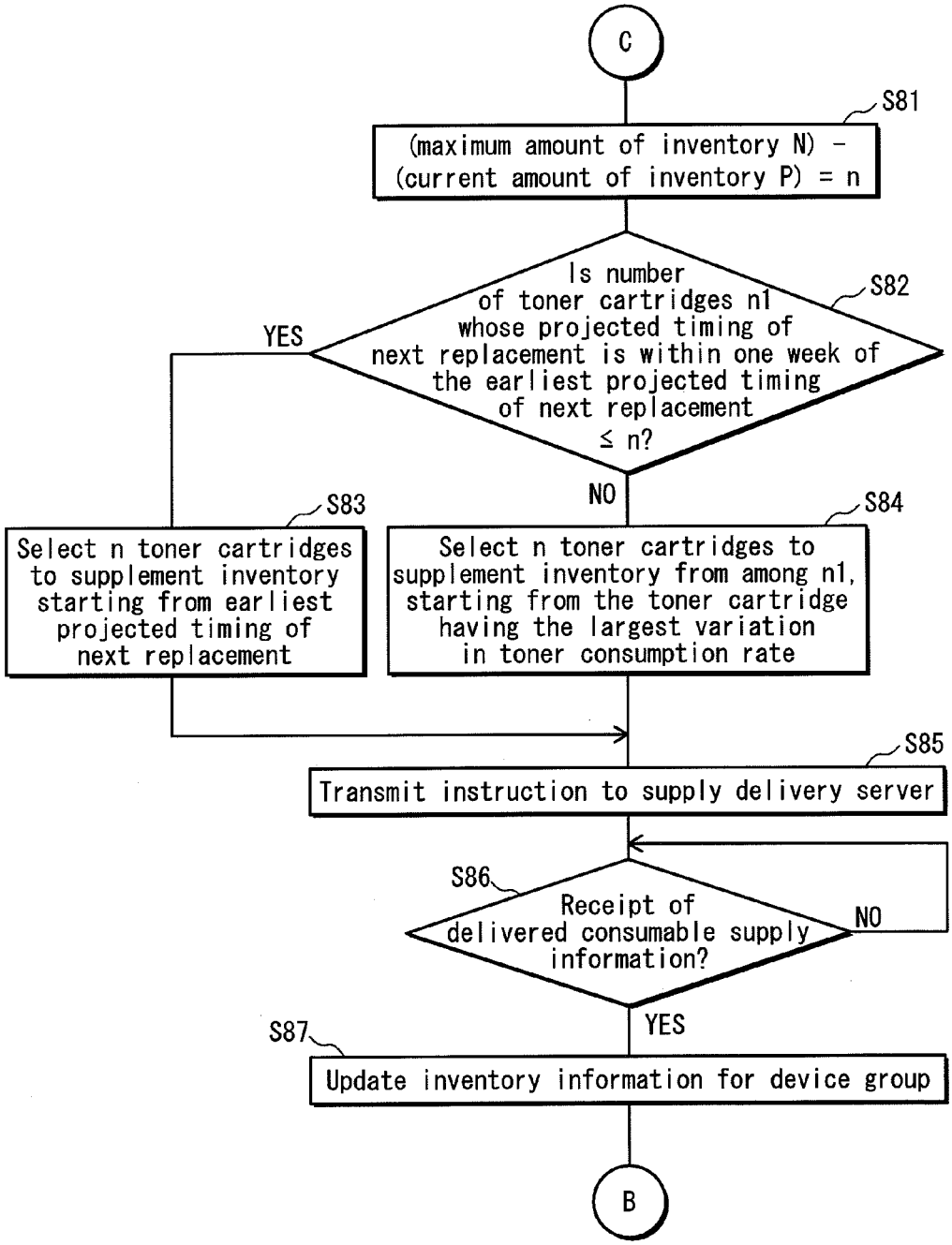
FIG. 21 is part of a flowchart of a control sequence for the image processing device and the inventory management device for consumable inventory management by the inventory management device of Modification 2, showing processing by the inventory management device.

FIG. 21 is part of a flowchart showing a control sequence for the image processing device 100 and the inventory management device 300 for consumable inventory management by the inventory management device of the present modification. Here, the control sequence for the image processing device 100 is the same as FIG. 14 and therefore is omitted from FIG. 21 and from the description below. Furthermore, in the control sequence for the inventory management device 300, processing before step S81 is the same as processing from step S31 through step S36 in FIG. 14, and thus these steps and a description thereof are similarly omitted.

Furthermore, steps S81 and S82 are respectively the same as steps S61 and S62 in the flowchart shown in FIG. 17, and the processing in steps S83 and S85 when the result of step S82 is determined to be YES is the same as the processing in steps S63 and S65 in the flowchart shown in FIG. 17 when the result of step S62 is determined to be YES. Therefore, a description of these steps is omitted.

In step S82, among the toner cartridges not in the inventory, if the total n1 of any toner cartridges whose projected timing of next replacement is within one week of the earliest projected timing of next replacement, including the toner cartridge having the earliest projected timing of next replacement, is not equal to or less than n, i.e. if n<n1 (step S82: NO), then among the toner cartridges whose projected timing of next replacement is within a week of the earliest projected timing of next replacement, n toner cartridges to supplement the inventory are selected starting with the toner cartridge having the largest variation in toner consumption rate (step S84). The supply delivery server 400 is instructed to deliver the selected toner cartridges to the user (step S85).

Steps S86 and S87 are the same as steps S40 and S41 in the flowchart in FIG. 15, and therefore a description thereof is omitted.

As described above, with the structure of the present modification, when there is a plurality of toner cartridges whose projected timing of next replacement is within a predetermined amount of time (in this modification, a week) of the earliest projected timing of next replacement, selection of the toner cartridge having the largest variation in toner consumption rate is prioritized so that a replacement toner cartridge is always stocked in the inventory even if the toner consumption rate is faster than projected causing the toner to be depleted earlier than projected.

(3) Among the functions with which an image processing device is provided, some functions are frequently used, whereas other functions are important to the user even if not used frequently. Among such functions, the FAX function is often used in offices to exchange valuable business information that, for security reasons, is preferable not to send or receive by e-mail, or to send or receive information, such as maps or drawings, that is difficult to explain over the telephone. Therefore, the inability to output (print out) received faxes due to an absence of toner is highly likely to be problematic.

In the present modification, a specific function provided in the image processing device, in particular the FAX function, is taken into consideration as the second criterion for prioritization.

FIG. 22A is an example of the structure of inventory information in the present modification. As an example, the following describes selection of toner cartridges to supplement the inventory at a point at which the color M toner cartridge in the image processing device 100-A01 in office A has been replaced (i.e. the timing of replacement has been confirmed). At this point in time, the inventory space in office A is stocked with three toner cartridges: color Y for the image processing device 100-A01, and colors M and K for the image processing device 100-A02. Since the maximum amount of inventory is four, one toner cartridge to supplement the inventory is selected.

The toner cartridges not currently included in the inventory for the device group (in this case, office A) are identified and listed in a table by projected timing of next replacement, starting with the earliest timing, as shown in FIG. 22B.

As further shown in FIG. 22B, the toner cartridge with the earliest projected timing of next replacement is the color K toner cartridge for the image processing device 100-A01, which has a projected timing of next replacement of Jun. 28, 2011. Furthermore, the color K toner cartridge for the image processing device 100-A03 has a projected timing of next replacement within one week of this date (projected timing of next replacement: Jun. 30, 2011). In FIG. 22B, the projected timing of next replacement for these two toner cartridges is shown in bold.

In this example, the image processing device 100-A03 has a FAX function, whereas the image processing device 100-A01 does not. Accordingly, in this case, the priority of the (color K) toner cartridge in the image processing device 100-A03, which has a FAX function, is increased, so that this toner cartridge is selected to supplement the inventory. Note that in FIG. 22B, for the sake of clarity, the entry for this toner cartridge is outlined in bold, and the priority, the projected timing of next replacement, and the indication of the FAX function are shown in bold.

Figure 23:
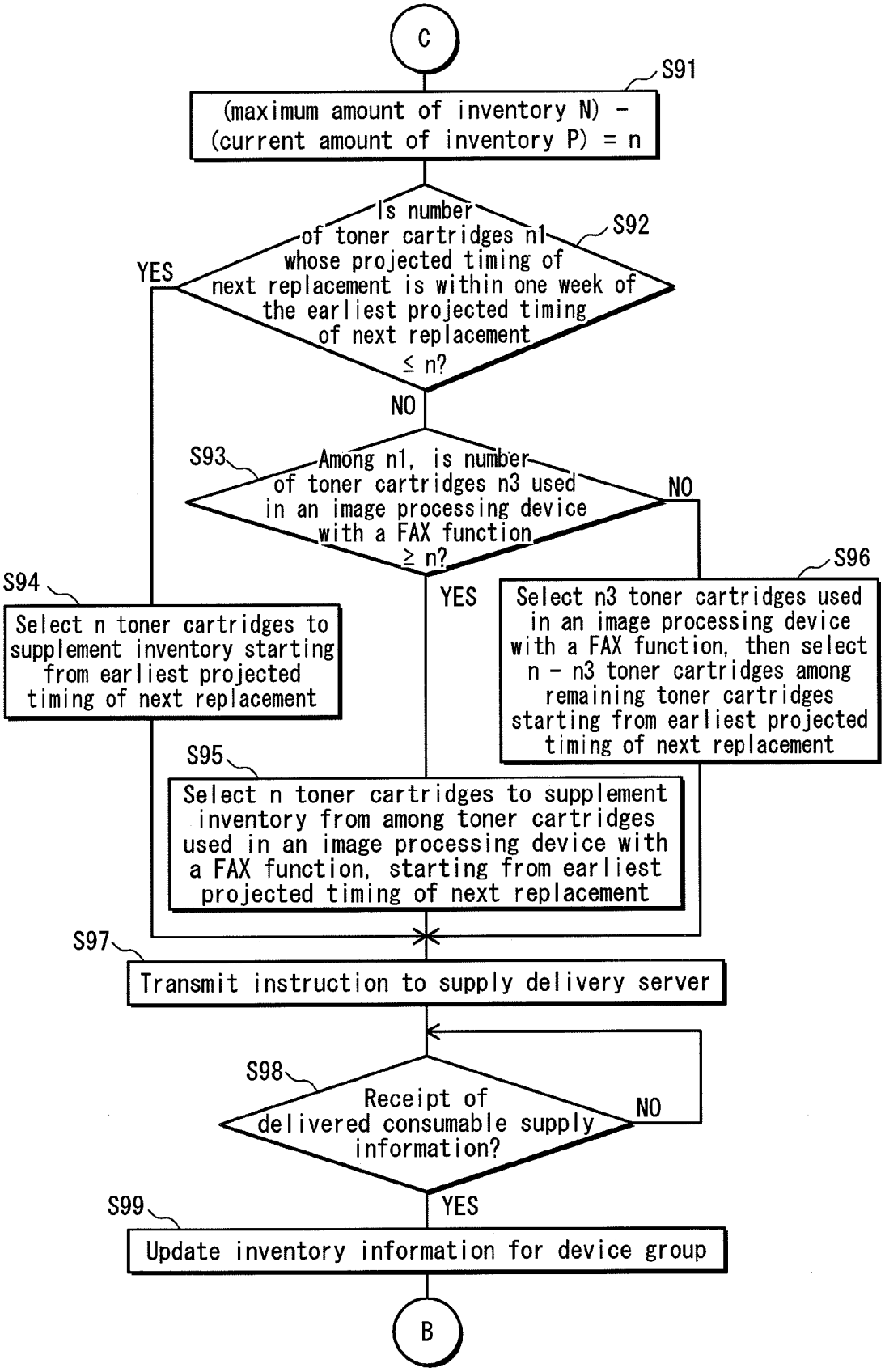
FIG. 23 is part of a flowchart of a control sequence for the image processing device and the inventory management device for consumable inventory management by the inventory management device of Modification 3, showing processing by the inventory management device.

FIG. 23 is part of a flowchart showing a control sequence for the image processing device 100 and the inventory management device 300 for consumable inventory management by the inventory management device of the present modification. Here, the control sequence for the image processing device 100 is the same as FIG. 14 and therefore is omitted from FIG. 23 and from the description below. Furthermore, in the control sequence for the inventory management device 300, processing before step S91 is the same as processing from step S31 through step S36 in FIG. 14, and thus these steps and a description thereof are similarly omitted.

Additionally, steps S91 and S92 are the same as steps S61 and S62 in the flowchart shown in FIG. 17, and thus a description thereof is omitted.

In step S92, when the number n1 of toner cartridges whose projected timing of next replacement is within a week of the earliest projected timing of next replacement is not less than or equal to n, i.e. when $n<n1$ (step S92: NO), it is determined whether, among the toner cartridges whose projected timing of next replacement is within a week of the earliest projected timing of next replacement, the number n3 of toner cartridges used in an image processing device with a FAX function is equal to or greater than n (step S93).

When $n3 \geq n$ (step S93: YES), then n toner cartridges to supplement the inventory are selected from among the toner cartridges used in an image processing device with a FAX function starting from the toner cartridge with the earliest projected timing of next replacement (step S95), and the supply delivery server 400 is instructed to deliver the selected toner cartridges to the user (step S97).

When n3 is not greater than or equal to n, i.e. when $n3<n$ (step S93: NO), then after selecting the n3 toner cartridges used in an image processing device with a FAX function as toner cartridges to supplement the inventory, n-n3 toner cartridges are selected from among the remaining toner cartridges not in the inventory other than the selected toner cartridges, starting from the toner cartridge with the earliest projected timing of next replacement (step S96), and the supply delivery server 400 is instructed to deliver the total of n selected toner cartridges to the user (step S97).

In step S92, when $n1 \leq n$ (step S92: YES), then a selection of n toner cartridges by the first selection mode in Embodiment 1 includes all of the toner cartridges whose projected timing of next replacement is within one week of the earliest projected timing of next replacement. Therefore, among the toner cartridges not in the inventory, n toner cartridges are selected to supplement the inventory starting with the earliest projected timing of next replacement (step S94), and the supply delivery server 400 is instructed to deliver the selected toner cartridges to the user (step S97).

Steps S98 and S99 are the same as steps S40 and S41 in the flowchart in FIG. 15, and therefore a description thereof is omitted.

As described above, with the structure of the present modification, when there is a plurality of toner cartridges whose projected timing of next replacement is within a predetermined amount of time (in this modification, a week) of the earliest projected timing of next replacement, selection of a toner cartridge used in an image processing device having a FAX function is prioritized to prevent a situation in which a received FAX cannot be output due to absence of toner.

Note that in the present modification, the color of the toner cartridge used in an image processing device with a FAX function is only K, but image processing devices with a FAX function are not limited in this way; a color MFP may be provided with a FAX function. In such a case, among the toner cartridges not in the inventory whose projected timing of next replacement is within a week of the earliest projected timing of next replacement, n3 in step S93 would be set to the number of toner cartridges that are both the color K and are used in an image processing device having a FAX function.

Furthermore, in the present modification, the second criterion for prioritization takes into consideration whether or not an image processing device has a FAX function, but the function taken into consideration for the second criterion for prioritization is not limited to the FAX function. For example, in an office where copies are frequently made, the copy function may be the target of the second criterion for prioritization. The user may be allowed to set which function of the image processing device is the target of the second criterion for prioritization.

(4) Once the cartridge empty state is detected, and a message is displayed on the control panel 16 to encourage the user to replace the toner cartridge, if the user continues to use the image processing device without replacing the toner cartridge, the sub-hopper empty state will eventually be detected, and printing will be prohibited. Once the toner cartridge is replaced and the toner concentration in the developing unit 5 recovers, printing by the image processing device is once again possible. The time that elapses between printing being prohibited in the image processing device and printing once again becoming possible is hereinafter referred to as the "duration of suspension".

If either the frequency of use, or the degree of importance, of an image processing device is low, the user is not greatly inconvenienced by printing being prohibited, and a busy user may leave such an image processing device as is. Conversely, if either the frequency of use, or the degree of importance, of an image processing device is high, the user is likely to replace the toner cartridge before printing is prohibited, and should printing happen to become prohibited, the user is likely to immediately become aware of and remedy the situation (by replacing the toner cartridge). Furthermore, even in the case of an image processing device with a high frequency of use, if most printing is monochrome and color printing is infrequent, the user is not very inconvenienced even if color (C, M, or Y) toner is depleted and color printing prohibited. In this case, it is relatively likely that the user will continue without replacing the toner cartridge even after color toner is consumed. Accordingly, the duration of suspension (unusable duration) of each image processing device may be stored as history information and used as an index of the importance to the user, or the frequency of use, of the image processing device. In this modification, among all of the past durations of suspension in the history of each image processing device, the longest duration of suspension is stored in the inventory information for both color (color C, M, and Y toner cartridges) and monochrome (color K toner cartridge).

In the present modification, the duration of suspension is taken into consideration as the second criterion for prioritization.

FIG. 24A is an example of the structure of inventory information in the present modification. As an example, the following describes selection of toner cartridges to supplement the inventory at a point at which the color M toner cartridge in the image processing device 100-A01 in office A has been replaced (i.e. the timing of replacement has been confirmed). At this point in time, the inventory space in office A is stocked with three toner cartridges: color K for the image processing device 100-A01, and colors M and K for the image processing device 100-A02. Since the maximum amount of inventory is four, one toner cartridge to supplement the inventory is selected.

The toner cartridges not currently included in the inventory for the device group (in this case, office A) are identified and listed in a table by projected timing of next replacement, starting with the earliest timing, as shown in FIG. 24B.

As further shown in FIG. 24B, the toner cartridge with the earliest projected timing of next replacement is the color Y toner cartridge for the image processing device 100-A01, which has a projected timing of next replacement of Jul. 20, 2011. Furthermore, the color C toner cartridge for the image processing device 100-A02 has a projected timing of next replacement within one week of this date (projected timing of next replacement: Jul. 22, 2011). In FIG. 24B, the projected timing of next replacement for these two toner cartridges is shown in bold.

The duration of suspension for these two toner cartridges is as follows: the duration of suspension for the color Y toner cartridge in the image processing device 100-A01 is six hours, whereas the duration of suspension for the color C toner cartridge in the image processing device 100-A02 is one hour.

Since a shorter duration of suspension can be considered to indicate a higher frequency of use or degree of importance of the image processing device, the priority of the color C toner cartridge the image processing device 100-A02 is increased as this toner cartridge has a shorter duration of suspension. The color C toner cartridge is thus selected to supplement the inventory. Note that in FIG. 24B, for the sake of clarity, the entry for this toner cartridge is outlined in bold, and the priority, the projected timing of next replacement, and the duration of suspension thereof are shown in bold.

Furthermore, in the present modification, color printing is prohibited if any one of the colors (C, M, Y) of toner enters the sub-hopper empty state, since color reproduction worsens. In this case as well, though, as long as the color K toner has not been depleted (as long as the sub-hopper empty state has not been entered), monochrome printing is possible and thus permitted.

Figure 25:
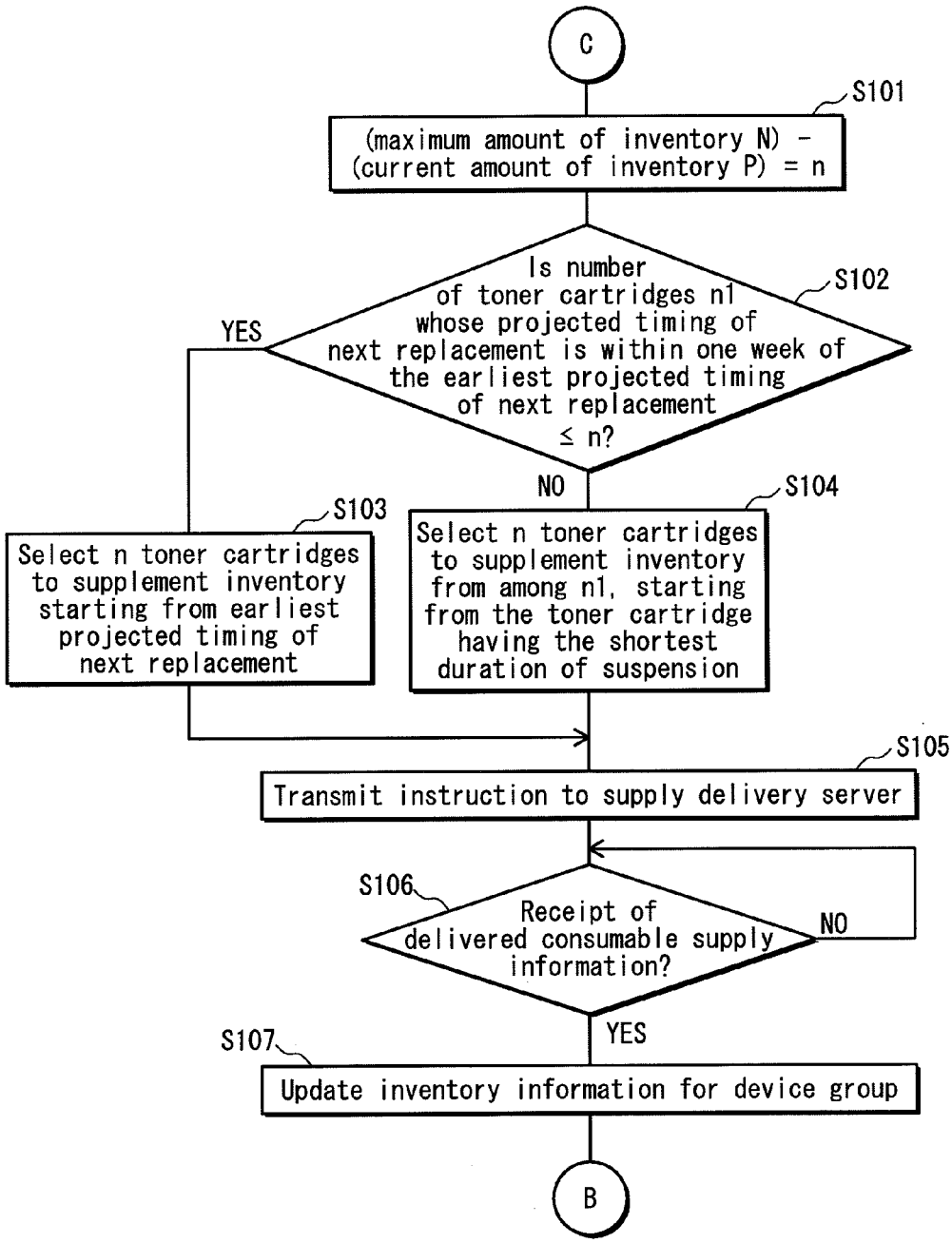
FIG. 25 is part of a flowchart of a control sequence for the image processing device and the inventory management device for consumable inventory management by the inventory management device of Modification 4, showing processing by the inventory management device.

FIG. 25 is part of a flowchart showing a control sequence for the image processing device 100 and the inventory management device 300 for consumable inventory management by the inventory management device of the present modification. Here, the control sequence for the image processing device 100 is the same as FIG. 14 and therefore is omitted from FIG. 25 and from the description below. Furthermore, in the control sequence for the inventory management device 300, processing before step S101 is the same as processing from step S31 through step S36 in FIG. 14, and thus these steps and a description thereof are similarly omitted.

Furthermore, steps S101 and S102 are respectively the same as steps S61 and S62 in the flowchart shown in FIG. 17, and the processing in steps S103 and S105 when the result of step S102 is determined to be YES is the same as the processing in steps S63 and S65 in the flowchart shown in FIG. 17 when the result of step S62 is determined to be YES. Therefore, a description of these steps is omitted.

In step S102, among the toner cartridges not in the inventory, if the total n1 of any toner cartridges whose projected timing of next replacement is within one week of the earliest projected timing of next replacement, including the toner cartridge having the earliest projected timing of next replacement, is not equal to or less than n, i.e. if $n<n1$ (step S102: NO), then among the toner cartridges whose projected timing of next replacement is within a week of the earliest projected timing of next replacement, n toner cartridges to supplement the inventory are selected starting with the toner cartridge having the shortest duration of suspension (step S104). The supply delivery server 400 is instructed to deliver the selected toner cartridges to the user (step S105).

Steps S106 and S107 are the same as steps S40 and S41 in the flowchart in FIG. 15, and therefore a description thereof is omitted.

As described above, with the structure of the present modification, when there is a plurality of toner cartridges whose projected timing of next replacement is within a predetermined amount of time (in this modification, a week) of the earliest projected timing of next replacement, selection of the toner cartridge with the shortest duration of suspension is prioritized so that a toner cartridge is always stocked in the inventory for an image processing device having a high frequency of use or a high degree of importance for the user.

Note that when the color K toner reaches the sub-hopper empty state, even if the color toner has not been depleted, both color printing and monochrome printing may be prohibited in devices that use color K toner to reproduce black portions of a color image.

Also note that when the toner is always replaced before entering the sub-hopper empty state, so that no history of suspension of printing exists, the duration of suspension is set to zero hours.

(5) Some toner cartridges can be used in different types of image processing devices, i.e. some toner cartridges are exchangeable. When using exchangeable toner cartridges, if the sub-hopper empty state is detected for a certain toner in an image processing device and printing is prohibited, and if no replacement toner cartridge is in the inventory, then if the image processing device needs to be used at all costs, printing can be performed by taking the emergency measure of removing the corresponding toner cartridge from a different image processing device and loading it into the image processing device that needs to be used. However, if toner cartridges are not exchangeable, the user cannot borrow a toner cartridge from another image processing device. Therefore, if no replacement is in the inventory when the sub-hopper empty state is detected, the user is greatly inconvenienced.

In the present modification, exchangeability of toner cartridges is taken into consideration as the second criterion for prioritization.

FIG. 26A is an example of the structure of inventory information in the present modification. As an example, the following describes selection of toner cartridges to supplement the inventory at a point at which the color M toner cartridge in the image processing device 100-A01 in office A has been replaced (i.e. the timing of replacement has been confirmed). At this point in time, the inventory space in office A is stocked with three toner cartridges: color Y for the image processing device 100-A01, and colors M and K for the image processing device 100-A02. Since the maximum amount of inventory is four, one toner cartridge to supplement the inventory is selected.

In the present modification, the toner cartridges used in the image processing device 100-A01 are exchangeable with the toner cartridges used in the image processing device 100-A02, but none of these toner cartridges is exchangeable with the toner cartridges used in the image processing device 100-A03.

The toner cartridges not currently included in the inventory for the device group (in this case, office A) are identified and listed in a table by projected timing of next replacement, starting with the earliest timing, as shown in FIG. 26B.

As further shown in FIG. 26B, the toner cartridge with the earliest projected timing of next replacement is the color K toner cartridge for the image processing device 100-A01, which has a projected timing of next replacement of Jun. 28, 2011. Furthermore, the color K toner cartridge for the image processing device 100-A03 has a projected timing of next replacement within one week of this date (projected timing of next replacement: Jun. 30, 2011). In FIG. 26B, the projected timing of next replacement for these two toner cartridges is shown in bold.

In this example, the color K toner cartridge for the image processing device 100-A01 is exchangeable, whereas the color K toner cartridge for the image processing device 100-A03 is not. Accordingly, in this case, the priority of the exchangeable (color K) toner cartridge in the image processing device 100-A03 is increased, so that this toner cartridge is selected to supplement the inventory. Note that in FIG. 26B, for the sake of clarity, the entry for this toner cartridge is outlined in bold, and the priority, the projected timing of next replacement, and the exchangeability thereof are shown in bold.

Figure 27:
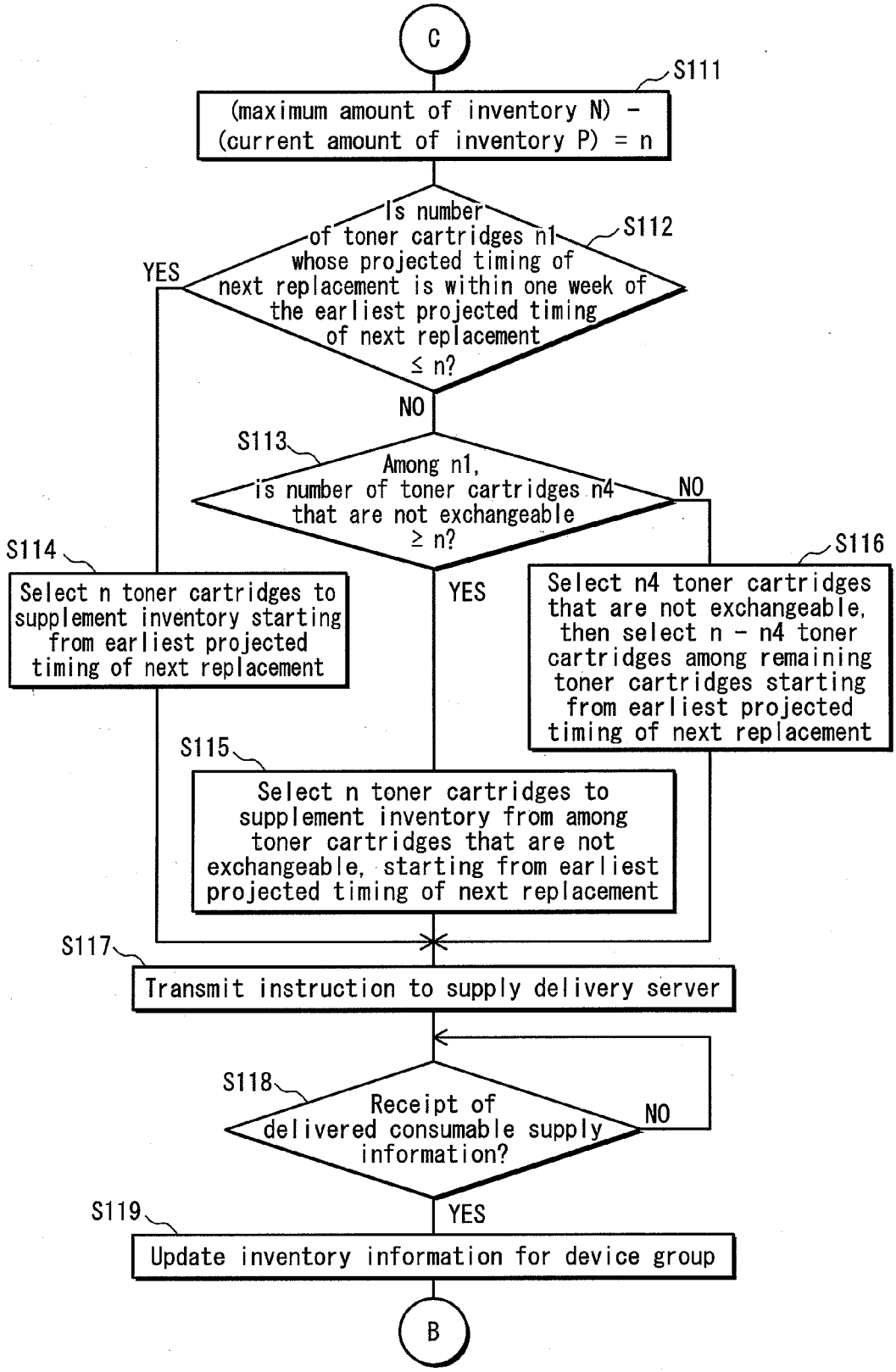
FIG. 27 is part of a flowchart of a control sequence for the image processing device and the inventory management device for consumable inventory management by the inventory management device of Modification 5, showing processing by the inventory management device.

FIG. 27 is part of a flowchart showing a control sequence for the image processing device 100 and the inventory management device 300 for consumable inventory management by the inventory management device of the present modification. Here, the control sequence for the image processing device 100 is the same as FIG. 14 and therefore is omitted from FIG. 27 and from the description below. Furthermore, in the control sequence for the inventory management device 300, processing before step S111 is the same as processing from step S31 through step S36 in FIG. 14, and thus these steps and a description thereof are similarly omitted.

Additionally, steps S111 and S112 are the same as steps S61 and S62 in the flowchart shown in FIG. 17, and thus a description thereof is omitted.

In step S112, when the number n1 of toner cartridges whose projected timing of next replacement is within a week of the earliest projected timing of next replacement is not less than or equal to n, i.e. when $n<n1$ (step S112: NO), it is determined whether, among the toner cartridges whose projected timing of next replacement is within a week of the earliest projected timing of next replacement, the number n4 of toner cartridges that are not exchangeable is equal to or greater than n (step S113).

When $n4 \geq n$ (step S113: YES), then n toner cartridges to supplement the inventory are selected from among the toner cartridges that are not exchangeable starting from the toner cartridge with the earliest projected timing of next replacement (step S115), and the supply delivery server 400 is instructed to deliver the selected toner cartridges to the user (step S117).

When n4 is not greater than or equal to n, i.e. when $n4<n$ (step S113: NO), then after selecting the n4 toner cartridges that are not exchangeable as toner cartridges to supplement the inventory, n-n4 toner cartridges are selected from among the remaining toner cartridges not in the inventory other than the selected toner cartridges, starting from the toner cartridge with the earliest projected timing of next replacement (step S116), and the supply delivery server 400 is instructed to deliver the total of n selected toner cartridges to the user (step S117).

In step S112, when $n1 \leq n$ (step S112: YES), then a selection of n toner cartridges by the first selection mode in Embodiment 1 includes all of the toner cartridges whose projected timing of next replacement is within one week of the earliest projected timing of next replacement. Therefore, among the toner cartridges not in the inventory, n toner cartridges are selected to supplement the inventory starting with the earliest projected timing of next replacement (step S114), and the supply delivery server 400 is instructed to deliver the selected toner cartridges to the user (step S117).

Steps S118 and S119 are the same as steps S40 and S41 in the flowchart in FIG. 15, and therefore a description thereof is omitted.

As described above, with the structure of the present modification, when there is a plurality of toner cartridges whose projected timing of next replacement is within a predetermined amount of time (in this modification, a week) of the earliest projected timing of next replacement, selection of toner cartridges that are not exchangeable is prioritized. This avoids a situation in which printing is impossible in an image processing device in which the sub-hopper empty state is detected due to the depleted toner cartridge not being exchangeable and no replacement toner cartridge being in the inventory.

Modifications to Embodiments 1 and 2

The present invention has been described through embodiments and modifications thereof, but of course the present invention is in no way limited to Embodiment 1, Embodiment 2, and the modifications to Embodiment 2. For example, the following further modifications are possible.

(6) In Embodiment 1, a structure has been described wherein when the toner cartridge is replaced, one or more toner cartridges are selected to supplement the inventory from among toner cartridges not in the inventory, starting from the earliest projected timing of next replacement. In Embodiment 2, a structure has been described wherein when, among the toner cartridges not in the inventory, there is a plurality of toner cartridges whose projected timing of next replacement is within a week of the earliest projected timing of next replacement, selection of a toner cartridge satisfying a second criterion for prioritization is prioritized.

Among users for whom inventory of consumable supplies (toner cartridges) is managed by the above embodiments, however, if there are both users with extremely limited inventory space as well as users with ample inventory space, some of the users with ample inventory space may want to have the same type of toner cartridge as the replaced toner cartridge delivered to supplement the inventory.

The present modification describes a structure in which a user is allowed to choose the selection mode in which the inventory management device 300 operates: the first selection mode in Embodiment 1, or a selection mode for selecting the same type of toner cartridge as the replaced toner cartridge when selecting the toner cartridge to supplement the inventory (hereinafter, "second selection mode"). Note that the user sets the selection mode by selecting between the above selection modes via the control panel 16 (see FIG. 2).

Figure 28:
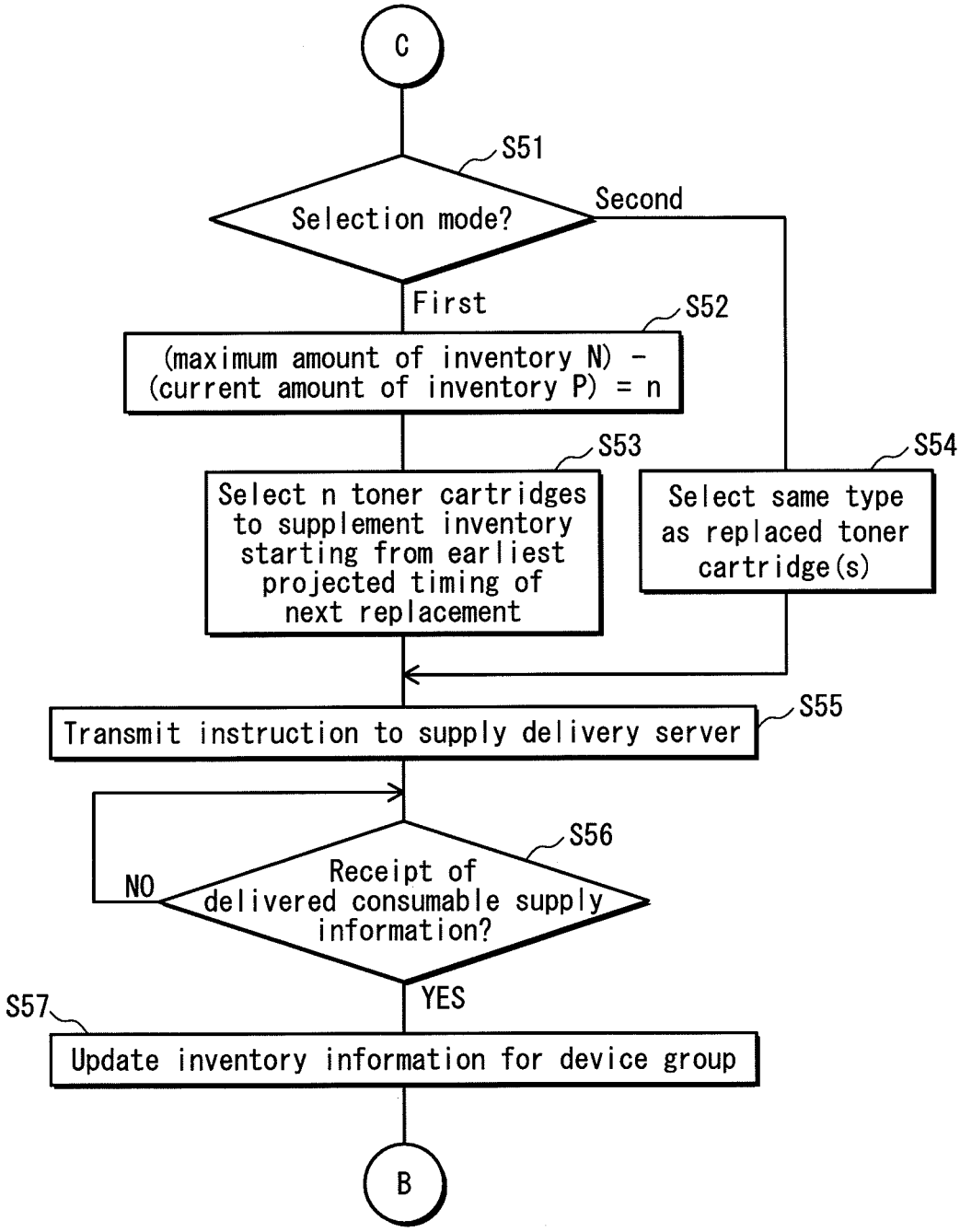
FIG. 28 is part of a flowchart of a control sequence for the image processing device and the inventory management device for consumable inventory management by the inventory management device of Modification 6, showing processing by the inventory management device.

FIG. 28 is part of a flowchart showing a control sequence for the image processing device 100 and the inventory management device 300 for consumable inventory management by the inventory management device of the present modification. Here, the control sequence for the image processing device 100 is the same as FIG. 14 and therefore is omitted from FIG. 28 and from the description below. Furthermore, in the control sequence for the inventory management device 300, processing before step S51 is the same as processing from step S31 through step S36 in FIG. 14, and thus these steps and a description thereof are similarly omitted.

In step S36 (see FIG. 14), when the current amount of inventory P is smaller than the maximum amount of inventory N (step S36: YES), it is then determined which selection mode the user has selected: the first selection mode, or the second selection mode (step S51).

When the user has selected the first selection mode (step S51: first), the current amount of inventory P is subtracted from the maximum amount of inventory N to calculate the number n (n being a positive integer) of toner cartridges to supplement the inventory (step S52).

Steps S52 through S57 are the same as steps S37 through S41 in the flowchart in FIG. 15, and therefore a description thereof is omitted.

In step S51, when the user has selected the second selection mode (step S51: second), the same type of toner cartridge as the replaced toner cartridge is selected to supplement the inventory (step S54), and the delivery instruction unit 316 (see FIG. 7) instructs the supply delivery server 400 to deliver the selected toner cartridge to the user (in this case, the inventory manager for office A; step S55).

Steps S56 and S57 are the same as steps S40 and S41 in the flowchart in FIG. 15, and therefore a description thereof is omitted.

As described above, with the structure of the present modification, the user is allowed to choose between the first and the second selection modes for selection of the toner cartridge to supplement the inventory, thereby contributing to providing an inventory management service that is even more convenient for the user by accommodating the user's preferences and needs.

The following case is also possible. If the image processing devices 100-A01, 100-A02, and 100-A03 used in office A are all color printers of the same type, then the same toner cartridges are useable in all of the image processing devices. Even when storing one of each type of toner cartridge, the total inventory is therefore four toner cartridges. On the other hand, if all of the image processing devices are monochrome printers, only one toner cartridge is used in each. Even if the three image processing devices are different types that use a different type of toner cartridge, the total inventory is thus only three toner cartridges when one of each type of toner cartridge is stocked. In such a case, if the maximum amount of inventory is, for example, four toner cartridges, it suffices to supplement the inventory with the same type of toner cartridge as the toner cartridge that was replaced.

In this case, if the toner cartridge delivered to supplement the inventory differs from the type of toner cartridge that was replaced, some users may feel uneasy, even if such a delivery in fact poses no problem.

Accordingly, in this case as well, allowing the user to choose between the first selection mode and the second selection mode contributes to providing an inventory management service that is even more convenient for the user.

In the above-described structure, one possibility is for the user to set the selection mode for toner cartridges once in advance, with this selection mode subsequently being maintained until the user changes the setting. Another possibility is for the user to be asked to choose a selection mode, for example by a message on the control panel 16, every time a toner cartridge is replaced and a toner cartridge to supplement the inventory is to be selected. Subsequent processing would then be in accordance with the selection mode chosen by the user.

In the above explanation, the user inputs the selection mode via the control panel 16, but input is not limited in this way. The selection mode may be input via the input/operation unit 303 in the inventory management device 300, or via an input means in the client device 200.

(7) In Modification 6, the user is allowed to choose between the first selection mode and the second selection mode, but the present invention is not limited in this way.

For example, the user may be allowed to choose between the second selection mode and a third selection mode whereby, as in Embodiment 2, when the number of toner cartridges, among toner cartridges not in the inventory, whose projected timing of next replacement is within a week of the earliest projected timing of next replacement is greater than the number of toner cartridges that are to be selected, selection of toner cartridges matching the second criterion for prioritization is prioritized.

(8) Furthermore, the user may be allowed to choose one selection mode from among the first, second, and third selection modes.

(9) In the structure described in embodiments 1 and 2, and in each of the modifications, when the inventory supplement selection unit 315 (see FIG. 7) in the inventory management device 300 (see FIG. 1) selects one or more toner cartridges to supplement the inventory, the delivery instruction unit 316 (see FIG. 7) transmits an instruction to the supply delivery server 400 to deliver the selected toner cartridge(s) to the user, so that toner cartridges are automatically delivered to the user.

The present invention is not limited in this way, however, and the following modification is possible. When the inventory supplement selection unit 315 selects toner cartridge(s) to supplement the inventory, instead of a delivery instruction being automatically transmitted to the supply delivery server 400, the selected toner cartridge(s) to supplement the inventory may be displayed on the control panel. Upon seeing the display, the user may then order the toner cartridges by FAX, telephone, or other means from an office supply distributor, a sales agent, or the like.

The following modification describes an application of the above structure to Embodiment 1.

Figure 29:
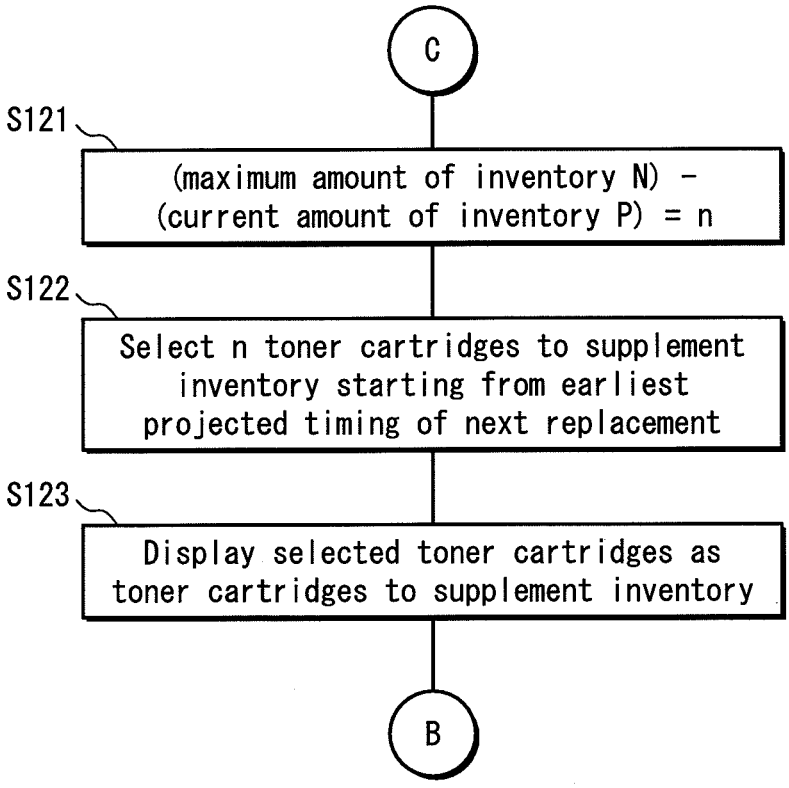
FIG. 29 is part of a flowchart of a control sequence for the image processing device and the inventory management device for consumable inventory management by the inventory management device of Modification 9, showing processing by the inventory management device.

FIG. 29 is part of a flowchart showing a control sequence for the image processing device 100 and the inventory management device 300 for consumable inventory management by the inventory management device of the present modification. Here, the control sequence for the image processing device 100 is the same as FIG. 14 and therefore is omitted from FIG. 29 and from the description below. Furthermore, in the control sequence for the inventory management device 300, processing before step S121 is the same as processing from step S31 through step S36 in FIG. 14, and thus these steps and a description thereof are similarly omitted.

Steps S121 and S122 are the same as steps S37 and S38 in the flowchart in FIG. 15, and therefore a description thereof is omitted.

In step S122, n toner cartridges to supplement the inventory are selected. The selected toner cartridges are then displayed on the control panel 16 (see FIG. 2) as toner cartridges to supplement the inventory (step S123). Processing then returns to step S31 in the flowchart in FIG. 14, and the inventory management device 300 monitors for receipt of the next replaced toner information (step S31).

With this structure, a user that wishes for the inventory management device 300 to automatically select toner cartridges to supplement the inventory, but who does not want the supply delivery server 400 to automatically order from the manufacturer of the image processing device, a sales company, or the like, can place an order directly with a dealer, such as a dealer with whom the user has a long-standing relationship. This structure thus contributes to providing an inventory management service that is even more convenient for the user.

Note that in the above embodiments and modifications of the present invention, the supply delivery server 400 in the inventory management system is not limited to a supply delivery server owned by the manufacturer of the image processing device or a sales company. Therefore, if the above dealer with whom a user has a long-standing relationship possesses a supply delivery server compatible with the inventory management system of the present invention, the inventory management system of the present invention may be adapted to treat that server as the supply delivery server 400.

The structure of the present modification may be adapted to Embodiment 2 and to each of the other modifications.

(10) In the above embodiments and modifications, the storage unit 320 (see FIG. 7) in the inventory management device 300 (see FIG. 1) refers to replaced toner information that has been acquired to update the inventory information for the device group in which a toner cartridge was replaced, updating the inventory information by subtracting the replaced toner cartridge from the inventory. The storage unit 320 also refers to delivered consumable supply information that has been received to update the inventory information for the device group to which a toner cartridge was delivered, updating the inventory information by adding the delivered toner cartridge to the inventory.

The present invention is not, however, limited in this way. The user may manually update the inventory information when the inventory increases or decreases.

Figure 30:
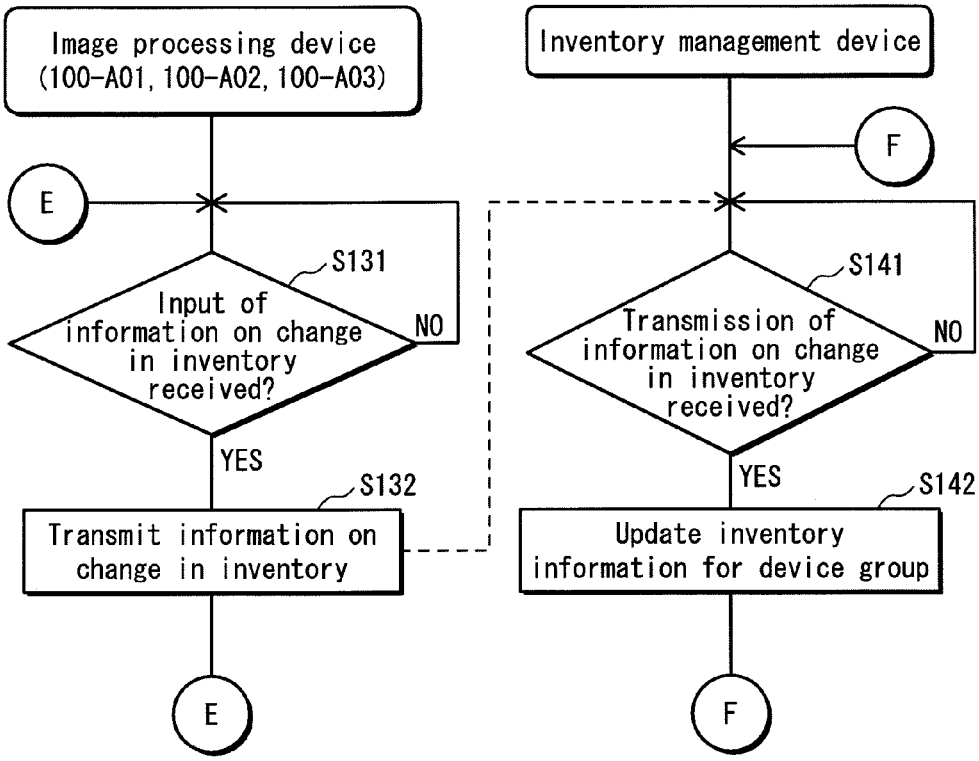
FIG. 30 is a flowchart of a control sequence for the image processing device and the inventory management device for updating of inventory information by the inventory management device of Modification 10.

FIG. 30 is a flowchart showing a control sequence for the image processing device 100 and the inventory management device 300 for updating of inventory information according to the inventory management device of the present modification. The following describes an example for office A (see FIG. 1).

First, the image processing devices 100-A01, 100-A02, and 100-A03 in office A each self-monitor for whether the user inputs information relating to an increase or decrease in inventory for the device (hereinafter, "information on change in inventory"; step S131).

Information on change in inventory includes information regarding a decrease in inventory due to replacement of a toner cartridge (corresponding to the "replaced toner information" in Embodiment 1), as well as information regarding an increase in inventory due to delivery and stocking of a toner cartridge to supplement the inventory (corresponding to the "delivered consumable supply information" in Embodiment 1).

The user inputs the information on change in inventory via the control panel 16 (see FIG. 2) of any of the image processing devices 100-A01, 100-A02, and 100-A03.

In step S131, if input of the information on change in inventory is received (step S131: YES), then after transmitting the information on change in inventory to the inventory management device 300 (step S132), processing returns to step S131, in which the image processing devices once again monitor for receipt of information on change in inventory (step S131).

The inventory management device 300 monitors for receipt of information on change in inventory, and upon receipt (step S141: YES) refers to the received information on change in inventory to update the inventory information for the corresponding device group (step S142). Processing then returns to step S141, in which the inventory management device 300 again monitors for receipt of information on change in inventory (S141).

As described above, with the structure of the present modification, the inventory information is updated to reflect the latest changes even when the user orders toner cartridges to supplement the inventory directly from a dealer. Therefore, the user can appropriately select toner cartridges to supplement the inventory.

While input of the information on change in inventory has been described as being performed by the user on the control panel 16 of any of the image processing devices 100-A01, 100-A02, and 100-A03, it is not necessary for input to be performed in this way. For example, only one of the image processing devices 100-A01, 100-A02, and 100-A03 may be capable of receiving the information on change in inventory. In this case, only the image processing device that is capable of receipt would monitor for input of the information on change in inventory in step S131.

Furthermore, input of the information on change in inventory is not limited to the control panel of the image processing device. For example, the information on change in inventory may be input using an input device, such as a keyboard, of a client device connected over a network. In this case, the information on change in inventory that is input may be transmitted to the inventory management device 300 directly, or may be transmitted to the inventory management device 300 via the image processing device 100.

Furthermore, input of the information on change in inventory may be restricted, by use of a password or the like, to the person in charge of inventory management. Doing so prevents a situation in which a user unwittingly inputs the same information on change in inventory that another user has already input.

A structure may also be adopted in which users manually input information only on an increase in inventory as the above information on change in inventory, whereas with regard to information on a decrease in inventory, the inventory management device 300 acquires replaced toner information from the image processing device 100 and refers to the acquired information to update the inventory information as in the above embodiments and modifications.

(11) In each of the above embodiments and modifications, when replacement of a toner cartridge is detected in one of the image processing devices 100 and the timing of replacement is confirmed, the replaced toner information is transmitted to the inventory management device 300. Each time the inventory management device 300 receives the replaced toner information, the inventory management device 300 requests information on toner replacement timing confirmation in progress from each of the image processing devices 100. When confirmation is in progress for a toner cartridge, the inventory management device 300 waits until confirmation is complete before updating the inventory information and selecting the toner cartridge to supplement the inventory.

The present invention is not limited in this way, however, and may for example adopt the following structure. Upon detecting replacement of a toner cartridge, an image processing device 100 acquires information on whether confirmation of toner replacement timing is in progress for a toner cartridge in any of the image processing devices in the device group to which the image processing device 100 belongs, including the image processing device 100 itself. When confirmation is not in progress for any toner cartridge, the image processing device 100 transmits the information on the replaced toner cartridge to the inventory management device 300 as replaced toner information, whereas when confirmation is in progress for a toner cartridge, the image processing device 100 waits to transmit the replaced toner information to the inventory management device 300 until confirmation is complete.

Figure 31:
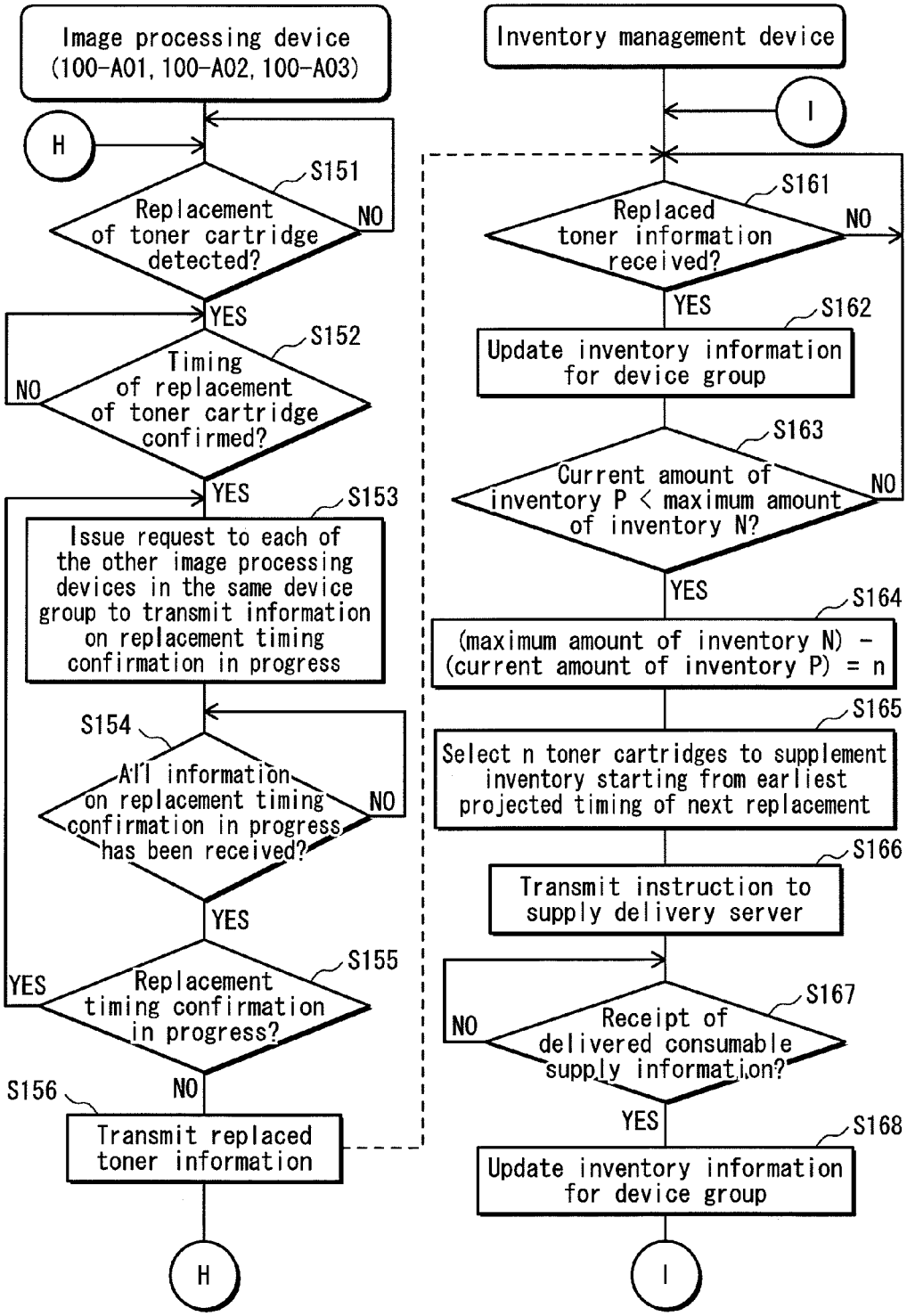
FIG. 31 is a flowchart of a control sequence for the image processing device and the inventory management device for consumable inventory management by the inventory management device of Modification 11.

FIG. 31 is a flowchart showing a control sequence for the image processing device 100 and the inventory management device 300 for consumable inventory management by the inventory management device of the present modification. The following describes an application of the present modification to Embodiment 1 using office A (see FIG. 1) as an example.

Steps S151 and S152 are the same as steps S21 and S22 in the flowchart shown in FIG. 14, and thus a description thereof is omitted.

In step S152, when the timing of replacement of the toner cartridge has been confirmed (step S152: YES), the image processing device 100 issues a request to each of the other image processing devices 100 in the same device group to transmit information indicating whether confirmation of toner replacement timing is in progress for any toner cartridge therein (step S153).

The image processing device 100 then monitors for receipt of the information on confirmation of toner replacement timing from each of the image processing devices 100 of which the information was requested (step S154).

Upon receipt of the information on confirmation of toner replacement timing from all of the image processing devices 100 (step S154: YES), the image processing device 100 refers to the received information to determine whether confirmation of toner replacement timing is in progress for any toner cartridge in the image processing devices 100 in the device group (step S155).

When confirmation of toner replacement timing is in progress for any toner cartridge (step S155: YES), processing returns to step S153, and the image processing device 100 once again issues a request to each of the other image processing devices 100 in the same device group to transmit information indicating whether confirmation of toner replacement timing is in progress (step S153). Subsequently, the steps S153 through S155 are repeated until it is determined that confirmation of toner replacement timing is not in progress for any toner cartridge.

When confirmation of toner replacement timing is not in progress for any toner cartridge (step S155: NO), the replaced toner information is transmitted to the inventory management device 300 (step S156).

The inventory management device 300 monitors for receipt of the replaced toner information (step S161).

When the replaced toner information acquisition unit 311 (see FIG. 7) in the inventory management device 300 receives the replaced toner information (step S161: YES), the storage unit 320 (see FIG. 7) refers to the replaced toner information that has been received to update the inventory information for the device group (in this case, office A) to which belongs the image processing device 100 in which a toner cartridge was replaced (step S162). The storage unit 320 updates the inventory information by subtracting the replaced toner cartridge from the inventory.

Subsequent steps S163 through S168 are the same as steps S36 through S41 in the flowcharts shown in FIGS. 14 and 15, and thus a description thereof is omitted.

With the above structure for the present modification, as in the above embodiments and modifications, the toner cartridge to supplement the inventory is selected more appropriately by referring to inventory information that is maintained more accurately, since updating of the inventory information is postponed until the timing of replacement is confirmed for a toner cartridge that is not provided with a new-toner-cartridge detection mechanism.

When transmitting the replaced toner information to the inventory management device 300, if the image processing device 100 in which replacement of a toner cartridge is detected differs from the image processing device 100 in which confirmation of the timing of replacement is in progress, each of the image processing devices 100 may individually transmit information on the toner cartridges that have been replaced therein to the inventory management device 300. Alternatively, one of the image processing devices 100 may for example collect the information on the toner cartridges that have been replaced and transmit the collected information to the inventory management device 300.

(12) In the above embodiments and modifications, the toner replacement timing projection unit 313 (see FIG. 7), which projects the timing of replacement of each toner cartridge in use in each image processing device, is provided in the inventory management device 300, but the toner replacement timing projection unit 313 is not limited in this way.

For example, each image processing device 100 may be provided with a toner replacement timing projection unit in order for each image processing device 100 to project the timing of replacement of each toner cartridge in use therein and transmit information on each projected timing of next replacement to the inventory management device 300.

Figure 32:
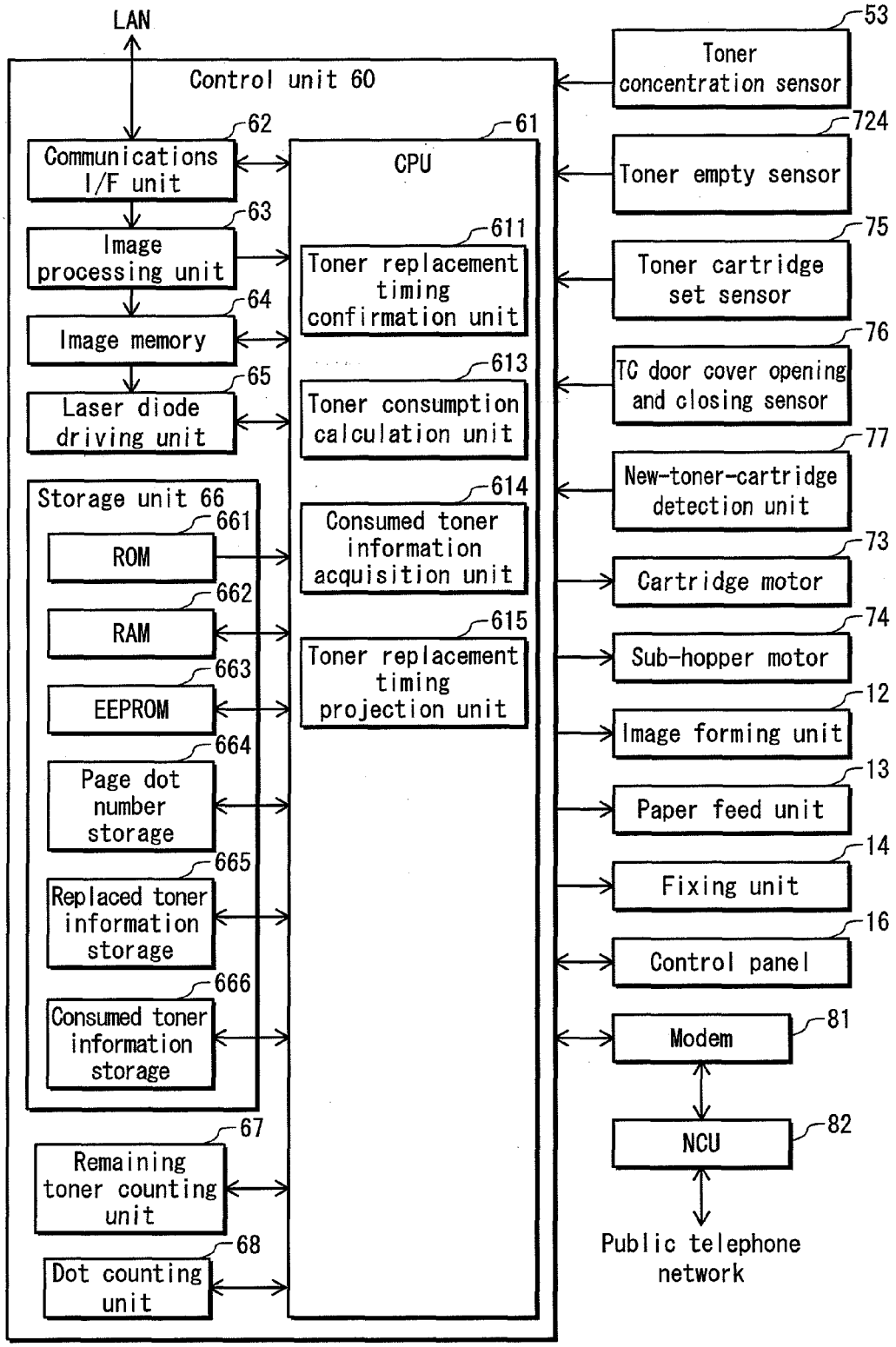
FIG. 32 is a control block diagram for the image processing device in Modification 12.
Figure 33:
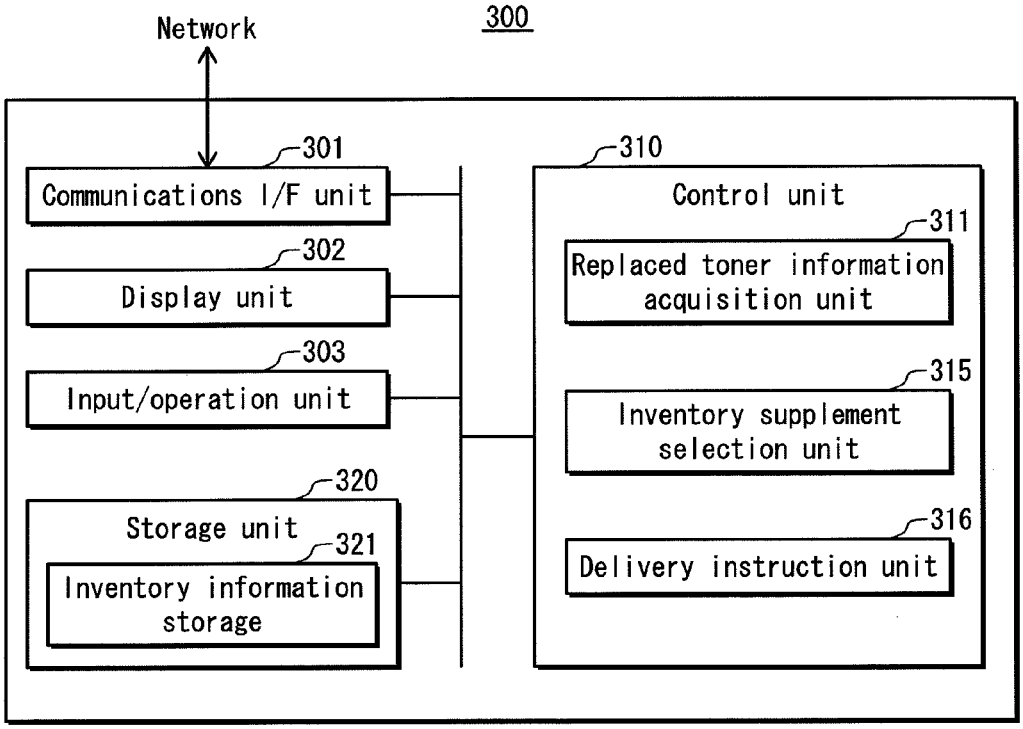
FIG. 33 is a control block diagram for the inventory management device in Modification 12.

FIG. 32 is a block diagram showing the structure of the control unit 60 in the image processing device 100 of the present modification. FIG. 33 is a block diagram showing the structure for control in the inventory management device 300 of the present modification.

The control unit 60 of the image processing device 100 in the present modification is provided with a consumed toner information acquisition unit 614 and a toner replacement timing projection unit 615, which respectively fulfill similar functions as the consumed toner information acquisition unit 312 and the toner replacement timing projection unit 313 in Embodiment 1 as shown in FIG. 7. These units are also a portion of the functions of the CPU 61.

The storage unit 66 includes a consumed toner information storage 666 that stores consumed toner information, which is information on the consumed amount of toner of each color in the image processing device 100. The consumed toner information storage 666 fulfills the same functions as the consumed toner information storage 322 in the inventory management device 300 of Embodiment 1 as shown in FIG. 7. Note that the EEPROM 663 may be caused to perform the functions of the consumed toner information storage 666.

On the other hand, the control unit 310 of the inventory management device 300 in the present modification is not provided with the consumed toner information acquisition unit 312, nor with the toner replacement timing projection unit 313, shown in FIG. 7.

Furthermore, the storage unit 320 of the inventory management device 300 in the present modification does not store the consumed toner information shown in FIG. 7.

(13) In each of the above embodiments and modifications, the maximum amount of inventory is set and managed as a number of toner cartridges. Depending on the type of toner cartridge, however, the size or shape of the toner cartridge may vary. Even for toner cartridges of the same size and shape, differences in materials and methods of packaging may lead to differences in the size or shape of the packaged toner cartridges. In such cases, for a user with extremely limited inventory space, certain combinations of toner cartridges in the inventory may exceed the total volume of the inventory space, even if the number of toner cartridges is within the maximum amount of inventory, thereby preventing the user from being able to store all of the toner cartridges.

To address this problem, the present modification manages the maximum amount of inventory not as a number of toner cartridges, but as the total volume of the toner cartridges when packaged.

Figure 34:
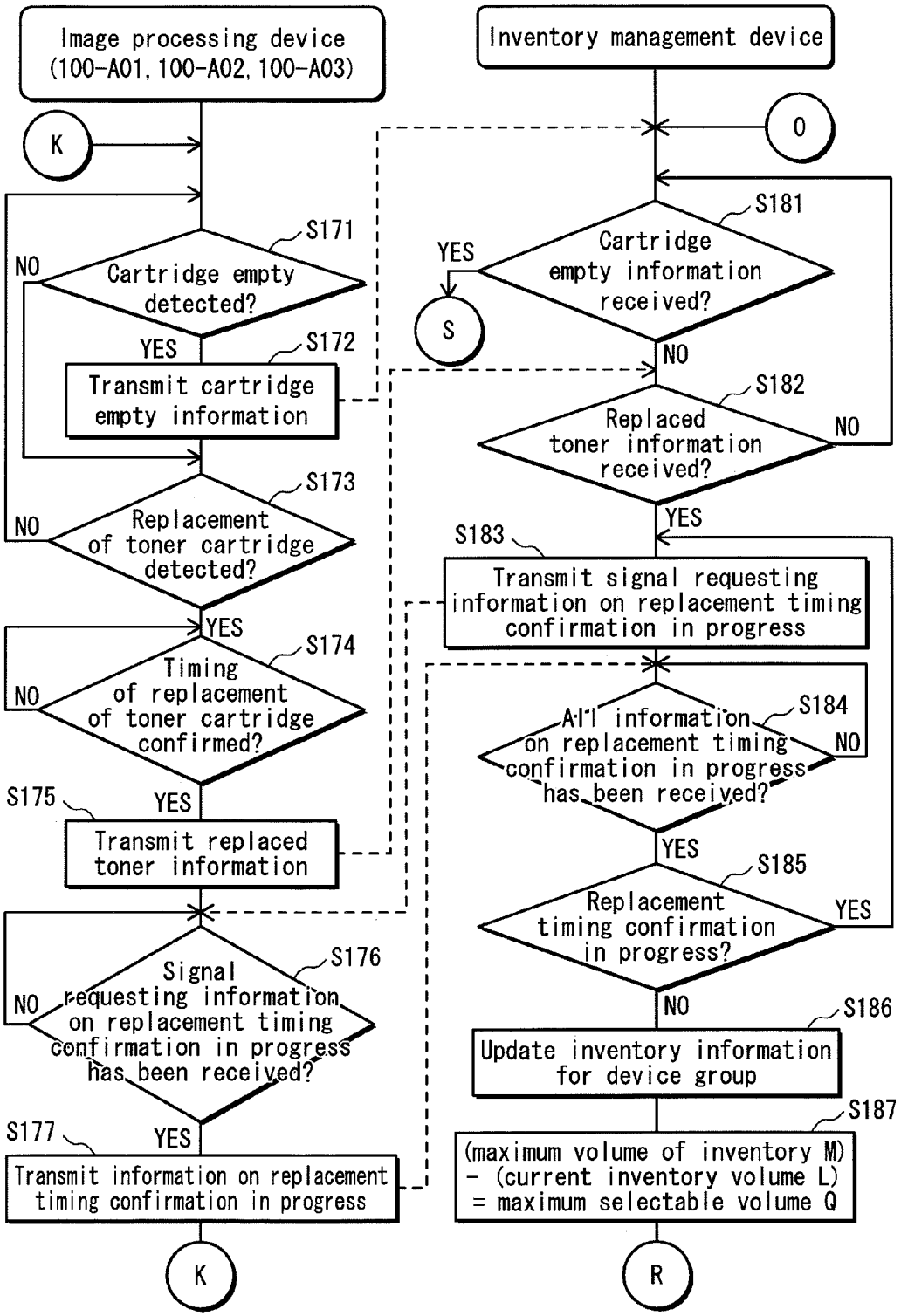
FIG. 34 is part of a flowchart of a control sequence for the image processing device and the inventory management device for consumable inventory management by the inventory management device of Modification 13.
Figure 35:
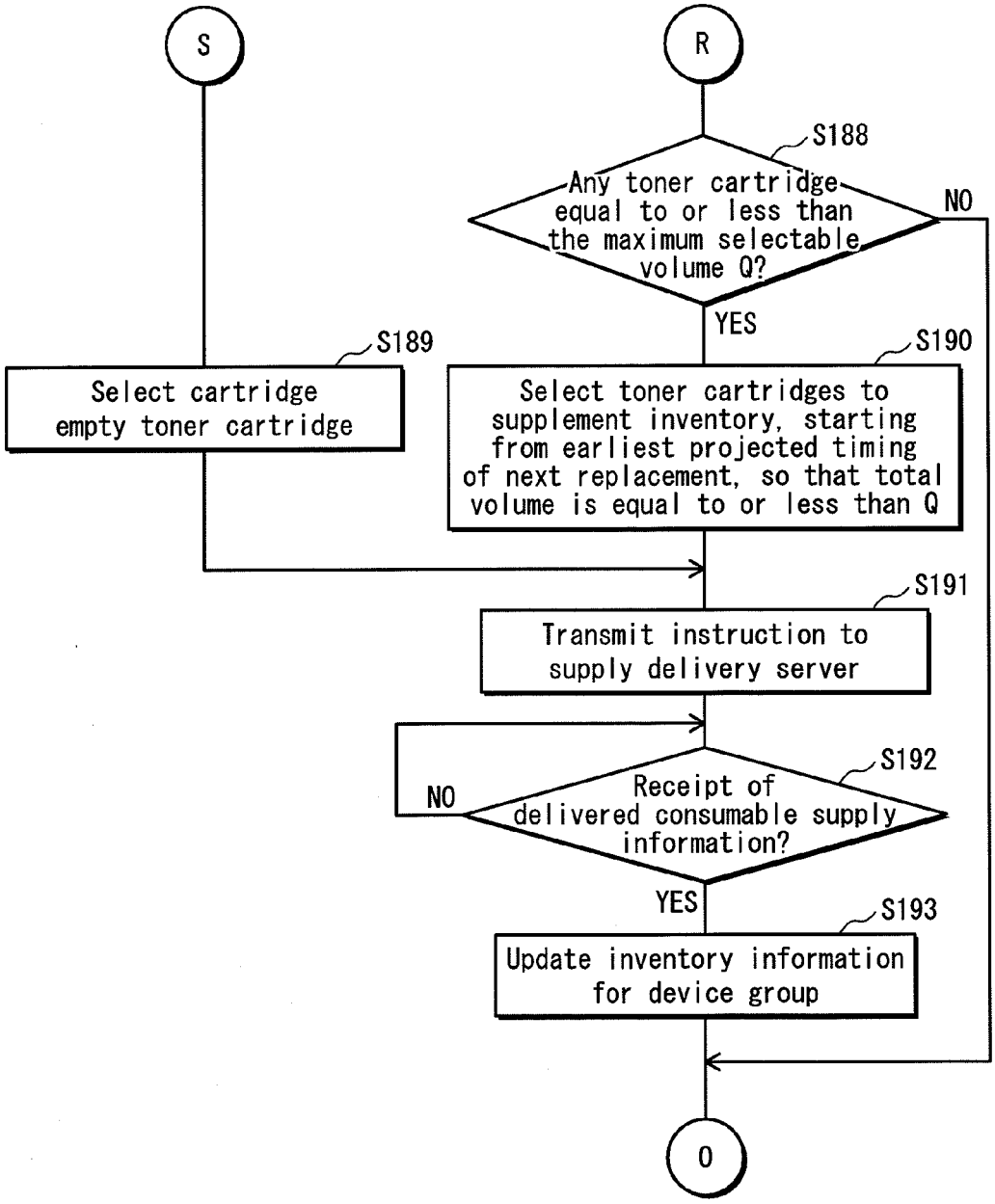
FIG. 35 is a flowchart showing a continuation of the flowchart in FIG. 34.

FIG. 34 is part of a flowchart showing a control sequence for the image processing device 100 and the inventory management device 300 for consumable inventory management by the inventory management device of the present modification. FIG. 35 is a continuation of FIG. 34 showing the remainder of the flowchart. The following describes an application of the present modification to Embodiment 1 using office A (see FIG. 1) as an example.

First, each of the image processing devices 100-A01, 100-A02, and 100-A03 belonging to office A determine whether the cartridge empty state has been detected therein (step S171).

When the cartridge empty state has been detected in any of the image processing devices 100-A01, 100-A02, and 100-A03 (step S171: YES), cartridge empty information is transmitted to the inventory management device 300 (step S172). The cartridge empty information indicates the toner cartridge for which the cartridge empty state was detected, the image processing device in which the toner cartridge is loaded, and the device group to which the image processing device belongs.

At this point, the inventory management device 300 determines whether the cartridge empty information has been received. If so (step S181: YES), the inventory supplement selection unit 315 (see FIG. 7) selects the toner cartridge for which the cartridge empty state was detected (step S189), and the delivery instruction unit 316 (see FIG. 7) instructs the supply delivery server 400 to deliver the selected toner cartridge to the user (step S191).

Steps S192 and S193 are the same as steps S40 and S41 in the flowchart in FIG. 15, and therefore a description thereof is omitted.

Returning now to the image processing device 100, when the cartridge empty state is not detected in step S171 (step S171: NO), it is next determined whether replacement of a toner cartridge has been detected (step S173).

When replacement of a toner cartridge has not been detected (step S173: NO), processing returns to step S171, in which it is once again determined whether the cartridge empty state has been detected (step S171).

When replacement of a toner cartridge has been detected (step S173: YES), it is next determined whether the timing of replacement of the toner cartridge has been confirmed (step S174).

Subsequent steps S174 through S177 are the same as steps S22 through S25 in the flowchart shown in FIG. 14, and thus a description thereof is omitted.

Returning now to the inventory management device 300, when the cartridge empty information is not received in step S181 (step S181: NO), it is next determined whether replaced toner information has been received (step S182).

When the replaced toner information has not been received (step S182: NO), processing returns to step S181, in which it is once again determined whether the cartridge empty information has been received (step S181).

When the replaced toner information has been received (step S182: YES), the inventory management device 300 transmits a signal to each of the image processing devices 100-A01, 100-A02, and 100-A03 requesting information on whether confirmation of the timing of replacement is in progress (step S183).

Subsequent steps S184 through S186 are the same as steps S33 through S35 in the flowchart shown in FIG. 14, and thus a description thereof is omitted.

In step S186, after updating the inventory information for the corresponding device group (in this example, office A; step S186), the inventory management device 300 next refers to the inventory information for the corresponding device group to subtract, from a preset maximum inventory volume M, a current inventory volume L that is a total of the volume of each packaged toner cartridge currently stocked in the inventory. The inventory management device 300 then calculates a maximum selectable volume Q for use when selecting the toner cartridge to supplement the inventory, the value of Q indicating the maximum volume of packaged toner cartridges that can be selected (step S187).

Note that the user determines the maximum inventory volume M based on the total volume of the shelves and the like in the inventory space, inputting the maximum inventory volume M in advance.

Next, it is determined whether the volume of any packaged toner cartridge is equal to or less than the maximum selectable volume Q (step S188).

If there is no toner cartridge that is equal to or less than the maximum selectable volume Q (step S188: NO), processing returns to step S181 without selecting a toner cartridge to supplement the inventory, and it is determined whether the cartridge empty information has been received (step S181).

When there is at least one toner cartridge equal to or less than the maximum selectable volume Q (step S188: YES), the inventory supplement selection unit 315 (see FIG. 7) refers to the inventory information to select one or more toner cartridges, starting from the earliest projected timing of next replacement, from among toner cartridges not stocked in the inventory while ensuring that the total volume of selected toner cartridges is equal to or less than the maximum selectable volume Q (step S190). The delivery instruction unit 316 (see FIG. 7) then instructs the supply delivery server 400 to deliver the selected toner cartridge(s) to the user (in this case, the inventory manager for office A; step S191).

As described above, subsequent steps S192 and S193 are the same as steps S40 and S41 in the flowchart shown in FIG. 15, and thus a description thereof is omitted.

With the present modification, the maximum inventory can be set and managed as the volume of packaged toner cartridges. Such inventory management by volume is more appropriate than inventory management by number of toner cartridges particularly when, for example, a plurality of types of toner cartridges with different sizes are used.

Furthermore, in the present modification, when the cartridge empty state is detected, the toner cartridge for which the cartridge empty state is detected is automatically delivered to the user regardless of the maximum selectable volume Q. Adopting this structure prevents the following sort of problem.

Suppose that the maximum inventory is set as a volume, with inventory being managed only by volume, and in a certain office (device group), a combination of toner cartridges with a large packaged volume and toner cartridges with a small packaged volume is used. When selecting the toner cartridge to supplement the inventory upon confirmed replacement of a small toner cartridge, for example, if the toner cartridge with the earliest projected timing of next replacement is large and the toner cartridge with the second earliest projected timing of next replacement is small, and the maximum selectable volume Q is between the size of the large toner cartridge and the size of the small toner cartridge, then the toner cartridge with the second highest priority is selected as the toner cartridge to supplement the inventory. If the next toner cartridge that is replaced is also small, however, the same situation as above occurs, and the toner cartridge with the second highest priority is once again selected. In such a situation, the large toner cartridge remains unselected, potentially leading to the problem of a replacement for the large toner cartridge not being in the inventory at the point when the large toner cartridge is depleted and requires replacement.

The structure of the present modification is useful in such cases as well, since upon receiving cartridge empty information, a replacement for the toner cartridge in the cartridge empty state is automatically selected regardless of the inventory status and delivered to the user, so that the user is provided with a replacement toner cartridge before printing is prohibited due to the toner cartridge entering the sub-hopper empty state. In this case, the total volume of the inventory may temporarily exceed the capacity of the inventory space, but this causes a relatively small inconvenience for the user as compared to when no replacement toner cartridge is in the inventory and printing becomes impossible. Therefore, this structure contributes to providing an inventory management service that is even more convenient for the user.

The time at which to automatically select a toner cartridge and deliver the toner cartridge to the user may be set to any status of the remaining amount of toner, but it is preferable to set this time to when the cartridge empty state is detected.

If this time is set to when the sub-hopper empty state is detected, printing is not longer possible, and thus the user has to wait to print until the replacement toner cartridge arrives.

On the other hand, if this time is set to when the cartridge near empty state is detected, enough toner still remains for printing of several thousand pages, and some time remains before the toner cartridge will actually need to be replaced. Since at this point there is no free inventory space, if the replacement toner cartridge is delivered, the user will be forced to deal with an overflow of toner cartridges from the inventory space for an extended period of time.

(14) In the above embodiments and modifications, the image processing device 100 and the inventory management device 300 are connected by a network. The inventory management device 300 manages the inventory by selecting one or more toner cartridges to supplement the inventory.

The present invention is not limited in this way, however. In the inventory management system shown in FIG. 1, instead of providing the inventory management device 300, each of the image processing devices may be caused to perform the functions of the inventory management device 300.

The following modification describes an application of the above structure to Embodiment 1.

Figure 36:
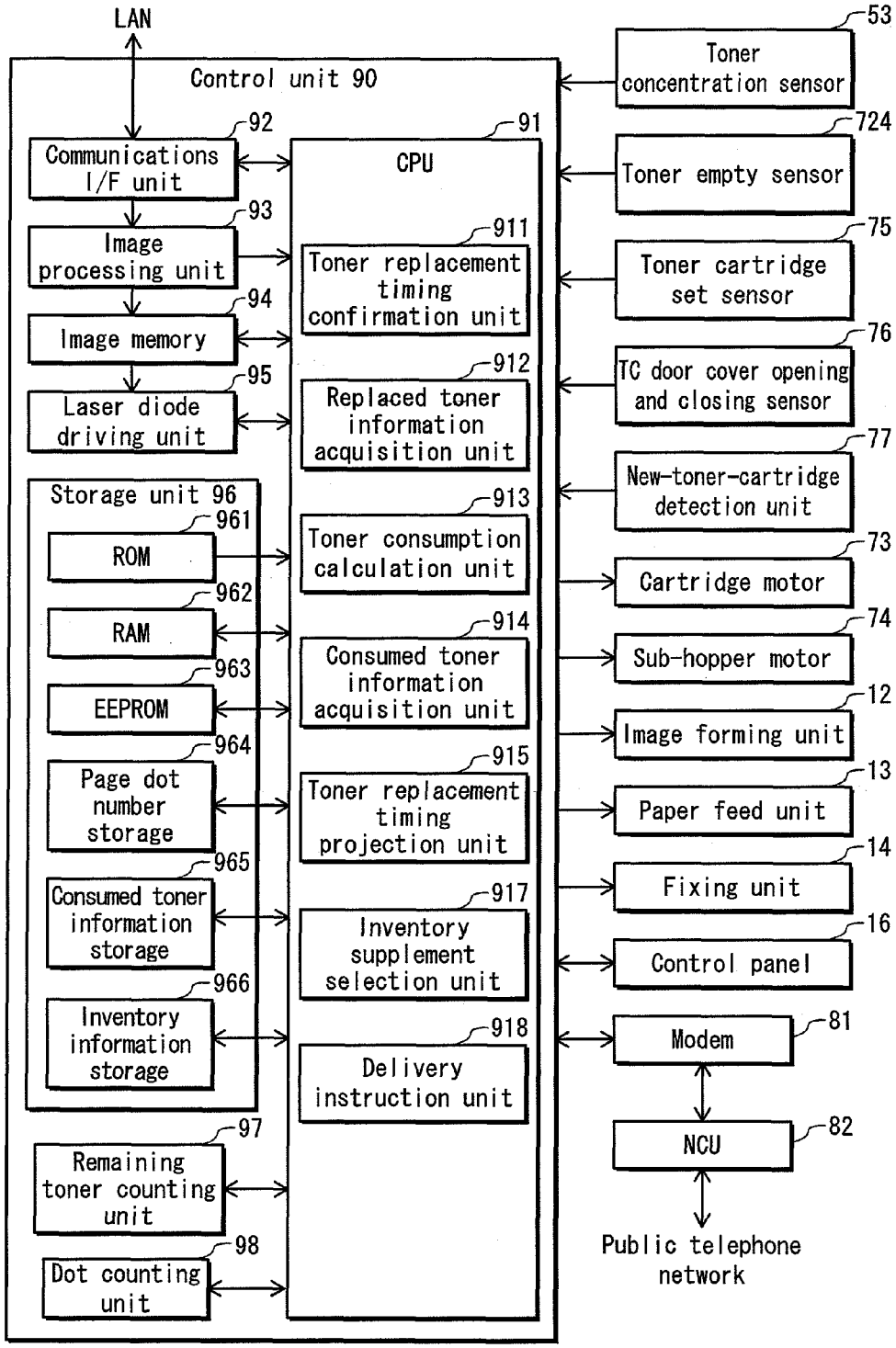
FIG. 36 is a control block diagram for the image processing device in Modification 14.

FIG. 36 is a block diagram showing the structure of a control unit 90 in an image processing device 900 according to the present modification. The image processing device 900 is located in office A (see FIG. 1).

An I/F unit 92, an image processing unit 93, an image memory 94, and a laser diode driving unit 95 respectively fulfill similar functions as the communications I/F unit 62, the image processing unit 63, the image memory 64, and the laser diode driving unit 65 in the control unit block diagram for the image processing device 100 in Embodiment 1, as shown in FIG. 6.

Furthermore, a CPU 91 is provided with a toner replacement timing confirmation unit 911, a toner consumption calculation unit 913, a consumed toner information acquisition unit 914, a toner replacement timing projection unit 915, an inventory supplement selection unit 917, and a delivery instruction unit 918, which respectively fulfill similar functions as the toner replacement timing confirmation unit 611, the toner consumption calculation unit 613, the consumed toner information acquisition unit 614, the toner replacement timing projection unit 615, the inventory supplement selection unit 315, and the delivery instruction unit 316 in FIGS. 6 and 7.

The CPU 91 is also provided with a replaced toner information acquisition unit 912 as part of the functions of the CPU 91. When a toner cartridge is replaced and the toner replacement timing confirmation unit 911 confirms the date the toner cartridge was actually replaced as the timing of toner replacement, the replaced toner information storage 912 stores replaced toner information composed of information indicating the type of toner cartridge that was replaced as detected by the toner cartridge set sensor 75 and information on the confirmed timing of toner replacement. The replaced toner information that is acquired may be temporarily stored in an EEPROM 963 or the like.

A storage unit 96 is provided with a ROM 961, a RAM 962, the EEPROM 963, and a page dot number storage 964, which respectively fulfill similar functions as the ROM 661, the RAM 662, the EEPROM 663, and the page dot number storage 664 shown in FIG. 6. The storage unit 96 is also provided with a consumed toner information storage 965 that fulfills similar functions as the consumed toner information storage 322 shown in FIG. 7.

In the present modification, the storage unit 96 of the control unit 90 is also provided with an inventory information storage 966 that fulfills similar functions as the inventory information storage 321 in FIG. 7.

Figure 37:
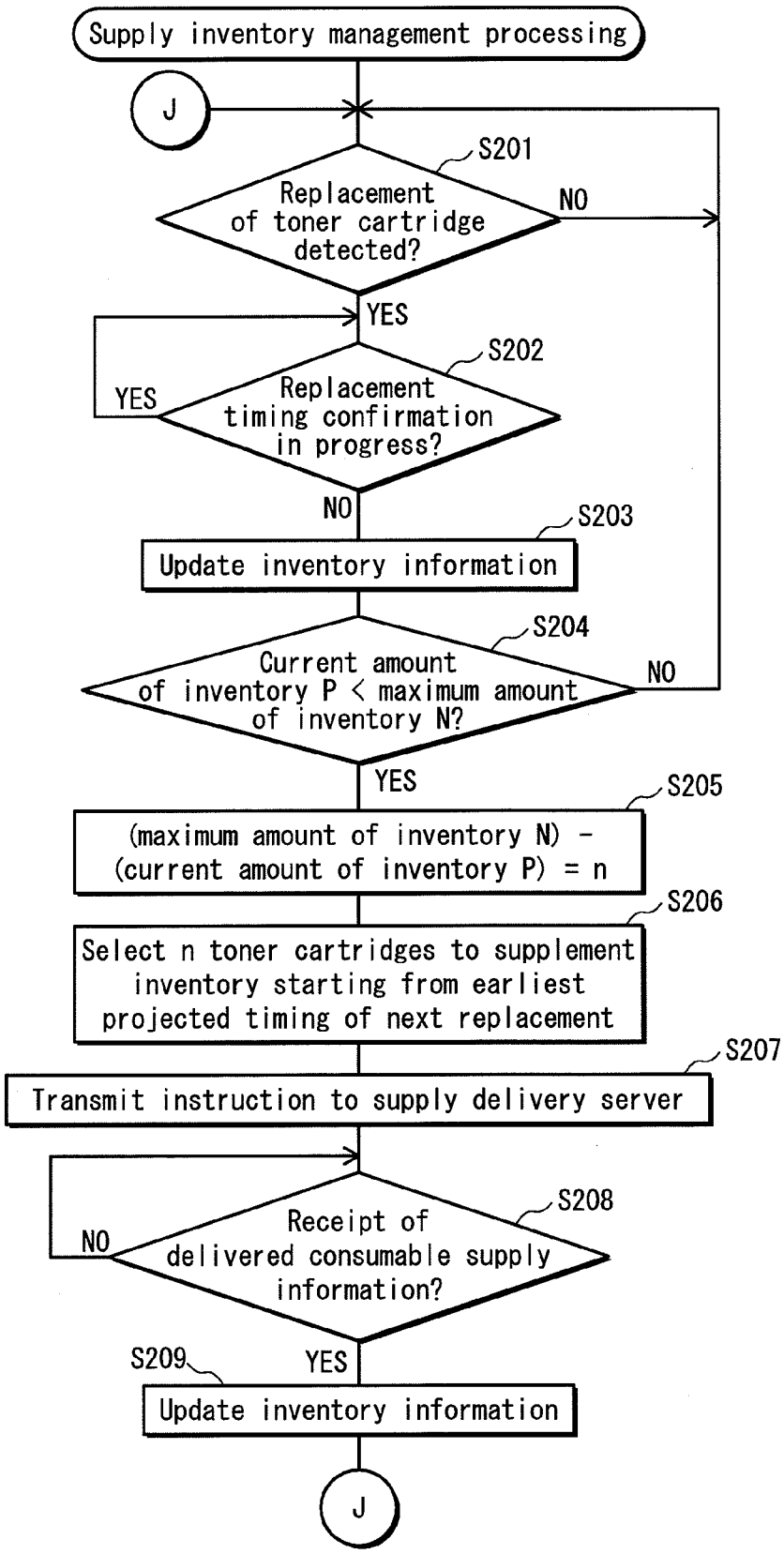
FIG. 37 is a flowchart showing supply inventory management processing by the image processing device of Modification 14.

FIG. 37 is a flowchart showing inventory management processing by the image processing device 900 of the present modification.

First, the image processing device 900 monitors for detection of replacement of a toner cartridge (step S201). This detection of replacement of a toner cartridge includes detection of an operation with possible toner cartridge replacement.

Upon detection of replacement of a toner cartridge (step S201: YES), the image processing device 900 determines whether confirmation of the timing of replacement is in progress (i.e. whether the timing has not yet been confirmed) for any toner cartridge in the image processing device, including the toner cartridge for which replacement was just detected (step S202).

When confirmation of the timing of replacement is in progress for a toner cartridge (step S202: YES), the determination is repeated until the timing of replacement is confirmed (step S202).

When confirmation of the timing of replacement is not in progress for any toner cartridge (step S202: NO), the inventory information storage 966 refers to the replaced toner information acquired by the replaced toner information acquisition unit 912 to update the inventory information (step S203).

Note that in the present modification, if a plurality of image processing devices 900 are located in office A, for example, and exclusive inventory space is allocated for the toner cartridges used in each device, then a maximum amount of inventory is set for the inventory space allocated to each device, and inventory information is stored in each device.

The image processing device 900 then refers to the updated inventory information to determine whether a current amount of inventory P is smaller than the maximum amount of inventory N that is preset for the image processing device 900 (step S204).

When the current amount of inventory P is not smaller than the maximum amount of inventory N, i.e. when P is equal to or greater than N (step S204: NO), the inventory is not supplemented. Rather, processing returns to step S201, and the image processing device 900 monitors for detection of replacement of a toner cartridge (step S201).

When the current amount of inventory P is smaller than the maximum amount of inventory N (step S204: YES), the current amount of inventory P is subtracted from the maximum amount of inventory N to calculate the number n (n being a positive integer) of toner cartridges to supplement the inventory (step S205).

The inventory supplement selection unit 917 (see FIG. 36) refers to the inventory information to select n toner cartridges, starting from the earliest projected timing of next replacement, from among toner cartridges not in the inventory (step S206). The delivery instruction unit 918 (see FIG. 36) then instructs the supply delivery server 400 to deliver the selected toner cartridges to the user (in this case, the inventory manager for office A; step S207).

Subsequently, the image processing device 900 monitors for receipt, from the supply delivery server 400, of delivered consumable supply information indicating that the designated toner cartridges were delivered to the user (in this case, the inventory manager for office A; step S208). Upon receipt of the delivered consumable supply information (step S208: YES), the inventory information storage 966 (see FIG. 36) refers to the received information to update the inventory information for the image processing device 900 by adding the delivered toner cartridges (step S209). Processing then returns to step S201, and the image processing device 900 monitors for replacement of a toner cartridge (step S201).

Note that in this modification, the supply delivery server 400 transmits the delivered consumable supply information to the image processing device 900 in which the delivered toner cartridge is used (i.e. the image processing device 900 for which inventory is supplemented).

Like the above embodiments and modifications, this modification contributes to providing an inventory management service that is convenient for the user by avoiding the problem of no replacement toner cartridge being available when a replacement is necessary, even if only a few toner cartridges are kept as inventory.

Note that in the present modification, it is necessary for the value of the maximum amount of inventory to be set to at least one for each of the image processing devices 900 used in each office or other location. Therefore, in the office or other location (corresponding to the device group in the above embodiments) as whole, the inventory space needs to be able to accommodate at least a number of cartridges equaling the number of image processing devices 900 in the office.

Note that the structure of the present modification is applicable when there is only one image processing device 900 in an office or other location.

(15) The number of image processing devices used in an office or other location may, for example, increase or decrease due to a change in the number of employees.

In such a case, in particular when the number of image processing devices increases, the setting for the maximum amount of inventory needs to be changed to avoid causing problems for appropriate inventory management.

Furthermore, when the number of image processing devices decreases, some users may want to reduce the inventory space by reducing the number of toner cartridges in the inventory as much as possible, in order to use the space that is freed up to store other equipment or supplies.

On the other hand, even if the number of image processing devices increases, some users for whom inventory space is extremely limited may not be able to increase the maximum amount of inventory at all. Other users may simply not wish to change the setting of the maximum amount of inventory.

Even when the number of image processing devices does not change, it may also be advisable to change the setting for the maximum amount of inventory if the type or total number of toner cartridges used in the device group changes, for example due to switching from a monochrome printer to a color printer.

Therefore, in the modification described below, if there is a change in the registration information for the image processing devices 100 managed by the inventory management device 300, for example due to a change in the number or type of image processing devices in the device group, then the inventory management device 300 inquires whether the user (manager) wishes to change the setting of the maximum amount of inventory. If the user indicates a change in the setting of the maximum amount of inventory, the inventory management device 300 updates the inventory information by changing the setting of the maximum amount of inventory in accordance with the user indication.

Figure 38:
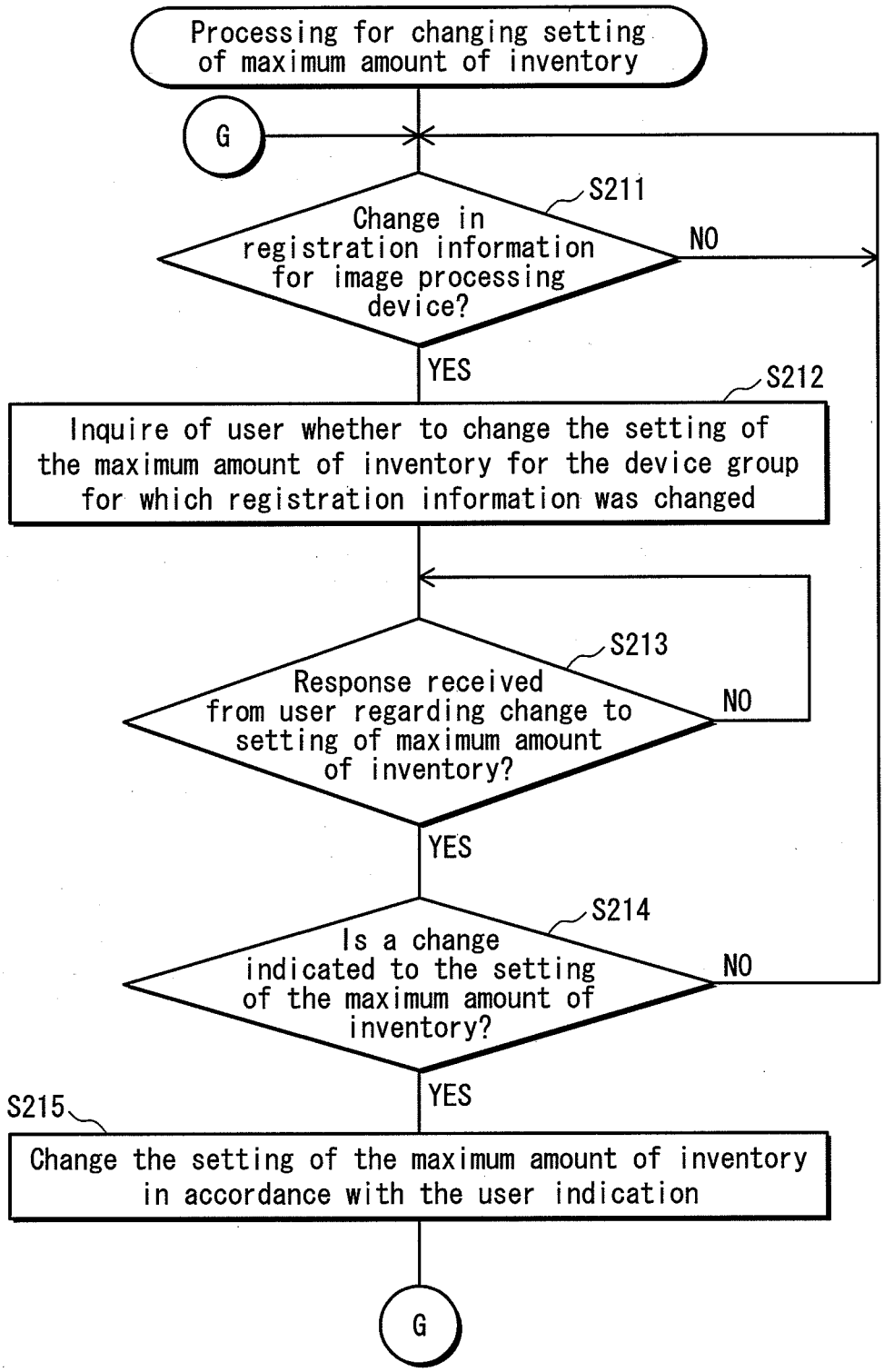
FIG. 38 is a flowchart showing processing by the inventory management device of Modification 15 for changing the setting of the maximum amount of inventory.

FIG. 38 is a flowchart showing processing by the inventory management device 300 of the present modification for changing the setting of the maximum amount of inventory.

First, the inventory management device 300 monitors for a change in the registration information for the image processing devices 100 in each managed device group (step S211).

When there is a change in the registration information (step S211: YES), the inventory management device 300 issues an inquiry to the user (manager) of the device group in which the change occurred, inquiring whether the user wishes to change the maximum amount of inventory that is currently set for the device group (step S212).

In this modification, changes to the registration information include changes to the information on functions (color, monochrome, FAX, and the like) caused by addition, removal, or a change in the type of an image processing device 100.

The above inquiry may be issued by E-mail or displayed as a message on the control panel 16 of the image processing device 100.

Next, the inventory management device 300 determines whether a response to the inquiry is received from the user (step S213).

If a response has not been received from the user (step S213: NO), the determination is performed again (step S213).

When a response is received from the user (step S213: YES), the inventory management device 300 determines whether the response indicates a change in the setting of the maximum amount of inventory (step S214).

When the response indicates a change in the setting of the maximum amount of inventory (step S214: YES), the inventory information storage 321 of the inventory management device 300 updates the inventory information for the corresponding device group by changing the maximum amount of inventory in the inventory information in accordance with the user indication (step S215). Processing subsequently returns to step S211, in which the inventory management device 300 monitors for a change in the registration information for the image processing devices 100 (step S211).

On the other hand, when the response does not indicate a change in the setting of the maximum amount of inventory (step S214: NO), processing returns directly to step S211, and the inventory management device 300 again monitors for a change in the registration information for the image processing devices 100 (step S211).

Note that a service representative for the image processing device manufacturer, or the manager of the office or other location, may make the change in the registration information either on the control panel 16 of the image processing device 100 or by accessing the inventory management device 300 from the client device (PC) 200.

The image processing device is normally shipped with an individual identifier, such as a model number, product number, or the like, pre-stored in an EEPROM, hard disk, or the like provided in the image processing device. Therefore, when a new image processing device is installed in the office or other location and connected to the network, a program may cause the inventory management device 300 to read the individual identifier and automatically register information for the newly installed image processing device based on the identifier.

Furthermore, on a recording medium such as a hard disk or the like in a newly installed image processing device 100, individual information may be pre-stored, such as information indicating that the device is an image processing device, information on the functions of the image processing device, the IP address, and the like. When the new image processing device is installed and connected to the network, a program may then cause the inventory management device 300 to read the individual information and automatically register information for the newly installed image processing device based on the individual information.

A program may also automate registration by causing the inventory management device 300 to periodically (for example, every few minutes, every hour, once a day, or the like) acquire information on the condition of the network connection of each managed image processing device 100. When connection of an image processing device 100 to the network is not detected for a predetermined period of time (for example, between a few weeks and a few months), the program causes the inventory management device 300 to consider the image processing device 100 to have been removed and to delete the image processing device 100 from the registration information.

The above structure manages inventory more appropriately by asking the user whether to change the setting for the maximum amount of inventory when there is a change in registration information, such as an increase, decrease, or change in the type of image processing devices, and by changing the setting for the maximum amount of inventory in accordance with user input.

(16) In modification 1, the second criterion for prioritization is whether the toner is color K (black), but the color of toner taken into consideration as the second criterion for prioritization may be any color of toner, C, M, Y, or K.

For example, in offices in which much color C toner is consumed, the color C may be the second criterion for prioritization.

(17) In Embodiment 3, inclusion of the FAX function has been described as the second criterion for prioritization, but the function of the image processing device that is taken into consideration as the second criterion for prioritization is not limited to the FAX function.

For example, it can easily be imagined that an image processing device in which a variety of types (regular paper, heavy paper, OHP sheets, and the like) and sizes (A4, B5, A3, postcard size, and the like) of recording sheets can be used is more convenient, more frequently used, and more important for the user. Accordingly, selection may be prioritized for toner cartridges used in an image processing device 100 compatible with more types and sizes of recording sheets.

(18) In the above embodiments and modifications, the time at which one or more toner cartridges to supplement the inventory are selected is the timing of replacement of a toner cartridge (the timing when replacement is confirmed), but selection is not limited in this way.

For example, toner cartridges may be selected at predetermined intervals, such as every day, every other day, every few hours, every few minutes, or the like. In this case, if the predetermined interval is too long, ordering of toner cartridges to supplement the inventory will be delayed, and a necessary replacement may not be delivered to the user in time. Therefore, at most the predetermined interval should be one week, for example. Note that selection need not be made at even intervals, as long as the interval between each selection is not too long.

Furthermore, if no toner cartridge is necessary to supplement the inventory, such as when there is no room in the inventory space, then of course no toner cartridge is selected.

(19) The above embodiments and modifications are described using the example of a toner cartridge as a consumable supply for which inventory is managed, but the consumable supply is not limited in this way.

Other than toner cartridges, inventory may be managed for consumable supplies such as photoreceptor units, transfer belt units, fixing units, or the like. In such a case, the time at which a replacement supply to supplement the inventory is selected may be the time at which the consumable supply is replaced (i.e. the time at which replacement is confirmed), as in the above embodiments, or may, for example, be set to when the consumable supply has reached a certain degree of consumption or wear.

(20) In the above embodiments and modifications, the toner empty sensor 724 detects whether there is toner in the sub-hopper 72, but detection of toner is not limited in this way.

For example, translucent windows may be provided on either side of the main body 725 of the sub-hopper 72, and a photo sensor composed of a light-emitting unit and a photoreceptive unit may be provided outside of the main body 725, with the light-emitting unit facing one translucent window and the photoreceptive unit facing the other. Depletion of toner in the sub-hopper 72 is detected if light emitted by the light-emitting unit passes through the translucent windows without being obstructed by toner in the sub-hopper 72 and is received by the photoreceptive unit. Another method to detect the remaining amount of toner is for a reed switch to detect the position of a magnet attached to a detection plate mounted on the surface of the toner liquid. Depletion of toner in the sub-hopper 72 can be detected when the detected height of the toner liquid in the sub-hopper 72 falls below a predetermined level.

(21) In modification 9, when the inventory management device 300 selects the one or more toner cartridges to supplement the inventory, the selected toner cartridges are displayed on the control panel 16 of the image processing device 100 to notify the user, but notification is not limited in this way. For example, the image processing device 100 may print out a recording sheet with the selected toner cartridges printed thereon. Alternatively, an e-mail may be sent to notify the user (manager), or the user may be notified by sound via a speaker provided in the image processing device 100.

(22) The above embodiments and modifications describe an example in which one inventory management device 300 manages inventory for a plurality of device groups, but management of inventory is not limited in this way. One inventory management device 300 may manage inventory for one device group. Furthermore, as described in Embodiment 1, a plurality of image processing devices need not be included in one device group; the number of image processing devices may be only one.

(23) In the above embodiments and modifications, when replacement of a toner cartridge is detected and the timing of replacement is confirmed, information on the replaced toner cartridge is updated in the inventory information, and the updated inventory information is referred to in order to select the toner cartridge to supplement the inventory, but the present invention is not limited in this way.

For example, when replacement of the toner cartridge is detected and the timing of replacement is confirmed, the toner cartridge to supplement the inventory may be selected before updating of the inventory information.

In inventory information that has not been updated with respect to a replaced toner cartridge, the toner cartridge in question is listed as being stocked in the inventory. Therefore, this toner cartridge does not become a candidate for selection as a toner cartridge to supplement the inventory. Sufficient toner still remains, however, in a toner cartridge that has just been replaced, and the timing of the next replacement has not yet been projected. It thus poses no problem to exclude such a toner cartridge from the candidates for selection as a toner cartridge to supplement the inventory.

In this case, however, it is preferable not to select a toner cartridge to supplement the inventory before timing of replacement of a toner cartridge has been confirmed. If the timing of replacement has not been confirmed, it is possible that the toner cartridge has not actually been replaced, in which case selection of a toner cartridge to supplement the inventory may exceed the maximum amount of inventory, causing toner cartridges to overflow from the inventory space.

Embodiment 3

In the present embodiment, toner cartridges to supplement the inventory are selected when a predetermined state of consumption of toner occurs.

Here, an example is described in which the predetermined state of consumption of toner is when a toner cartridge (a consumable supply) is replaced (specifically, when the timing of replacement of the toner cartridge is confirmed), at which point toner cartridges are selected to supplement the inventory. All toner cartridges whose projected timing of next replacement falls within a predetermined time frame for selection, counting from the time at which a toner cartridge was replaced, are selected to supplement the inventory. An example of the time frame for selection is described as being 60 days. Hereinafter, the standard length for the time frame for selection is 60 days and is referred to as the "standard time frame for selection".

FIG. 39A shows an example of inventory information that the inventory management device 300 uses to manage inventory of toner cartridges by device group. The inventory information includes a device group identifier, the maximum amount of inventory set for the device group, an identifier for each image processing device belonging to the device group, an inventory status for each toner cartridge used in each image processing device, and a projected timing of next replacement for each of the toner cartridges currently in use. These pieces of information are stored in association with each other in the inventory information storage 321 of the inventory management device 300 (see FIG. 7). As an example, FIG. 39A shows inventory information after having been updated upon the color M toner cartridge in the image processing device 100-A01 being replaced (i.e. the timing of replacement being confirmed) in office A on Jun. 15, 2011. Since the color M toner cartridge in the image processing device 100-A01 has just been replaced (i.e. the timing of replacement has just been confirmed), the timing of next replacement has not been projected. At this point in time, the inventory space in office A is stocked with four toner cartridges: colors C and K for the image processing device 100-A01, and colors M and K for the image processing device 100-A02. There is no inventory for five toner cartridges: colors M and Y for the image processing device 100-A01, colors C and Y for the image processing device 100-A02, and color K for the image processing device 100-A03.

Note that in FIG. 39A, entries for the cartridges not included in the inventory are outlined in bold. The same is true in Embodiment 4 and in each of the modifications.

Furthermore, when the inventory management device 300 only manages inventory for one device group, it is not necessary to include information identifying the device group in the inventory information.

The inventory supplement selection unit 315 in the inventory management device 300 (see FIG. 7) refers to the inventory information and selects one or more toner cartridges (consumable supplies) to supplement the inventory. With reference to the figures, the following describes the method of the present embodiment for selecting the toner cartridge(s) to supplement the inventory.

The toner cartridges not currently included in the inventory for the device group (in this case, office A) are identified and listed in a table by projected timing of next replacement starting with the earliest timing, i.e. in order starting with the fewest number of days from confirmation of the timing of replacement until the projected timing of next replacement, as shown in FIG. 39B. For each toner cartridge, the table in FIG. 39B shows the number of days d (hereinafter, "selection day count") from confirmation of the timing of replacement (in this example, Jun. 15, 2011) until the projected timing of next replacement. The toner cartridges for which the selection day count d is within the standard time frame for selection of 60 days are the color C toner cartridge in the image processing device 100-A02 (d=40 days, projected timing of next replacement of Jul. 25, 2011) and the color Y toner cartridge in the image processing device 100-A01 (d=56 days, projected timing of next replacement of Aug. 10, 2011). In the present embodiment, toner cartridges whose projected timing of next replacement is within the time frame for selection are selected as toner cartridges to supplement the inventory. Accordingly, in this case, the color C toner cartridge in the image processing device 100-A02 and the color Y toner cartridge in the image processing device 100-A01 are selected as toner cartridges to supplement the inventory. Note that in FIG. 39B, for the sake of clarity, the entries for these toner cartridges are outlined in bold, and the selection day count d is shown in bold.

Since the color M toner cartridge for the image processing device 100-A01 has just been replaced, the timing of next replacement for this toner cartridge has not been projected. The remaining amount of toner immediately after replacement, however, can be assumed to be approximately 100%, and therefore this toner cartridge is included in the table as having the latest projected timing of next replacement, as shown in FIG. 39B. The same is true in Embodiment 4 and in each of the modifications.

Figure 40:
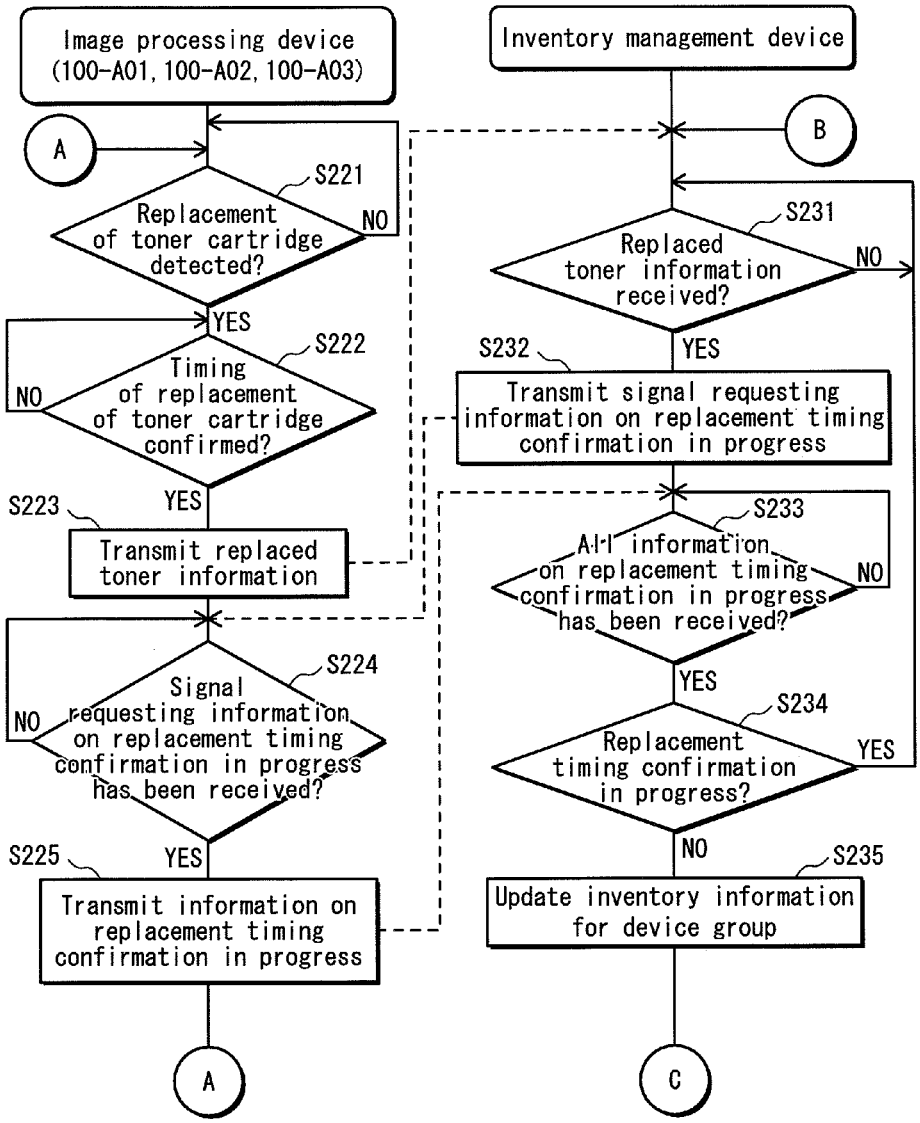
FIG. 40 is part of a flowchart showing a control sequence for the image processing device and the inventory management device for consumable inventory management by the inventory management device of Embodiment 3.
Figure 41:
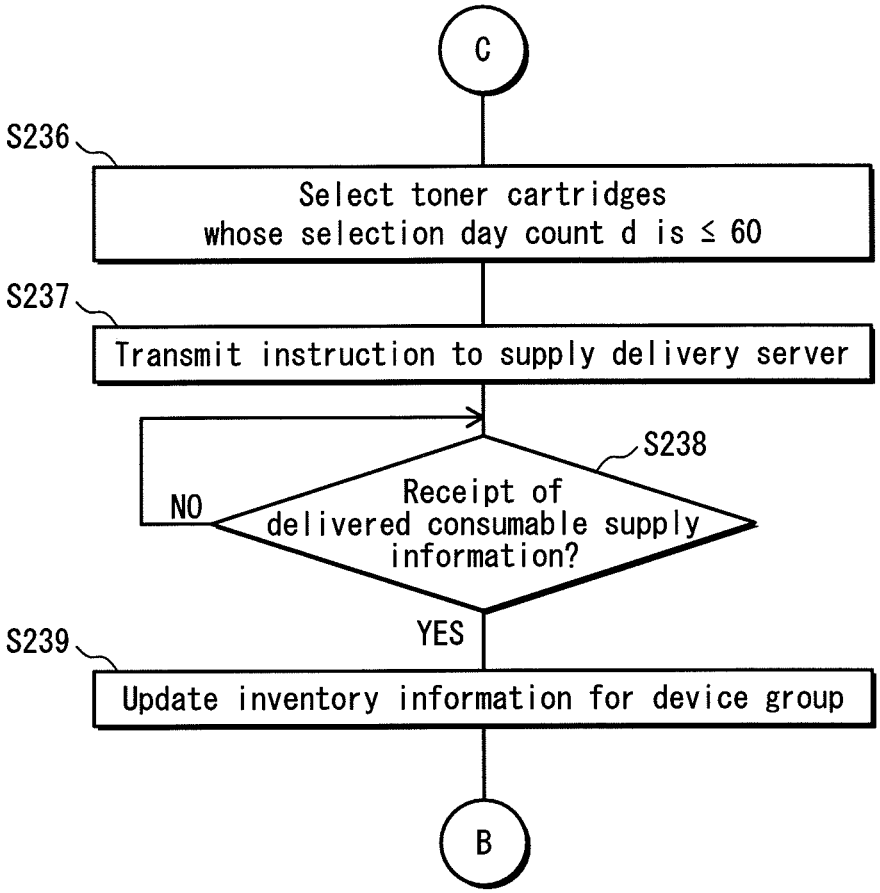
FIG. 41 is a flowchart showing a continuation of the flowchart in FIG. 40.

FIG. 40 is part of a flowchart showing a control sequence for the image processing device 100 and the inventory management device 300 for consumable inventory management by the inventory management device of the present embodiment. FIG. 41 is a continuation of FIG. 40 showing the remainder of the flowchart. The following describes an example for office A (see FIG. 1).

First, each of the image processing devices 100-A01, 100-A02, and 100-A03 belonging to office A self-monitor to detect replacement of a toner cartridge (step S221). This detection of replacement of a toner cartridge includes detection of an operation with possible toner cartridge replacement.

Upon detection of replacement of a toner cartridge in one of the image processing devices 100-A01, 100-A02, and 100-A03 (step S221: YES), the image processing device that detects replacement determines whether the toner replacement timing confirmation unit 611 (see FIG. 6) has confirmed the timing of replacement of the toner cartridge (step S222).

When the timing of replacement of the toner cartridge has not been confirmed (step S222: NO), the determination is repeated until the timing of replacement is confirmed (step S222).

When the timing of replacement of the toner cartridge has been confirmed (step S222: YES), the replaced toner information stored in the replaced toner information storage 665 (see FIG. 6) is transmitted to the inventory management device 300 (step S223).

The inventory management device 300 monitors for receipt of the replaced toner information (step S231). When the replaced toner information acquisition unit 311 (see FIG. 7) receives the replaced toner information (step S231: YES), the inventory management device 300 transmits a signal to each of the image processing devices 100-A01, 100-A02, and 100-A03 requesting information on whether, for any toner cartridges, the toner replacement timing confirmation is in progress (i.e. whether the toner replacement timing has not yet been confirmed for any toner cartridges; step S232).

At this point, the image processing devices 100-A01, 100-A02, and 100-A03 are monitoring for receipt of the signal requesting information on toner replacement timing confirmation in progress (step S224). Upon receiving the signal requesting information on toner replacement timing confirmation in progress (step S224: YES), the image processing devices transmit the information on toner replacement timing confirmation in progress to the inventory management device 300 (step S225).

The inventory management device 300 monitors for receipt of the information on toner replacement timing confirmation in progress from all of the image processing devices 100 to which the request signal was transmitted. Upon receiving the information on toner replacement timing confirmation in progress (step S233: YES), the inventory management device 300 refers to the received information to determine whether confirmation of the toner replacement timing is in progress for any toner cartridges (step S234).

If confirmation of the toner replacement timing is in progress for any toner cartridges in any of the image processing devices 100-A01, 100-A02, and 100-A03 (step S234: YES), processing returns to step S231, and the inventory management device 300 waits until receiving replaced toner information indicating confirmation of the toner replacement timing for the toner cartridge whose confirmation was in progress (step S231).

If confirmation of the toner replacement timing is not in progress for any toner cartridge (step S234: NO), the storage unit 320 in the inventory management device 300 (see FIG. 7) refers to the replaced toner information received in step S231 to update the inventory information for the device group (in this case, office A) to which belongs the image processing device 100 in which a toner cartridge was replaced (step S235). The storage unit 320 updates the inventory information by subtracting the replaced toner cartridge from the inventory. By thus waiting to update the inventory information in the case that confirmation of the toner replacement timing is in progress for a toner cartridge, the inventory information more accurately reflects current inventory status, resulting in a more accurate selection of the toner cartridge to supplement the inventory, as described below.

The inventory management device 300 refers to the latest updated inventory information to select toner cartridges whose selection day count d from the confirmed timing of replacement (in this example, Jun. 15, 2011) until the projected timing of next replacement is within the standard time frame for selection of 60 days (step S236). The delivery instruction unit 316 (see FIG. 7) then instructs the supply delivery server 400 to deliver the selected toner cartridges to the user (in this case, the inventory manager for office A; step S237).

Subsequently, the inventory management device 300 monitors for receipt, from the supply delivery server 400, of delivered consumable supply information indicating that the designated toner cartridges were delivered to the user (in this case, the inventory manager for office A; step S238). Upon receipt of the delivered consumable supply information (step S238: YES), the inventory information storage 321 (see FIG. 7) refers to the received information to update the inventory information for the corresponding device group (in this case, office A) by adding the delivered toner cartridges to the inventory information of the device group (step S239). Processing then returns to step S231, and the inventory management device 300 monitors for receipt of the next replaced toner information.

As described above, with the structure of the present embodiment, inventory of toner cartridges, which are consumable supplies used in image processing devices, is managed by device group. The time when a toner cartridge will be consumed and require replacement is projected, and the predetermined state of consumption at which point toner cartridges are selected to supplement the inventory is the time when a toner cartridge is replaced (specifically, when the timing of replacement is confirmed). The inventory management device 300 acquires replaced toner information as "inventory supplement timing information", which indicates the timing at which to supplement the inventory, and then selects toner cartridges whose projected timing of next replacement is within the standard time frame for selection (in the present embodiment, 60 days) as toner cartridges to supplement the inventory. The selected toner cartridges are then delivered to the user. Hereinafter, the method of selecting toner cartridges to supplement the inventory in the present embodiment is referred to as the "first selection mode". Note that this "first selection mode" differs from the "first selection mode" in Embodiment 1.

This structure allows for stocking of toner cartridges with a high probability of being replaced next, without having to set a maximum amount of inventory or a minimum order amount. Therefore, this structure contributes to providing an inventory management service that is convenient for the user by reducing the burden on the user while avoiding a situation in which no replacement toner cartridge is in the inventory when a replacement is necessary.

Note that in the above-described embodiment, the device group of an image processing device in which a toner cartridge has been replaced is specified by looking up the image processing device identifier, included in the replaced toner information, in the image processing device registration information, but confirmation is not limited in this way. For example, the identifier for the device group to which belongs the image processing device 100 in which a toner cartridge has been replaced may be included in the replaced toner information. In this case, the device group identifier may be included as part of the image processing device identifier. With this structure, the inventory management device 300 (inventory information storage 321) acquires the identifier for the device group to which belongs the image processing device 100 in which a toner cartridge has been replaced without referring to the image processing device registration information, but rather directly from the replaced toner information.

Furthermore, in the present embodiment, the standard time frame for selection is 60 days, but the time frame is not limited in this way. For example, an appropriate number of days may be set as the standard time frame for selection by taking into consideration factors such as the number of image processing devices provided in each device group or the overall toner consumption rate for each device group. Furthermore, the manager of the inventory management system or the inventory management device 300 may be allowed to set and change the number of days in the standard time frame for selection, or the user may be allowed to do so via the control panel 16 or the client device 200. Note also that the standard time frame for selection is not limited to being a number of days, and may be expressed in units of years, months, hours, minutes, seconds, etc. The same is true in Embodiment 4 and in each of the modifications.

Note that if an excessively short time is set as the standard time frame for selection, only toner cartridges whose projected timing of next replacement is imminent will be selected to supplement the inventory and ordered, creating the risk of replacement becoming necessary before the supplementary toner cartridge is actually delivered to the user. It is therefore preferable to set an appropriate time frame taking into consideration factors such as the toner consumption rate and the number of days necessary for delivery.

Embodiment 4

In Embodiment 3, when toner cartridges to supplement the inventory are selected, the projected timing of next replacement is treated as the first criterion for prioritization, and all toner cartridges whose projected timing of next replacement is within the standard time frame for selection are selected. If the toner consumption rate is faster than expected, however, causing the timing of replacement to be sooner than projected, there is a risk that waiting to order inventory until the projected timing of next replacement is within the standard time frame for selection will result in the toner cartridge being delivered to the user immediately before replacement is necessary, or possibly thereafter.

Furthermore, even if all the color toner (colors C, M, and Y) is depleted, monochrome printing is possible, whereas printing is impossible if all the black toner is depleted. Therefore, the degree of importance of the color K toner is assumed to be higher.

In some cases, therefore, such as toner for which the projected timing of next replacement easily becomes off target due to large variation in the toner consumption rate, or toner having a higher degree of importance like color K toner, it is preferable to order inventory early, i.e. to select a toner cartridge to supplement the inventory ahead of time, so that the toner cartridge will reliably be stocked in the inventory.

The present embodiment describes a structure in which, in addition to the toner cartridges whose projected timing of next replacement is within the standard time frame for selection (i.e. whose selection day count d is within the standard time frame for selection), toner cartridges satisfying a second criterion for prioritization of being a predetermined color (in this example, K) are also selected to supplement the inventory if the projected timing of next replacement of such toner cartridges is within an extended time frame for selection that is longer than the standard time frame for selection. In the present embodiment, the extended time frame for selection is 90 days.

Note that to avoid repetition, a description of what is the same as in Embodiment 3 is omitted, and the same constituent elements are indicated with the same reference signs. The same is also true for all of the modifications below.

FIG. 42A is an example of the structure of inventory information in the present embodiment. As an example, the following describes selection of toner cartridges to supplement the inventory at a point at which the color M toner cartridge in the image processing device 100-A01 in office A has been replaced (i.e. the timing of replacement has been confirmed).

Note that among the categories constituting the inventory information, the device group is the same as in FIG. 39A, and therefore this category is omitted from FIG. 39A. The same is also true for all of the modifications below.

The toner cartridges not currently included in the inventory for the device group (in this case, office A) are identified and listed in a table by projected timing of next replacement starting with the earliest timing, i.e. in order starting with the smallest selection day count d, as shown in FIG. 42B. For each toner cartridge, the table in FIG. 42B shows the selection day count d from confirmation of the timing of replacement (in this example, Jun. 15, 2011) until the projected timing of next replacement. The only toner cartridge for which the selection day count d is within the standard time frame for selection of 60 days is the color Y toner cartridge in the image processing device 100-A01 (d=56 days, projected timing of next replacement of Aug. 10, 2011), which is first selected as a toner cartridge to supplement the inventory.

Next, the toner cartridges whose selection day count d is between the standard time frame for selection (60 days) and the extended time frame for selection (90 days) are the color C toner cartridge (d=78 days) in the image processing device 100-A02 and the color K toner cartridge (d=78 days) in the image processing device 100-A03. Since the degree of importance of the color K is high, the color K toner cartridge in the image processing device 100-A03 is also selected as a toner cartridge to supplement the inventory.

Note that in FIG. 42B, for the sake of clarity, the entries for the two selected toner cartridges are outlined in bold, and the selection day count d as well as the type of toner cartridge, which indicates the color of the toner (color K), are shown in bold.

Figure 43:
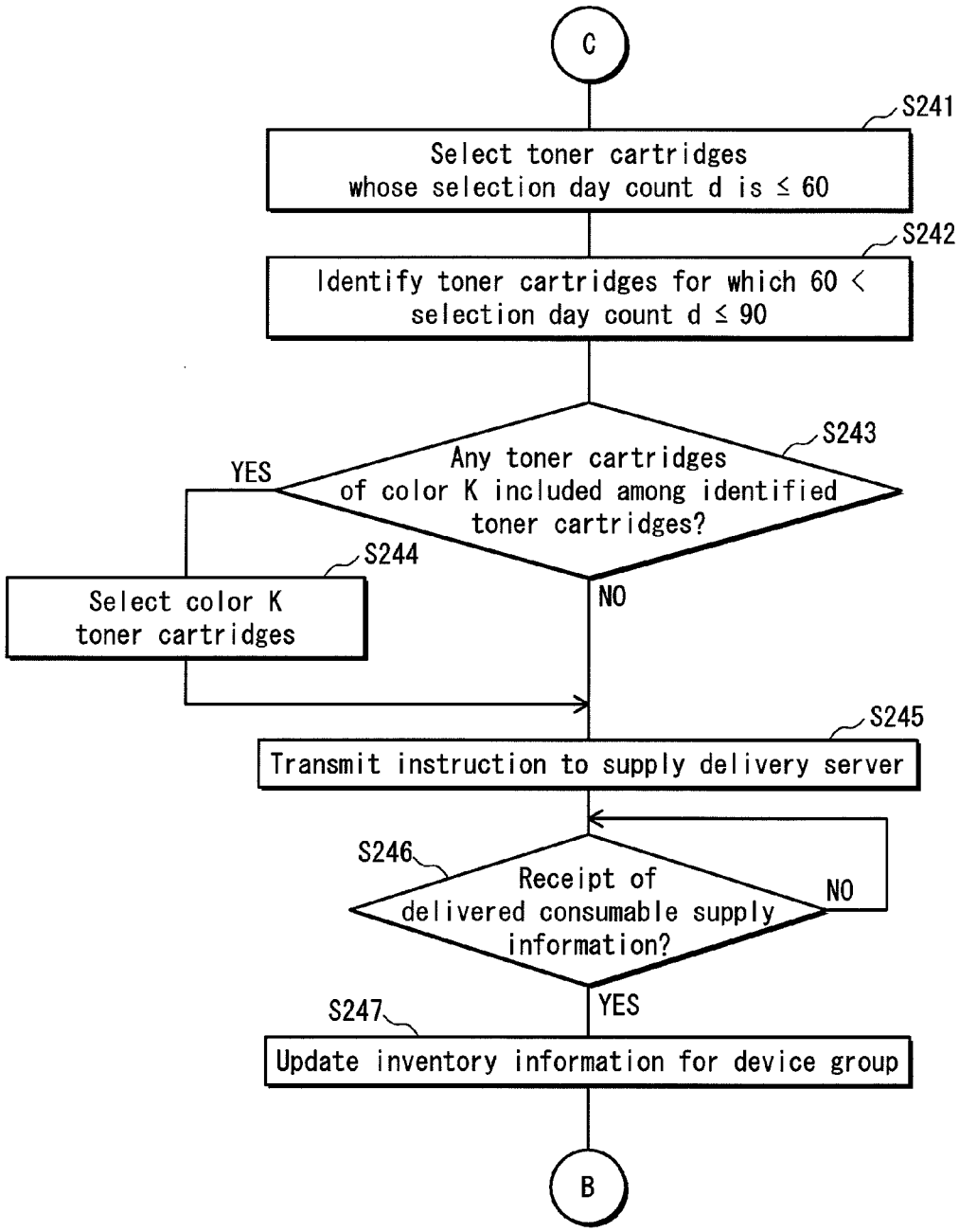
FIG. 43 is part of a flowchart of a control sequence for the image processing device and the inventory management device for consumable inventory management by the inventory management device of Embodiment 4, showing processing by the inventory management device.

FIG. 43 is part of a flowchart showing a control sequence for the image processing device 100 and the inventory management device 300 for consumable inventory management by the inventory management device of the present embodiment. Here, the control sequence for the image processing device 100 is the same as FIG. 40 and therefore is omitted from FIG. 43 and from the description below. Furthermore, in the control sequence for the inventory management device 300, processing before step S241 is the same as processing from step S231 through step S235 in FIG. 40, and thus these steps and a description thereof are similarly omitted.

Upon updating of the inventory information in step S235 (see FIG. 40), toner cartridges whose selection day count d from the confirmed timing of replacement until the projected timing of next replacement is less than or equal to 60 are first selected (step S241).

Next, toner cartridges having a selection day count d greater than 60 and at most 90 (step S242) are identified, and it is determined whether any toner cartridges of color K are included among the identified toner cartridges (step S243).

When one or more toner cartridges of color K are included (step S243: YES), the toner cartridges are selected to supplement the inventory (step S244). The delivery instruction unit 316 (see FIG. 7) then instructs the supply delivery server 400 (see FIG. 1) to deliver the toner cartridges selected in steps S241 and S244 to the user (in this case, the inventory manager for office A; step S245).

When no toner cartridges of color K are included (step S243: NO), the delivery instruction unit 316 instructs the supply delivery server 400 to deliver only the toner cartridges selected in step S241 to the user (step S245).

Steps S246 and S247 are the same as steps S238 and S239 in the flowchart in FIG. 41, and therefore a description thereof is omitted.

As described above, with the structure of the present embodiment, in addition to toner cartridges whose selection day count d falls within the standard time frame for selection, color K toner cartridges whose selection day count d falls within the extended time frame for selection, which is longer than the standard time frame for selection, are also selected to supplement the inventory. Color K toner cartridges are thus selected earlier than if selection were only based on the standard time frame for selection. As a result, replacements for color K toner cartridges, which have a higher degree of priority, are more reliably stocked in the inventory.

In the present embodiment, the extended time frame for selection is set to 90 days, but the time frame is not limited in this way and may be set to any length that is longer than the standard time frame for selection (60 days). The manager of the inventory management system or the inventory management device 300 may be allowed to set and change the number of days in the extended time frame for selection, or the user may be allowed to do so via the control panel 16 or the client device 200. Furthermore, a specific number of days need not be set as the extended time frame for selection. Instead, the number of days for the extended time frame for selection may, for example, be obtained by multiplying the standard time frame for selection by a predetermined coefficient greater than one that is set by the user. Note also that the extended time frame for selection is not limited to being a number of days, and may be expressed in units of years, months, hours, minutes, seconds, etc. The same is also true for all of the modifications below.

Modifications to Embodiment 4

In Embodiment 4, the color of toner is treated as the second criterion for prioritization, but the second criterion for prioritization is not limited to the color of toner. The following modifications are possible.

(24) If the toner consumption rate fluctuates greatly, the projection of the timing of next replacement easily becomes off target, increasing the risk of the toner being depleted more quickly than projected.

In the present modification, the variation (level of stability) in the toner consumption rate is taken into consideration as the second criterion for prioritization.

The index used as the variation in the toner consumption rate in the present modification is the standard deviation of the toner consumption rate. The toner consumption rate is the amount of toner consumed per unit of time (day), which is obtained from the total amount of toner consumed during the predetermined period of time as used to calculate the projected timing of next replacement. When the value of the standard deviation is ten or greater, the variation in the toner consumption rate is considered to be large, and the extended time frame for selection applies. Hereinafter, the variation in the toner consumption rate is represented as v.

FIG. 44A is an example of the structure of inventory information in the present modification. As an example, the following describes selection of toner cartridges to supplement the inventory at a point at which the color M toner cartridge in the image processing device 100-A01 in office A has been replaced (i.e. the timing of replacement has been confirmed).

The toner cartridges not currently included in the inventory for the device group (in this case, office A) are identified and listed in a table by projected timing of next replacement starting with the earliest timing, i.e. in order starting with the smallest selection day count d, as shown in FIG. 44B.

The toner cartridges for which the selection day count d is within the standard time frame for selection of 60 days in FIG. 44B are the color Y toner cartridge in the image processing device 100-A01 (d=35 days, projected timing of next replacement of Jul. 20, 2011) and the color C toner cartridge in the image processing device 100-A02 (d=35 days, projected timing of next replacement of Jul. 20, 2011), and these toner cartridges are selected first.

Next, the toner cartridges whose selection day count d is between the standard time frame for selection (60 days) and the extended time frame for selection (90 days) are the color Y toner cartridge (d=76 days) in the image processing device 100-A02 and the color K toner cartridge (d=87 days) in the image processing device 100-A03. In this example, the variation v in the toner consumption rate of the color Y toner cartridge in the image processing device 100-A02 is 14.9, and the variation v in the toner consumption rate of the color K toner cartridge in the image processing device 100-A03 is 5.4. Since the variation v in the toner consumption rate of the color Y toner cartridge in the image processing device 100-A02 is at least ten, this toner cartridge is selected to supplement the inventory.

Note that in FIG. 44B, for the sake of clarity, the entries for the three selected toner cartridges are outlined in bold, and the selection day count d, as well as the variation v in the toner consumption rate of the color Y toner cartridge in the image processing device 100-A02, are shown in bold.

Figure 45:
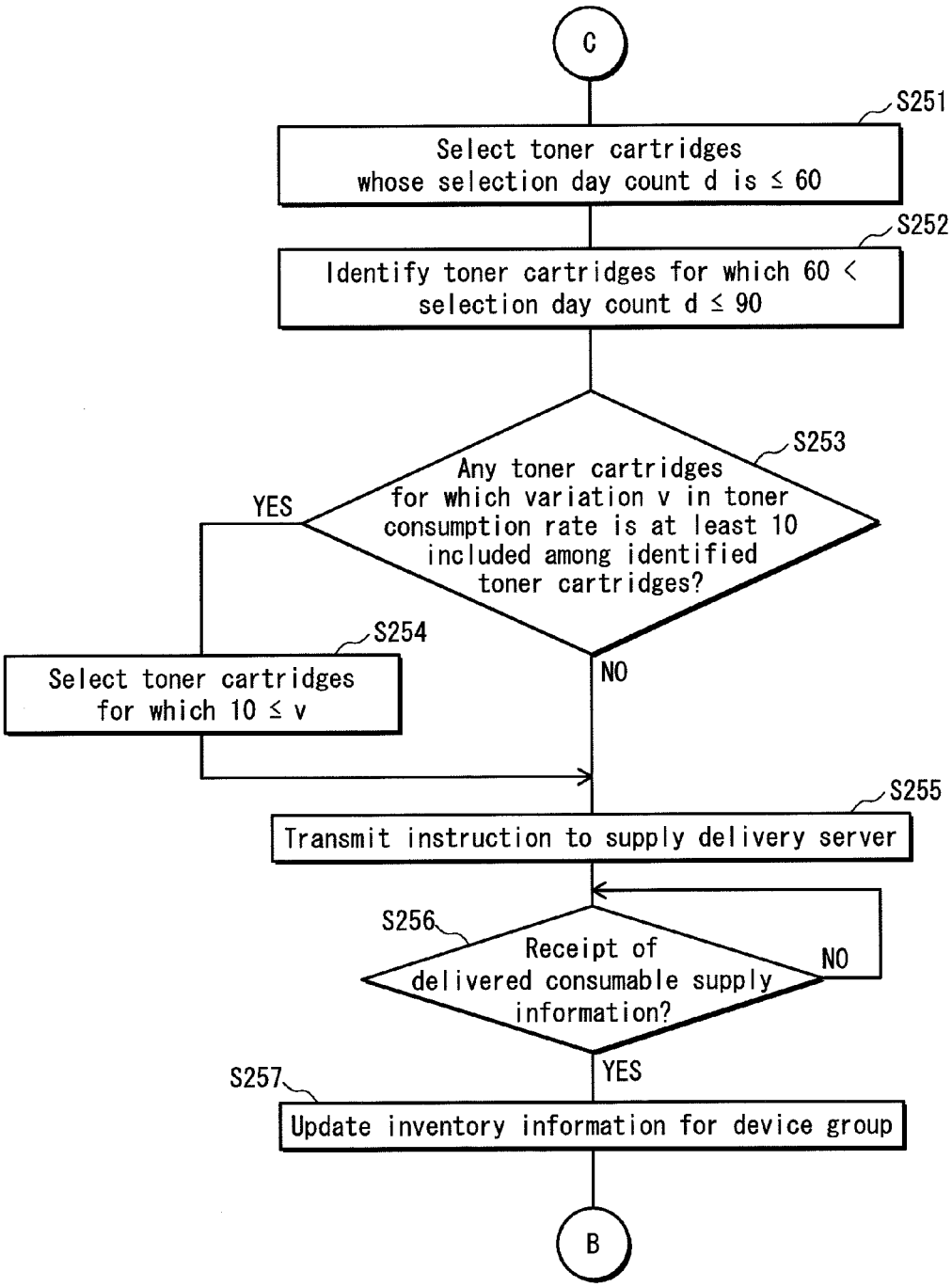
FIG. 45 is part of a flowchart of a control sequence for the image processing device and the inventory management device for consumable inventory management by the inventory management device of Modification 24, showing processing by the inventory management device.

FIG. 45 is part of a flowchart showing a control sequence for the image processing device 100 and the inventory management device 300 for consumable inventory management by the inventory management device of the present modification. Here, the control sequence for the image processing device 100 is the same as FIG. 40 and therefore is omitted from FIG. 45 and from the description below. Furthermore, in the control sequence for the inventory management device 300, processing before step S251 is the same as processing from step S231 through step S235 in FIG. 40, and thus these steps and a description thereof are similarly omitted.

Additionally, steps S251 and S252 are the same as steps S241 and S242 in the flowchart shown in FIG. 43, and the processing from step S255 through step S257 is the same as the processing from step S237 through step S239 in the flowchart in FIG. 41. Therefore, a description of these steps is omitted.

In step S252, when at least one toner cartridge is identified as having a selection day count d greater than 60 and at most 90, it is determined whether the variation v in the toner consumption rate of any of the identified toner cartridges is at least ten (step S253).

When the variation v is at least ten for any of the toner cartridges (step S253: YES), these toner cartridges are selected to supplement the inventory (step S254). The delivery instruction unit 316 (see FIG. 7) then instructs the supply delivery server 400 (see FIG. 1) to deliver the toner cartridges selected in steps S251 and S254 to the user (in this case, the inventory manager for office A; step S255).

When no toner cartridges have a variation of at least ten (step S253: NO), the delivery instruction unit 316 instructs the supply delivery server 400 to deliver only the toner cartridges selected in step S251 to the user (step S255).

As described above, with the structure of the present modification, the time frame for selection is extended for toner cartridges having a large variation in toner consumption rate, so that the selection day count d falls within the extended time frame for selection. These toner cartridges are thus selected to supplement the inventory, so that a replacement toner cartridge is always stocked in the inventory even if the toner consumption rate is faster than projected, causing the toner to be depleted earlier than projected.

In the present modification, the index used as the variation v in the toner consumption rate is the standard deviation of the toner consumption rate. The toner consumption rate is the amount of toner consumed per unit of time (day), which is obtained from the total amount of toner consumed during the predetermined period of time as used to calculate the projected timing of next replacement. The index is not limited in this way, however, and any index that indicates the degree of variation in the toner consumption rate may be used.

Furthermore, the threshold at which the variation v in the toner consumption rate is considered to be large is ten, at which point the extended time frame for selection applies. This value is only an example, however, and the threshold may be any appropriate value.

It is also not necessary to use only one threshold value; two or more threshold values may be used.

Alternatively, instead of using a fixed value for the threshold, the variation v for the toner consumption rate of each toner cartridge whose selection day count d is outside of the standard time frame for selection may be multiplied by a predetermined coefficient to calculate the extended time frame for selection for that toner cartridge. Each toner cartridge whose selection day count d falls within the corresponding extended time frame for selection would then be selected to supplement the inventory.

(25) Among the functions with which an image processing device is provided, some functions are frequently used, whereas other functions are important to the user even if not used frequently. Among such functions, the FAX function is often used in offices to exchange valuable business information that, for security reasons, is preferable not to send or receive by e-mail, or to send or receive information, such as maps or drawings, that is difficult to explain over the telephone. Therefore, the inability to output (print out) received faxes due to an absence of toner is highly likely to be problematic.

In the present modification, a specific function provided in the image processing device, in particular the FAX function, is taken into consideration as the second criterion for prioritization.

FIG. 46A is an example of the structure of inventory information in the present modification. As an example, the following describes selection of toner cartridges to supplement the inventory at a point at which the color M toner cartridge in the image processing device 100-A01 in office A has been replaced (i.e. the timing of replacement has been confirmed).

The toner cartridges not currently included in the inventory for the device group (in this case, office A) are identified and listed in a table by projected timing of next replacement starting with the earliest timing, i.e. in order starting with the smallest selection day count d, as shown in FIG. 46B.

In the table shown in FIG. 46B, the selection day count d is not within the standard time frame for selection of 60 days for any toner cartridge. In this modification, any toner cartridge whose selection day count d is within the standard time frame for selection of 60 days is first selected to supplement the inventory.

Next, the toner cartridges whose selection day count d is between the standard time frame for selection (60 days) and the extended time frame for selection (90 days) are the color K toner cartridge (d=76 days) in the image processing device 100-A01 and the color K toner cartridge (d=76 days) in the image processing device 100-A03.

In this example, the image processing device 100-A03 has a FAX function, whereas the image processing device 100-

A01 does not. Accordingly, in this case, the (color K) toner cartridge in the image processing device 100-A03, which has a FAX function, is selected to supplement the inventory. Note that in FIG. 46B, for the sake of clarity, the entry for this toner cartridge is outlined in bold, and the projected timing of next replacement, as well as the indication of the FAX function, are shown in bold.

Figure 47:
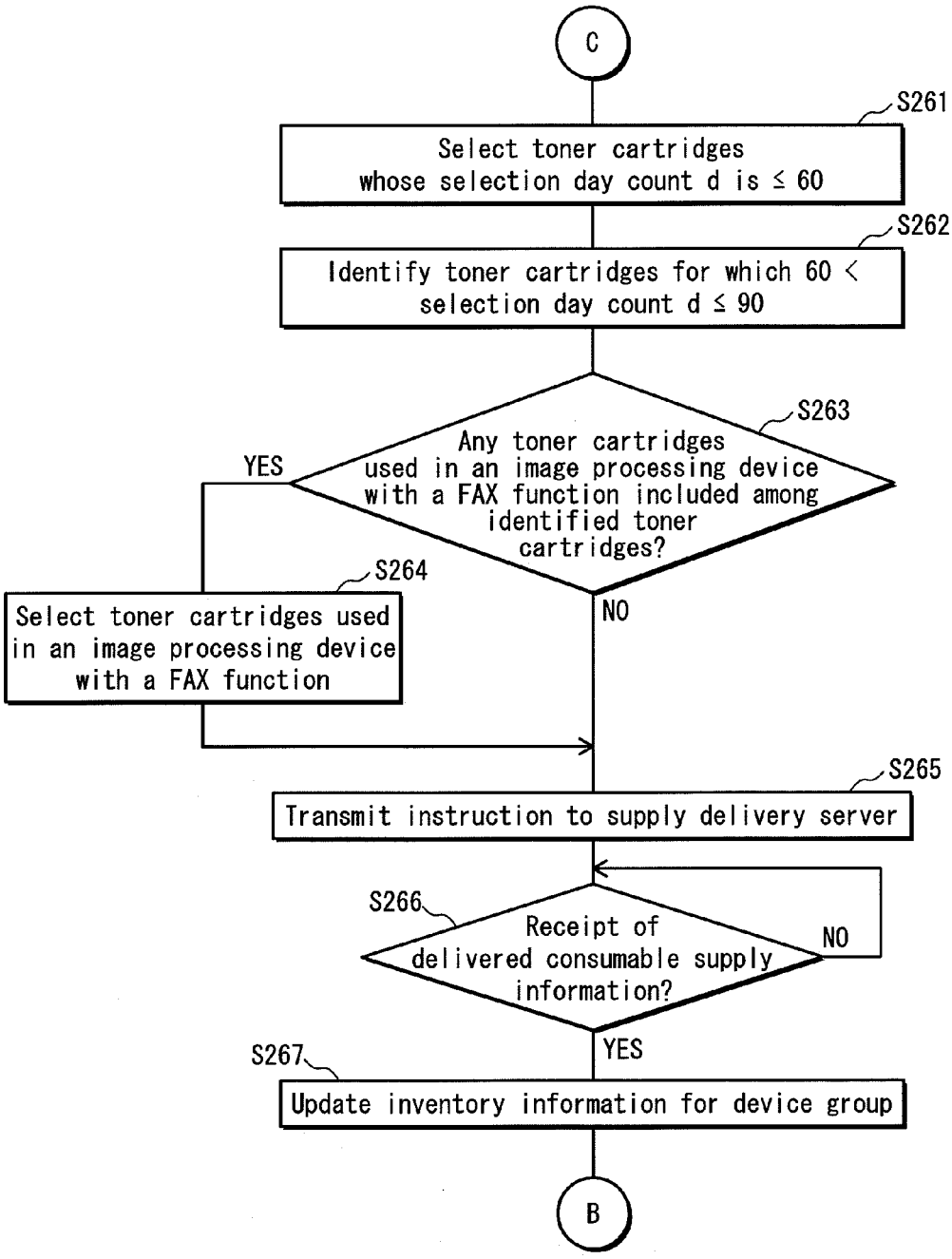
FIG. 47 is part of a flowchart of a control sequence for the image processing device and the inventory management device for consumable inventory management by the inventory management device of Modification 25, showing processing by the inventory management device.

FIG. 47 is part of a flowchart showing a control sequence for the image processing device 100 and the inventory management device 300 for consumable inventory management by the inventory management device of the present modification. Here, the control sequence for the image processing device 100 is the same as FIG. 40 and therefore is omitted from FIG. 47 and from the description below. Furthermore, in the control sequence for the inventory management device 300, processing before step S261 is the same as processing from step S231 through step S235 in FIG. 40, and thus these steps and a description thereof are similarly omitted.

Additionally, steps S261 and S262 are the same as steps S241 and S242 in the flowchart shown in FIG. 43, and the processing from step S265 through step S267 is the same as the processing from step S237 through step S239 in the flowchart in FIG. 41. Therefore, a description of these steps is omitted.

In step S262, when at least one toner cartridge is identified as having a selection day count d greater than 60 and at most 90, it is determined whether any of the identified toner cartridges are used in an image processing device with a FAX function (step S263).

When any of the toner cartridges are used in an image processing device with a FAX function (step S263: YES), the toner cartridges are selected to supplement the inventory (step S264). The delivery instruction unit 316 (see FIG. 7) then instructs the supply delivery server 400 (see FIG. 1) to deliver the toner cartridges selected in steps S261 and S264 to the user (in this case, the inventory manager for office A; step S265). When no toner cartridges are used in an image processing device with a FAX function (step S263: NO), the delivery instruction unit 316 instructs the supply delivery server 400 to deliver only the toner cartridges selected in step S261 to the user (step S265).

As described above, with the structure of the present modification, if the selection day count d for a toner cartridge used in an image processing device having a FAX function is within the extended time frame for selection, which is longer than the standard time frame for selection, the toner cartridge is also selected to supplement the inventory. Such toner cartridges are thus selected earlier than if selection were only based on the standard time frame for selection. As a result, replacements are more reliably stocked in the inventory for toner cartridges used in an image processing device having a FAX function, since such an image processing device has a higher degree of priority. This prevents a situation in which a received FAX cannot be output due to absence of toner.

Note that in the present modification, the color of the toner cartridge used in an image processing device with a FAX function is only K, but image processing devices with a FAX function are not limited in this way; a color MFP may be provided with a FAX function. In this case, toner cartridges that are both the color K and are used in an image processing device having a FAX function are selected in step S264.

Furthermore, in the present modification, the second criterion for prioritization takes into consideration whether or not an image processing device has a FAX function, but the function taken into consideration for the second criterion for prioritization is not limited to the FAX function. For example, in an office where copies are frequently made, the copy function may be the target of the second criterion for prioritization. The user may be allowed to set which function of the image processing device is the target of the second criterion for prioritization.

(26) Many image processing devices, such as MFPs or printers, that are installed in offices and other locations are leased from a manufacturer or a sales office. Normally, the lease contract is approximately three to five years. When the lease contract expires and is not renewed, the manufacturer or a sales office takes back the image processing device. Even when the lease contract is renewed, the image processing device is often exchanged for a model with higher performance and a greater variety of functions.

Even if an image processing device is not under lease, the probability of the image processing device being exchanged for a new one increases over time, either because malfunction or other problems become more frequent, or because users become dissatisfied with the functions or performance of the image processing device, such as processing speed.

If the image processing device is replaced with a different model, the toner cartridges used in the old image processing device often can no longer be used in the new model. The toner cartridges in the inventory therefore go to waste.

To address this problem, the present modification describes a structure whereby the time frame for selection is shortened from the standard time frame for selection for toner cartridges used in an image processing device that has been in use for more than a predetermined period of time, thus delaying selection of such toner cartridges to supplement the inventory.

The present modification describes an example in which the above predetermined period of time is five years, and the time frame for selection that is shortened from the standard time frame for selection (hereinafter "shortened time frame for selection") is 30 days.

FIG. 48A is an example of the structure of inventory information in the present modification. As an example, the following describes selection of toner cartridges to supplement the inventory at a point at which the color M toner cartridge in the image processing device 100-A01 in office A has been replaced (i.e. the timing of replacement has been confirmed).

The toner cartridges not currently included in the inventory for the device group (in this case, office A) are identified and listed in a table by projected timing of next replacement starting with the earliest timing, i.e. in order starting with the smallest selection day count d, as shown in FIG. 48B.

As shown in FIG. 48B, the toner cartridges for which the selection day count d is within the standard time frame for selection of 60 days are the color Y toner cartridge in the image processing device 100-A01 (d=47 days) and the color C toner cartridge in the image processing device 100-A02 (d=56 days).

Looking at the usage period p for the image processing device in which these two toner cartridges are used, the usage period p for the image processing device 100-A02, which uses the color C toner cartridge, is one year, whereas the usage period p for the image processing device 100-A01, which uses the color Y toner cartridge, is six years. The image processing device 100-A01 has thus been in use five years or greater. Accordingly, the shortened time frame for selection applies to the color Y toner cartridge in the image processing device 100-A01. Since the shortened time frame for selection is 30 days, the number of days d=56 for the color Y toner cartridge in the image processing device 100-A01 does not fall within the shortened time frame for selection. In this case, therefore, the color Y toner cartridge in the image processing device 100-A01 is not selected to supplement the inventory. Only the color C toner cartridge in the image processing device 100-A02 is selected.

Note that in FIG. 48B, for the sake of clarity, the entry for the color Y toner cartridge in the image processing device 100-A01 is outlined in bold, and the selection day count d as well as the usage period p are shown in bold.

Figure 49:
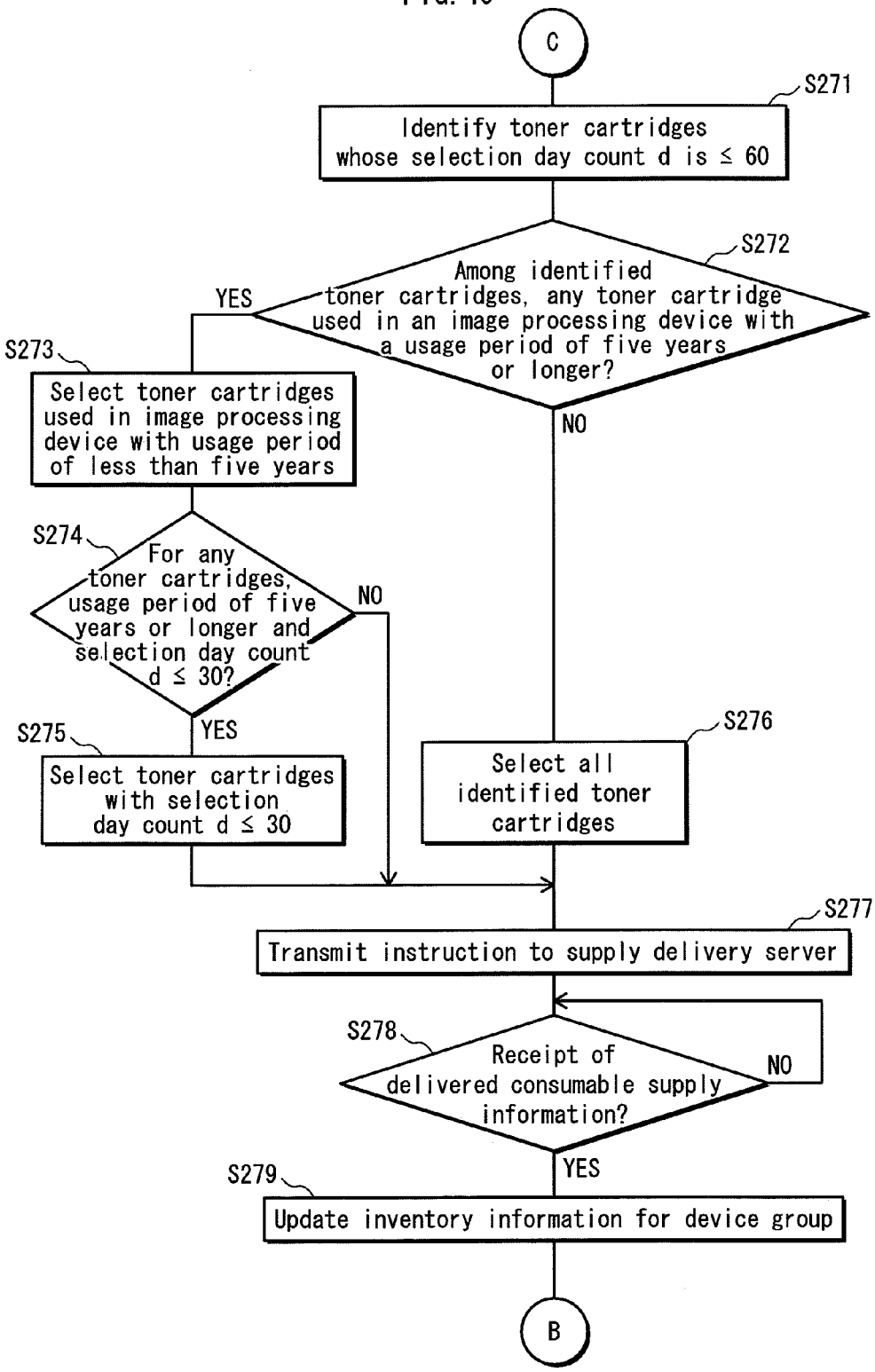
FIG. 49 is part of a flowchart of a control sequence for the image processing device and the inventory management device for consumable inventory management by the inventory management device of Modification 26, showing processing by the inventory management device.

FIG. 49 is part of a flowchart showing a control sequence for the image processing device 100 and the inventory management device 300 for consumable inventory management by the inventory management device of the present modification. Here, the control sequence for the image processing device 100 is the same as FIG. 40 and therefore is omitted from FIG. 49 and from the description below. Furthermore, in the control sequence for the inventory management device 300, processing before step S271 is the same as processing from step S231 through step S235 in FIG. 40, and thus these steps and a description thereof are similarly omitted.

Subsequent steps S277 through S279 are the same as steps S237 through S239 in the flowchart shown in FIG. 41, and thus a description thereof is omitted.

Upon updating of the inventory information in step S235 (see FIG. 40), toner cartridges whose selection day count d from the confirmed timing of replacement until the projected timing of next replacement is less than or equal to 60 are identified (step S271). It is then determined whether any of the identified toner cartridges are used in an image processing device whose usage period is five years or longer (step S272).

If no toner cartridges are used in an image processing device with a usage period of five years or longer (step S272: NO), all of the identified toner cartridges are selected to supplement the inventory (step S276). The delivery instruction unit 316 (see FIG. 7) then instructs the supply delivery server 400 (see FIG. 1) to deliver the selected toner cartridges to the user (in this case, the inventory manager for office A; step S277).

If any of the toner cartridges is used in an image processing device with a usage period of five years or longer (step S272: YES), the toner cartridges used in an image processing device with a usage period of less than five years are first selected (S273).

It is then determined whether, among the toner cartridges used in an image processing device with a usage period of five years or longer, the selection day count d is 30 days or less for any toner cartridge (step S274).

Among the toner cartridges used in an image processing device with a usage period of five years or longer, any toner cartridges for which the selection day count d is 30 days or less (step S274: YES) are selected to supplement the inventory (step S275). The delivery instruction unit 316 (see FIG. 7) then instructs the supply delivery server 400 (see FIG. 1) to deliver the toner cartridges selected in steps S273 and S275 to the user (in this case, the inventory manager for office A; step S277).

Among toner cartridges used in an image processing device for which the usage period is five years or longer, when the selection day count d is not 30 days or less for any toner cartridge (step S274: NO), the delivery instruction unit 316 instructs the supply delivery server 400 to deliver only the toner cartridges selected in step S273 to the user (step S277).

As described above, in the present modification, the time frame for selection is shortened from the standard time frame for selection for toner cartridges used in an image processing device with a long usage period, thus delaying selection of such toner cartridges to supplement the inventory and shortening the period during which such toner cartridges are stocked in the inventory. This reduces the number of toner cartridges that go to waste when an image processing device with a long usage period is replaced, thus reducing loss by the user.

In the example described in the present modification, the usage period for an image processing device to which the shortened time frame for selection is applied is five years. However, the usage period is not limited in this way. The usage period may be shorter (for example, three years) or longer (for example, ten years) than five years.

Note also that while in the above example, the shortened time frame for selection is 30 days, the shortened time frame for selection may be set to any number of days that is shorter than the standard time frame for selection (in the above example, 60 days). Furthermore, the manager of the inventory management system or the inventory management device 300 may be allowed to set and change the number of days in the standard time frame for selection, or the user may be allowed to do so via the control panel 16 or the client device 200. Note also that the standard time frame for selection is not limited to being a number of days, and may be expressed in units of years, months, hours, minutes, seconds, etc.

Modifications to Embodiments 3 and 4

The present invention has been described through embodiments and modifications thereof, but of course the present invention is in no way limited to Embodiment 3, Embodiment 4, and the modifications to Embodiment 4. For example, the following further modifications are possible.

(27) Even if there is little variation in the consumption rate of individual toner cartridges, there may be large variation in the toner consumption rate when examining the amount of toner consumed in a device group as a whole, due to the combined result of small individual variations.

Furthermore, offices or other locations often experience busy periods and lulls in response to clients or to industry conditions. During a busy period, an image processing device that is already frequently used may not be sufficient, and usage of an image processing device that is normally not used frequently may increase. In such a case, a toner cartridge whose toner consumption rate was previously relatively slow, and which therefore had a late projected timing of next replacement, experiences an increase in the toner consumption rate and requires replacement earlier than projected.

To address this problem, the present modification describes changing the length of the time frame for selection by taking into account toner consumption tendencies for a device group as a whole.

In the present modification, toner consumption tendencies are determined based on the amount of toner consumed in a device group as a whole over a counting period of three months.

FIG. 50A is a table showing, for three-month periods, the amount of toner consumed in office A by each image processing device 100 and the total for the device group as a whole. As an example, the following describes selection of toner cartridges to supplement the inventory on Jun. 15, 2011, when the color M toner cartridge in the image processing device 100-A01 in office A has been replaced (i.e. the timing of replacement has been confirmed).

Note that for the April to June period in the table, the amount of toner consumed includes an estimated value for June 15 through June 30. As when projecting the next timing of replacement, this estimate of the amount of toner consumed is based on the amount of toner consumed as acquired for each toner cartridge.

No large variation occurs in the amount of color K toner consumed in the image processing device 100-A03 over the previous nine months (October to June). The amount of toner consumed in office A as a whole, however, greatly increases: whereas this amount is 300 g for October to December and 290 g for January to March, the amount jumps to 440 g for April to June. It can therefore be deduced that the image processing devices are used more frequently in office A as a whole, and that use of the image processing device 100-A03 may increase in the future.

Accordingly, when a large amount of toner is consumed in a device group (in this example, office A) as a whole, the time frame for selection is extended for the device group. Toner cartridges are thus selected to supplement the inventory and delivered to the user further in advance.

FIG. 50B is a table showing the correspondence between the amount of toner consumed in a device group as a whole and the length of the time frame for selection. If t, the total amount of toner consumed for the device group as a whole over three months, is less than 200 g, the time frame for selection is 30 days. If t is between 200 g and 400 g, the time frame for selection is 60 days, and if t is over 400 g, the time frame for selection is 90 days.

FIG. 51A is an example of the structure of inventory information in the present modification. FIG. 51B is a table in which the toner cartridges not currently included in the inventory for the device group (in this case, office A) are identified and listed by projected timing of next replacement starting with the earliest timing, i.e. in order starting with the smallest selection day count d.

The amount of toner consumed during the three months from April to June in office A as shown in the table in FIG. 50A is 440 g. Therefore, as indicated in the table in FIG. 50B, the time frame for selection is 90 days.

In the table shown in FIG. 51B, the toner cartridges whose selection day count d is 90 days or less are the color K toner cartridge in the image processing device 100-A01 (d=45 days) and the color K toner cartridge in the image processing device 100-A03 (d=76 days). Therefore, in this example, these two toner cartridges are selected to supplement the inventory.

Note that in FIG. 50B, for the sake of clarity, the entries for the color K toner cartridge in the image processing device 100-A01 and the color K toner cartridge in the image processing device 100-A03 are outlined in bold, and the selection day count d for each toner cartridge is shown in bold.

Figure 52:
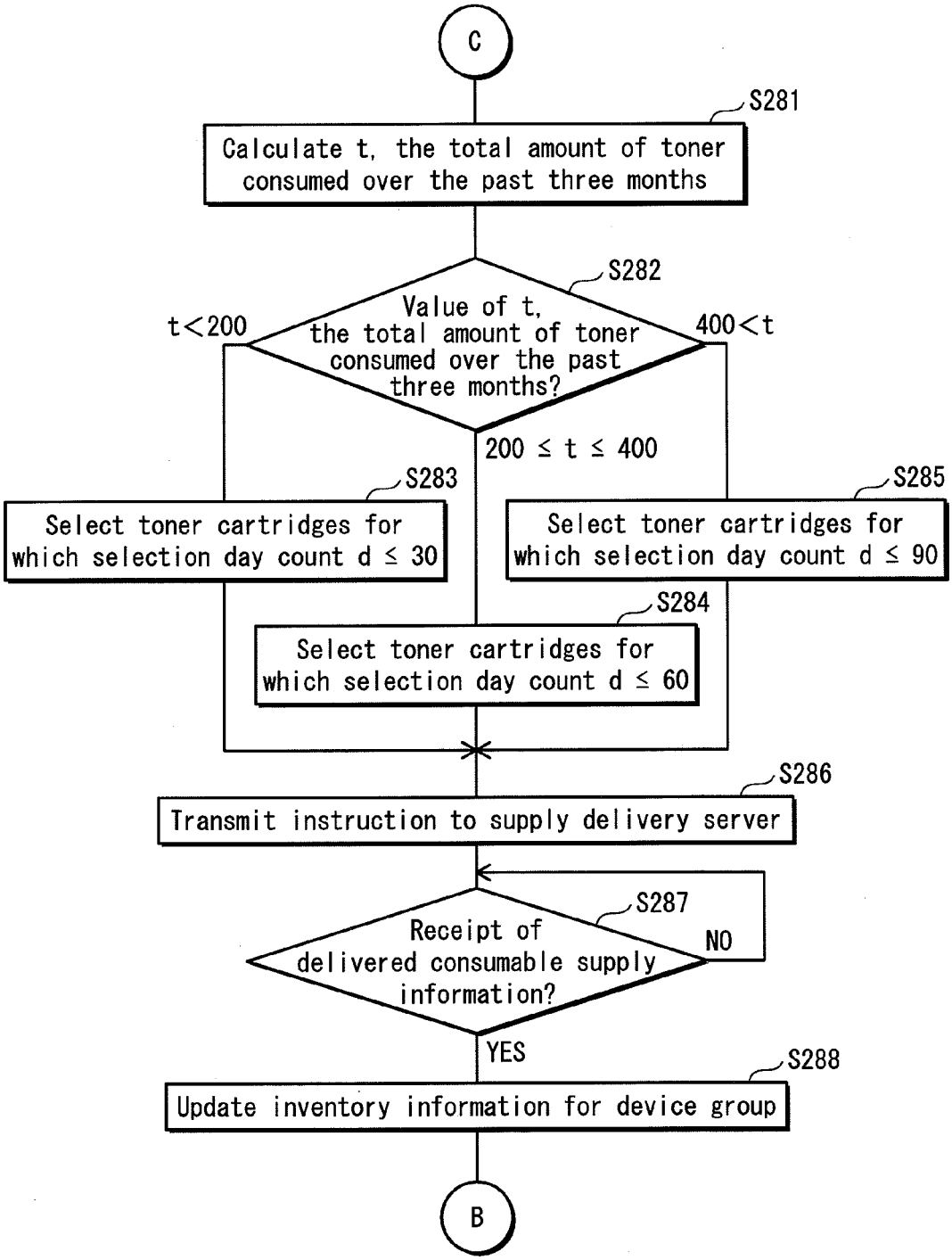
FIG. 52 is part of a flowchart of a control sequence for the image processing device and the inventory management device for consumable inventory management by the inventory management device of Modification 27, showing processing by the inventory management device.

FIG. 52 is part of a flowchart showing a control sequence for the image processing device 100 and the inventory management device 300 for consumable inventory management by the inventory management device of the present modification. Here, the control sequence for the image processing device 100 is the same as FIG. 40 and therefore is omitted from FIG. 52 and from the description below. Furthermore, in the control sequence for the inventory management device 300, processing before step S281 is the same as processing from step S231 through step S235 in FIG. 40, and thus these steps and a description thereof are similarly omitted.

Subsequent steps S286 through S288 are the same as steps S237 through S239 in the flowchart shown in FIG. 41, and thus a description thereof is omitted.

Upon updating of the inventory information in step S235 (see FIG. 40), the total amount of toner consumed t in the device group (in this case, office A) as a whole over the past three months is calculated (step S281). It is then determined if the value oft is less than 200 g, between 200 g and 400 g, or greater than 400 g (step S282).

If the value of t is less than 200 g (step S282: t<200), then all toner cartridges whose selection day count d is 30 days or less are selected to supplement the inventory (step S283). The delivery instruction unit 316 (see FIG. 7) then instructs the supply delivery server 400 (see FIG. 1) to deliver the selected toner cartridges to the user (in this case, the inventory manager for office A; step S286).

If the value oft is between 200 g and 400 g (step S282: 200≤t≤400), then all toner cartridges whose selection day count d is 60 days or less are selected to supplement the inventory (step S284), and an instruction is issued to deliver the selected toner cartridges to the user (step S286).

If the value oft is greater than 400 g (step S282: 400<t), then all toner cartridges whose selection day count d is 90 days or less are selected to supplement the inventory (step S285), and an instruction is issued to deliver the selected toner cartridges to the user (step S286).

The above structure yields the following advantageous effect, for example. As shown in the table in FIG. 50A, while there was no large change in the amount of color K toner consumed in the image processing device 100-A03 over the previous nine months, if the time frame for selection is changed in accordance with the amount of toner consumed in office A as a whole, as described above, the color K toner cartridge in the image processing device 100-A03 is selected to supplement the inventory. Therefore, even if the frequency of use of the image processing device 100-A03 increases in the future, inventory of the toner cartridge is guaranteed in advance.

As described above, with the structure of the present modification, when a large amount of toner is consumed in a device group as a whole, the time frame for selection is extended, and toner cartridges to supplement the inventory for the device group are selected in advance. On the other hand, when a small amount of toner is consumed in the device group a whole, the time frame for selection is shortened, so that selection of toner cartridges to supplement the inventory is delayed. This structure therefore manages inventory of toner cartridges in response to when conditions of use of image processing devices in an office as a whole change, such as during busy periods and lulls.

Note that in the above description, the total amount of toner consumed in a device group as a whole over a counting period of three months serves as the basis for determining the length of the time frame for selection, but the counting period is not limited in this way. For example, the counting period may be shorter or longer than three months. If the counting period is too short or too long, however, the tendency in the amount of toner consumed in the device group as a whole becomes unclear. The counting period should thus preferably be set between several weeks and several months.

The table in FIG. 50A lists data for the amount of toner consumed over the past year, but data is not limited in this way. Data for the amount of toner consumed only over the past three months may be stored. Alternatively, data for over a year may be stored, and if the same tendencies in the change in amount of toner consumed are observed every year, these tendencies may serve as the basis for future projections of the amount of toner consumed, and the time frame for selection may be changed in advance.

In the present modification, the total amount of toner consumed is calculated at fixed quarterly intervals (every three months). When calculating a total partway through an interval, an estimated value is used for the remainder of the interval, but calculation is not limited in this way. For example, the total amount of toner consumed may be calculated for the past three months, starting from the point in time at which the toner cartridge to supplement the inventory is selected.

(28) In Embodiments 3 and 4, and in the modifications to Embodiment 4, a structure has been described wherein when the toner cartridge is replaced, one or more toner cartridges whose selection day count is within the time frame for selection are selected to supplement the inventory from among toner cartridges not in the inventory, starting from the earliest projected timing of next replacement.

Among users for whom inventory of consumable supplies (toner cartridges) is managed by the above embodiments, however, if there are both users with extremely limited inventory space as well as users with ample inventory space, some of the users with ample inventory space may want to have the same type of toner cartridge as the replaced toner cartridge delivered to supplement the inventory.

The present modification describes a structure in which a user is allowed to choose the selection mode in which the inventory management device 300 operates: the first selection mode in Embodiment 3, or a selection mode for selecting the same type of toner cartridge as the replaced toner cartridge when selecting the toner cartridge to supplement the inventory (hereinafter, "second selection mode"). Note that the user sets the selection mode by selecting between the above selection modes via the control panel 16 (see FIG. 2).

Figure 53:
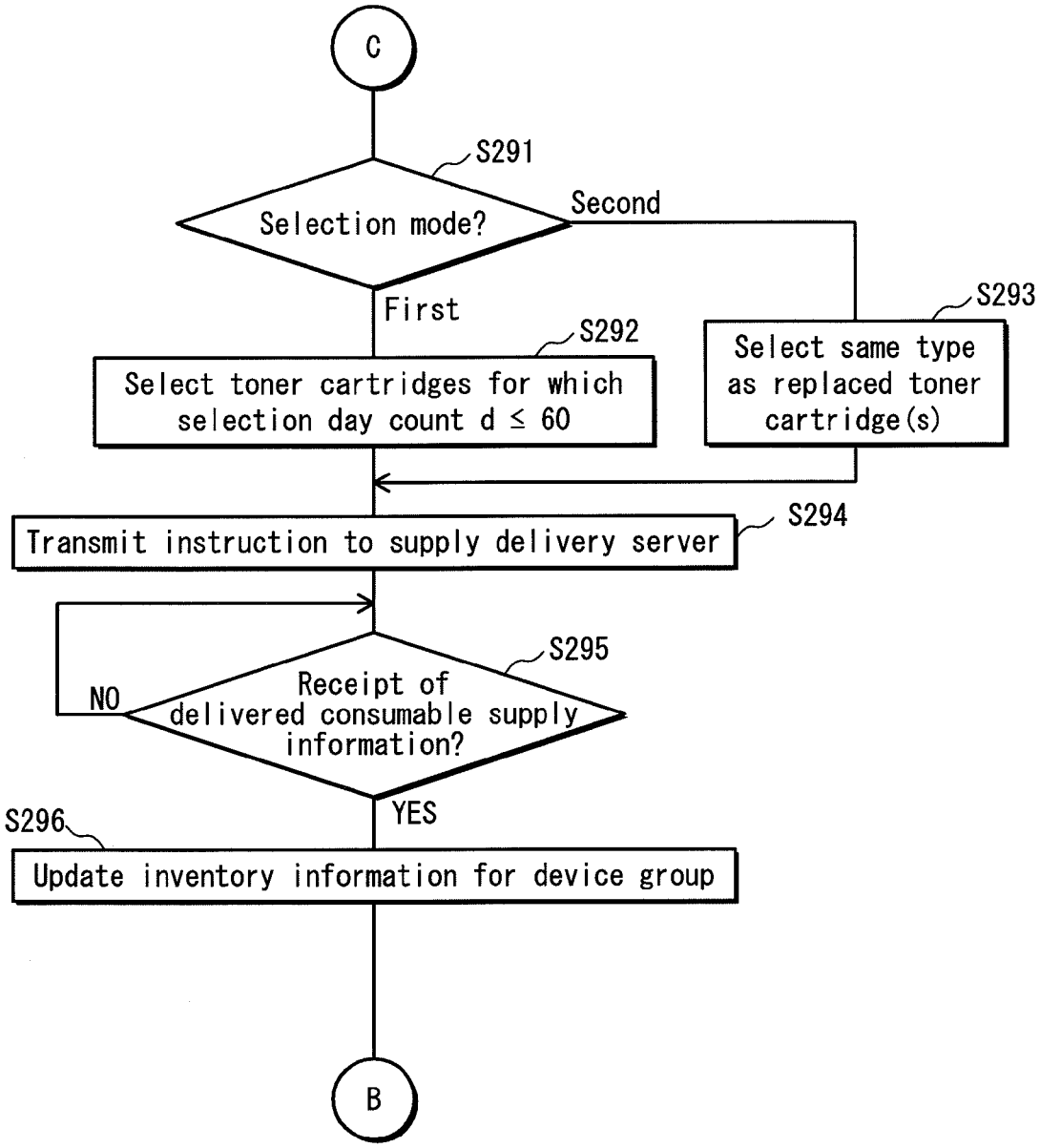
FIG. 53 is part of a flowchart of a control sequence for the image processing device and the inventory management device for consumable inventory management by the inventory management device of Modification 28, showing processing by the inventory management device.

FIG. 53 is part of a flowchart showing a control sequence for the image processing device 100 and the inventory management device 300 for consumable inventory management by the inventory management device of the present modification. Here, the control sequence for the image processing device 100 is the same as FIG. 40 and therefore is omitted from FIG. 53 and from the description below. Furthermore, in the control sequence for the inventory management device 300, processing before step S291 is the same as processing from step S231 through step S235 in FIG. 40, and thus these steps and a description thereof are similarly omitted.

Subsequent steps S294 through S296 are the same as steps S237 through S239 in the flowchart shown in FIG. 41, and thus a description thereof is omitted.

Upon updating of the inventory information in step S235 (see FIG. 40), it is then determined which selection mode the user has selected: the first selection mode, or the second selection mode (step S291).

When the user has selected the first selection mode (step S291: first), toner cartridges whose selection day count d is 60 days or less are selected to supplement the inventory (step S292). The delivery instruction unit 316 (see FIG. 7) then instructs the supply delivery server 400 (see FIG. 1) to deliver the selected toner cartridges to the user (in this case, the inventory manager for office A; step S293).

In step S291, when the user has selected the second selection mode (step S291: second), the same type of toner cartridge as the replaced toner cartridge is selected to supplement the inventory (step S293), and the supply delivery server 400 is instructed to deliver the selected toner cartridge to the user (step S294).

As described above, with the structure of the present modification, the user is allowed to choose between the first and the second selection modes for selection of the toner cartridge to supplement the inventory, thereby contributing to providing an inventory management service that is even more convenient for the user by accommodating the user's preferences and needs.

If the toner cartridge delivered to supplement the inventory differs from the type of toner cartridge that was replaced, some users may feel uneasy, even if such a delivery in fact poses no problem. In this case as well, therefore, allowing the user to choose between the first selection mode and the second selection mode contributes to providing an inventory management service that reduces users' anxiety.

In the above-described structure, one possibility is for the user to set the selection mode for toner cartridges once in advance, with this selection mode subsequently being maintained until the user changes the setting. Another possibility is for the user to be asked to choose a selection mode, for example by a message on the control panel 16, every time a toner cartridge is replaced and a toner cartridge to supplement the inventory is to be selected. Subsequent processing would then be in accordance with the selection mode chosen by the user.

In the above explanation, the user inputs the selection mode via the control panel 16, but input is not limited in this way. The selection mode may be input via the input/operation unit 303 in the inventory management device 300, or via an input means in the client device 200.

(29) In Modification 28, the user is allowed to choose between the first selection mode and the second selection mode, but the present invention is not limited in this way.

For example, the user may be allowed to choose between the second selection mode and a third selection mode whereby, as in Embodiment 4 and the modifications thereto, in addition to toner cartridges whose projected timing of next replacement (selection day count d) is within the standard time frame for selection, toner cartridges meeting a second criterion for prioritization are also selected to supplement the inventory if the projected timing of next replacement thereof falls within an extended time frame for selection, which is longer than the standard time frame for selection. Note that this "third selection mode" differs from the "third selection mode" in Embodiment 3.

(30) Furthermore, the user may be allowed to choose one selection mode from among the first, second, and third selection modes.

(31) In the above embodiments and modifications, the predetermined state of consumption that serves as the timing for supplementing the inventory of consumable supplies is replacement of a toner cartridge in an image processing device 100 (the timing of replacement having been specified). The predetermined state of consumption that serves as the timing for supplementing the inventory of consumable supplies is not limited in this way, however, and may be the point at which the toner reaches a predetermined level of consumption (such as cartridge near empty).

The present modification describes a structure in which toner cartridges are selected to supplement the inventory when the cartridge near empty state is detected.

Figure 54:
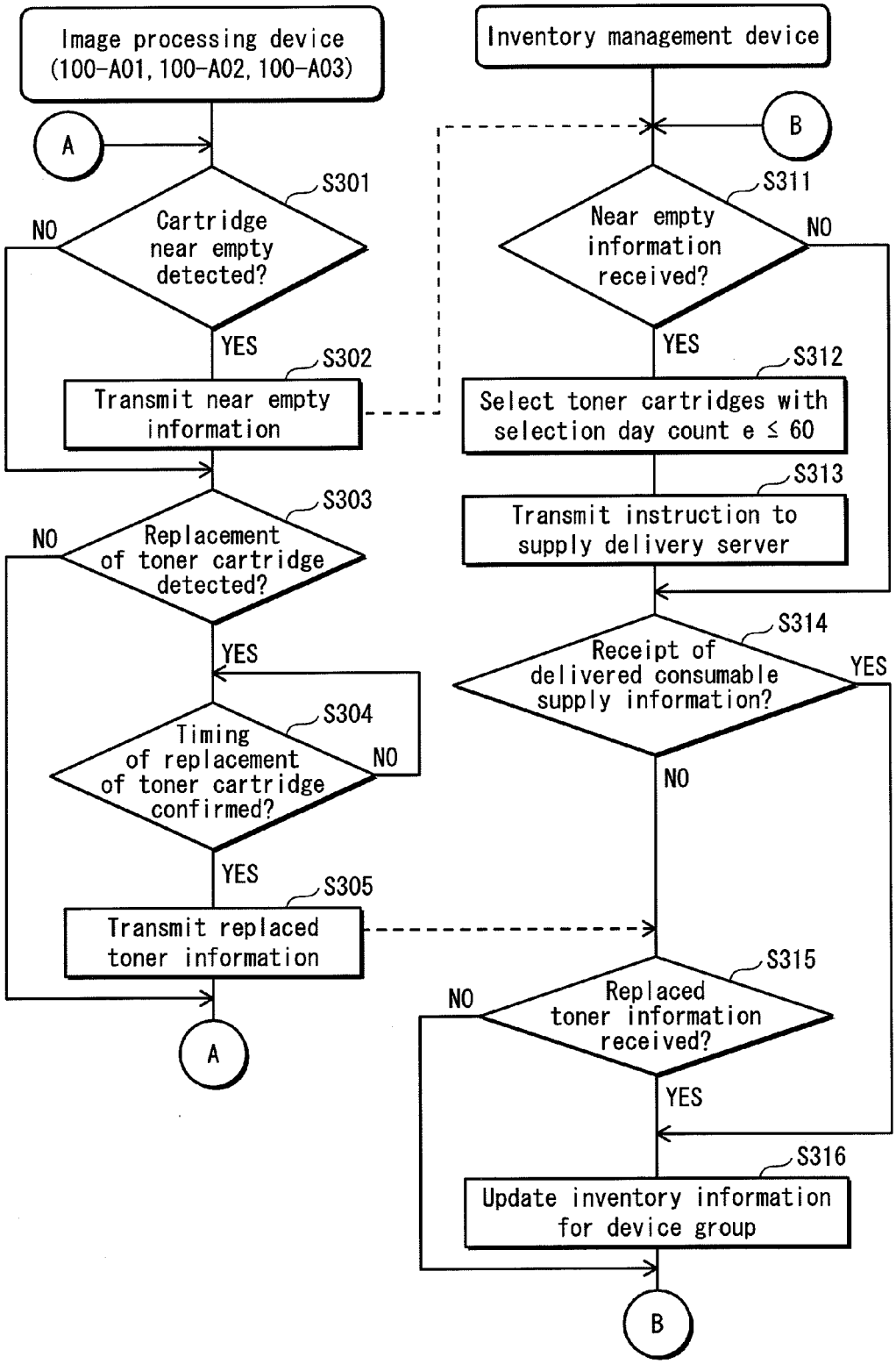
FIG. 54 is a flowchart of a control sequence for the image processing device and the inventory management device for consumable inventory management by the inventory management device of Modification 31.

FIG. 54 is a flowchart showing a control sequence for the image processing device 100 and the inventory management device 300 for consumable inventory management by the inventory management device of the present modification. The following describes an example for office A (see FIG. 1).

First, each of the image processing devices 100-A01, 100-A02, and 100-A03 belonging to office A determine whether the cartridge near empty state has been detected therein (step S301).

When the cartridge near empty state is not detected (step S301: NO), it is next determined whether replacement of a toner cartridge has been detected (step S303). Note that this detection of replacement of a toner cartridge includes detection of an operation with possible toner cartridge replacement.

When replacement of a toner cartridge has not been detected (step S303: NO), processing returns to step S301, in which it is once again determined whether the cartridge near empty state has been detected (step S301).

Upon detection of replacement of a toner cartridge (step S303: YES), the image processing device that detects replacement determines whether the toner replacement timing confirmation unit 611 (see FIG. 6) has confirmed the timing of replacement of the toner cartridge (step S304).

When the timing of replacement of the toner cartridge has not been confirmed (step S304: NO), the determination is repeated until the timing of replacement is confirmed (step S304).

When the timing of replacement of the toner cartridge has been confirmed (step S304: YES), the replaced toner information stored in the replaced toner information storage 665 (see FIG. 6) is transmitted to the inventory management device 300 (step S305).

In step S301, when the cartridge near empty state is detected (step S301: YES), near empty information is transmitted to the inventory management device 300 (step S302).

FIG. 55 shows an example of the configuration of a notification frame of near empty information transmitted by the image processing device 100 to the inventory management device 300. As shown in FIG. 55, the near empty information includes the following: a notification destination identifying the destination of the near empty information (the inventory management device 300); an image processing device identifier that identifies the notification source, i.e. the image processing device 100 providing the near empty information, which is the image processing device 100 in which the cartridge near empty state was detected; a toner cartridge identifier indicating the type of toner cartridge in which the cartridge near empty state was detected; and information indicating the date of detection of the cartridge near empty state. This near empty information corresponds to the replaced toner information in Embodiment 3. In the present modification, the near empty information is used as the inventory supplement timing information.

Returning to the flowchart in FIG. 54, the image processing device 100 transmits the near empty information to the inventory management device 300 in step S302, whereas the inventory management device 300 determines whether it has received the near empty information (step S311).

If the inventory management device 300 has received the near empty information (step S311: YES), toner cartridges with a selection day count e of 60 days or less are selected to supplement the inventory (step S312). The selection day count e is the number of days from the date on which the cartridge near empty state is detected until the projected timing of next replacement. The delivery instruction unit 316 (see FIG. 7) then instructs the supply delivery server 400 (see FIG. 1) to deliver the selected toner cartridges to the user (in this case, the inventory manager for office A; step S313). Subsequently, the inventory management device 300 monitors for receipt, from the supply delivery server 400, of delivered consumable supply information indicating that the designated toner cartridges were delivered to the user (step S314).

In step S311, when the near empty information has not been received (step S311: NO), it is then determined whether delivered consumable supply information has been received from the supply delivery server 400 (step S314).

In step S314, when the delivered consumable supply information has been received (step S314: YES), the inventory management device 300 refers to the received information to update the inventory information for the device group corresponding to the user to whom toner cartridges were delivered (step S316). Processing then returns to step S311, where it is determined whether near empty information has been received (step S311).

When the delivered consumable supply information has not been received (step S314: NO), the inventory management device 300 then determines whether it has received replaced toner information (step S315).

When replaced toner information has been received (step S315: YES), the inventory management device 300 refers to the received information to update the inventory information for the device group to which belongs the image processing device 100 that transmitted the replaced toner information (step S316).

When the replaced toner information has not been received (step S315: NO), processing returns to step S311, where the inventory management device 300 determines whether it has received near empty information (step S311).

Like the above embodiments and modifications, in which toner cartridges are selected to supplement the inventory when a toner cartridge is replaced, the present structure, in which toner cartridges are selected when the cartridge near empty state is detected, relieves the user of the burden of setting a maximum amount of inventory or a minimum order amount, while appropriately stocking toner cartridges in the inventory.

While the selection day count e has been described as the number of days from the date on which the cartridge near empty state is detected until the projected timing of next replacement, the selection day count e is not limited in this way. For example, the selection day count e may be the number of days from the date on which the inventory management device 300 receives (acquires) the near empty information.

Furthermore, the level of consumption of toner that serves as the timing for selection of toner cartridges to supplement the inventory is not limited to the cartridge near empty state. For example, this level of consumption of toner may be when half of the toner remains in the toner cartridge, or when the cartridge empty state is detected.

(32) In the structure described in embodiments 3 and 4, and in each of the modifications, when the inventory supplement selection unit 315 (see FIG. 7) in the inventory management device 300 (see FIG. 1) selects one or more toner cartridges to supplement the inventory, the delivery instruction unit 316 (see FIG. 7) transmits an instruction to the supply delivery server 400 to deliver the selected toner cartridge(s) to the user, so that toner cartridges are automatically delivered to the user.

The present invention is not limited in this way, however, and the following modification is possible. When the inventory supplement selection unit 315 selects toner cartridge(s) to supplement the inventory, instead of a delivery instruction being automatically transmitted to the supply delivery server 400, the selected toner cartridge(s) to supplement the inventory may be displayed on the control panel. Upon seeing the display, the user may then order the toner cartridges by FAX, telephone, or other means from an office supply distributor, a sales agent, or the like.

The following modification describes an application of the above structure to Embodiment 3.

Figure 56:
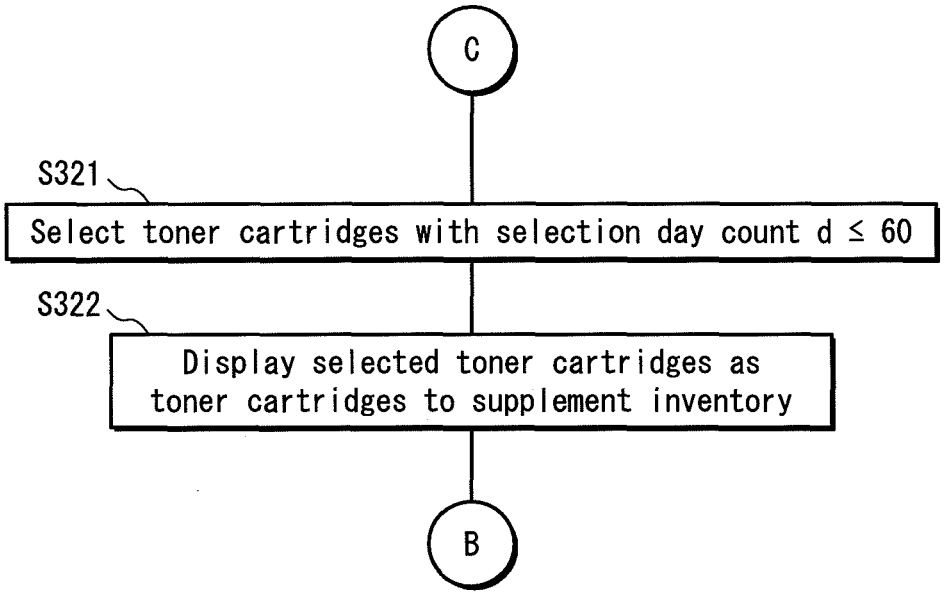
FIG. 56 is part of a flowchart of a control sequence for the image processing device and the inventory management device for consumable inventory management by the inventory management device of Modification 32, showing processing by the inventory management device.

FIG. 56 is part of a flowchart showing a control sequence for the image processing device 100 and the inventory management device 300 for consumable inventory management by the inventory management device of the present modification. Here, the control sequence for the image processing device 100 is the same as FIG. 40 and therefore is omitted from FIG. 56 and from the description below. Furthermore, in the control sequence for the inventory management device 300, processing before step S321 is the same as processing from step S231 through step S235 in FIG. 40, and thus these steps and a description thereof are similarly omitted. Step S321 is also the same as step S236 in FIG. 41, and thus a description thereof is omitted below.

In step S321, upon selection of toner cartridges whose selection day count d is 60 days or less, the selected toner cartridges are displayed on the control panel 16 (see FIG. 2) as toner cartridges to supplement the inventory (step S322). Processing then returns to step S231 in the flowchart in FIG. 40, and the inventory management device 300 monitors for receipt of the next replaced toner information (step S231).

With this structure, a user that wishes for the inventory management device 300 to automatically select toner cartridges to supplement the inventory, but who does not want the supply delivery server 400 to automatically order from the manufacturer of the image processing device, a sales company, or the like, can place an order directly with a dealer, such as a dealer with whom the user has a long-standing relationship. This structure thus contributes to providing an inventory management service that is even more convenient for the user.

Note that in the above embodiments and modifications of the present invention, the supply delivery server 400 in the inventory management system is not limited to a supply delivery server owned by the manufacturer of the image processing device or a sales company. Therefore, if the above dealer with whom a user has a long-standing relationship possesses a supply delivery server compatible with the inventory management system of the present invention, the inventory management system of the present invention may be adapted to treat that server as the supply delivery server 400.

The structure of the present modification may be adapted to Embodiment 4 and to each of the other modifications.

(33) In the above embodiments and modifications, the storage unit 320 (see FIG. 7) in the inventory management device 300 (see FIG. 1) refers to replaced toner information that has been acquired to update the inventory information for the device group in which a toner cartridge was replaced, updating the inventory information by subtracting the replaced toner cartridge from the inventory. The storage unit 320 also refers to delivered consumable supply information that has been received to update the inventory information for the device group to which a toner cartridge was delivered, updating the inventory information by adding the delivered toner cartridge to the inventory.

The present invention is not, however, limited in this way. The user may manually update the inventory information when the inventory increases or decreases.

Figure 57:
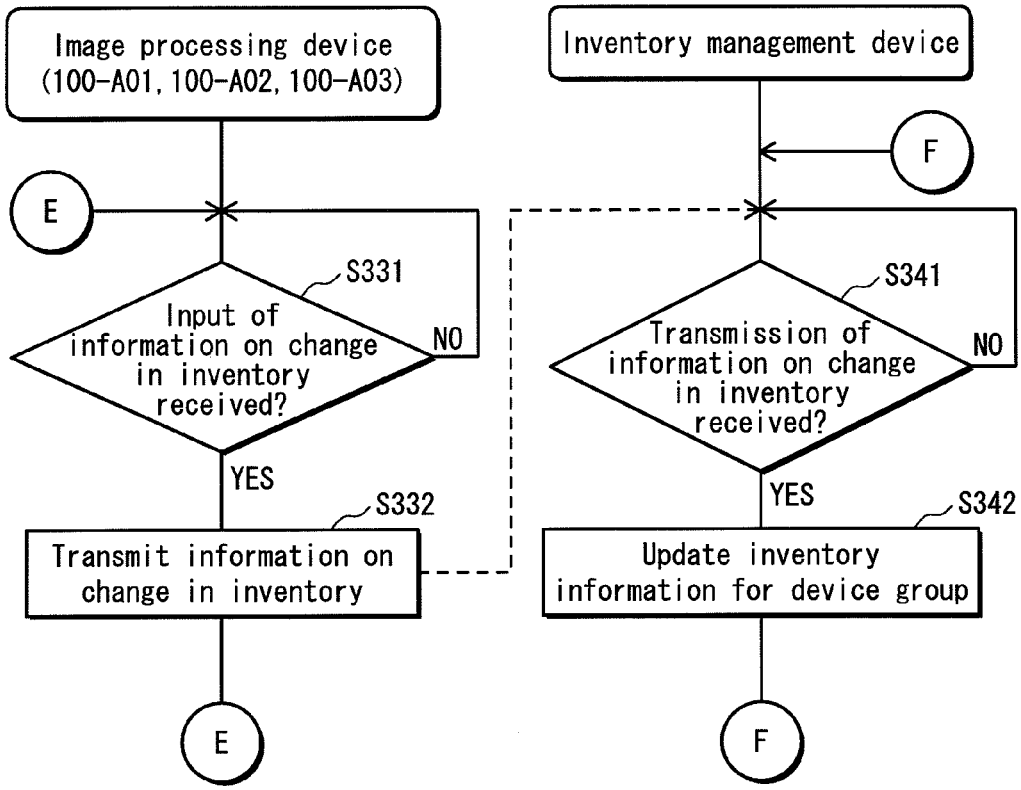
FIG. 57 is a flowchart of a control sequence for the image processing device and the inventory management device for updating of inventory information by the inventory management device of Modification 33.

FIG. 57 is a flowchart showing a control sequence for the image processing device 100 and the inventory management device 300 for updating of inventory information according to the inventory management device of the present modification. The following describes an example for office A (see FIG. 1).

First, the image processing devices 100-A01, 100-A02, and 100-A03 in office A each self-monitor for whether the user inputs information relating to an increase or decrease in inventory for the device (hereinafter, "information on change in inventory"; step S331).

Information on change in inventory includes information regarding a decrease in inventory due to replacement of a toner cartridge (corresponding to the "replaced toner information" in Embodiment 3), as well as information regarding an increase in inventory due to delivery and stocking of a toner cartridge to supplement the inventory (corresponding to the "delivered consumable supply information" in Embodiment 3).

The user inputs the information on change in inventory via the control panel 16 (see FIG. 2) of any of the image processing devices 100-A01, 100-A02, and 100-A03.

In step S331, if input of the information on change in inventory is received (step S331: YES), then after transmitting the information on change in inventory to the inventory management device 300 (step S332), processing returns to step S331, in which the image processing devices once again monitor for receipt of information on change in inventory (step S331).

The inventory management device 300 monitors for receipt of information on change in inventory, and upon receipt (step S341: YES) refers to the received information on change in inventory to update the inventory information for the corresponding device group (step S342). Processing then returns to step S341, in which the inventory management device 300 again monitors for receipt of information on change in inventory (S341).

As described above, with the structure of the present modification, the inventory information is updated to reflect the latest changes even when the user orders toner cartridges to supplement the inventory directly from a dealer. Therefore, the user can appropriately select toner cartridges to supplement the inventory.

While input of the information on change in inventory has been described as being performed by the user on the control panel 16 of any of the image processing devices 100-A01, 100-A02, and 100-A03, it is not necessary for input to be performed in this way. For example, only one of the image processing devices 100-A01, 100-A02, and 100-A03 may be capable of receiving the information on change in inventory. In this case, only the image processing device that is capable of receipt would monitor for input of the information on change in inventory in step S331.

Furthermore, input of the information on change in inventory is not limited to the control panel of the image processing device. For example, the information on change in inventory may be input using an input device, such as a keyboard, of a client device connected over a network. In this case, the information on change in inventory that is input may be transmitted to the inventory management device 300 directly, or may be transmitted to the inventory management device 300 via the image processing device 100.

Furthermore, input of the information on change in inventory may be restricted, by use of a password or the like, to the person in charge of inventory management. Doing so prevents a situation in which a user unwittingly inputs the same information on change in inventory that another user has already input.

A structure may also be adopted in which users manually input information only on an increase in inventory as the above information on change in inventory, whereas with regard to information on a decrease in inventory, the inventory management device 300 acquires replaced toner information from the image processing device 100 and refers to the acquired information to update the inventory information as in the above embodiments and modifications.

(34) In the above embodiments and in each of the modifications, except for modification 31, when the timing of replacement is confirmed for a toner cartridge replaced in the image processing device 100, replaced toner information is transmitted to the inventory management device 300. Upon each receipt of the replaced toner information, the inventory management device 300 requests information on toner replacement timing confirmation in progress from each of the image processing devices 100 in the device group. When toner replacement timing confirmation is in progress for a toner cartridge, the inventory management device 300 waits for the confirmation to be complete before updating the inventory information and selecting toner cartridges to supplement the inventory.

The present invention is not limited in this way, however, and may for example adopt the following structure. Upon detecting replacement of a toner cartridge, an image processing device 100 acquires information on whether confirmation of toner replacement timing is in progress for a toner cartridge in any of the image processing devices in the device group to which the image processing device 100 belongs, including the image processing device 100 itself. When confirmation is not in progress for any toner cartridge, the image processing device 100 transmits the information on the replaced toner cartridge to the inventory management device 300 as replaced toner information, whereas when confirmation is in progress for a toner cartridge, the image processing device 100 waits to transmit the replaced toner information to the inventory management device 300 until confirmation is complete.

Figure 58:
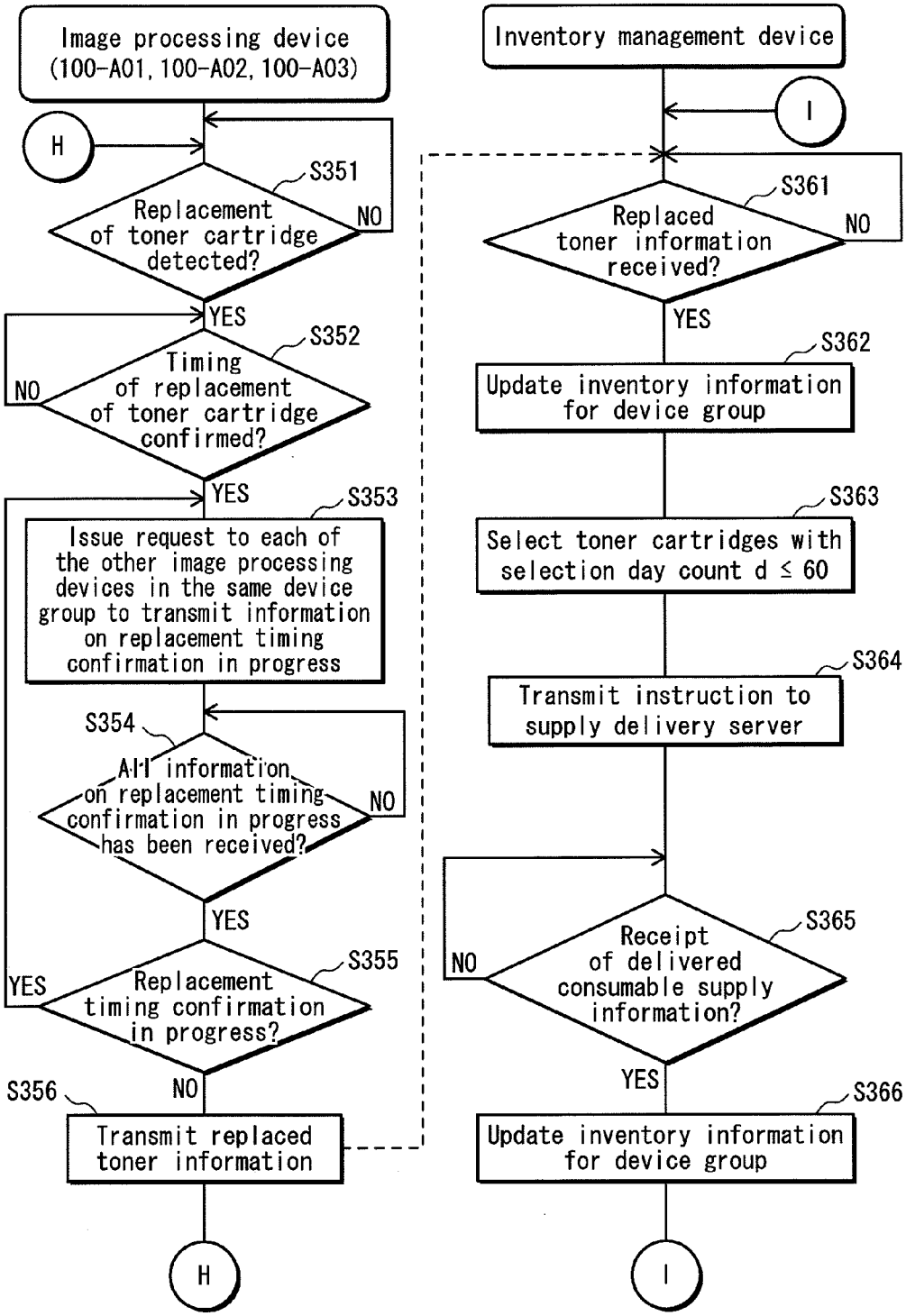
FIG. 58 is a flowchart of a control sequence for the image processing device and the inventory management device for consumable inventory management by the inventory management device of Modification 34.

FIG. 58 is a flowchart showing a control sequence for the image processing device 100 and the inventory management device 300 for consumable inventory management by the inventory management device of the present modification. The following describes an application of the present modification to Embodiment 3 using office A (see FIG. 1) as an example.

Steps S351 and S352 are the same as steps S221 and S222 in the flowchart shown in FIG. 40, and thus a description thereof is omitted.

In step S352, when the timing of replacement of the toner cartridge has been confirmed (step S352: YES), the image processing device 100 issues a request to each of the other image processing devices 100 in the same device group to transmit information indicating whether confirmation of toner replacement timing is in progress for any toner cartridge therein (step S353).

The image processing device 100 then monitors for receipt of the information on confirmation of toner replacement timing from each of the image processing devices 100 of which the information was requested (step S354).

Upon receipt of the information on confirmation of toner replacement timing from all of the image processing devices 100 (step S354: YES), the image processing device 100 refers to the received information to determine whether confirmation of toner replacement timing is in progress for any toner cartridge in the image processing devices 100 in the device group (step S355).

When confirmation of toner replacement timing is in progress for any toner cartridge (step S355: YES), processing returns to step S353, and the image processing device 100 once again issues a request to each of the other image processing devices 100 in the same device group to transmit information indicating whether confirmation of toner replacement timing is in progress (step S353). Subsequently, the steps S353 through S355 are repeated until it is determined that confirmation of toner replacement timing is not in progress for any toner cartridge.

When confirmation of toner replacement timing is not in progress for any toner cartridge (step S355: NO), the replaced toner information is transmitted to the inventory management device 300 (step S356).

The inventory management device 300 monitors for receipt of the replaced toner information (step S361).

When the replaced toner information acquisition unit 311 (see FIG. 7) in the inventory management device 300 receives the replaced toner information (step S361: YES), the storage unit 320 (see FIG. 7) refers to the replaced toner information that has been received to update the inventory information for the device group (in this case, office A) to which belongs the image processing device 100 in which a toner cartridge was replaced (step S362). The storage unit 320 updates the inventory information by subtracting the replaced toner cartridge from the inventory.

Subsequent steps S363 through S366 are the same as steps S236 through S239 in the flowchart shown in FIG. 41, and thus a description thereof is omitted.

With the above structure for the present modification, as in the above embodiments and modifications, the toner cartridge to supplement the inventory is selected more appropriately by referring to inventory information that is maintained more accurately, since updating of the inventory information is postponed until the timing of replacement is confirmed for a toner cartridge that is not provided with a new-toner-cartridge detection mechanism.

When transmitting the replaced toner information to the inventory management device 300, if the image processing device 100 in which replacement of a toner cartridge is detected differs from the image processing device 100 in which confirmation of the timing of replacement is in progress, each of the image processing devices 100 may individually transmit information on the toner cartridges that have been replaced therein to the inventory management device 300. Alternatively, one of the image processing devices 100 may for example collect the information on the toner cartridges that have been replaced and transmit the collected information to the inventory management device 300.

(35) In the above embodiments and modifications, the toner replacement timing projection unit 313 (see FIG. 7), which projects the timing of replacement of each toner cartridge in use in each image processing device, is provided in the inventory management device 300, but the toner replacement timing projection unit 313 is not limited in this way.

For example, each image processing device 100 may be provided with a toner replacement timing projection unit in order for each image processing device 100 to project the timing of replacement of each toner cartridge in use therein and transmit information on each projected timing of next replacement to the inventory management device 300.

Figure 59:
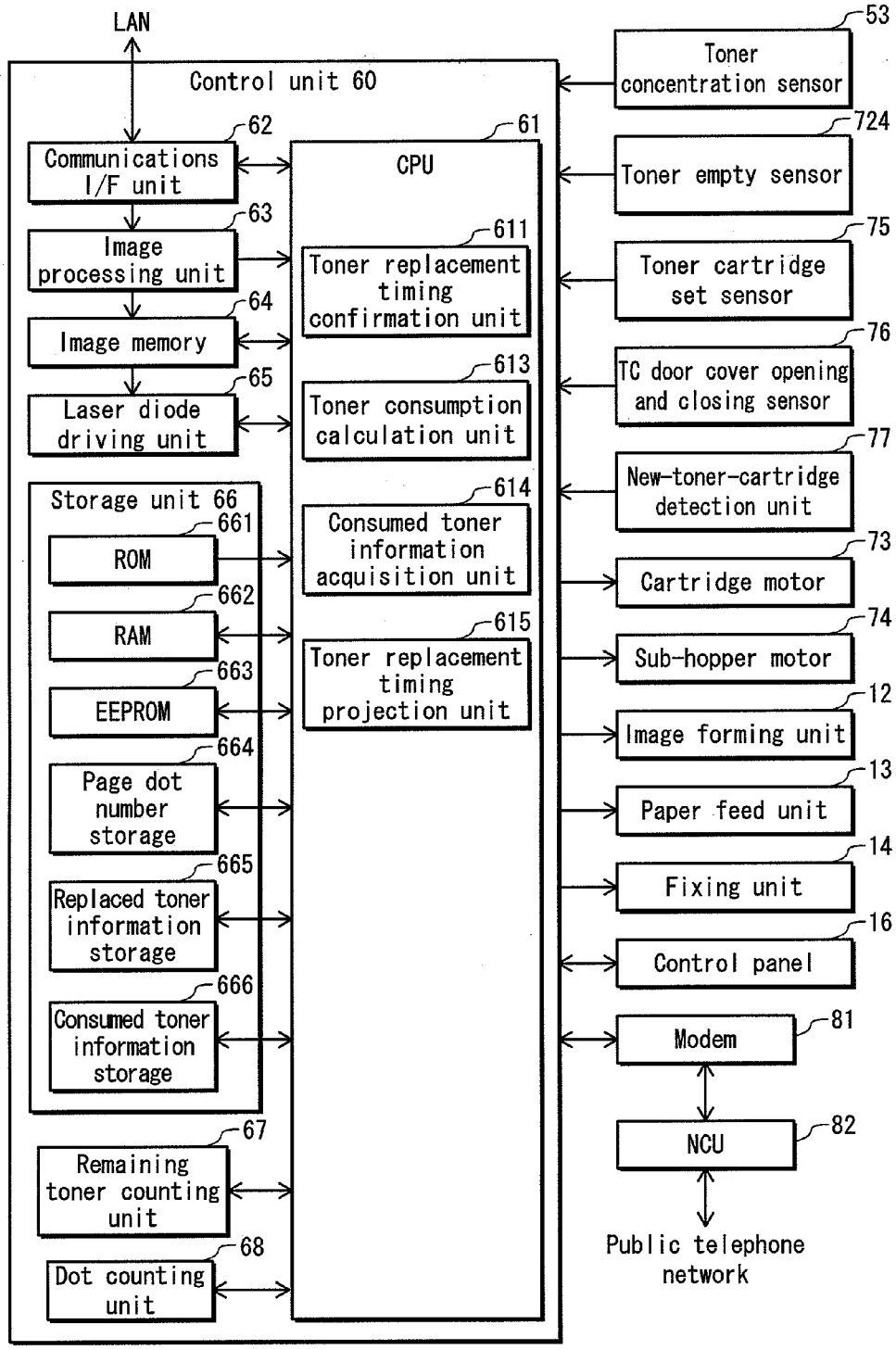
FIG. 59 is a control block diagram for the image processing device in Modification 35.
Figure 60:
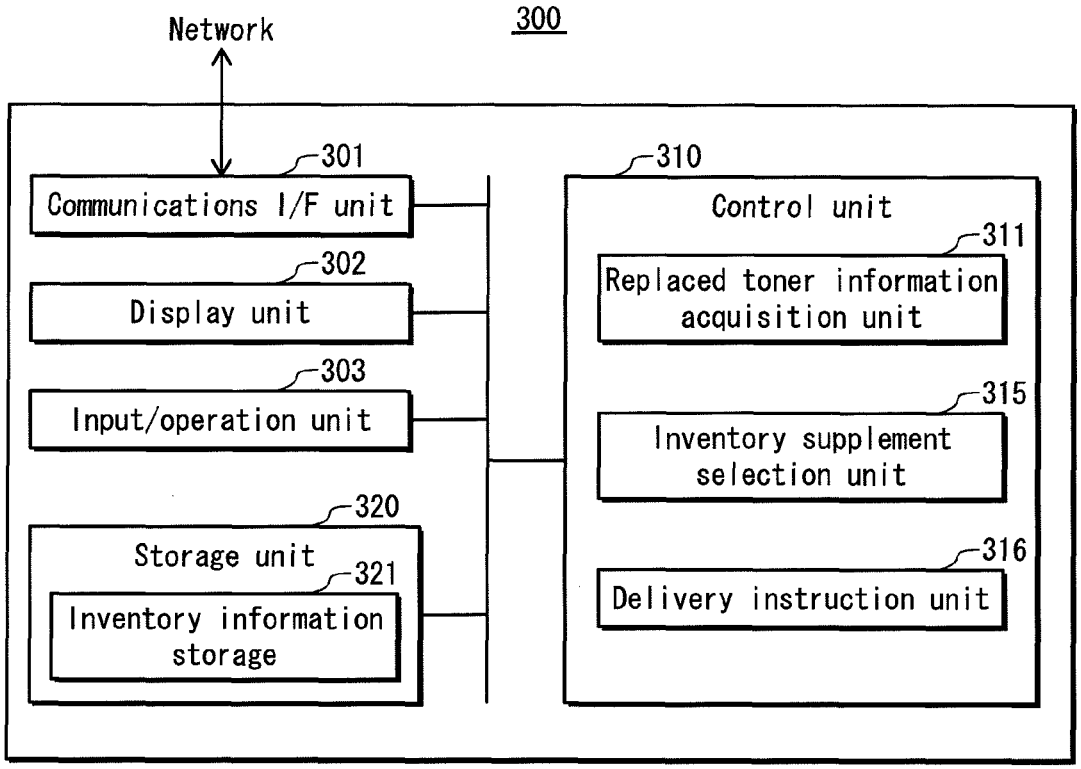
FIG. 60 is a control block diagram for the inventory management device in Modification 35.

FIG. 59 is a block diagram showing the structure of the control unit 60 in the image processing device 100 of the present modification. FIG. 60 is a block diagram showing the structure for control in the inventory management device 300 of the present modification.

The control unit 60 of the image processing device 100 is provided with a consumed toner information acquisition unit 614 and a toner replacement timing projection unit 615, which respectively fulfill similar functions as the consumed toner information acquisition unit 312 and the toner replacement timing projection unit 313 in Embodiment 3 as shown in FIG. 7. These units are also a portion of the functions of the CPU 61.

The storage unit 66 includes a consumed toner information storage 666 that stores consumed toner information, which is information on the consumed amount of toner of each color in the image processing device 100. The consumed toner information storage 666 fulfills the same functions as the consumed toner information storage 322 in the inventory management device 300 of each Embodiment as shown in FIG. 7. Note that the EEPROM 663 may be caused to perform the functions of the consumed toner information storage 666.

On the other hand, the control unit 310 of the inventory management device 300 in the present modification is not provided with the consumed toner information acquisition unit 312, nor with the toner replacement timing projection unit 313, shown in FIG. 7.

Furthermore, the storage unit 320 of the inventory management device 300 in the present modification does not store the consumed toner information shown in FIG. 7.

(36) In the above embodiments and modifications, the image processing device 100 and the inventory management device 300 are connected by a network. The inventory management device 300 manages the inventory by selecting one or more toner cartridges to supplement the inventory.

The present invention is not limited in this way, however. In the inventory management system shown in FIG. 1, instead of providing the inventory management device 300, each of the image processing devices may be caused to perform the functions of the inventory management device 300.

The following modification describes an application of the above structure to Embodiment 3.

Figure 61:
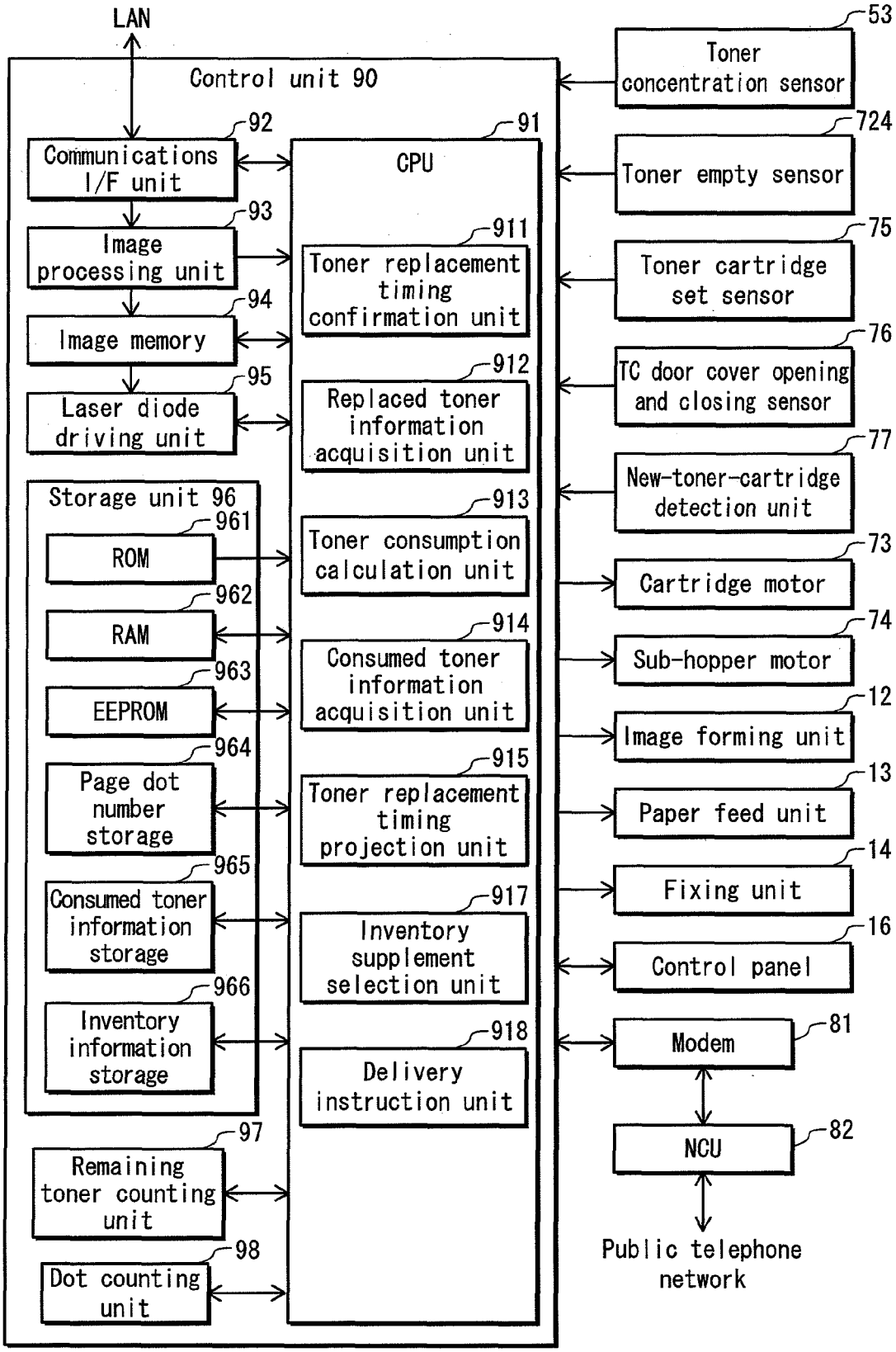
FIG. 61 is a control block diagram for the image processing device in Modification 36.

FIG. 61 is a block diagram showing the structure of a control unit 90 in an image processing device 900 according to the present modification. The image processing device 900 is located in office A (see FIG. 1).

An I/F unit 92, an image processing unit 93, an image memory 94, and a laser diode driving unit 95 respectively fulfill similar functions as the communications I/F unit 62, the image processing unit 63, the image memory 64, and the laser diode driving unit 65 in the control unit block diagram for the image processing device 100 in Embodiment 3, as shown in FIG. 6.

Furthermore, a CPU 91 is provided with a toner replacement timing confirmation unit 911, a toner consumption calculation unit 913, a consumed toner information acquisition unit 914, a toner replacement timing projection unit 915, an inventory supplement selection unit 917, and a delivery instruction unit 918, which respectively fulfill similar functions as the toner replacement timing confirmation unit 611, the toner consumption calculation unit 613, the consumed toner information acquisition unit 614, the toner replacement timing projection unit 615, the inventory supplement selection unit 315, and the delivery instruction unit 316 in FIGS. 6 and 7.

The CPU 91 is also provided with a replaced toner information acquisition unit 912 as part of the functions of the CPU 91. When a toner cartridge is replaced and the toner replacement timing confirmation unit 911 confirms the date the toner cartridge was actually replaced as the timing of toner replacement, the replaced toner information storage 912 stores replaced toner information composed of information indicating the type of toner cartridge that was replaced as detected by the toner cartridge set sensor 75 and information on the confirmed timing of toner replacement. The replaced toner information that is acquired may be temporarily stored in an EEPROM 963 or the like.

A storage unit 96 is provided with a ROM 961, a RAM 962, the EEPROM 963, and a page dot number storage 964, which respectively fulfill similar functions as the ROM 661, the RAM 662, the EEPROM 663, and the page dot number storage 664 shown in FIG. 6. The storage unit 96 is also provided with a consumed toner information storage 965 that fulfills similar functions as the consumed toner information storage 322 shown in FIG. 7.

In the present modification, the storage unit 96 of the control unit 90 is also provided with an inventory information storage 966 that fulfills similar functions as the inventory information storage 321 in FIG. 7.

Figure 62:
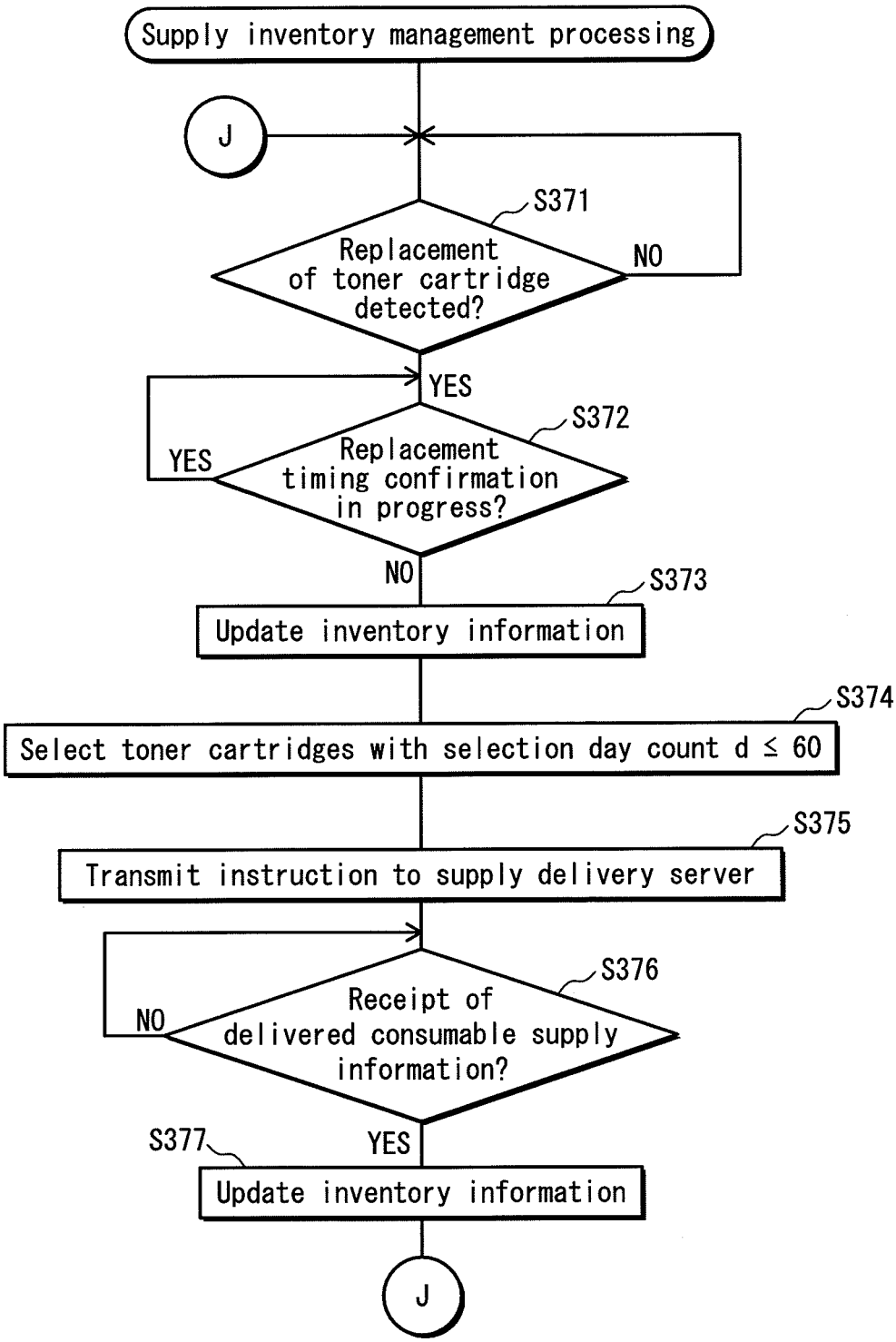
FIG. 62 is a flowchart showing supply inventory management processing by the image processing device of Modification 36.

FIG. 62 is a flowchart showing inventory management processing by the image processing device 900 of the present modification.

First, the image processing device 900 monitors for detection of replacement of a toner cartridge (step S371). This detection of replacement of a toner cartridge includes detection of an operation with possible toner cartridge replacement.

Upon detection of replacement of a toner cartridge (step S371: YES), the image processing device 900 determines whether confirmation of the timing of replacement is in progress (i.e. whether the timing has not yet been confirmed) for any toner cartridge in the image processing device, including the toner cartridge for which replacement was just detected (step S372).

When confirmation of the timing of replacement is in progress for a toner cartridge (step S372: YES), the determination is repeated until the timing of replacement is confirmed (step S372).

When confirmation of the timing of replacement is not in progress for any toner cartridge (step S372: NO), the inventory information storage 966 refers to the replaced toner information acquired by the replaced toner information acquisition unit 912 to update the inventory information (step S373).

Note that in the present modification, if a plurality of image processing devices 900 are located in office A, for example, and exclusive inventory space is allocated for the toner cartridges used in each device, then a maximum amount of inventory is set for the inventory space allocated to each device, and inventory information is stored in each device.

The image processing device 900 then refers to the latest updated inventory information in order to select toner cartridges whose selection day count d is 60 days or less (step S374). The delivery instruction unit 918 (see FIG. 61) instructs the supply delivery server 400 to deliver the selected toner cartridges to the user (in this case, the inventory manager for office A; step S375).

Subsequently, the image processing device 900 monitors for receipt, from the supply delivery server 400, of delivered consumable supply information indicating that the designated toner cartridges were delivered to the user (in this case, the inventory manager for office A; step S376). Upon receipt of the delivered consumable supply information (step S376: YES), the inventory information storage 966 (see FIG. 61) refers to the received information to update the inventory information for the image processing device 900 by adding the delivered toner cartridges (step S377). Processing then returns to step S371, and the image processing device 900 monitors for replacement of a toner cartridge (step S371).

Note that in this modification, the supply delivery server 400 transmits the delivered consumable supply information to the image processing device 900 in which the delivered toner cartridge is used (i.e. the image processing device 900 for which inventory is supplemented).

Like the above embodiments and modifications, this modification contributes to providing an inventory management service that is convenient for the user by avoiding the problem of no replacement toner cartridge being available when a replacement is necessary, even if only a few toner cartridges are kept as inventory.

Note that the structure of the present modification is applicable when there is only one image processing device 900 in an office or other location.

(37) In Embodiment 4, the second criterion for prioritization is whether the toner is color K (black), but the color of toner taken into consideration as the second criterion for prioritization may be any color of toner, C, M, Y, or K.

For example, in offices in which much color C toner is consumed, the color C may be the second criterion for prioritization.

(38) In Embodiment 3, inclusion of the FAX function has been described as the second criterion for prioritization, but the function of the image processing device that is taken into consideration as the second criterion for prioritization is not limited to the FAX function.

For example, it can easily be imagined that an image processing device in which a variety of types (regular paper, heavy paper, OHP sheets, and the like) and sizes (A4, B5, A3, postcard size, and the like) of recording sheets can be used is more convenient, more frequently used, and more important for the user. Accordingly, selection may be prioritized for toner cartridges used in an image processing device 100 compatible with more types and sizes of recording sheets.

(39) In the above embodiments and modifications, the time at which one or more toner cartridges to supplement the inventory are selected is the timing of replacement of a toner cartridge (the timing when replacement is confirmed), but selection is not limited in this way.

For example, toner cartridges may be selected at predetermined intervals, such as every day, every other day, every few days, every few hours, or the like. In this case, if the predetermined interval is too long, ordering of toner cartridges to supplement the inventory will be delayed, and a necessary replacement may not be delivered to the user in time. Therefore, at most the predetermined interval should be one week, for example. Note that selection need not be made at even intervals, as long as the interval between each selection is not too long.

(40) The above embodiments and modifications are described using the example of a toner cartridge as a consumable supply for which inventory is managed, but the consumable supply is not limited in this way.

Other than toner cartridges, inventory may be managed for consumable supplies such as photoreceptor units, transfer belt units, fixing units, or the like. In such a case, the time at which a replacement supply to supplement the inventory is selected may be the time at which the consumable supply is replaced (i.e. the time at which replacement is confirmed), as in the above embodiments, or may, for example, be set to when the consumable supply has reached a certain degree of consumption or wear.

(41) In the above embodiments and modifications, the toner empty sensor 724 detects whether there is toner in the sub-hopper 72, but detection of toner is not limited in this way.

For example, translucent windows may be provided on either side of the main body 725 of the sub-hopper 72, and a photo sensor composed of a light-emitting unit and a photoreceptive unit may be provided outside of the main body 725, with the light-emitting unit facing one translucent window and the photoreceptive unit facing the other. Depletion of toner in the sub-hopper 72 is detected if light emitted by the light-emitting unit passes through the translucent windows without being obstructed by toner in the sub-hopper 72 and is received by the photoreceptive unit. Another method to detect the remaining amount of toner is for a reed switch to detect the position of a magnet attached to a detection plate mounted on the surface of the toner liquid. Depletion of toner in the sub-hopper 72 can be detected when the detected height of the toner liquid in the sub-hopper 72 falls below a predetermined level.

(42) In modification 32, when the inventory management device 300 selects the one or more toner cartridges to supplement the inventory, the selected toner cartridges are displayed on the control panel 16 of the image processing device 100 to notify the user, but notification is not limited in this way. For example, the image processing device 100 may print out a recording sheet with the selected toner cartridges printed thereon. Alternatively, an e-mail may be sent to notify the user (manager), or the user may be notified by sound via a speaker provided in the image processing device 100.

(43) The above embodiments and modifications describe an example in which one inventory management device 300 manages inventory for a plurality of device groups, but management of inventory is not limited in this way. One inventory management device 300 may manage inventory for one device group. Furthermore, as described in Embodiment 3, a plurality of image processing devices need not be included in one device group; the number of image processing devices may be only one.

(44) In the above embodiments and modifications, when replacement of a toner cartridge is detected and the timing of replacement is confirmed, information on the replaced toner cartridge is updated in the inventory information, and the updated inventory information is referred to in order to select the toner cartridge to supplement the inventory, but the present invention is not limited in this way.

For example, when replacement of the toner cartridge is detected and the timing of replacement is confirmed, the toner cartridge to supplement the inventory may be selected before updating of the inventory information.

In inventory information that has not been updated with respect to a replaced toner cartridge, the toner cartridge in question is listed as being stocked in the inventory. Therefore, this toner cartridge does not become a candidate for selection as a toner cartridge to supplement the inventory. Sufficient toner still remains, however, in a toner cartridge that has just been replaced, and the timing of the next replacement has not yet been projected. It thus poses no problem to exclude such a toner cartridge from the candidates for selection as a toner cartridge to supplement the inventory.

In this case, however, it is preferable not to select a toner cartridge to supplement the inventory before timing of replacement of a toner cartridge has been confirmed. If the timing of replacement has not been confirmed, it is possible that the toner cartridge has not actually been replaced, in which case selection of a toner cartridge to supplement the inventory may exceed the maximum amount of inventory, causing toner cartridges to overflow from the inventory space.

(45) The image processing device of the present invention is not limited to a tandem-type color digital MFP, but may also be an MFP that forms monochrome images. Furthermore, the image processing device is not limited to MFPs, but may be a printer, copier, FAX, or the like that forms color or monochrome images.

The above embodiments and modifications may be combined with one another.

Note that the values shown in the embodiments, modifications, and drawings are only examples, and actual values are of course not limited to these.

Furthermore, aspects of the present invention are not limited to an inventory management device, an inventory management system, and an image processing device, but also include a method of managing inventory in the above devices or system. This method may also be a computer program executed by a computer. Furthermore, the program according to an aspect of the present invention may be recorded on a computer-readable recording medium such as the following: magnetic tape; a magnetic disk such as a flexible disk; an optical recording medium such as a DVD, CD-ROM, CD-R, BD-ROM, BD-R, BD-RE, HD DVD-R, HD DVD-ROM, HD DVD-RW, HD DVD-RAM, MO, or PD; or a flash memory recording medium such as Smart Media™. This recording medium with the program recorded thereon may be manufactured or transferred. Furthermore, the program may be supplied by transmission over wired or wireless networks including the Internet, by broadcasting, over telecommunications networks, or by satellite transmission.

The following summarizes the features and advantageous effects of the present invention.

An aspect of the present invention is an inventory management device, connected over a network to one or more device groups each including one or more image processing devices, for managing inventory, by device group, of consumable supplies used in the image processing devices, the inventory management device comprising: a replaced supply information acquisition unit configured to acquire, from each image processing device, replaced supply information that includes an indication of replacement of a supply in the image processing device, a type of the supply that is replaced, and an identifier of the image processing device; a consumption information acquisition unit configured to acquire consumption information indicating a degree of consumption of each supply in use in each image processing device; a projected replacement timing unit configured to calculate, in accordance with the consumption information, a projected replacement timing for replacement of each supply as necessitated by consumption; an inventory information storage unit for storing inventory information by device group, the inventory information including, in association for each supply, a current amount of the inventory, an identifier of the image processing device in which the supply is to be used, an identifier of the device group of the image processing device, a maximum inventory amount that is set for the device group, and the projected replacement timing calculated by the projected replacement timing unit, the inventory information storage unit updating the inventory information by referring to the replaced supply information; and an inventory supplement selection unit configured to select one or more supplies to supplement the inventory, wherein upon acquisition of the replaced supply information by the replaced supply information acquisition unit, the inventory supplement selection unit refers to the updated inventory information for the device group of the image processing device from which the replaced supply information is acquired in order to operate in a first supply selection mode for selecting, from among supplies used in the device group and not currently in the inventory, each supply to supplement the inventory without exceeding the maximum inventory amount for the device group, starting from the supply with an earliest projected replacement timing.

In the inventory management device according to the above aspect of the present invention, the inventory information may include an indication of a predetermined criterion for prioritization, and when the inventory information for the device group of the image processing device providing the replaced supply information includes, among the supplies not currently in the inventory, a plurality of supplies with a projected replacement timing within a predetermined time period from the earliest projected replacement timing, then instead of operating in the first supply selection mode, the inventory supplement selection unit may select each supply to supplement the inventory without exceeding the maximum inventory amount for the device group in accordance with the predetermined criterion for prioritization.

The inventory management device according to the above aspect of the present invention may further comprise a supply delivery instruction unit configured to instruct a delivery server, connected over the network, to deliver each supply selected by the inventory supplement selection unit, wherein the replaced supply information acquisition unit is further configured to acquire, from the delivery server, delivered supply information indicating that each supply has been delivered as instructed, and the inventory information storage unit updates the inventory information by referring to the delivered supply information.

In the inventory management device according to the above aspect of the present invention, the inventory supplement selection unit may cause a display unit provided in the image processing device to display a message notifying a user that each supply selected by the inventory supplement selection unit should be ordered.

The inventory management device according to the above aspect of the present invention may further comprise a mode acquisition unit configured to acquire user selection of a supply selection mode, the supply selection mode being one of the first supply selection mode and a second supply selection mode for selecting a same type of supply as the type of the supply that is replaced, wherein when the user selection acquired by the mode acquisition unit is the second supply selection mode, the inventory supplement selection unit operates in the second supply selection mode instead of in the first supply selection mode.

In the inventory management device according to the above aspect of the present invention, the predetermined criterion for prioritization may be a degree of consumption of the supply, and the inventory supplement selection unit may increasingly prioritize selection, from among the supplies, as the degree of consumption of the supplies increases.

In the inventory management device according to the above aspect of the present invention, the predetermined criterion for prioritization may be related to a color of the supplies used in the image processing devices, and when the supplies include supplies used for a color black, the inventory supplement selection unit may prioritize selection, from among the supplies, of the supplies used for the color black over selection supplies used for other colors.

In the inventory management device according to the above aspect of the present invention, the predetermined criterion for prioritization may be a degree of stability of a consumption rate of the supply, and the inventory supplement selection unit may increasingly prioritize selection, from among the supplies, as the degree of stability of the supplies decreases.

In the inventory management device according to the above aspect of the present invention, the predetermined criterion for prioritization may be related to a function of the image processing device, and the inventory supplement selection unit may prioritize selection, from among the supplies, of supplies used in an image processing device having a facsimile function.

In the inventory management device according to the above aspect of the present invention, the predetermined criterion for prioritization may be the length of an unusable period from when a supply is completely consumed, rendering an image processing device unusable, until the supply is replaced, rendering the image processing device usable again, and the inventory supplement selection unit may increasingly prioritize selection of a supply as the length of the unusable period of the image processing device in which the supply is used shortens.

In the inventory management device according to the above aspect of the present invention, the predetermined criterion for prioritization may be exchangeability of a supply with another image processing device in the same device group as the image processing device in which the supply is expected to be used, and the inventory supplement selection unit may prioritize selection of exchangeable supplies over selection of non-exchangeable supplies.

The inventory management device according to the above aspect of the present invention may further comprise: a notification unit configured to issue a message when a change occurs in registration information for any of the device groups, the change being addition of an image processing device, removal of one of the image processing devices, or a change in type of one of the image processing devices, the message being issued to a user of the device group in which the change in registration information occurs and requesting the user to input a new setting for the maximum inventory amount for the device group; and a maximum inventory amount setting acquisition unit configured to acquire the new setting for the maximum inventory amount from the user, wherein the inventory information storage unit updates the inventory information by changing the maximum inventory amount in accordance with the new setting from the user acquired by the maximum inventory amount setting acquisition unit.

In the inventory management device according to the above aspect of the present invention, each image processing device may be provided with a replacement timing confirmation unit configured to confirm a timing of replacement of a supply used in the image processing device, and upon acquisition of the replaced supply information by the replaced supply information acquisition unit, when the replacement timing confirmation unit has not confirmed the timing of replacement of a supply that has been replaced, the inventory supplement selection unit may select each supply to supplement the inventory for the device group of the image processing device providing the replaced supply information after the replacement timing confirmation unit confirms the timing of replacement.

In the inventory management device according to the above aspect of the present invention, the maximum inventory amount may be a total number of supplies.

In the inventory management device according to the above aspect of the present invention, the maximum inventory amount may be determined based on the volume of supplies in a packaged state.

In the inventory management device according to the above aspect of the present invention, the image processing device may be provided with a consumption information calculation unit configured to acquire the consumption information by calculation based on a cumulative value of a dot count by a dot counter, the dot count being a count of an amount of toner used to form a toner image on a sheet of paper.

Another aspect of the present invention is an inventory management system that includes an inventory management device. The inventory management system is formed by a device group, which includes one or more image processing devices, and an inventory management device, connected to the device group over a network, for managing inventory, by device group, of consumable supplies used in the image processing devices.

The image processing device includes the following: a supply replacement detection unit configured to detect replacement of a supply used in the image processing device; a replaced supply information storage unit for storing, upon detection of replacement of a supply, information indicating replacement of a supply, a type of the replaced supply, and an identifier of the image processing device; and a consumption information detection unit configured to detect consumption information indicating a degree of consumption of each supply in use. The inventory management device includes the following: a replaced supply information acquisition unit configured to acquire the replaced supply information from the image processing device; a consumption information acquisition unit configured to acquire the consumption information from the image processing device; a projected replacement timing unit configured to calculate, in accordance with the consumption information, a projected replacement timing for replacement of each supply as necessitated by consumption; an inventory information storage unit for storing inventory information by device group, the inventory information including, in association for each supply, a current amount of the inventory, an identifier of the image processing device in which the supply is to be used, an identifier of the device group of the image processing device, a maximum inventory amount that is set for the device group, and the projected replacement timing calculated by the projected replacement timing unit, the inventory information storage unit updating the inventory information by referring to the replaced supply information; and an inventory supplement selection unit configured to refer, upon acquisition of the replaced supply information, to the inventory information for the device group of the image processing device from which the replaced supply information is acquired in order to operate in a first supply selection mode for selecting, from among supplies used in the device group and not currently in the inventory, each supply to supplement the inventory without exceeding the maximum inventory amount for the device group, starting from the supply with an earliest projected replacement timing.

In the inventory management system according to the above aspect of the present invention, the inventory information may include an indication of a predetermined criterion for prioritization, and when the inventory information for the device group of the image processing device providing the replaced supply information includes, among the supplies not currently in the inventory, a plurality of supplies with a projected replacement timing within a predetermined time period from the earliest projected replacement timing, then instead of operating in the first supply selection mode, the inventory supplement selection unit may select each supply to supplement the inventory without exceeding the maximum inventory amount for the device group in accordance with the predetermined criterion for prioritization.

In the inventory management system according to the above aspect of the present invention, the predetermined criterion for prioritization may be a degree of consumption of the supply, and the inventory supplement selection unit may increasingly prioritize selection, from among the supplies, as the degree of consumption of the supplies increases.

In the inventory management system according to the above aspect of the present invention, the predetermined criterion for prioritization may be related to a color of the supplies used in the image processing devices, and when the supplies include supplies used for a color black, the inventory supplement selection unit may prioritize selection, from among the supplies, of the supplies used for the color black over selection supplies used for other colors.

In the inventory management system according to the above aspect of the present invention, the predetermined criterion for prioritization may be a degree of stability of a consumption rate of the supply, and the inventory supplement selection unit may increasingly prioritize selection, from among the supplies, as the degree of stability of the supplies decreases.

In the inventory management system according to the above aspect of the present invention, the predetermined criterion for prioritization may be related to a function of the image processing device, and the inventory supplement selection unit may prioritize selection, from among the supplies, of supplies used in an image processing device having a facsimile function.

In the inventory management system according to the above aspect of the present invention, the predetermined criterion for prioritization may be the length of an unusable period from when a supply is completely consumed, rendering an image processing device unusable, until the supply is replaced, rendering the image processing device usable again, and the inventory supplement selection unit may increasingly prioritize selection of a supply as the length of the unusable period of the image processing device in which the supply is used shortens.

In the inventory management system according to the above aspect of the present invention, the predetermined criterion for prioritization may be exchangeability of a supply with another image processing device in the same device group as the image processing device in which the supply is expected to be used, and the inventory supplement selection unit may prioritize selection of exchangeable supplies over selection of non-exchangeable supplies.

Another aspect of the present invention is an image processing device to which a plurality of replaceable consumable supplies can be attached, the image processing device comprising: a supply replacement detection unit configured to detect replacement of a supply used in the image processing device; a replaced supply information acquisition unit configured to acquire, when replacement of a supply is detected, replaced supply information that includes a type of the replaced supply; a consumption information detection unit configured to detect consumption information indicating a degree of consumption of each supply in use; a projected replacement timing unit configured to calculate, in accordance with the consumption information, a projected replacement timing for replacement of each supply as necessitated by consumption; an inventory information storage unit for storing inventory information including, in association for each supply, a current amount of the inventory, a maximum inventory amount that is set for the image processing device, and the projected replacement timing calculated by the projected replacement timing unit, the inventory information storage unit updating the inventory information by referring to the replaced supply information; and an inventory supplement selection unit configured to select one or more supplies to supplement the inventory, wherein upon acquisition of the replaced supply information by the replaced supply information acquisition unit, the inventory supplement selection unit refers to the inventory information in order to operate in a first supply selection mode for selecting, from among supplies not currently in the inventory, each supply to supplement the inventory without exceeding the maximum inventory amount, starting from the supply with an earliest projected replacement timing.

Another aspect of the present invention is an inventory management method executed by an inventory management device. Specifically, this aspect is an inventory management method used in an inventory management device, connected over a network to one or more device groups each including one or more image processing devices, for managing inventory, by device group, of consumable supplies used in the image processing devices, the inventory management method comprising the steps of: acquiring consumption information indicating a degree of consumption of each supply in use in each image processing device; calculating, in accordance with the consumption information, a projected replacement timing for replacement of each supply as necessitated by consumption; storing inventory information by device group, the inventory information including, in association for each supply, a current amount of the inventory, an identifier of the image processing device in which the supply is to be used, an identifier of the device group of the image processing device, a maximum inventory amount that is set for the device group, and the projected replacement timing; acquiring, from each image processing device, replaced supply information that includes an indication of replacement of a supply in the image processing device, a type of the supply that is replaced, and an identifier of the image processing device providing the replaced supply information; updating the inventory information by referring to the replaced supply information when the replaced supply information is acquired; and operating in a first supply selection mode, upon acquisition of the replaced supply information, to refer to the inventory information for the device group of the image processing device providing the replaced supply information in order to select, from among supplies used in the device group and not currently in the inventory, one or more supplies to supplement the inventory without exceeding the maximum inventory amount for the device group, starting from the supply with an earliest projected replacement timing.

Another aspect of the present invention is a recording medium on which is recorded an inventory management program executed by a computer in an inventory management device. The recording medium according to this aspect of the present invention has recorded thereon an inventory management program for an inventory management device, connected over a network to one or more device groups each including one or more image processing devices, for managing inventory, by device group, of consumable supplies used in the image processing devices, the inventory management program causing a computer in the inventory management device to perform the following processing: consumption information acquisition processing for acquiring consumption information indicating a degree of consumption of each supply in use in each image processing device; projected replacement timing processing for calculating, in accordance with the consumption information, a projected replacement timing for replacement of each supply as necessitated by consumption; inventory information storage processing for storing, by device group, inventory information including, in association for each supply, a current amount of the inventory, an identifier of the image processing device in which the supply is to be used, an identifier of the device group of the image processing device, a maximum inventory amount that is set for the device group, and the projected replacement timing; replaced supply information acquisition processing for acquiring replaced supply information that includes an indication of replacement of a supply in one of the image processing devices, a type of the supply that is replaced, and an identifier of the one of the image processing devices; inventory information updating processing for updating the inventory information by referring to the replaced supply information when the replaced supply information is acquired; and first supply selection mode execution processing for referring, upon acquisition of the replaced supply information, to the inventory information for the device group of the image processing device providing the replaced supply information in order to select, from among supplies used in the device group and not currently in the inventory, one or more supplies to supplement the inventory without exceeding the maximum inventory amount for the device group, starting from the supply with an earliest projected replacement timing.

Another aspect of the present invention is an inventory management device, connected over a network to one or more device groups each including one or more image processing devices, for managing inventory, by device group, of consumable supplies used in the image processing devices, the inventory management device comprising: a consumption information acquisition unit configured to acquire consumption information indicating a degree of consumption of each supply in use in each image processing device; a projected replacement timing unit configured to calculate, in accordance with the consumption information, a projected replacement timing for replacement of each supply as necessitated by consumption; an inventory information storage unit for storing inventory information by device group, the inventory information including, in association for each supply, a current amount of the inventory, an identifier of the image processing device in which the supply is to be used, an identifier of the device group of the image processing device, and the projected replacement timing calculated by the projected replacement timing unit; an inventory supplement timing information acquisition unit configured to acquire, from each image processing devices, inventory supplement timing information including a consumption indicator indicating an occurrence of a predetermined state of consumption, a type of a consumed supply in which the state of consumption occurs, and an identifier of the image processing device in which the consumed supply is used, the occurrence of the predetermined state of consumption indicating that the inventory is to be supplemented; and an inventory supplement selection unit configured to select one or more supplies to supplement the inventory, wherein upon acquisition of the inventory supplement timing information by the inventory supplement timing information acquisition unit, the inventory supplement selection unit refers to the inventory information for the device group of the image processing device in which the consumed supply is used in order to operate in a first supply selection mode for selecting, from among supplies used in the device group and not currently in the inventory, each supply to supplement the inventory, the projected replacement timing of each selected supply falling within a selection time frame of a preset standard length.

In the inventory management device according to the above aspect of the present invention, the inventory information may include an indication of a predetermined criterion for prioritization, and the inventory supplement selection unit may operate in a third supply selection mode instead of the first supply selection mode to select, among the supplies not currently in the inventory for the device group of the image processing device in which the consumed supply is used, any supply not satisfying the predetermined criterion for prioritization and having a projected replacement timing within the selection time frame of the standard length, and to select any supply satisfying the predetermined criterion for prioritization and having a projected replacement timing within an extended selection time frame that is longer than the selection time frame of the standard length.

The inventory management device according to the above aspect of the present invention may further comprise a replaced supply information acquisition unit configured to acquire replaced supply information that includes an indication of replacement of a supply in any of the image processing devices, a type of the supply that is replaced, and an identifier of the image processing device, wherein the inventory information storage unit is further configured to update the inventory information by referring to the replaced supply information.

The inventory management device according to the above aspect of the present invention may further comprise a supply delivery instruction unit configured to instruct a delivery server, connected over the network, to deliver each supply selected by the inventory supplement selection unit.

In the inventory management device according to the above aspect of the present invention, the replaced supply information acquisition unit may be further configured to acquire delivered supply information indicating that each supply has been delivered as instructed by the supply delivery instruction unit, and the inventory information storage unit may be further configured to update the inventory information by referring to the delivered supply information.

In the inventory management device according to the above aspect of the present invention, the inventory supplement selection unit causes a display unit provided in the image processing device to display a message notifying a user that each supply selected by the inventory supplement selection unit should be ordered.

The inventory management device according to the above aspect of the present invention may further comprise a mode acquisition unit configured to acquire user selection of a supply selection mode, the supply selection mode being one of the first supply selection mode and a second supply selection mode for selecting a same type of supply as the consumed supply, wherein when the user selection acquired by the mode acquisition unit is the second supply selection mode, the inventory supplement selection unit operates in the second supply selection mode instead of in the first supply selection mode.

In the inventory management device according to the above aspect of the present invention, each image processing device is provided with a replacement timing confirmation unit configured to confirm a timing of replacement of a supply used in the image processing device, and the predetermined state of consumption is confirmation of the timing of replacement of a supply.

In the inventory management device according to the above aspect of the present invention, the predetermined state of consumption may be when a degree of consumption of a supply reaches a predetermined degree of consumption.

In the inventory management device according to the above aspect of the present invention, the predetermined criterion for prioritization may be whether the supply is used for black image processing in the image processing device.

In the inventory management device according to the above aspect of the present invention, the predetermined criterion for prioritization may be a degree of stability of a consumption rate of the supply, and the time frame for selection may be lengthened as the degree of stability of the consumption rate is lower.

In the inventory management device according to the above aspect of the present invention, the predetermined criterion for prioritization may be whether the image processing device in which the supply is to be used has a facsimile function.

The inventory management device according to the above aspect of the present invention may further comprise a usage period acquisition unit configured to acquire a usage period for each image processing device, wherein with respect to any supply that is used in an image processing device whose usage period is longer than a predetermined period, the inventory supplement selection unit operates in a fourth supply selection mode instead of the first supply selection mode to select any supply that has a projected replacement timing within a shortened selection time frame that is shorter than the selection time frame of the standard length.

The inventory management device according to the above aspect of the present invention may further comprise: a consumption history storage unit for storing the consumption information as consumption history; and a cumulative consumption acquisition unit configured, upon acquisition of the inventory supplement timing information, to refer to the consumption history to acquire a cumulative consumption by calculation over each of predetermined counting periods for the device group of the image processing device in which the consumed supply is used, wherein the inventory supplement selection unit operates in a fifth supply selection mode instead of the first supply selection mode to select each supply while increasing the length of the selection time frame in accordance with an increase in the cumulative consumption of a most recent counting period.

In the inventory management device according to the above aspect of the present invention, when the replacement timing confirmation unit confirms the timing of replacement of a first supply, and in the device group of the image processing device in which the first supply is used, the timing of replacement of a second supply has not been confirmed, the inventory supplement selection unit selects each supply to supplement the inventory after the replacement timing confirmation unit confirms the timing of replacement of the second supply.

In the inventory management device according to the above aspect of the present invention, the image processing device may be provided with a consumption information calculation unit configured to acquire the consumption information by calculation based on a cumulative value of a dot count by a dot counter, the dot count being a count of an amount of toner used to form a toner image on a sheet of paper.

Another aspect of the present invention is an inventory management system that includes an inventory management device. The inventory management system is formed by a device group, which includes one or more image processing devices, and an inventory management device, connected to the device group over a network, for managing inventory, by device group, of consumable supplies used in the image processing devices. The image processing device includes the following: a consumption information detection unit configured to detect consumption information indicating a degree of consumption of each supply used in the image processing device; a consumption state occurrence detection unit configured to detect occurrence of a predetermined state of consumption of a supply used in the image processing device, the occurrence of the predetermined state of consumption indicating that the inventory is to be supplemented; and an inventory supplement timing information storage unit for storing, upon detection of the occurrence of the predetermined state of consumption, inventory supplement timing information that includes a consumption indicator indicating the occurrence of the predetermined state of consumption of a supply, a type of a consumed supply in which the state of consumption occurs, and an identifier of the image processing device. The inventory management device includes the following: an inventory supplement timing information acquisition unit configured to acquire the inventory supplement timing information from the image processing device; a consumption information acquisition unit configured to acquire the consumption information from the image processing device; a projected replacement timing unit configured to calculate, in accordance with the consumption information, a projected replacement timing for replacement of each supply as necessitated by consumption; an inventory information storage unit for storing inventory information by device group, the inventory information including, in association for each supply, a current amount of the inventory, an identifier of the image processing device in which the supply is to be used, an identifier of the device group of the image processing device, and the projected replacement timing calculated by the projected replacement timing unit; and an inventory supplement selection unit configured to refer, upon acquisition of the inventory supplement timing information, to the inventory information for the device group of the image processing device in which the consumed supply is used in order to operate in a first supply selection mode for selecting, from among supplies used in the device group and not currently in the inventory, each supply to supplement the inventory, the projected replacement timing of each selected supply falling within a selection time frame of a preset standard length.

In the inventory management system according to the above aspect of the present invention, the inventory information may include an indication of a predetermined criterion for prioritization.

The inventory supplement selection unit may operate in a third supply selection mode instead of the first supply selection mode to select, among the supplies not currently in the inventory for the device group of the image processing device in which the consumed supply is used, any supply not satisfying the predetermined criterion for prioritization and having a projected replacement timing within the selection time frame of the standard length, and to select any supply satisfying the predetermined criterion for prioritization and having a projected replacement timing within an extended selection time frame that is longer than the selection time frame of the standard length.

In the inventory management system according to the above aspect of the present invention, the predetermined criterion for prioritization may be whether the supply is used for black image processing in the image processing device.

In the inventory management system according to the above aspect of the present invention, the predetermined criterion for prioritization may be a degree of stability of a consumption rate of the supply, and the time frame for selection may be lengthened as the degree of stability of the consumption rate is lower.

In the inventory management system according to the above aspect of the present invention, the predetermined criterion for prioritization may be whether the image processing device in which the supply is to be used has a facsimile function.

Another aspect of the present invention is an inventory management method executed by an inventory management device. Specifically, this aspect of the present invention is an inventory management method used in an inventory management device, connected over a network to one or more device groups each including one or more image processing devices, for managing inventory, by device group, of consumable supplies used in the image processing devices, the inventory management method comprising the steps of: acquiring consumption information indicating a degree of consumption of each supply in use in each image processing device; calculating, in accordance with the consumption information, a projected replacement timing for replacement of each supply as necessitated by consumption; storing inventory information by device group, the inventory information including, in association for each supply, a current amount of the inventory, an identifier of the image processing device in which the supply is to be used, an identifier of the device group of the image processing device, and the projected replacement timing; acquiring, from each image processing device, inventory supplement timing information including a consumption indicator indicating an occurrence of a predetermined state of consumption of a supply, a type of a consumed supply in which the state of consumption occurs, and an identifier of the image processing device in which the consumed supply is used, the occurrence of the predetermined state of consumption indicating that the inventory is to be supplemented; and operating in a first supply selection mode, upon acquisition of the inventory supplement timing information, to refer to the inventory information for the device group of the image processing device in which the consumed supply is used in order to select, from among supplies used in the device group and not currently in the inventory, one or more supplies to supplement the inventory, the projected replacement timing of each selected supply falling within a selection time frame of a preset standard length.

Another aspect of the present invention is a recording medium on which is recorded an inventory management program executed by a computer in an inventory management device. The recording medium according to this aspect of the present invention has recorded thereon an inventory management program for an inventory management device, connected over a network to one or more device groups each including one or more image processing devices, for managing inventory, by device group, of consumable supplies used in the image processing devices, the inventory management program causing a computer in the inventory management device to perform the following processing: consumption information acquisition processing for acquiring consumption information indicating a degree of consumption of each supply in use in each image processing device; projected replacement timing processing for calculating, in accordance with the consumption information, a projected replacement timing for replacement of each supply as necessitated by consumption; inventory information storage processing for storing inventory information by device group, the inventory information including, in association for each supply, a current amount of the inventory, an identifier of the image processing device in which the supply is to be used, an identifier of the device group of the image processing device, and the projected replacement timing calculated by the projected replacement timing unit; inventory supplement timing information acquisition processing for acquiring, from each image processing devices, inventory supplement timing information including a consumption indicator indicating an occurrence of a predetermined state of consumption, a type of a consumed supply in which the state of consumption occurs, and an identifier of the image processing device in which the consumed supply is used, the occurrence of the predetermined state of consumption indicating that the inventory is to be supplemented; and first supply selection mode processing for referring, upon acquisition of the inventory supplement timing information, to the inventory information for the device group of the image processing device in which the consumed supply is used in order to select, from among supplies used in the device group and not currently in the inventory, one or more supplies to supplement the inventory, the projected replacement timing of each selected supply falling within a selection time frame of a preset standard length.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An inventory management device, connected over a network to one or more device groups each including one or more image processing devices, for managing inventory, by device group, of consumable supplies used in the image processing devices, the inventory management device comprising:

a replaced supply information acquisition unit configured to acquire, from each image processing device, replaced supply information that includes an indication of replacement of a supply in the image processing device, a type of the supply that is replaced, and an identifier of the image processing device;

a consumption information acquisition unit configured to acquire consumption information indicating a degree of consumption of each supply in use in each image processing device;

a projected replacement timing unit configured to calculate, in accordance with the consumption information, a projected replacement timing for replacement of each supply as necessitated by consumption;

an inventory information storage unit for storing inventory information by device group, the inventory information including, in association for each supply, a current amount of the inventory, an identifier of the image processing device in which the supply is to be used, an identifier of the device group of the image processing device, a maximum inventory amount that is set for the device group, and the projected replacement timing calculated by the projected replacement timing unit, the inventory information storage unit updating the inventory information by referring to the replaced supply information; and an inventory supplement selection unit configured to select one or more supplies to supplement the inventory, wherein upon acquisition of the replaced supply information by the replaced supply information acquisition unit, the inventory supplement selection unit refers to the updated inventory information for the device group of the image processing device from which the replaced supply information is acquired in order to operate in a first supply selection mode for selecting, from among supplies used in the device group and not currently in the inventory, each supply to supplement the inventory without exceeding the maximum inventory amount for the device group, starting from the supply with an earliest projected replacement timing.

2. The inventory management device of claim 1, wherein the inventory information includes an indication of a predetermined criterion for prioritization, and when the inventory information for the device group of the image processing device providing the replaced supply information includes, among the supplies not currently in the inventory, a plurality of supplies with a projected replacement timing within a predetermined time period from the earliest projected replacement timing, then instead of operating in the first supply selection mode, the inventory supplement selection unit selects each supply to supplement the inventory without exceeding the maximum inventory amount for the device group in accordance with the predetermined criterion for prioritization.

3. The inventory management device of claim 1, further comprising:

a supply delivery instruction unit configured to instruct a delivery server, connected over the network, to deliver each supply selected by the inventory supplement selection unit, wherein the replaced supply information acquisition unit is further configured to acquire, from the delivery server, delivered supply information indicating that each supply has been delivered as instructed, and the inventory information storage unit updates the inventory information by referring to the delivered supply information.

4. The inventory management device of claim 1, wherein the inventory supplement selection unit causes a display unit provided in the image processing device to display a message notifying a user that each supply selected by the inventory supplement selection unit should be ordered.

5. The inventory management device of claim 1, further comprising:

a mode acquisition unit configured to acquire user selection of a supply selection mode, the supply selection mode being one of the first supply selection mode and a second supply selection mode for selecting a same type of supply as the type of the supply that is replaced, wherein when the user selection acquired by the mode acquisition unit is the second supply selection mode, the inventory supplement selection unit operates in the second supply selection mode instead of in the first supply selection mode.

6. The inventory management device of claim 1, further comprising:

a notification unit configured to issue a message when a change occurs in registration information for any of the device groups, the change being addition of an image processing device, removal of one of the image processing devices, or a change in type of one of the image processing devices, the message requesting a user of the device group in which the change in registration information occurs to input a new setting for the maximum inventory amount for the device group; and a maximum inventory amount setting acquisition unit configured to acquire the new setting for the maximum inventory amount from the user, wherein the inventory information storage unit updates the inventory information by changing the maximum inventory amount in accordance with the new setting from the user acquired by the maximum inventory amount setting acquisition unit.

7. The inventory management device of claim 1, wherein each image processing device is provided with a replacement timing confirmation unit configured to confirm a timing of replacement of a supply used in the image processing device, and upon acquisition of the replaced supply information by the replaced supply information acquisition unit, when the replacement timing confirmation unit has not confirmed the timing of replacement of a supply that has been replaced, the inventory supplement selection unit selects each supply to supplement the inventory for the device group of the image processing device providing the replaced supply information after the replacement timing confirmation unit confirms the timing of replacement.

8. An inventory management method used in an inventory management device, connected over a network to one or more device groups each including one or more image processing devices, for managing inventory, by device group, of consumable supplies used in the image processing devices, the inventory management method comprising the steps of:

acquiring consumption information indicating a degree of consumption of each supply in use in each image processing device;

calculating, in accordance with the consumption information, a projected replacement timing for replacement of each supply as necessitated by consumption;

storing inventory information by device group, the inventory information including, in association for each supply, a current amount of the inventory, an identifier of the image processing device in which the supply is to be used, an identifier of the device group of the image processing device, a maximum inventory amount that is set for the device group, and the projected replacement timing;

acquiring, from each image processing device, replaced supply information that includes an indication of replacement of a supply in the image processing device, a type of the supply that is replaced, and an identifier of the image processing device providing the replaced supply information;

updating the inventory information by referring to the replaced supply information when the replaced supply information is acquired; and operating in a first supply selection mode, upon acquisition of the replaced supply information, to refer to the inventory information for the device group of the image processing device providing the replaced supply information in order to select, from among supplies used in the device group and not currently in the inventory, one or more supplies to supplement the inventory without exceeding the maximum inventory amount for the device group, starting from the supply with an earliest projected replacement timing.

9. An inventory management device, connected over a network to one or more device groups each including one or more image processing devices, for managing inventory, by device group, of consumable supplies used in the image processing devices, the inventory management device comprising:

a consumption information acquisition unit configured to acquire consumption information indicating a degree of consumption of each supply in use in each image processing device;

a projected replacement timing unit configured to calculate, in accordance with the consumption information, a projected replacement timing for replacement of each supply as necessitated by consumption;

an inventory information storage unit for storing inventory information by device group, the inventory information including, in association for each supply, a current amount of the inventory, an identifier of the image processing device in which the supply is to be used, an identifier of the device group of the image processing device, and the projected replacement timing calculated by the projected replacement timing unit;

an inventory supplement timing information acquisition unit configured to acquire, from each image processing devices, inventory supplement timing information including a consumption indicator indicating an occurrence of a predetermined state of consumption, a type of a consumed supply in which the state of consumption occurs, and an identifier of the image processing device in which the consumed supply is used, the occurrence of the predetermined state of consumption indicating that the inventory is to be supplemented; and an inventory supplement selection unit configured to select one or more supplies to supplement the inventory, wherein upon acquisition of the inventory supplement timing information by the inventory supplement timing information acquisition unit, the inventory supplement selection unit refers to the inventory information for the device group of the image processing device in which the consumed supply is used in order to operate in a first supply selection mode for selecting, from among supplies used in the device group and not currently in the inventory, each supply to supplement the inventory, the projected replacement timing of each selected supply falling within a selection time frame of a preset standard length.

10. The inventory management device of claim 9, wherein the inventory information includes an indication of a predetermined criterion for prioritization, and the inventory supplement selection unit operates in a third supply selection mode instead of the first supply selection mode to select, among the supplies not currently in the inventory for the device group of the image processing device in which the consumed supply is used, any supply not satisfying the predetermined criterion for prioritization and having a projected replacement timing within the selection time frame of the standard length, and to select any supply satisfying the predetermined criterion for prioritization and having a projected replacement timing within an extended selection time frame that is longer than the selection time frame of the standard length.

11. The inventory management device of claim 9, further comprising:

a replaced supply information acquisition unit configured to acquire replaced supply information that includes an indication of replacement of a supply in any of the image processing devices, a type of the supply that is replaced, and an identifier of the image processing device, wherein the inventory information storage unit is further configured to update the inventory information by referring to the replaced supply information.

12. The inventory management device of claim 9, further comprising:

a supply delivery instruction unit configured to instruct a delivery server, connected over the network, to deliver each supply selected by the inventory supplement selection unit.

13. The inventory management device of claim 9, wherein the replaced supply information acquisition unit is further configured to acquire delivered supply information indicating that each supply has been delivered as instructed by the supply delivery instruction unit, and the inventory information storage unit is further configured to update the inventory information by referring to the delivered supply information.

14. The inventory management device of claim 9, wherein the inventory supplement selection unit causes a display unit provided in the image processing device to display a message notifying a user that each supply selected by the inventory supplement selection unit should be ordered.

15. The inventory management device of claim 9, further comprising:

a mode acquisition unit configured to acquire user selection of a supply selection mode, the supply selection mode being one of the first supply selection mode and a second supply selection mode for selecting a same type of supply as the consumed supply, wherein when the user selection acquired by the mode acquisition unit is the second supply selection mode, the inventory supplement selection unit operates in the second supply selection mode instead of in the first supply selection mode.

16. The inventory management device of claim 9, wherein each image processing device is provided with a replacement timing confirmation unit configured to confirm a timing of replacement of a supply used in the image processing device, and the predetermined state of consumption is confirmation of the timing of replacement of a supply.

17. The inventory management device of claim 9, further comprising:

a usage period acquisition unit configured to acquire a usage period for each image processing device, wherein with respect to any supply that is used in an image processing device whose usage period is longer than a predetermined period, the inventory supplement selection unit operates in a fourth supply selection mode instead of the first supply selection mode to select any supply that has a projected replacement timing within a shortened selection time frame that is shorter than the selection time frame of the standard length.

18. The inventory management device of claim 9, further comprising:

a consumption history storage unit for storing the consumption information as consumption history; and a cumulative consumption acquisition unit configured, upon acquisition of the inventory supplement timing information, to refer to the consumption history to acquire a cumulative consumption by calculation over each of predetermined counting periods for the device group of the image processing device in which the consumed supply is used, wherein the inventory supplement selection unit operates in a fifth supply selection mode instead of the first supply selection mode to select each supply while increasing the length of the selection time frame in accordance with an increase in the cumulative consumption of a most recent counting period.

19. The inventory management device of claim 16, wherein when the replacement timing confirmation unit confirms the timing of replacement of a first supply, and in the device group of the image processing device in which the first supply is used, the timing of replacement of a second supply has not been confirmed, the inventory supplement selection unit selects each supply to supplement the inventory after the replacement timing confirmation unit confirms the timing of replacement of the second supply.

20. An inventory management method used in an inventory management device, connected over a network to one or more device groups each including one or more image processing devices, for managing inventory, by device group, of consumable supplies used in the image processing devices, the inventory management method comprising the steps of:

acquiring consumption information indicating a degree of consumption of each supply in use in each image processing device;

calculating, in accordance with the consumption information, a projected replacement timing for replacement of each supply as necessitated by consumption;

storing inventory information by device group, the inventory information including, in association for each supply, a current amount of the inventory, an identifier of the image processing device in which the supply is to be used, an identifier of the device group of the image processing device, and the projected replacement timing;

acquiring, from each image processing device, inventory supplement timing information including a consumption indicator indicating an occurrence of a predetermined state of consumption of a supply, a type of a consumed supply in which the state of consumption occurs, and an identifier of the image processing device in which the consumed supply is used, the occurrence of the predetermined state of consumption indicating that the inventory is to be supplemented; and operating in a first supply selection mode, upon acquisition of the inventory supplement timing information, to refer to the inventory information for the device group of the image processing device in which the consumed supply is used in order to select, from among supplies used in the device group and not currently in the inventory, one or more supplies to supplement the inventory, the projected replacement timing of each selected supply falling within a selection time frame of a preset standard length.

21. An inventory management system formed by a device group, which includes one or more image processing devices, and an inventory management device, connected to the device group over a network, for managing inventory, by device group, of consumable supplies used in the image processing devices, the image processing device comprising:

a supply replacement detection unit configured to detect replacement of a supply used in the image processing device;

a replaced supply information storage unit for storing, upon detection of replacement of a supply, information indicating replacement of a supply a type of the replaced supply, and an identifier of the image processing device; and a consumption information detection unit configured to detect consumption information indicating a degree of consumption of each supply in use, the inventory management device comprising:

a replaced supply information acquisition unit configured to acquire the replaced supply information from the image processing device;

a consumption information acquisition unit configured to acquire the consumption information from the image processing device;

a projected replacement timing unit configured to calculate, in accordance with the consumption information, a projected replacement timing for replacement of each supply as necessitated by consumption;

an inventory information storage unit for storing inventory information by device group, the inventory information including, in association for each supply, a current amount of the inventory, an identifier of the image processing device in which the supply is to be used, an identifier of the device group of the image processing device, a maximum inventory amount that is set for the device group, and the projected replacement timing calculated by the projected replacement timing unit, the inventory information storage unit updating the inventory information by referring to the replaced supply information; and an inventory supplement selection unit configured to refer, upon acquisition of the replaced supply information, to the inventory information for the device group of the image processing device from which the replaced supply information is acquired in order to operate in a first supply selection mode for selecting, from among supplies used in the device group and not currently in the inventory, each supply to supplement the inventory without exceeding the maximum inventory amount for the device group, starting from the supply with an earliest projected replacement timing.

22. An image processing device to which a plurality of replaceable consumable supplies can be attached, the image processing device comprising:

a supply replacement detection unit configured to detect replacement of a supply used in the image processing device;

a replaced supply information acquisition unit configured to acquire, when replacement of a supply is detected, replaced supply information that includes a type of the replaced supply;

a consumption information detection unit configured to detect consumption information indicating a degree of consumption of each supply in use;

a projected replacement timing unit configured to calculate, in accordance with the consumption information, a projected replacement timing for replacement of each supply as necessitated by consumption;

an inventory information storage unit for storing inventory information including, in association for each supply, a current amount of the inventory, a maximum inventory amount that is set for the image processing device, and the projected replacement timing calculated by the projected replacement timing unit, the inventory information storage unit updating the inventory information by referring to the replaced supply information; and an inventory supplement selection unit configured to select one or more supplies to supplement the inventory, wherein upon acquisition of the replaced supply information by the replaced supply information acquisition unit, the inventory supplement selection unit refers to the inventory information in order to operate in a first supply selection mode for selecting, from among supplies not currently in the inventory, each supply to supplement the inventory without exceeding the maximum inventory amount, starting from the supply with an earliest projected replacement timing.

23. A non-transitory computer readable medium comprising an inventory management device, connected over a network to one or more device groups each including one or more image processing devices, for managing inventory, by device group, of consumable supplies used in the image processing devices, the inventory management program causing a computer in the inventory management device to perform the following processing:

consumption information acquisition processing for acquiring consumption information indicating a degree of consumption of each supply in use in each image processing device; projected replacement timing processing for calculating, in accordance with the consumption information, a projected replacement timing for replacement of each supply as necessitated by consumption;

inventory information storage processing for storing, by device group, inventory information including, in association for each supply, a current amount of the inventory, an identifier of the image processing device in which the supply is to be used, an identifier of the device group of the image processing device, a maximum inventory amount that is set for the device group, and the projected replacement timing;

replaced supply information acquisition processing for acquiring replaced supply information that includes an indication of replacement of a supply in one of the image processing devices, a type of the supply that is replaced, and an identifier of the one of the image processing devices;

inventory information updating processing for updating the inventory information by referring to the replaced supply information when the replaced supply information is acquired; and first supply selection mode execution processing for referring, upon acquisition of the replaced supply information, to the inventory information for the device group of the image processing device providing the replaced supply information in order to select, from among supplies used in the device group and not currently in the inventory, one or more supplies to supplement the inventory without exceeding the maximum inventory amount for the device group, starting from the supply with an earliest projected replacement timing.

24. An inventory management system formed by a device group, which includes one or more image processing devices, and an inventory management device, connected to the device group over a network, for managing inventory, by device group, of consumable supplies used in the image processing devices, the image processing device comprising:

a consumption information detection unit configured to detect consumption information indicating a degree of consumption of each supply used in the image processing device;

a consumption state occurrence detection unit configured to detect occurrence of a predetermined state of consumption of a supply used in the image processing device, the occurrence of the predetermined state of consumption indicating that the inventory is to be supplemented; and an inventory supplement timing information storage unit for storing, upon detection of the occurrence of the predetermined state of consumption, inventory supplement timing information that includes a consumption indicator indicating the occurrence of the predetermined state of consumption of a supply, a type of a consumed supply in which the state of consumption occurs, and an identifier of the image processing device, the inventory management device comprising:

an inventory supplement timing information acquisition unit configured to acquire the inventory supplement timing information from the image processing device;

a consumption information acquisition unit configured to acquire the consumption information from the image processing device;

a projected replacement timing unit configured to calculate, in accordance with the consumption information, a projected replacement timing for replacement of each supply as necessitated by consumption;

an inventory information storage unit for storing inventory information by device group, the inventory information including, in association for each supply, a current amount of the inventory, an identifier of the image processing device in which the supply is to be used, an identifier of the device group of the image processing device, and the projected replacement timing calculated by the projected replacement timing unit; and an inventory supplement selection unit configured to refer, upon acquisition of the inventory supplement timing information, to the inventory information for the device group of the image processing device in which the consumed supply is used in order to operate in a first supply selection mode for selecting, from among supplies used in the device group and not currently in the inventory, each supply to supplement the inventory, the projected replacement timing of each selected supply falling within a selection time frame of a present standard length.

25. A non-transitory computer readable medium comprising an inventory management device, connected over a network to one or more device groups each including one or more image processing devices, for managing inventory, by device group, of consumable supplies used in the image processing devices, the inventory management program causing a computer in the inventory management device to perform the following processing:

consumption information acquisition processing for acquiring consumption information indicating a degree of consumption of each supply in use in each image processing device;

projected replacement timing processing for calculating, in accordance with the consumption information, a projected replacement timing for replacement of each supply as necessitated by consumption;

inventory information storage processing for storing inventory information by device group, the inventory information including, in association for each supply, a current amount of the inventory, an identifier of the image processing device in which the supply is to be used, an identifier of the device group of the image processing device, and the projected replacement timing calculated by the projected replacement timing unit;

inventory supplement timing information acquisition processing for acquiring, from each image processing devices, inventory supplement timing information including a consumption indicator indicating an occurrence of a predetermined state of consumption, a type of a consumed supply in which the state of consumption occurs, and an identifier of the image processing device in which the consumed supply is used, the occurrence of the predetermined state of consumption indicating that the inventory is to be supplemented; and first supply selection mode processing for referring, upon acquisition of the inventory supplement timing information, to the inventory information for the device group of the image processing device in which the consumed supply is used in order to select, from among supplies used in the device group and not currently in the inventory, one or more supplies to supplement the inventory, the projected replacement timing of each selected supply falling within a selection time frame of a preset standard length.

* * * * *